US009289874B1

(12) United States Patent
Sabo

(10) Patent No.: US 9,289,874 B1
(45) Date of Patent: Mar. 22, 2016

(54) MODULAR HONING GUIDE SYSTEM

(71) Applicant: Daniel B. Sabo, Taylor, MI (US)

(72) Inventor: Daniel B. Sabo, Taylor, MI (US)

( * ) Notice: Subject to any disclaimer, the term of this patent is extended or adjusted under 35 U.S.C. 154(b) by 301 days.

(21) Appl. No.: 13/886,539

(22) Filed: May 3, 2013

Related U.S. Application Data

(60) Provisional application No. 61/687,910, filed on May 3, 2012.

(51) Int. Cl.
*B24D 15/06* (2006.01)
*B24B 33/10* (2006.01)

(52) U.S. Cl.
CPC ..... *B24B 33/10* (2013.01); *B24D 15/06* (2013.01)

(58) Field of Classification Search
CPC ..... B24D 15/06; B24D 15/08; B24B 33/10
USPC ..... 451/45
See application file for complete search history.

(56) References Cited

U.S. PATENT DOCUMENTS

| | | | | |
|---|---|---|---|---|
| 103,739 | A | 5/1870 | Hanks | |
| 223,315 | A | 1/1880 | Brower | |
| 449,673 | A | 4/1891 | Francis | |
| 471,679 | A | 3/1892 | Spruce | |
| 560,111 | A | 5/1896 | Salot | |
| 828,853 | A * | 8/1906 | Ives | 451/321 |
| 850,084 | A | 4/1907 | Crocker | |
| 870,365 | A | 11/1907 | Hight | |
| 1,126,891 | A * | 2/1915 | Graves | 451/224 |
| 1,192,416 | A * | 7/1916 | McEachron | 451/370 |
| 1,221,556 | A * | 4/1917 | Lentz | 451/370 |
| 1,239,494 | A | 9/1917 | Lange | |
| 1,770,538 | A | 7/1930 | Washer | |
| 2,107,921 | A | 2/1938 | Weed | |
| 2,131,626 | A | 9/1938 | Keith | |
| 2,165,929 | A * | 7/1939 | Lentz | 451/320 |
| 2,370,908 | A * | 3/1945 | Llorens | 451/378 |
| 2,741,077 | A | 4/1956 | Ayer | |
| 3,950,899 | A | 4/1976 | Gilbert | |
| 4,217,735 | A * | 8/1980 | McGeoch et al. | 451/321 |
| 4,733,501 | A | 3/1988 | McLean | |
| 5,547,419 | A | 8/1996 | Hulnicki | |

(Continued)

OTHER PUBLICATIONS

Cliff Colley, "Honing Guides", Fine Woodworking Magazine, Sep./Oct. 2005 Issue, 4 Pages, The Taunton Press, Inc., Newtown, CT, USA.

(Continued)

*Primary Examiner* — Joseph J Hail
*Assistant Examiner* — Marc Carlson

(57) ABSTRACT

A modular honing guide system comprised of interchangeable parts, having a multitude of configurations (FIGS. 1A, 4C, 8A, 9A, 10P, 11D, 12H, 13A, 14A, 16A, 17A) for manually sharpening or honing a multitude of tool types used for but not limited to wood carving, wood working, fine art printmaking, jewelry making and metal work. Tools are honed on a planar abrasive surface, while a honing guide base is moved across a supporting work surface. A plurality of edge tool clamps can be mounted to a unified honing guide base system. With manual random motion or combined random motion and uniform rotational or rocking motion, a combined cutting edge and honing guide is moved across abrading and work surfaces respectively. A multitude of bevel, skew and cutting edge profiles are attained. System is an improvement over honing guides which are designed for specific or limited types of edge tools.

20 Claims, 53 Drawing Sheets

(56) References Cited

U.S. PATENT DOCUMENTS

| | | | | |
|---|---|---|---|---|
| 5,582,542 | A * | 12/1996 | Stein | 451/367 |
| 5,810,649 | A * | 9/1998 | Oar et al. | 451/378 |
| 6,393,712 | B1 * | 5/2002 | Jansson | 33/628 |
| 6,726,551 | B2 * | 4/2004 | Friel, Sr. | 451/344 |
| 6,881,137 | B2 * | 4/2005 | Friel, Sr. | 451/349 |
| 6,935,937 | B2 | 8/2005 | Port | |
| 7,144,310 | B2 | 12/2006 | Longbrake | |
| 7,335,093 | B1 | 2/2008 | Stanley | |
| 7,553,216 | B2 * | 6/2009 | Hyde et al. | 451/45 |
| 7,857,681 | B2 * | 12/2010 | Bonapace | 451/45 |
| 7,874,896 | B1 * | 1/2011 | Watson | 451/45 |
| 8,197,304 | B2 * | 6/2012 | Hummel | 451/45 |
| 8,262,438 | B1 * | 9/2012 | Allison et al. | 451/321 |
| 8,292,701 | B2 * | 10/2012 | Heng | 451/371 |
| 8,348,725 | B2 | 1/2013 | Clay | |
| 8,388,413 | B1 | 3/2013 | Dovel et al. | |

OTHER PUBLICATIONS

Chris Pye, "Select and Sharpen Your V Tool", self published on line article in PDF format, 2006 edition 2006.1, 102 Pages.

Christopher Schwarz, "Understand Honing Guides", Popular Woodworking Magazine, Feb. 2008 Issue, 6 Pages, F+W Media, Inc. Blue Ash, OH, USA.

* cited by examiner

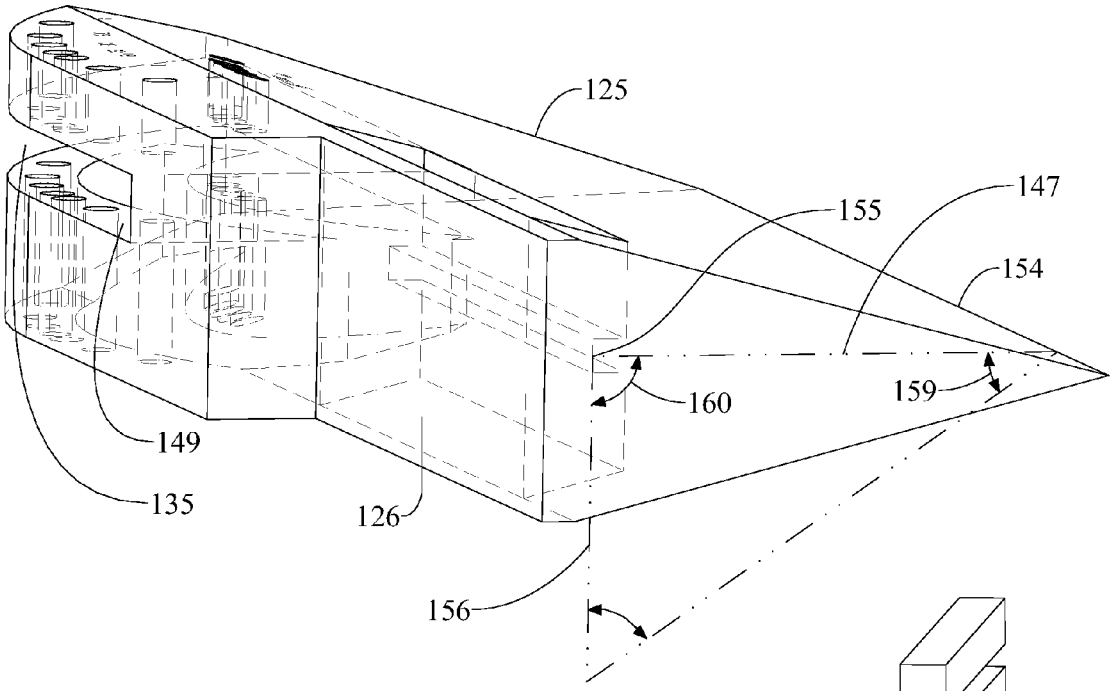
Fig. 5S
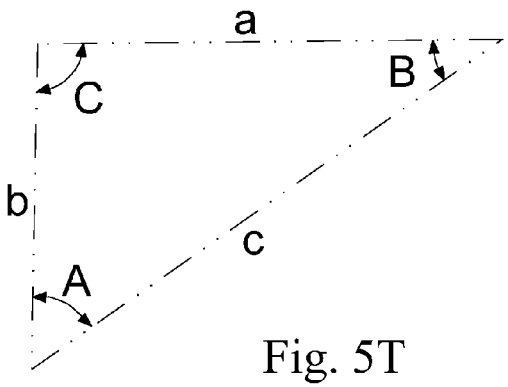
Fig. 5T
$$\frac{\sin(A)}{a} = \frac{\sin(B)}{b} = \frac{\sin(c)}{c}$$
a: 147, known dimension
b: 156
C: 90°
B: Known & desired bevel Angle
A; 90° minus desired bevel angle
Knowing a, A and B, thus solve for b to determine tang slot location for manufacturing purposes.
Fig. 5U
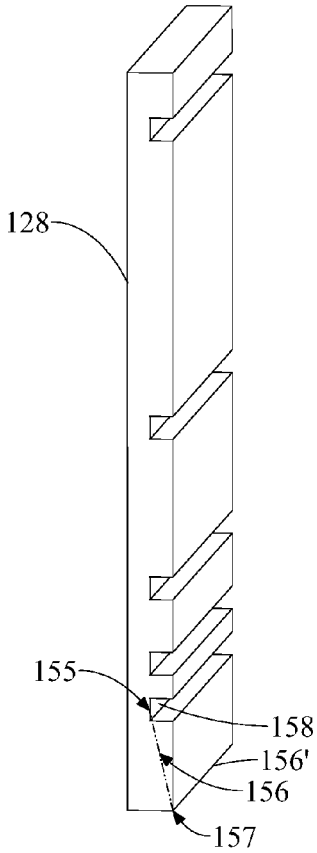
Fig. 5V

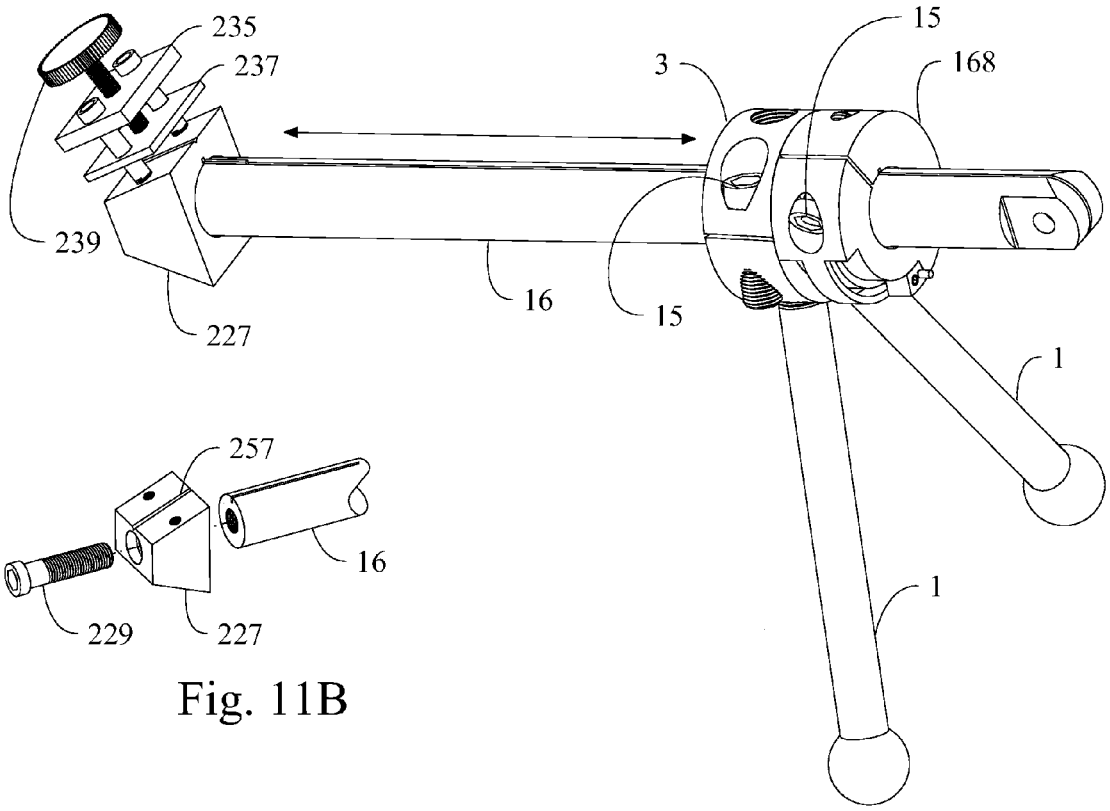
Fig. 11B
Fig. 11A
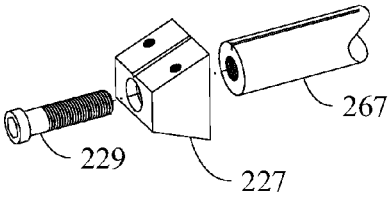
Fig. 11C
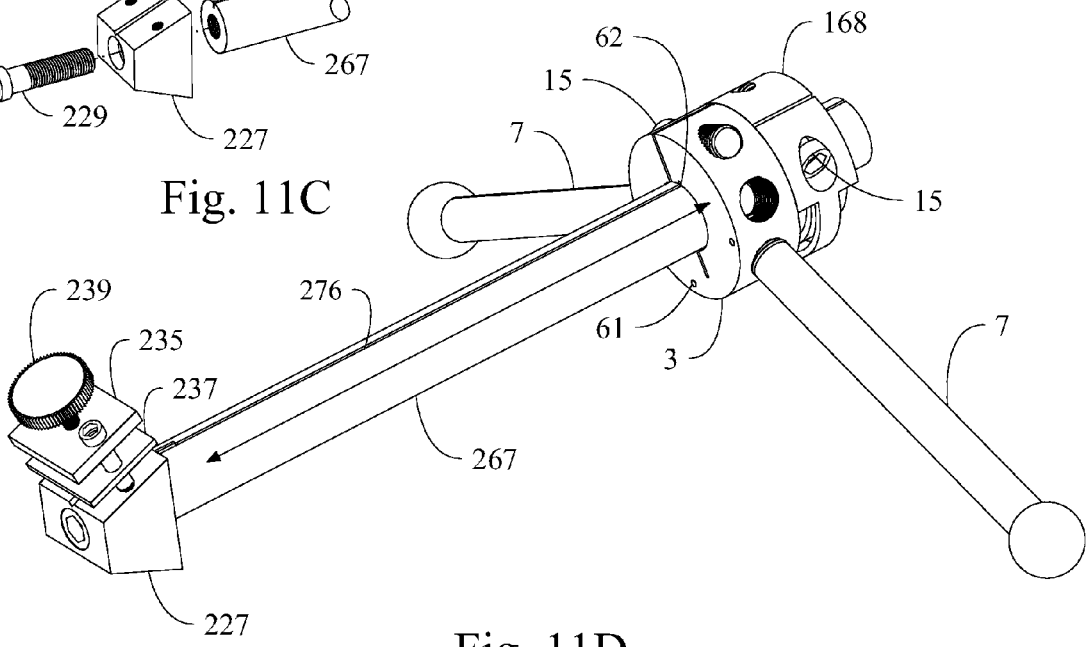
Fig. 11D

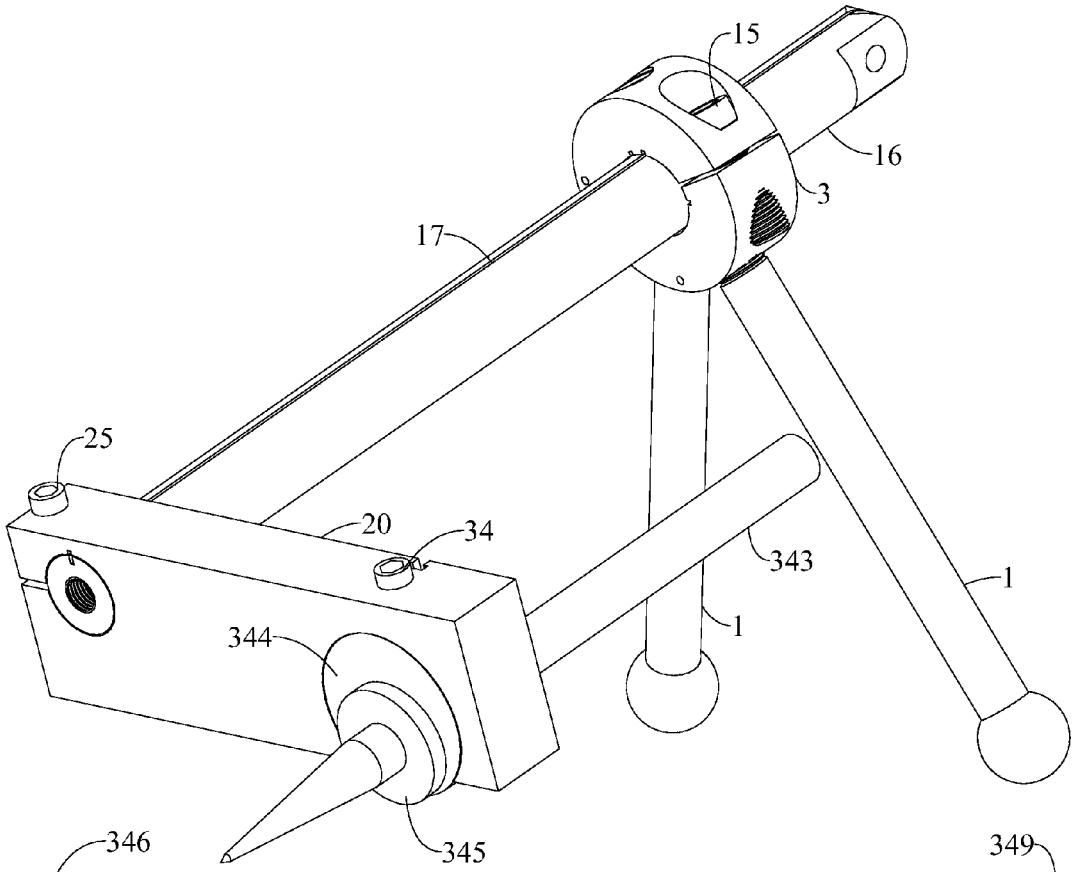
Fig. 16A
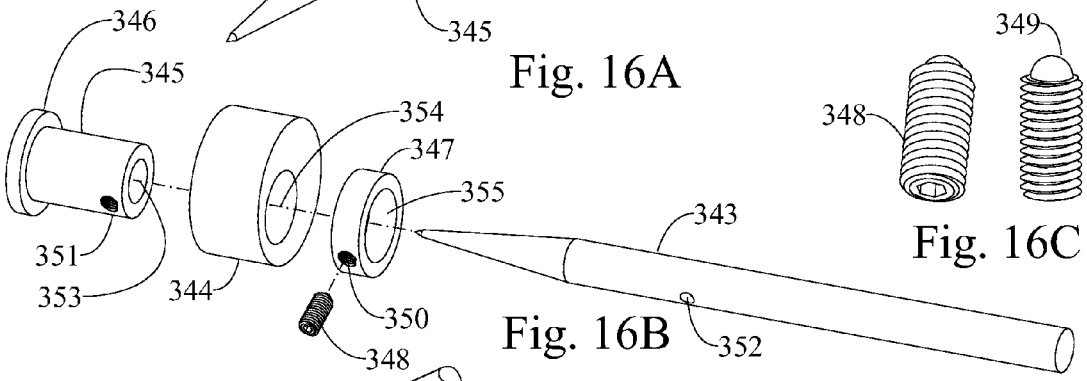
Fig. 16B
Fig. 16C
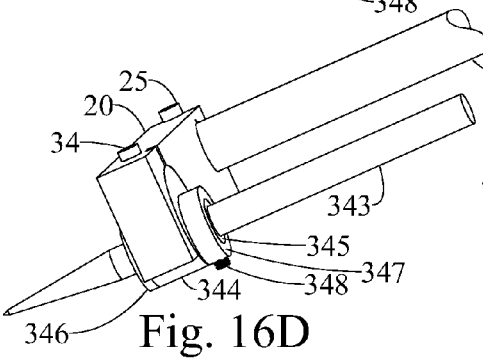
Fig. 16D
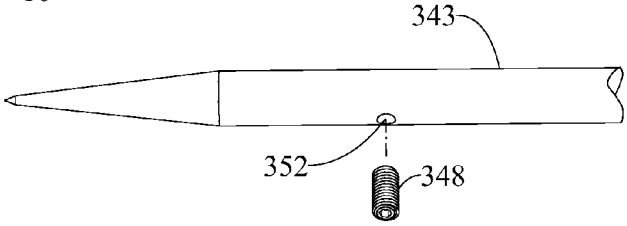
Fig. 16E

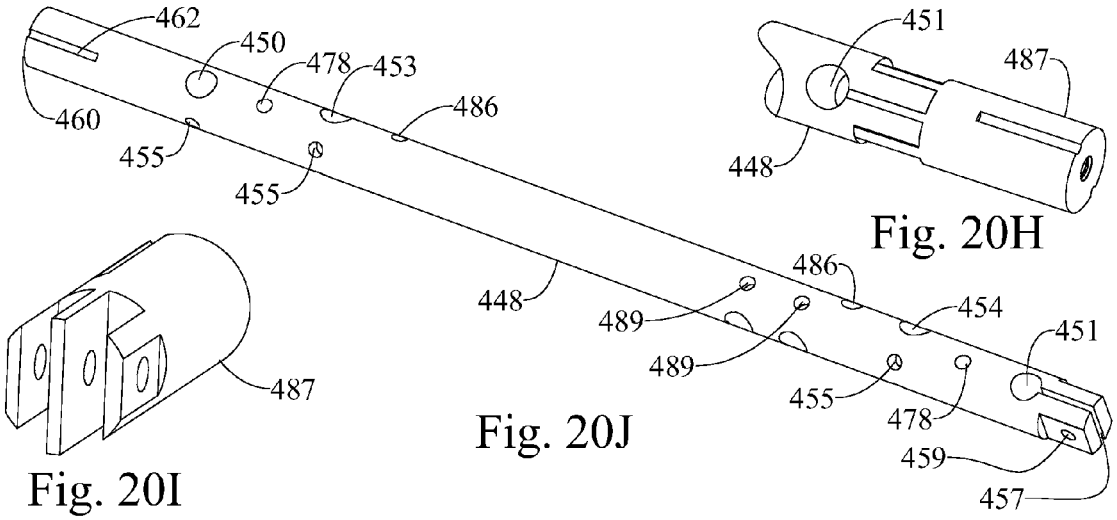
Fig. 20J
Fig. 20H
Fig. 20I
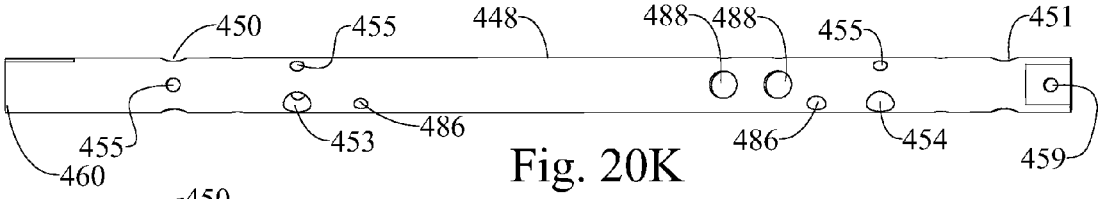
Fig. 20K
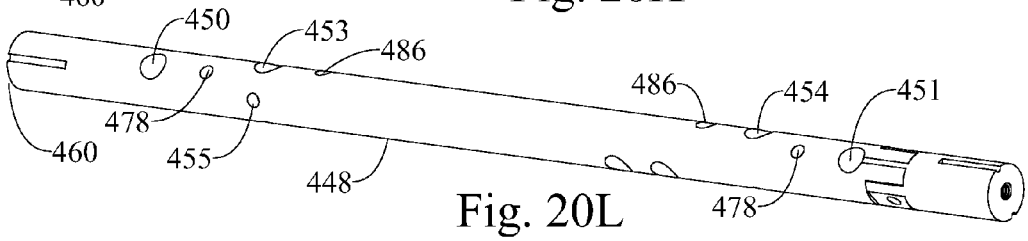
Fig. 20L
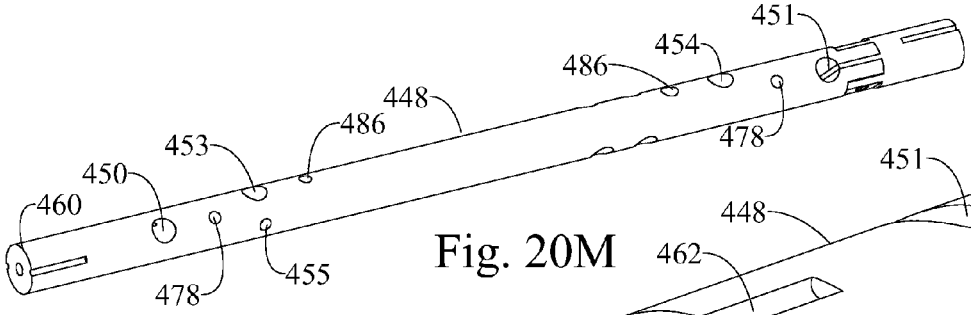
Fig. 20M
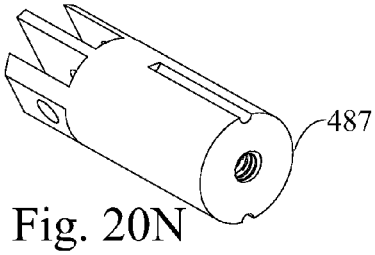
Fig. 20N
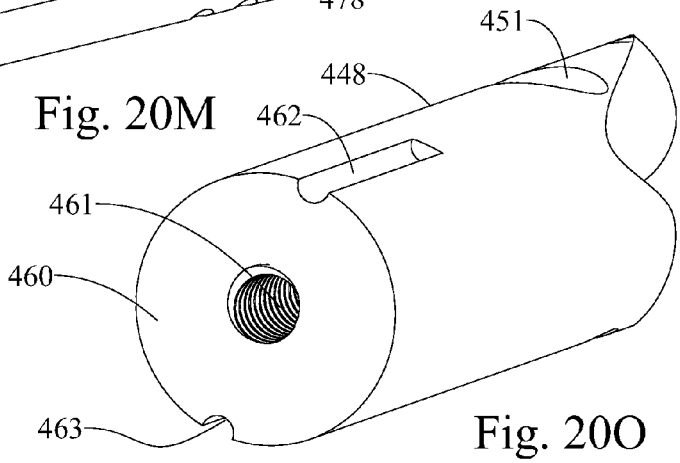
Fig. 20O

MODULAR HONING GUIDE SYSTEM

CROSS-REFERENCE TO RELATED APPLICATIONS

This application claims the benefit of provisional patent application Ser. No. 61/687,910, filed May 3, 2012 by the present inventor, which is incorporated by reference.

BACKGROUND-PRIOR ART

The following is a tabulation of some prior art that presently appears relevant:

| U.S. patents | | |
|---|---|---|
| Pat. No. | Issue Date | Patentee |
| 103,739 | May 31, 1870 | Hanks |
| 223,315 | Jan. 6, 1880 | Brower |
| 449,673 | Apr. 7, 1891 | Francis |
| 471,679 | Mar. 29, 1892 | Spruce |
| 560,111 | May 12, 1896 | Salot |
| 828,853 | Aug. 14, 1906 | Ives |
| 850,084 | Apr. 9, 1907 | Crocker |
| 1,239,494 | Sep. 11, 1917 | Lange |
| 2,107,921 | Feb. 8, 1938 | Weed |
| 2,131,626 | Sep. 27, 1938 | Keith |
| 2,165,929 | Jul. 11, 1939 | Lentz |
| 5,582,542 | Dec. 10, 1996 | Stein |
| 5,810,649 | Sep. 22, 1998 | Oar |
| 6,393,712 | May 28, 2002 | Jansson |
| 7,144,310 | Dec. 5, 2006 | Longbrake |
| 7,335,093 | Feb. 26, 2008 | Harrelson |
| 7,553,216 | Jun. 30, 2009 | Hyde |
| 8,197,304 | Jun. 12, 2012 | Hummel |

There are many types of honing or sharpening guides available to the consumer. Many of these jigs are designed for specific tool types, such as for honing hand held wood carving tools used in woodworking, finish or rough carpentry, printmaking, jewelry making, metal smith or silver smith work and related arts and crafts.

For example, there are honing guides the type of which clamp an edge-tool such that a combined edge-tool and clamping jig are both manually run across an abrading surface. U.S. Pat. No. 449,673 (1891) Francis, U.S. Pat. No. 560,111 (1896) Salot, U.S. Pat. No. 1,239,494 (1917) Lange, U.S. Pat. No. 5,582,542 (1996) Stein, U.S. Pat. No. 7,335,093 (2008) Harrelson, U.S. Pat. No. 7,553,216 (2009) Hyde, are of this type. These types of honing guide jigs are generally used for sharpening or honing of flat edge tools such as hand plane blades, chisels and the like. A number of problems with these types of honing guides result when an abrading surface is used as a support base for a jig. With this type of a jig, a tool edge is un able to access the entire surface area of an abrading medium with unrestricted random motion. Since a portion of an abrading surface is used as a support base for a jig, a larger than necessary honing stone is required to hone a tool. This limits a users choices as to sizes of honing stones that can be used with these types of jigs. Smaller honing stones that a user owns are not useable with these types of honing guides.

Since some areas of an abrading surface are not accessible to a tool edge, un even wear of a honing stone or abrading surface can result. And since an abrading surface is used as a support base, with long term use, such can cause un wanted wear to a jig.

An interesting design is that of U.S. Pat. No. 7,335,093 (2008) Harrelson, of which aim was to address the need for a sharpening holder that allows access to a relatively larger surface area of a honing stone, then the prior art allowed. This embodiment offers a honing guide which moves in a side to side motion over the lengthwise surface area of a honing stone, and is supported by several wheels which run on an abrading surface. This design however still requires a significant portion of the surface area of the stone to support the honing guide. Although a honing stone can be rotated 180° so that both lengthwise edges of the honing stone can have access to a tool edge, a problem still remains for edge tools honed at low bevel angles on narrow stones. For example—the lower the bevel angle of a tool edge, the greater the protrusion distance from the front of the jig is required. Thus, although the side to side motion, which does have merit with the idea of providing greater access to the surface area of larger stones compared to the then prior art—the problem of providing greater access to the honing stone is still not solved for tools requiring low bevel angles on relatively narrow honing stones. For some of the narrower honing stones, a tool edge will not be able to reach the edge of the honing stone, since the stone is acting as a support base for the jig. In other words, for low bevel angles, this solution will require relatively wide abrading surfaces to both support the honing guide and the edge tool, in order to meet the longer protrusion distances required for low bevel angles. Another problem that this embodiment brings about, is if the user tends to hone many tools at low bevel angles; depending on the width of the honing stone, only the areas near the edges of a honing stone will come into contact with a tool edge. This can create a convex situation at the lengthwise center areas of some honing stones, since the edges of relatively narrow stones are receiving more abrasive action then the center of the stone.

Jigs that are designed in such a way that only a tool edge comes into contact with an abrading surface, and a jig base rides on a flat smooth work surface which supports both stone and jig base, could have been a solution to this prior art problem. Although these types of jigs offer an entire surface area of an abrading surface to a tool edge, a problem the applicant has found with these types of honing guides, is that when a honing stone of a different thickness is swapped in, bevel and skew angles at a tool edge change due to an abrading height differential.

This problem was partially addressed by honing guides designed for tools in which only the cutting edge comes into contact with an abrading surface for example as in U.S. Pat. No. 850,084 (1907) Crocker. This type of jig has been used to sharpen tools known as Gravers or Buins used in the printmaking or jewelry arts. Base height adjustability was in the original design; however, the Crocker solution does not address the problem of raising the base height of the jig perpendicular or normal to the work surface by the exact amount of a height differential between two abrading surfaces independent of any bevel and skew angle a tool is set. Thus, when adjusting the correct bevel angle for one abrading surface, it is not possible to maintain that angle when switching to another abrading surface of a differing thickness. Re adjustment of skew and bevel angles is required each time a different abrading height is used. The original patent shows adjustable base legs that can be locked into place by a thumbwheel. However when raising or lowering the base legs, the legs are at an angle and are not perpendicular to a work surface. What results is that each time a different stone is swapped in, more material will be removed from the tool edge than necessary, because the bevel and skew angle settings are slightly different when the tool edge is at a slightly different elevation. This causes additional honing time as well as un necessary tool wear, and thus shorter tool life. For this very reason, many of the honing guides on the market today for wider tool shanks have been designed such that a base of the honing guide rides on the abrading surface due to the difficulty in creating a system for vertical base height adjustability independent of bevel and skew angle settings.

The applicant has found it difficult to hone short shafted, tiny hand carving gouges used in the wood cut print making arts, such as Japanese style hand carving gouges, to a consistent edge. Tiny western style gouges used in fine detail work are also a challenge to hone a tool edge to a uniform profile. These tools need to be held to an abrading surface at a constant bevel angle and rotated along the lengthwise axis of the tool shank, while simultaneously passed over an abrading surface in a completely random motion. Some of these tools are less than 1 mm in cut width and have shanks that are removable from a tool handle, and are less than two inches long when purchased new. The prior art is lacking in a universal manual honing solution that can be used on small planar abrasive surfaces, that can be applied to these tiny gouges, to larger gouges and to wide flat shanked cutting edges such as plane blades. This is because it is difficult to find a solution to clamp short tool shanks and present them to an abrading surface at a low bevel angle without a honing guide base bumping in to the edge of a honing stone. As these smaller tools become shorter with use, it is difficult to hone a uniform edge profile due to less shank length to either hold on to, or clamp into a honing guide. The shorter one can sharpen these expensive tools, tool life is extended.

One design for gouges, v-tools and chisels is U.S. Pat. No. 5,810,649 (1998) Oar. This design offers complete access to an abrading surface since the support base does not ride on an abrading surface. However, the design requires that a work surface which supports the jig base, be coplanar with the abrading surface at all times. This design does not allow for quick and easy adjustment of the jig base. Instead, one must have a support base of the same thickness of the honing stone or abrading surface. Unless one has the equipment such as a power planer to fabricate several work surfaces of differing thickness, or the manual skills to fashion several work surfaces of uniform thickness using hand planes, the jig base will be unable to maintain consistent bevel and skew angles without repeated re adjustment each time a new abrading surface is swapped in.

For gouges in which a fingernail type profile is desired, the inventor knows of no solutions available to the consumer today, which are capable of honing a repeatable fingernail profile on a gouge, using a planar (flat) and non motorized abrasive surface. Tools used for sharpening—honing this type of edge profile generally employ a wet grinding wheel system and associated fixturing attached to a wheel system—for example as in U.S. Pat. No. 6,393,712 (2002) Jansson. This configuration is part of a complete motorized system to sharpen multiple types of tools, such as chisels, gouges, hand and power plane blades and the like, utilizing a slow speed wet grinding system. Although wet grinding systems are capable of honing a wide variety of tools, such requires expensive motorized equipment and grinding wheels or abrasive discs. The user is thus limited to a narrow range of grinding wheels which operate on motorized equipment, and is unable to fully utilize the diverse and wide ranging types of honing stones and abrasive papers or films available to the consumer today. Many wood carvers or crafts people also do not have access to a work shop and prefer to work in the home, and would prefer manually non motorized equipment.

ADVANTAGES

Accordingly there are several advantages of one or more aspects as follows: to provide a honing guide system which addresses (and is not limited to) the prior art.

A plurality of members used in the following honing guide configurations are interchangeable across the entire range of clamping solutions for various tool groups. This reduces the need of redundant, multitude parts for each configuration, and separate individualized jig systems which operate in a disparate manner, each of which are designed for a relatively narrow range of tool types.

Provides greater access to an abrading surface, such that un even wear of an abrading surface can be mitigated since the user has access to the entire surface of the stone.

A system that allows the user the utility of honing most or all of their tools, in a small area, on a table top or work bench, with one unified system for most or all of their tools. If the user has a collection of honing stones from coarse to fine or extra fine grades, which can be expensive, all stones could be fully utilized with a non motorized system.

A simple and quick method of setting a configuration to match vertical height differentials of abrading surfaces, without need of re adjusting the bevel angle at the tool edge to match these height differentials, for a wide array of tool types.

A simple method which aids in the honing of tiny short shafted gouges uniformly while providing full access of an abrading surface to the tool edge.

A system capable of honing a fingernail profile on a non motorized planar abrading surface. The profiles can offer a multitude of benefits to those engaged in relief wood carving work and other forms of hand carving.

The possibility of "hollow grind", which is caused by the curvature of a grinding wheel on a tool edge is mitigated, since the ensuing is designed to hone tools on a planar abrading surface.

A simple set up for honing a bevel angle on both sides of a skewed or non skewed blade, without need to un clamp and then re clamp a tool into the jig would be of benefit to the user.

Other advantages of one or more aspects will become apparent from a consideration of the ensuing description and accompanying drawings.

SUMMARY

A plurality of honing guide base members are interchangeable with a multitude of tool holding clamps—called honing guide body assemblies, or honing guide bodies. A multitude of honing guide configurations can be assembled from these members, and positioned to meet the honing or sharpening requirements of the tool—for example to hone a new, or maintain a desired combination of bevel and skew angles on an edge-tool. Honing or sharpening V-angles of v tools, or setting bevel angles for fingernail profiles on gouges is also possible. The base of any jig configuration, and the tool edge, are moved across a work surface and a planar abrading surface respectively, in a random or semi random manner, to sharpen a cutting edge. The edge tools can be sharpened or honed on a planar abrading surface such as a honing stone, abrasive film, abrasive paper, diamond impregnated stone, Arkansas stone, Japanese style water stone or the like.

A group of secondary relative height maintaining configuration members can be connected to honing guide base configuration members, for abrading surface height differentials resulting from abrading surfaces of differing thickness, such that bevel and skew angles at a tool edge can be maintained without resetting bevel and skew angles at the tool edge, regardless of the abrading surface thickness.

Each honing guide body configuration is designed to clamp and hold a specific tool type or tool group, whereas the elongated support member system and method of use is designed for universal use and technique throughout the range of honing or sharpening configurations.

An additional relative height maintaining—elongated support member system can be used with a fingernail profile configuration. This base and edge tool holder configuration uses a plurality of members that are also used in the honing guide base configurations.

The resulting synergy produced by a modular member-interchangeable system thus allows for the honing of a diverse range of edge-tool types. The system is operationally similar across the wide range of configurations shown and suggested in the following specification, and thus combines value added versatility, expandability, ease of use and repeatability for artists, craftspeople, hobbyists and the creative trades in a way in which current state of the prior art is lacking.

DRAWINGS

FIGS.

In the drawings, closely related Figs. have the same number but different alphabetic suffixes.

FIGS. 9A to 9E show a honing guide body assembly configuration which can be used to hone and sharpen parting tools and the like.

FIGS. 14A to 14H show a honing guide body assembly and clamp configuration which can be used for the sharpening/honing of pocket knives, cutlery, long knives and the like.

FIGS. 16A to 16E show an etching or drypoint scriber honing guide body assembly configuration, and a scriber tool designed for use with this configuration.

DETAILED DESCRIPTION

FIGS. 1A Through 18M

First Embodiment

Due to a honing guide system in which a plurality of members are used in all honing and sharpening applications and configurations, all drawing Figs. with number prefixes between 1 and 18 are considered the First Embodiment of this specification. Drawing Figs. starting with the number 19 and 20 prefixes are alternative embodiments of the members.

All described members, except fasteners, can be manufactured of (and not limited to) aluminum, steel or other metallic materials, or from plastics or composite materials or wood.

Figure 1A:
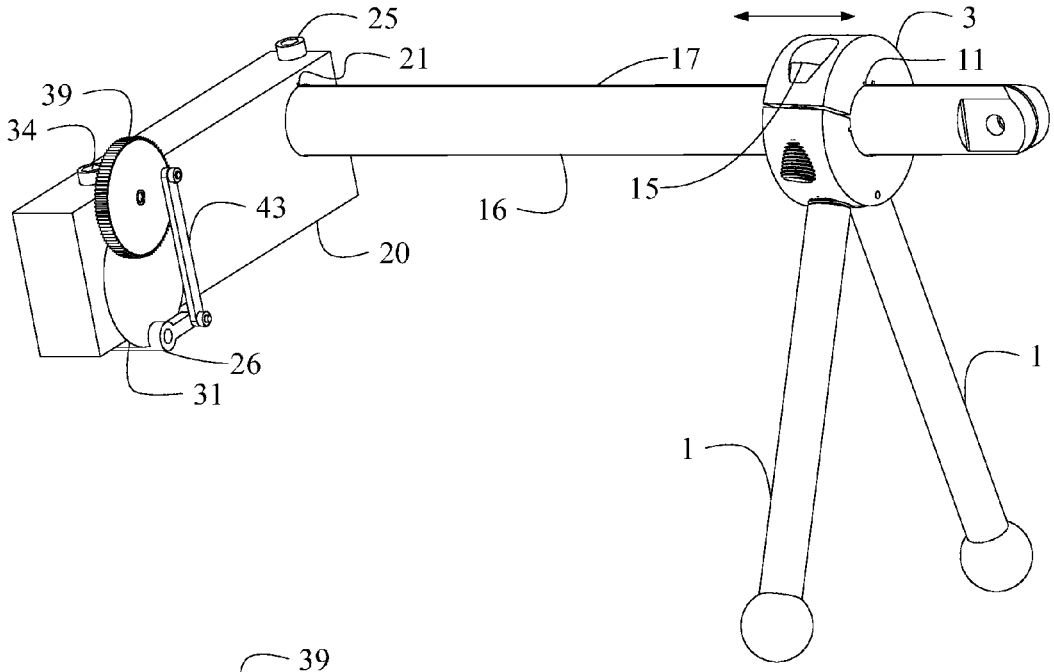
FIGS. 1A to 1P show a honing guide body assembly and configuration for gouges, and a honing guide base assembly used in configurations throughout this specification.
Figure 1B:
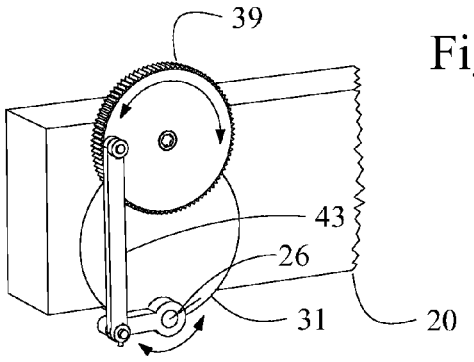
Figure 1C:
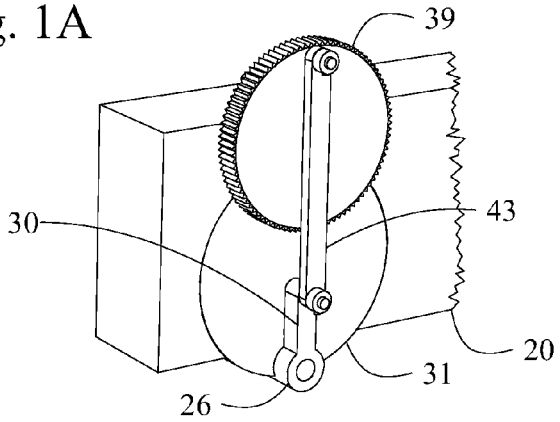
Figure 1D:
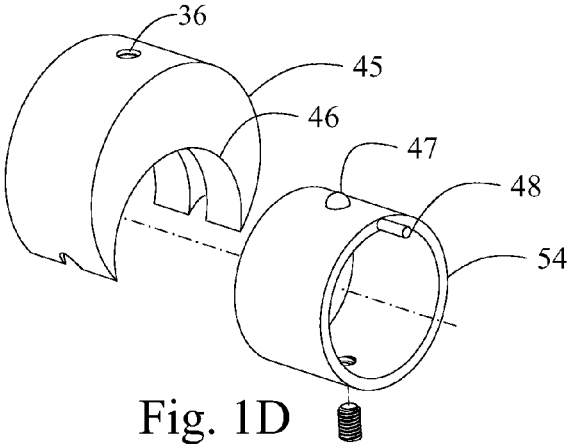
Figure 1E:
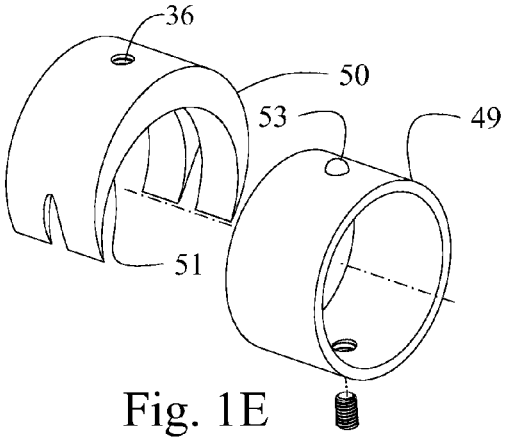
Figure 1F:
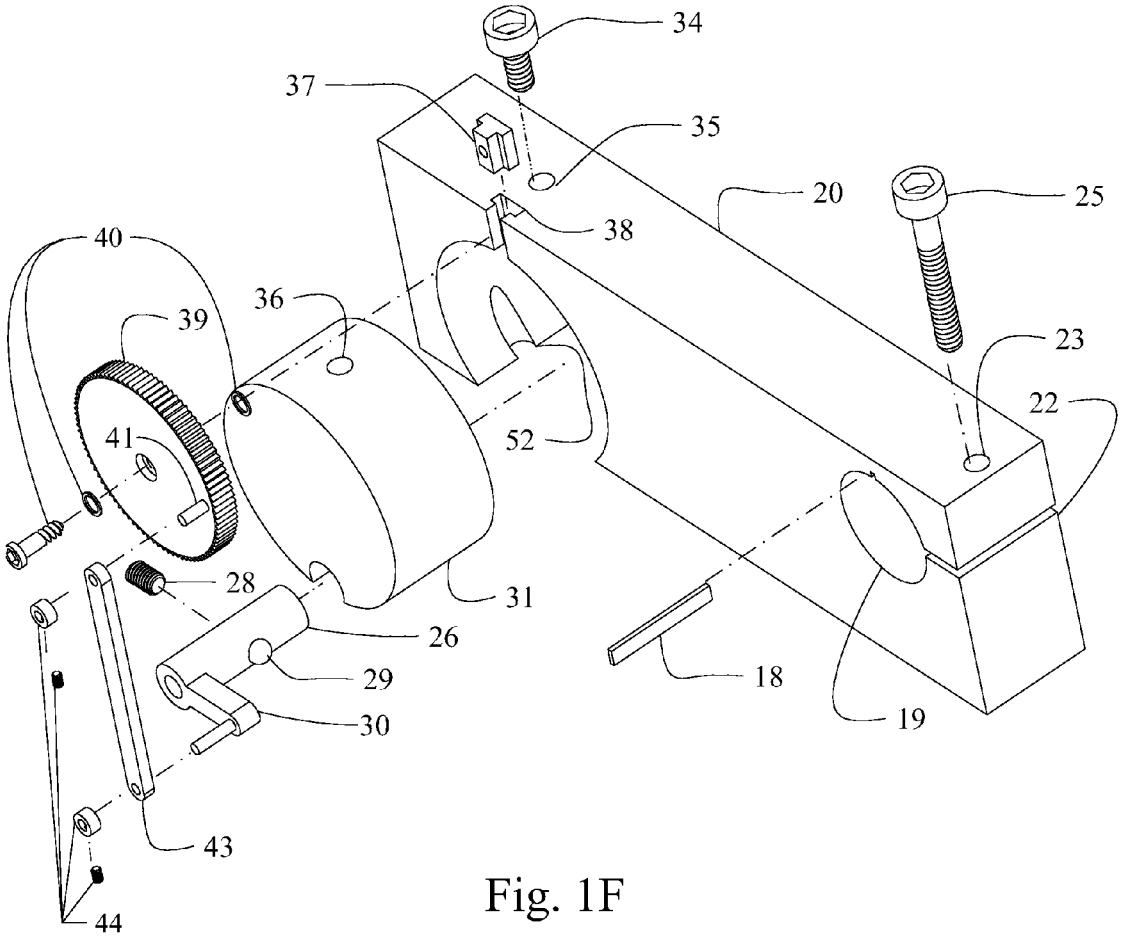
Figure 1G:
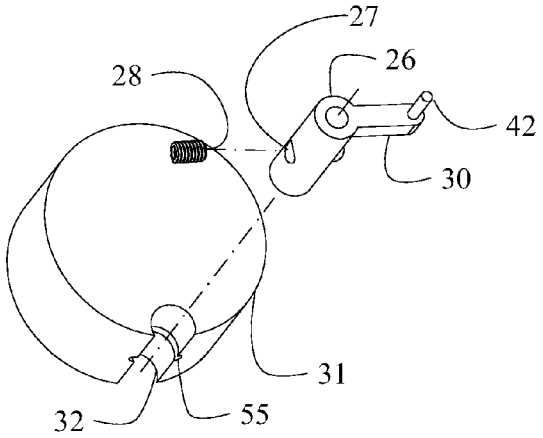
Figure 1H:
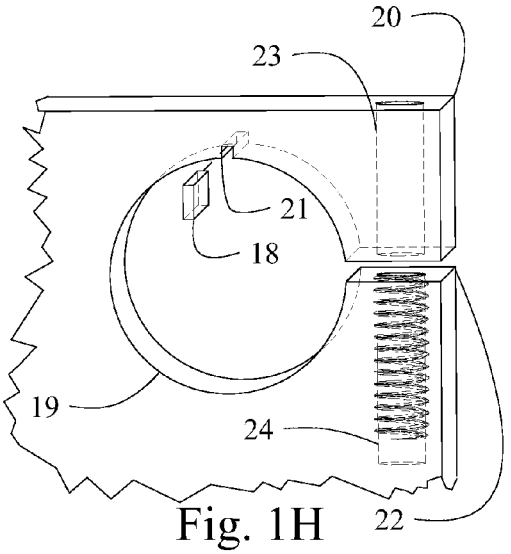
Figure 1I:
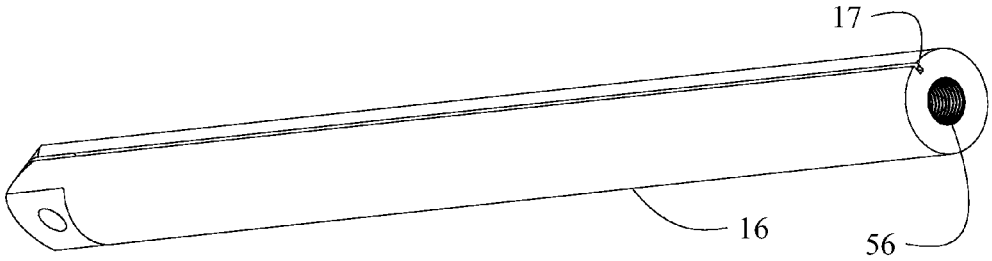
Figure 1J:
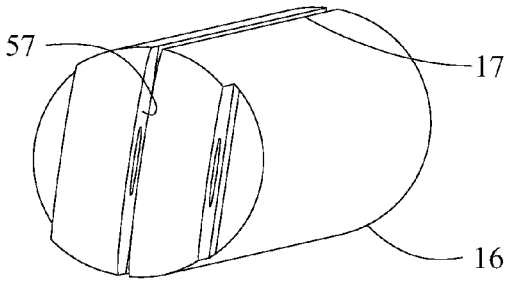
Figure 1K:
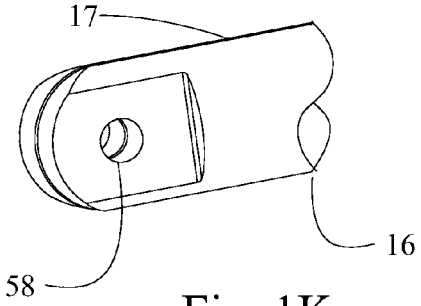
Figure 1L:
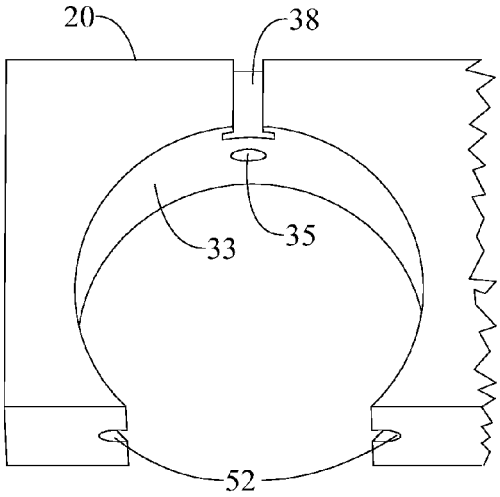
Figure 1M:
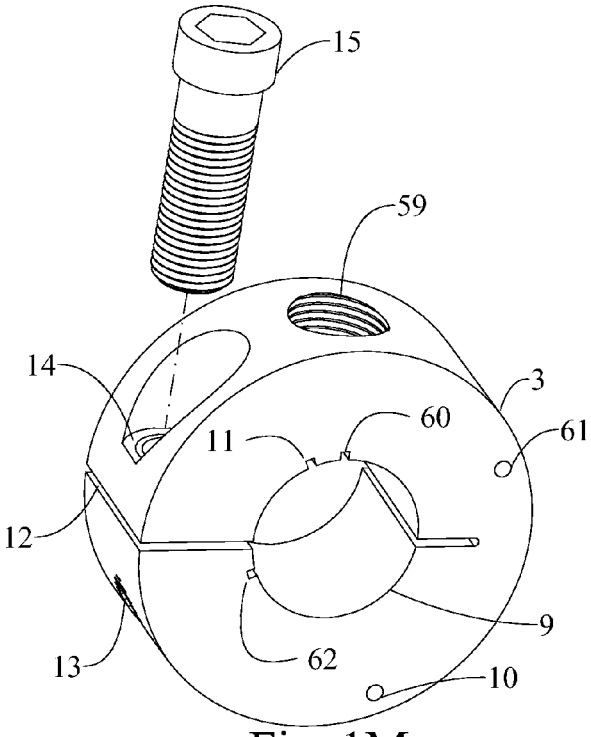
Figure 1N:
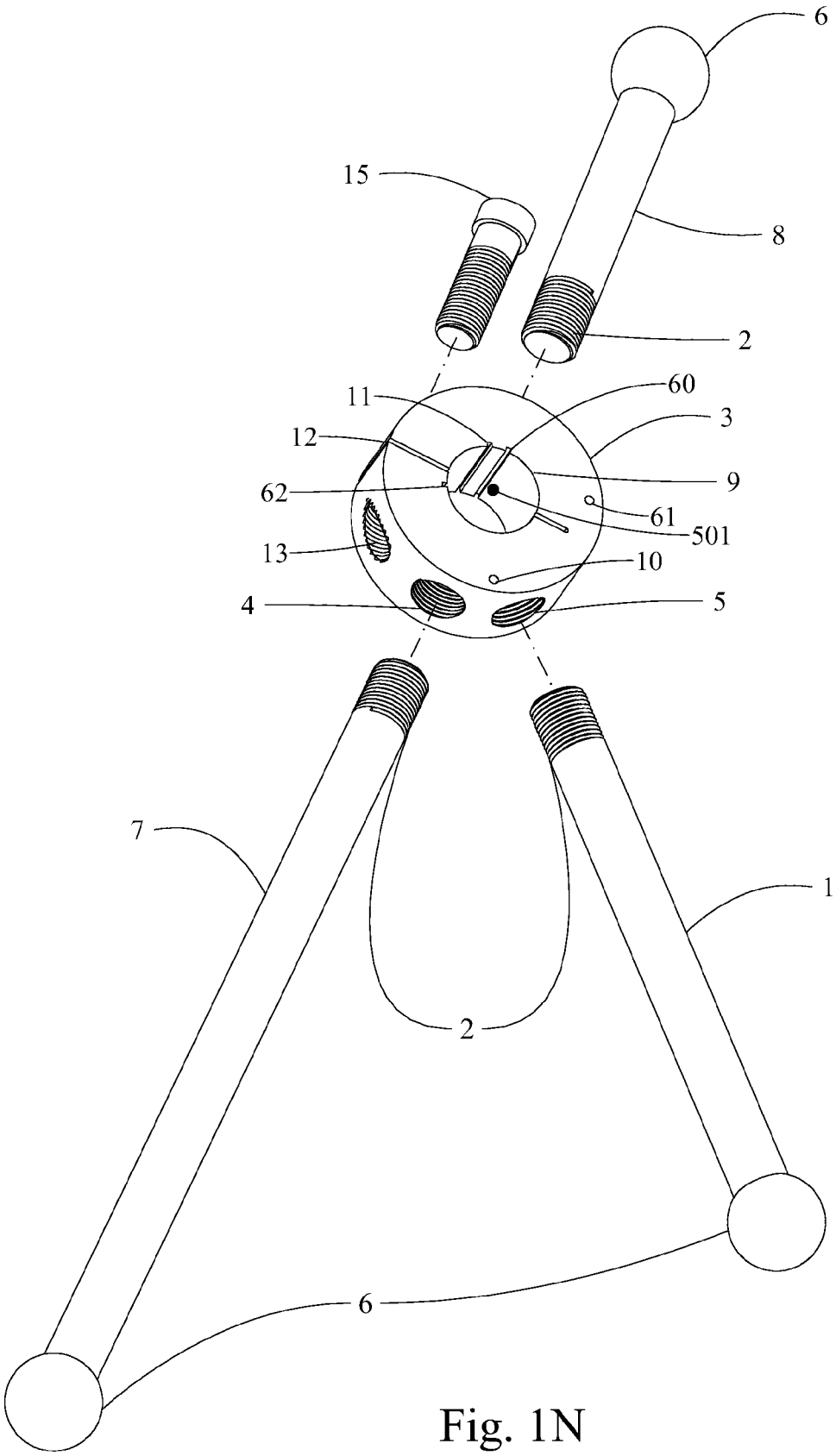
Figure 1O:
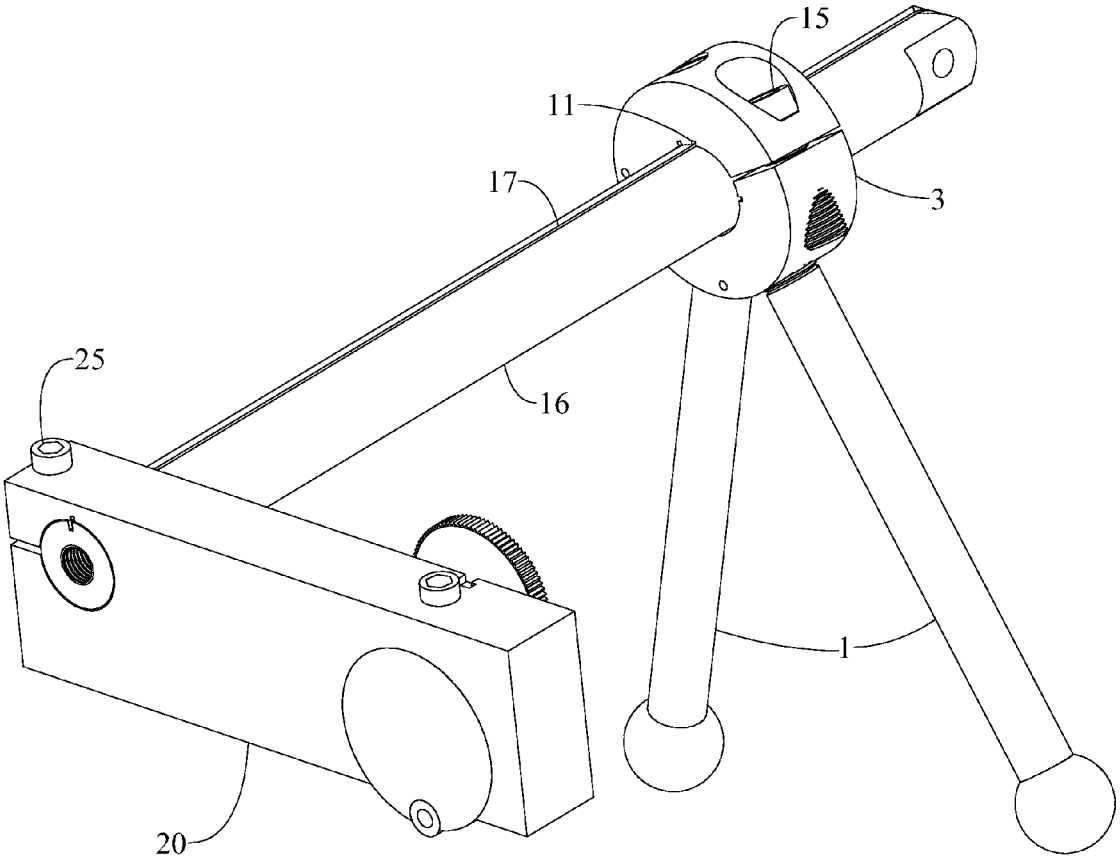
Figure 1P:
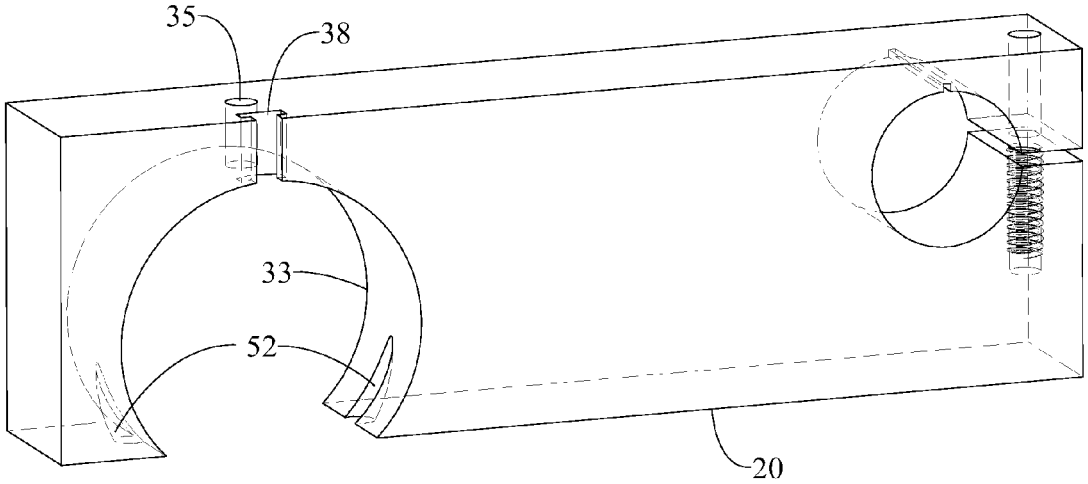

FIGS. 1A Through 1P

Detailed Static Description

FIGS. 1A and 1O show an assembled honing guide configuration for out cannel gouges. An embodiment of a member of the configuration, leg 1 (FIGS. 1A, 1N, 1O), is an elongated support base member with a spherical or hemispherical shaped end or ball 6 (FIG. 1N), and a threaded end 2 (FIG. 1N). At present, it is anticipated that the spherical end could preferably be made of a hardened material able to resist long term wear. For example such as a chromium steel ball commonly used in bearings, and attached to the end of leg 1 by welding, brazing, industrial adhesive etc. Other leg forms can be made, such as a hemispherical machined end of leg 1 with hemispherical leg end having the same radius as that of the leg diameter. The leg end can be heat treated to resist long term wear. Leg 1 could also be made of flat bar stock, round stock, hex bar, tubing, angle stock, channel stock, I beam stock, pipe or of other differently shaped elongated materials with a hemispherical or rounded end.

An embodiment of an elongated support base member system (or honing guide base assembly) for this configuration is comprised of two legs 1 (FIGS. 1A, 1N, 1O), of which are attached to an adjustable clamping member such as a leg collar 3 (FIGS. 1A, 1M, 1N, 1O), by virtue of two threaded leg bores 4, 5 (FIG. 1N). Legs 1 can also be attached to the collar by being affixed permanently such as by welding or brazing or other type of permanent attachment, or other forms of removable attachment. Leg collar 3 could be differently shaped, and an unthreaded leg collar-rod bore 9 (FIG. 1M) could also be differently shaped. A long leg 7 and a short leg 8 (FIG. 1N), which are of the same construction as leg 1, including leg 1, can be manufactured in a multitude of lengths. Three different leg lengths are shown in this specification; however this and all other configurations can utilize one length leg for a multitude of honing and or sharpening applications.

A reference for center of rotation, a main rod collar bore center point 501 (FIG. 1N) of a leg collar-rod bore 9 (FIGS. 1M, 1N) is shown. Threaded leg bores 4 and 5 in leg collar 3, are equivalently radially positioned (in degrees), away from a skew angle registration hole 10 (FIG. 1M, 1N). Threaded leg bores 4 and 5 are also equivalently radially positioned toward a primary keyway 11 (FIG. 1M, 1N). Leg collar 3 is a slotted clamp type collar which by virtue of a leg collar-clamp slot 12 (FIG. 1M, 1N), a leg collar threaded bore 13 (FIG. 1M, 1N), an unthreaded leg collar bore 14 (FIG. 1M), and a leg collar lock bolt 15 (FIGS. 1A, 1M, 1N, 1O), delivers clamping power to the outside diameter of a main elongated support base member such as a bar or a main rod 16 (FIG. 1A, 1I, 1J, 1K, 1O) via a leg collar-rod bore 9, locking in both bevel and skew angles at a tool edge. This is accomplished by virtue of leg collar threaded bore 13 being threaded—below leg collar-clamp slot 12, and unthreaded leg collar bore 14 above leg collar-clamp slot 12, thus a compressive action via leg collar bolt 15 onto the countersunk face of unthreaded leg collar bore 14 results. This slightly reduces the inside diameter of leg collar-rod bore 9 as leg collar clamp bolt (or thumbscrew) 15 is tightened, and uniform clamping pressure to the outside diameter of main rod 16 results.

Main rod 16 could also be made of the previously described shaped elongated materials such as was described for leg 1 (minus the spherical end), to match other shaped embodiments of leg collar-rod bore 9. This embodiment of main rod 16 shown in the drawing Figs. provides a slidably, rotably adjustable and secure clamping surface for the previously described, or for other forms of attachment of the legs onto other honing guide configurations. Otherwise matched shapes of leg collar-rod bore 9 & main rod 16 could also provide for index-able positions of leg collar 3 on main rod 16.

Main rod 16 can be a multitude of lengths, and has a radius equal to or slightly less than leg collar-rod bore 9. Along the entire length of main rod 16, is a keyway 17 (FIG. 1A, 1I, 1J, 1K, 1O). Keyway 17, and leg collar 3 and primary keyway 11 are aligned by a key 18 (FIGS. 1F, 1H). Once leg collar 3 is aligned and slidably moved to the desired position along main rod 16, leg collar bolt 15 can be tightened. Key 18 can be left in keyway 17, or removed. Key 18 can be rectangular shaped, or disk or otherwise shaped.

Main rod 16 is then inserted into a slotted guide body main rod bore 19 (FIGS. 1F, 1H) of a sleeved gouge guide body 20 (FIGS. 1A, 1B, 1C, 1F, 1H, 1L, 1O, 1P). Main rod 16, and thus legs 1, are aligned to sleeved gouge guide body 20 via inserting key 18 into keyway 17 and a guide body keyway 21 (FIGS. 1A, 1H). Thus, leg collar 3 and main rod 16 orient lengthwise, the underside of sleeved gouge guide body 20, to be in parallel with a work surface that legs 1 rest upon. This is known as a "non skewed" position. It is non skewed, because guide body keyway 21 is located at the top or upper most radial position of guide body main rod bore 19, relative to the top surface of the guide body which is the surface where the head of a guide body main clamp bolt 25 is seated (FIGS. 1A, 1F, 1M, 1N, 1O), and because sleeved gouge guide body 20 is a rectangular shaped member. If a differently shaped main rod 16 is used to match a differently shaped leg collar-rod bore 9, guide body main rod bore 19 could also be differently shaped to match rotatable indexing of leg collar 3, as described in the previous.

Guide body main rod bore 19 of sleeved gouge guide body 20, in conjunction with a guide body clamp slot 22 (FIGS. 1F, 1H), an unthreaded guide body clamp bore 23 (FIGS. 1F, 1H), a threaded guide body clamp bore 24 (FIG. 1H), and guide body clamp bolt 25 (FIGS. 1A, 1F, 1O), provide clamping power to the end outside diameter of main rod 16, when guide body clamp bolt 25 is tightened and compresses the inside diameter of guide body main rod bore 19 around the outside diameter of main rod 16. All of the slotted clamps on all guide bodies shown in the drawing Figs. function in the same way. However, other embodiments of attachment means to a honing guide base assembly for this and following guide bodies could be made.

Although threaded guide body clamp bore 24 is shown in FIG. 1H as not passing through the entire height of the guide body, it may pass all the way through due to machining requirements. Unthreaded guide body clamp bore 23 may be converted to a threaded bore for the same reason. In some of the following drawings of guide bodies, although threaded guide body clamp bore 24 is not shown, it is still included in these guide bodies as part of the clamping system, as indicated by virtue of the presence of guide body main clamp bolt 25, and the guide body clamp slot 22 in the following drawing figures.

FIG. 1F is an exploded view of a simple mechanism or assembly comprised of members which aid the user in manual rotation of relatively small diameter shanks of out cannel gouges, in a uniform and controlled manner, while moving the gouge over a honing surface. This is useful for tiny gouges of two inches or less in shank length. A small gouge sleeve 26 (FIGS. 1A, 1B, 1C, 1F, 1G) is a tubular or bored assembly comprised of a set screw bore on small gouge sleeve 27 (FIG. 1G) which accepts a small gouge set screw 28 (FIGS. 1F, 1G). On the surface of the outside diameter of small gouge sleeve 26, is a small gouge tang 29 (FIG. 1F) spherically shaped or rectangular or differently shaped). The tang can be machined into the sleeve, or can be attached to the sleeve by welding, brazing, industrial adhesive or other techniques. To install the sleeve into the configuration, the sleeve is rotated such that a small gouge sleeve crank lever 30 (FIGS. 1C, 1F, 1G) is facing away from a small sleeve housing 31 (FIGS. 1A, 1B, 1C, 1F, 1G), and a small sleeve housing bore 32 (FIG. 1G) which is offset from center of small sleeve housing 31. Once inserted, the sleeve assembly is rotated 180° to a vertical crank position as shown in FIG. 1C. Small gouge sleeve 26 is held securely into small sleeve housing 31, by virtue of a small sleeve tang slot 55 (FIG. 1G) and small gouge tang 29, and is secure until rotated into the downward crank position used for install. Small gouge sleeve crank lever 30 is attached to small gouge sleeve 26 by machining in, welding, brazing, industrial adhesive or other techniques, such that the crank and sleeve are one complete member.

Small sleeve housing 31 is then inserted into guide body housing bore 33 (FIGS. 1L, 1P) of the gouge guide body 20. Small sleeve housing 31 is then secured into sleeved gouge guide body 20 by a sleeve housing lock bolt 34 (FIGS. 1A, 1F). Sleeve housing lock bolt 34 protrudes down through a housing lock bore 35 (FIGS. 1F, 1L, 1P) on sleeved gouge guide body 20, and into a small sleeve housing lock bore 36 (FIG. 1F), threaded or un threaded, on the outside diameter of the small sleeve housing 31.

A t-slot nut or sliding channel nut or t-nut 37 (FIG. 1F), is then inserted into a t-slot 38 (FIGS. 1F, 1L, 1P), and a crankshaft dial 39 (FIGS. 1A, 1B, 1C, 1F) is then attached to t-nut 37 by virtue of a crankshaft dial bolt & nylon washer 40 (FIG. 1F) through the unthreaded center bore of crankshaft dial 39. T-nut 37 and t-slot 38, provide attachment of crankshaft dial 39 to gouge guide body 20, such that slidably vertical positioning and locking of the dial on gouge guide body 20 is possible.

On the face of crankshaft dial 39, near the outside diameter, is affixed a crankshaft dial crank pin 41 (FIG. 1F). On the end of small gouge sleeve crank lever 30 is a small sleeve crank pin 42 (FIG. 1G). Crankshaft dial crank pin 41 and small sleeve crank pin 42 are connected to a crankshaft 43 (FIGS. 1A, 1B, 1C, 1F), by inserting the through bore holes on the ends of crankshaft 43 over the pins and securing both pins to crankshaft 43 by virtue of a set screw & collar 44 (FIG. 1F).

Small gouge sleeve crank lever 30, and the inside and outside diameters of small gouge sleeve 26 (and thus the diameter of offset small sleeve housing bore 32), can be a plurality of lengths and diameters respectively. This is so that a multitude of gouge shank diameters can be accommodated for this configuration. The larger the sleeve diameter, the shorter the crank length will be. This is because crankshaft 43 should be in a vertical position all through rotation of crankshaft dial 39 and small gouge sleeve 26 in order for uniform and non binding motion of the gouge to occur. Thus the variable horizontal distance (defining the length of gouge guide body 20 as the horizontal), between the axis of rotation of any gouge sleeve, including 26, and the lengthwise axes formed between crankshaft dial crank pin 41 and small sleeve crank pin 42, are equivalent, for any sized sleeve, through the rotation of the dial and sleeve, with the crankshaft remaining vertical at all points through rotation.

For example, FIG. 1D shows a medium sleeve 54 (relative to small gouge sleeve 26), with a medium sleeve housing 45 (FIG. 1D). A medium sleeve housing bore 46 (FIG. 1D) is sized to match the outside diameter of medium sleeve 54. This sleeve-housing combination is comprised of the same tang and tang slot arrangement as previously discussed for small gouge sleeve 26, namely, a medium sleeve tang 47 (FIG. 1D) and a medium sleeve housing tang slot 502 (FIG. 1D). In this case, the face of the sleeve acts as the crank, since a medium sleeve crank pin 48 (FIG. 1D) is affixed to the face of the sleeve. A sleeve with the pin mounted on its face represents the largest sleeve configuration which utilizes crankshaft 43 and crankshaft dial 39. As the sleeve diameter becomes smaller (for a multitude of smaller sleeve sizes), the sleeve cranks become longer, and become offset from the sleeve wall in the form of a protruding crank, up to the relatively longest crank length of small gouge sleeve crank lever 30.

Sleeves relatively larger than sleeve 54, such as a large sleeve 49 (FIG. 1E), with a large sleeve housing 50 (FIG. 1E) and a large sleeve bore 51 (FIG. 1E), can be employed for relatively large sized gouges, in which crankshaft dial 39 and crankshaft 43 may be omitted for these larger gouge configurations. All sleeve housings, regardless of sleeve diameter, have the same outside diameter, and all sleeve housings, no matter what the sleeve diameter, fit into sleeved guide body housing bore 33 of sleeved gouge guide body 20.

Therefore, t-nut 37, and t-slot 38 provide vertical adjustability of crankshaft dial 39, in order to accommodate a multitude of sleeve crank lengths while using the same length crankshaft 43. Therefore several different length crank shafts, one matched to each sleeve and housing set, are not needed, and one crank will suffice for a multitude of gouge sizes.

Guide body tang slot 52, (FIGS. 1F, 1L, 1P) allow medium sleeve tang 47 and a large sleeve tang 53 (FIG. 1E), to extend past the outside diameter of medium sleeve housing 45 and large sleeve housing 50. As the sleeve diameter increases, thinner walls on medium sleeve housing 45 and large sleeve housing 50 are the result, and hence medium sleeve housing tang slot 502 and a large sleeve housing tang slot 503 (FIG. 1E), are shown. Medium sleeve tang 47 and large sleeve tang 53 protrude through the tang slots, as medium sleeve 54 and large sleeve 49 near the end of 90° rotation from the position shown in FIG. 1C (as in for the smaller sleeve).

To assemble a differential height adjust member system for use on multiple abrading surfaces of different heights or thicknesses, see prefixed section 4 of the drawing Figs.—static description.

FIGS. 1A Through 1P

Detailed Operational Description

A gouge shaft or shank is inserted into small gouge sleeve 26 from the rear (crankshaft dial 39 side) of gouge guide body 20, with the underside of the gouge shaft facing small gouge set screw 28. Small gouge set screw 28 (if the smaller sleeve 26 is used), is tightened with an Allen Wrench, such that a clamping force is applied to the underside of the gouge shaft, thus holding the gouge securely into place inside the sleeve.

When keyway 17 in main rod 16, and primary keyway 11 on leg collar 3 are aligned and clamped together, guide body keyway 21 in sleeved gouge guide body 20 that is aligned to keyway 17 on the opposite end of main rod 16, shares the same radial reference point to legs 1, as does primary keyway 11. Thus, the underside of sleeved gouge guide body 20, is parallel to a work surface, and is in a zero skew position. When the three keyways are in alignment and clamped together, there is no radial tilt of the guide body toward a work surface, or abrading surface, and thus no skew or zero skew. Therefore, for tools which have no skew angle, all three keyways are in alignment. For adjusting bevel angles, moving leg collar 3 towards the guide body increases the bevel angle at the tool tip, since as leg collar 3 and thus legs 1 are moved toward the guide body, due to the geometry, the entire configuration tilts forward. Moving leg collar 3 away from the guide body thus reduces the bevel angle at the tool tip. At leg collar 3 and main rod 16 clamp joint, both a bevel and a skew angle can be set for a tool, by sliding and rotating leg collar 3 on main rod 16, and then tightening bolt or thumb screw 15, once a desired bevel and skew combination is set; such allows the user to lock both bevel and skew angles with one lock. In this configuration with sleeved gouge guide body 20, generally, non skewed positions should be used, and thus key 18 should be used at all times when setting bevel angles to keep the keyways aligned prior to clamping (unless the user wishes to experiment with non traditional profiles on gouges). Skew angles for other configurations are covered in more detail later in this specification.

To set a specific bevel angle at a tool edge, there are at least two methods. One method is to clamp a tool into the configuration, and view at eye level an existing bevel angle on a tool edge while it rests on an abrading surface (or in the case where a plurality of abrading surfaces of differing thicknesses are being used, see prefixed Section 4 of the drawing Figs.—static description). The existing bevel angle of a tool is then matched to an abrading surface by sliding leg collar 3 on main rod 16 towards the guide body to increase the bevel angle at the tool tip, or away from the guide body to decrease the bevel angle at the tool tip. Leg collar bolt 15 is then tightened, thus locking leg collar 3 and the bevel angle into place. A second method to set the bevel angle at the tool edge is covered in Section 2.

Short legs 8, or long legs 7, could be inserted into leg collar 3. Compared to legs 1, the shorter legs 8 provide relatively lower bevel angles over the range of motion of leg collar 3 on main rod 16. Long legs 7 provide relatively higher bevel angles over the range of motion of leg collar 3 on main rod 16. All three legs have lengths which provide an over lapping range of bevel angles through the range of motion of leg collar 3 on main rod 16, relative to equivalent tool protrusion distances from the front of all guide bodies (tool protrusion is discussed in section 18).

Once a desired bevel angle for the tool tip is set, the jig configuration can be held in any fashion, and legs 1 of the configuration are then moved across a smooth and flat work surface such as a table top, work bench, a granite slab, tempered glass or the like, while the tip of the tool is run across an abrading surface that rests upon a work surface. Some of the materials used for kitchen countertops are also a good choice as a work surface because they offer a very flat, smooth and low friction surface. Inexpensive remnants of such are available from home improvement stores. While moving the jig and gouge across a work surface and abrading surface respectively, crankshaft dial 39 is rocked back and forth by the users thumb, finger, palm or hand, using steady and uniform motion over approximately 180° of rotation, more or less, depending on the particular gouge being honed. Thus easy and uniform rotary motion for even the tiniest or shortest of gouges is possible. The relatively large diameter of crankshaft dial 39, compared to smaller gouge shank diameters, provides precision in motion, and reduces—or de amplifies—the relative rocking motion of the users hand or fingers, relative to the diameter of the gouge shank, such that even tiny gouges can be rotated slowly and uniformly, and honed to a near perfect edge profile.

The offset (from center) medium sleeve housing bore 46, large sleeve bore 51 and small sleeve housing bore 32 in medium sleeve housing 45, large sleeve housing 50 and small gouge sleeve 26 respectively, are off center in the housings, such that presenting the tool tip to an abrading surface in a manner which allows for low bevel angles, and short tool edge protrusion distances from the front of the guide body is possible. Thus, the rotating sleeve which clamps the gouge, and not the guide body or the sleeve housing, is near an abrading surface. This allows for very short shafted tools common in the printmaking trade, to be sharpened to very short lengths, since the clearance between the jig and an abrading surface is determined solely by the sleeve wall thicknesses of medium sleeve 54, large sleeve 49 or small gouge sleeve 26. The thinner the sleeve wall the lower the bevel angle and the shorter the tool that can be honed without the configuration bumping the edge of an abrading surface or touching an abrading surface. Thus, the tool clamping is up and out of the way of the honing stone as much as is possible.

For relatively larger gouges, large sleeve 49 with large sleeve housing 50 can be used. For the largest sized gouges, due to greater tool shank diameters or larger handles, crankshaft dial 39 and crankshaft 43 can be removed from sleeved gouge guide body 20, and rotation of the tool can be accomplished by rotating the tool shank or the tool handle while clamped into large sleeve 49. For users who wish greater precision or control in the adjustability of bevel angles in this configuration, the micro adjust collar assembly discussed in the Section 15 can be used with this configuration.

A primary purpose of a multitude of different sized gouge sleeve diameters and sleeve housings, is to match or closely match the centerline axis of rotation of the gouge sleeve, to that of the centerline axis of the gouge itself, such that the two axes are not offset, or not offset by a great distance relative to the diameter of the gouge shaft. Keeping these two axes in close relative proximity or collinear provides a uniform bevel angle at a gouge tool edge.

FIGS. 2A Through 3B

Detailed Static Description

Figure 2A:
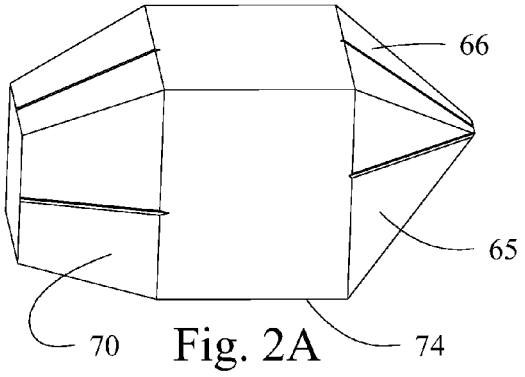
FIGS. 2A to 2C show multi faceted angle calibration blocks which can be used to set bevel angles at a tool edge.
Figure 2B:
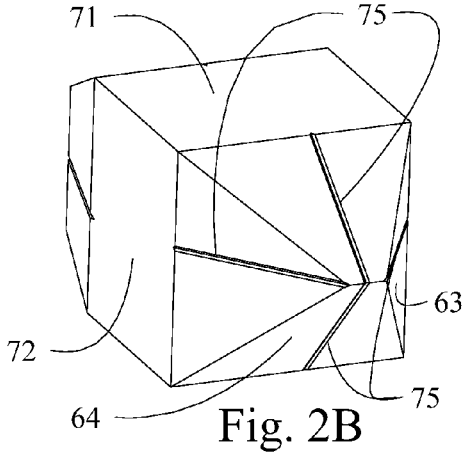
Figure 2C:
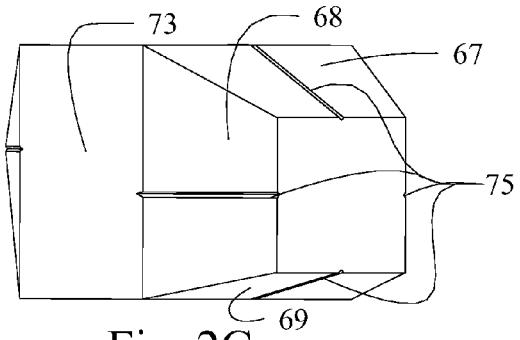

FIGS. 2A, 2B and 2C show a one piece, eight faceted angle gauge block. Angle facets 63 and 64 (FIG. 2B), angle facets 65 and 66 (FIG. 2A), angle facets 67, 68, 69 (FIG. 2C), and an angle facet 70 (FIG. 2A), all are of differing angles in relation to four angle block bases 71, 72 (FIG. 2B), 73 (FIG. 2C) and 74 (FIG. 2A). Each facet has a milled or molded v-groove or printed or etched line 75 (FIGS. 2B, 2C) lengthwise down the facets; lines or grooves which are perpendicular to their respective proximate planar edges of each angle block base 71, 72, 73 and 74.

Figure 3A:
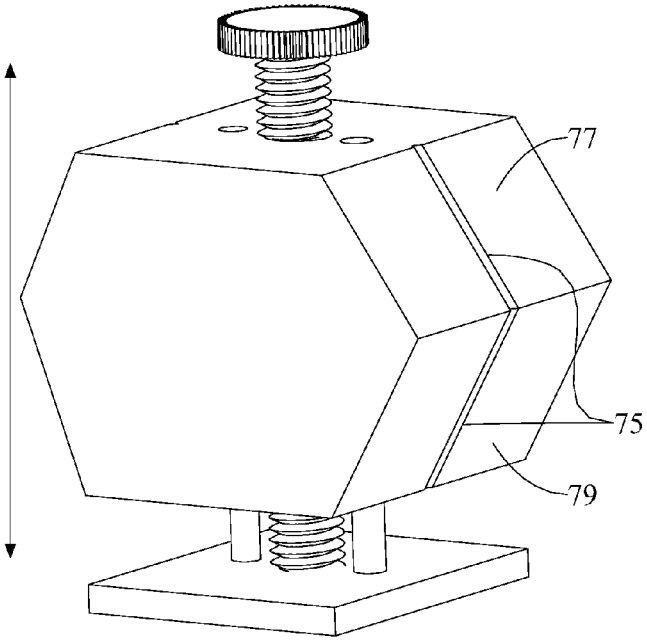
FIGS. 3A and 3B show a multi faceted angle calibration block which can be used in the fingernail profile configuration to set bevel angles at the tool edge.
Figure 3B:
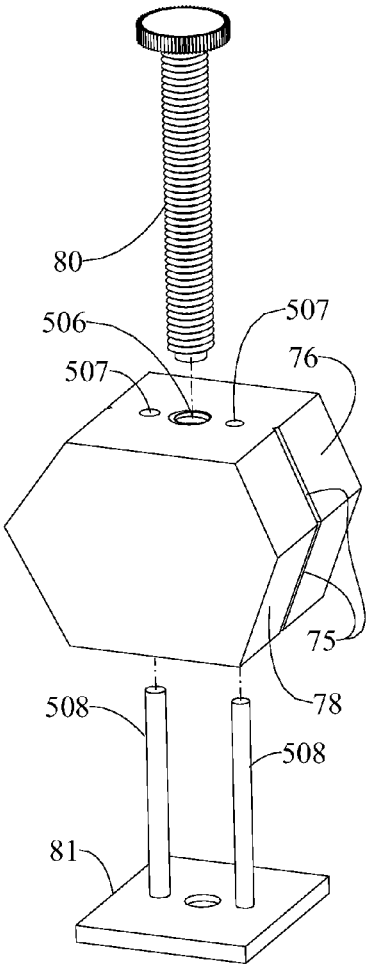

FIGS. 3A and 3B show a height adjustable bevel angle block. These facets make relatively steeper angles (than FIG. 2A blocks) to the work surface. This block is used primarily for the fingernail profile configuration of Section 10. To assemble the height adjustable bevel angle block, two riser posts 508 (FIG. 2B) are inserted into a pair of riser bores 507 (FIG. 2B). A high angle block thumbscrew 80 (FIG. 2B) is then threaded into threaded bore 506 (FIG. 2B). This embodiment can be used with large shanked gouges, in situations where the facets on the block are unable to reach the top edges of the gouge. The block can be raised or lowered to enable the facets to meet the top edges of the tool shank. FIG. 2A shows the adjustability of the block.

The high angle facets 77 and 79 (FIG. 3A) and high angle facets 76 and 78 (FIG. 3B) are relatively steep bevel angles compared to the facets of the block shown in FIGS. 3A and 3B. They can be used for some of the higher bevel angles found on fingernail profiles. V grooves or lines 75 (FIG. 3A, 3B); are also an aid to help align the tool shank to the facet.

FIGS. 2A Through 3B

Detailed Operational Description

The multi faceted angle gauge blocks are designed for purpose of setting a bevel angle for a cutting edge such as a gouge, v-tool, power planer blade, pocket knives or cutlery or hatchets. In the case of the eight faceted angle gauge block of FIGS. 2A through 2C, this is accomplished by choosing (as an example) the angle represented by angle facet 64, and setting angle block base 74 on a work surface. If the tool is a straight shanked tool with uniform shank diameter, angle facet 64 is then moved to the gouge shaft, and v groove or line 75 is aligned lengthwise along the top of the gouge shank such that the groove aligns in parallel to the lengthwise top edge of the gouge—along the shank edge. This helps to keep the facet in a non skewed position in relation to the gouge shank. The jig can then be adjusted to set the bevel angle of the gouge, to match the angle the facet makes to a work surface.

The angle gauge block shown in FIGS. 3A to 3B are for use with the fingernail profile configuration which generally require higher bevel angles.

For large gouges in the fingernail profile configuration of Section 10, high angle block thumbscrew 80 is rotated to raise or lower the bevel angle block such that one of the four facet surfaces is able to meet the top edges of a gouge such that a bevel angle for a tool edge can be set.

In situations where very large shank diameters of gouges requiring lower than 45 degree bevel angles do not allow the facets to reach the top of the gouge shank, an alternative embodiment for the block shown in FIGS. 2A through 2C is described in Section 19, which also allows for base height adjustability of the angle gauge block, to enable the facets to reach the top of the gouge shanks.

Figure 4A:
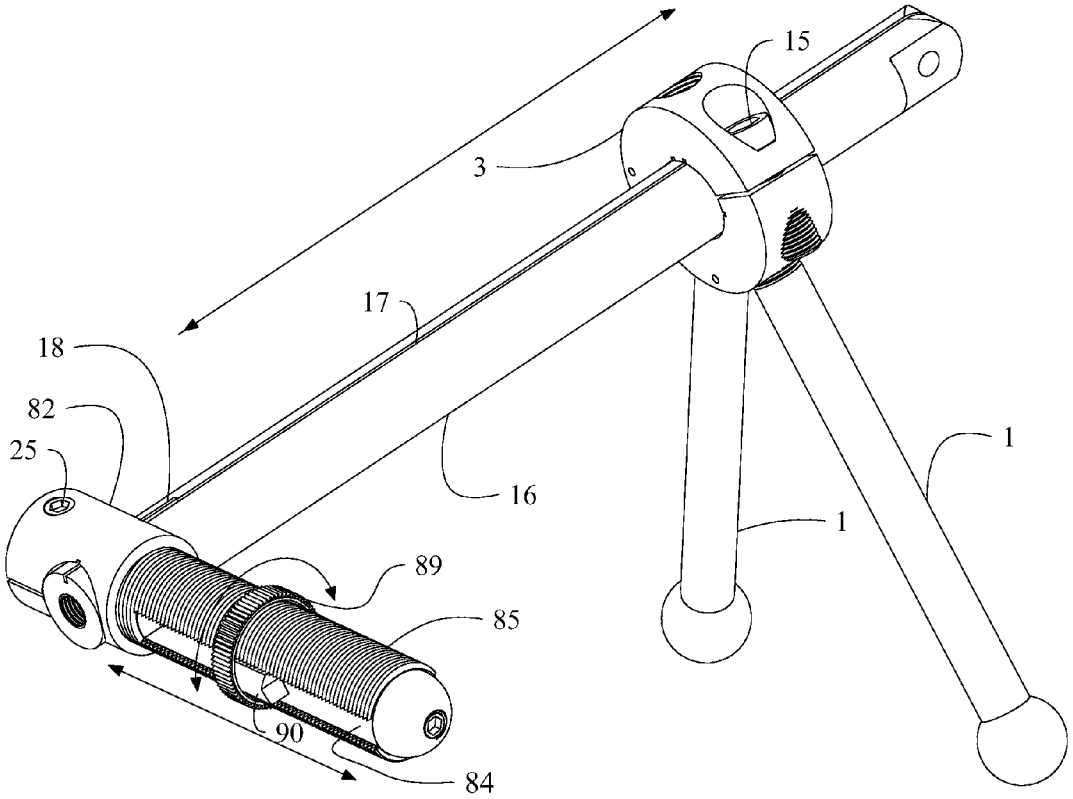
FIGS. 4A to 4P show a flat edge-tool honing guide body assembly configuration, including height differential adjust (riser) members used in conjunction with the elongated support member system.
Figure 4B:
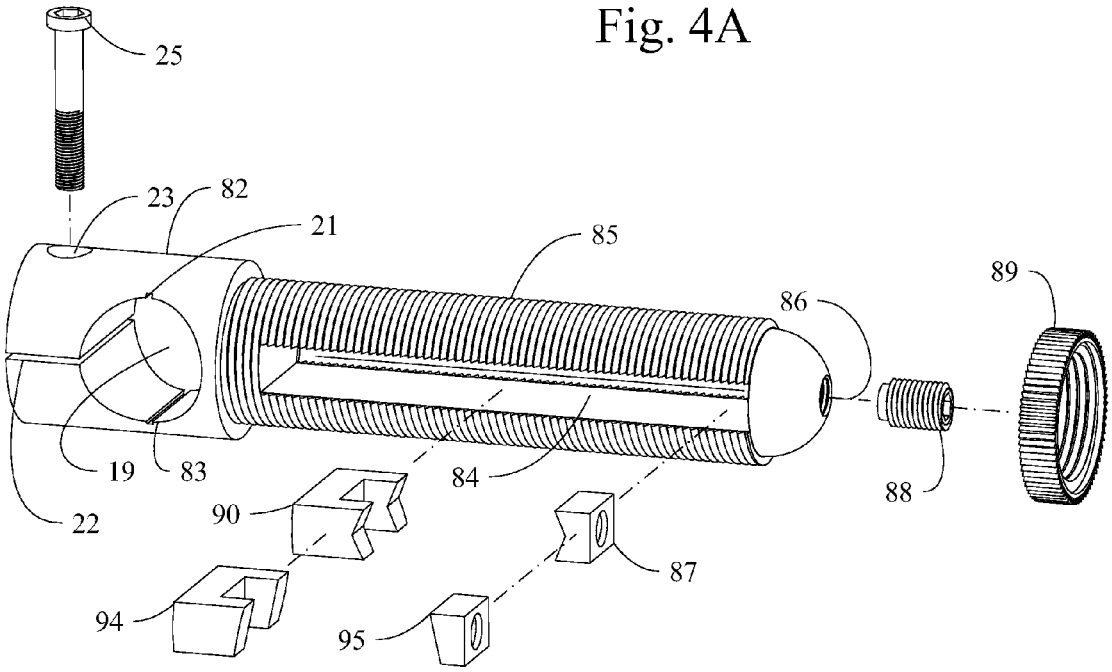
Figure 4C:
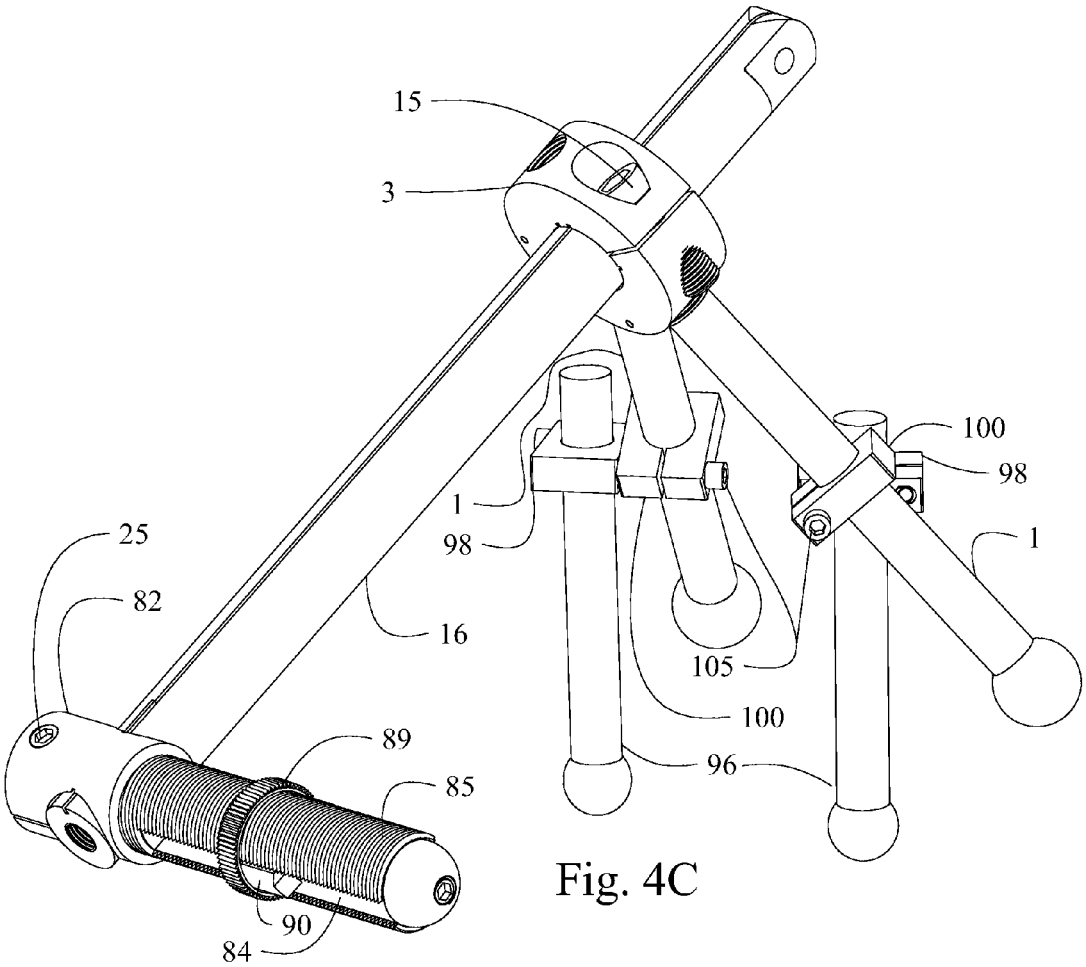
Figure 4D:
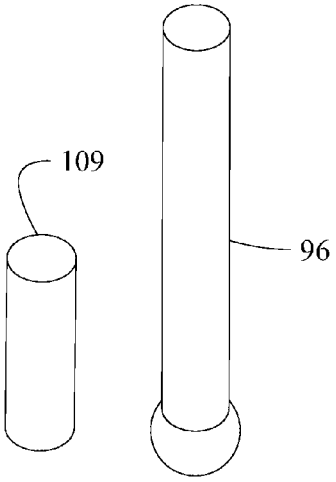
Figure 4E:
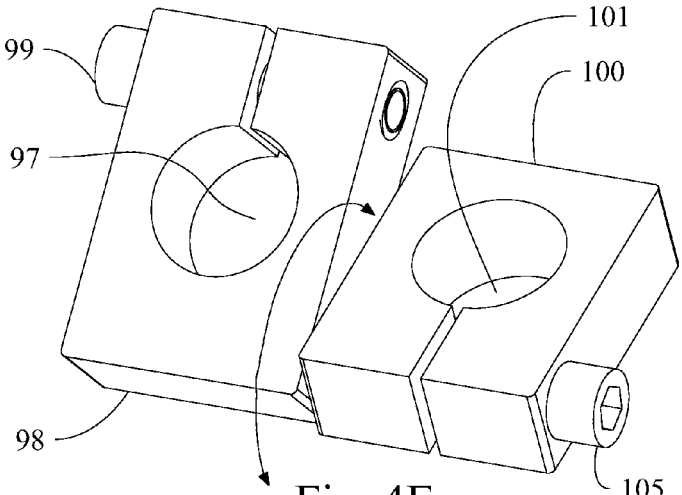
Figure 4F:
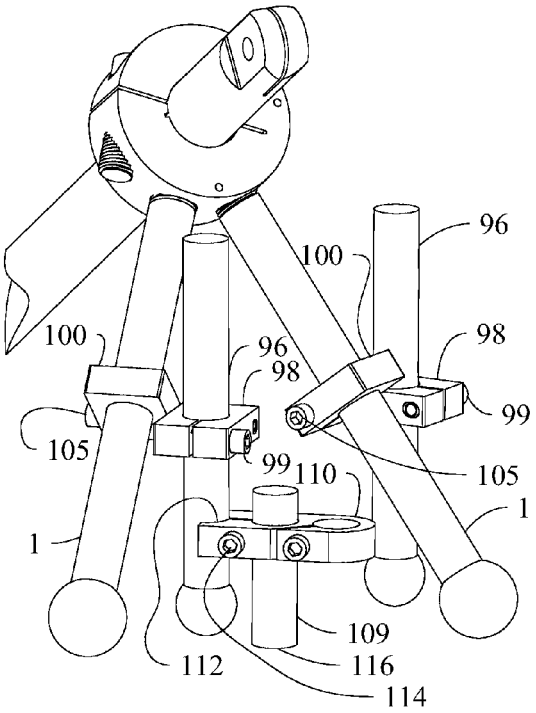
Figure 4G:
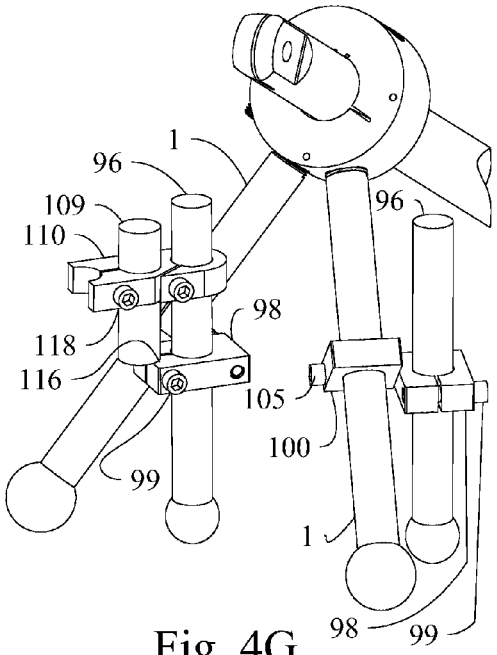
Figure 4H:
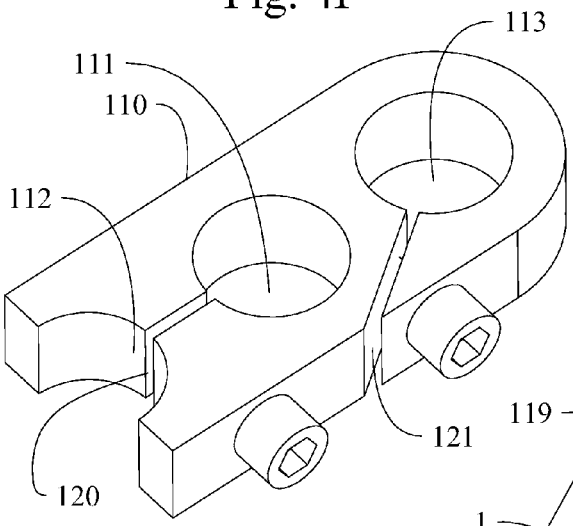
Figure 4I:
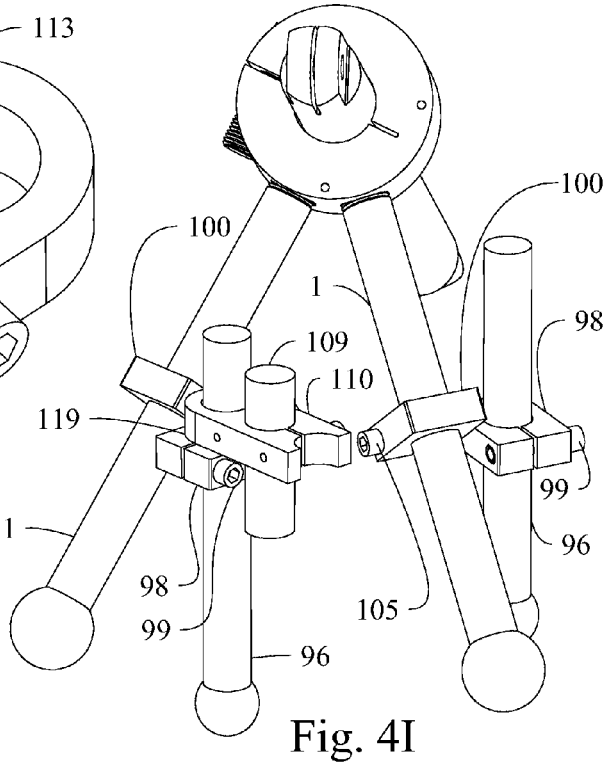
Figure 4J:
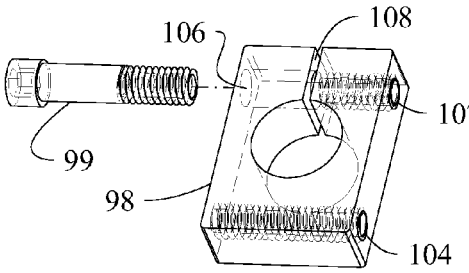
Figure 4K:
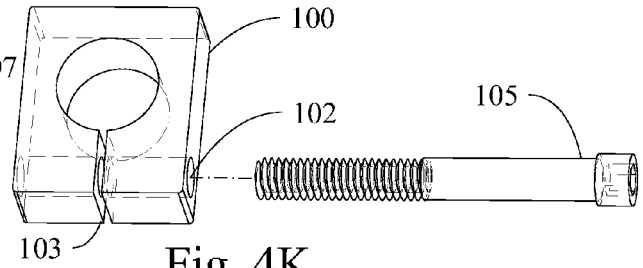
Figure 4L:
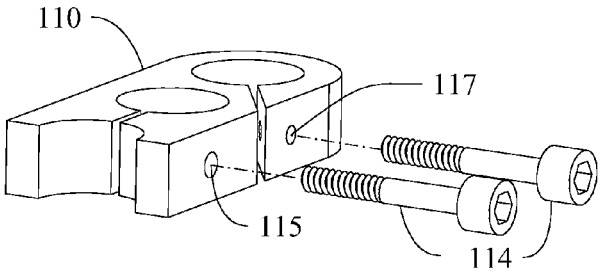
Figure 4M:
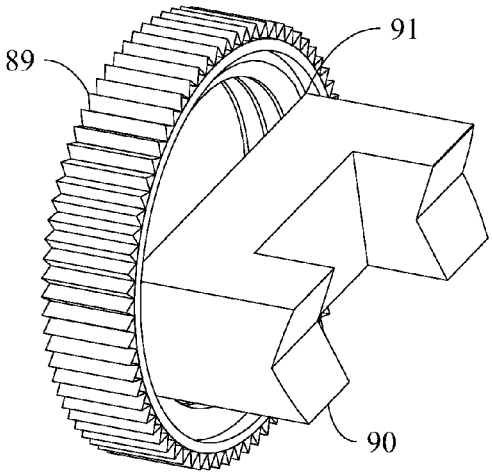
Figure 4N:
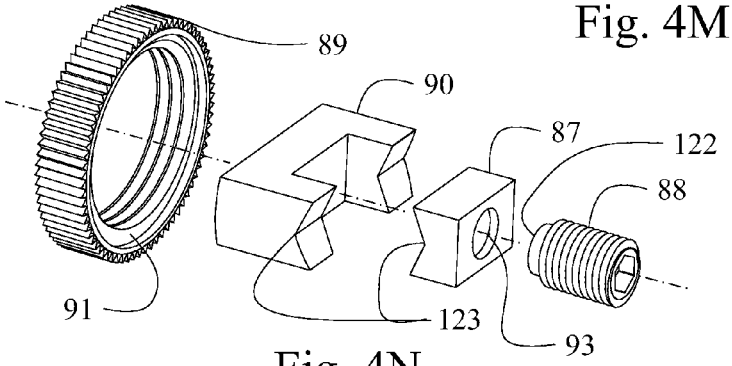
Figure 4O:
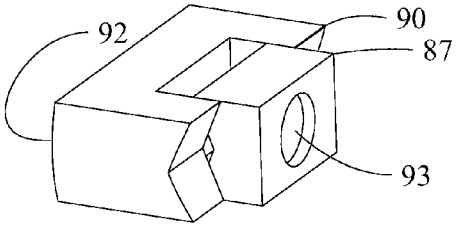
Figure 4P:
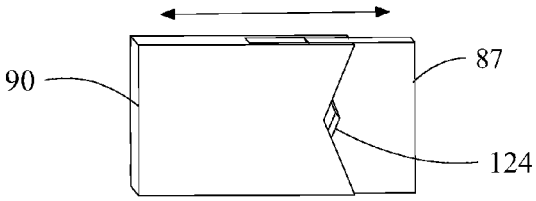

FIGS. 4A Through 4P

Detailed Static Description

FIGS. 4A and 4C show as members of a configuration, the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous.

A flat tool guide body 82 is shown in (FIGS. 4A, 4B, 4C). The configurations shown in FIGS. 4A and 4C are for non skewed honing applications for edge tools. Flat tool guide body 82 is mounted to the end of main rod 16 with the same previously described procedure used to mount sleeved gouge guide body 20 to main rod 16. This is accomplished by guide body clamp slot 22, guide body keyway 21, guide body main rod bore 19, key 18 and guide body clamp bolt 25 (FIG. 4B). A dual bevel keyway 83 (FIG. 4B) is also shown.

Flat tool guide body 82 is comprised of a flat tool slot 84 (FIGS. 4A, 4B, 4C), threads 85 (FIGS. 4A, 4B, 4C), on the outside diameter of the guide body which run the entire length of flat tool slot 84, and a stop screw bore 86 (FIG. 4B), into which a stop screw 88 (FIGS. 4B, 4N) is inserted. An exploded view of the guide body clamp assembly is shown in FIG. 4B. Stop screw 88 will be discussed in detail in Section 5.

To assemble the clamp, a flat blade dial 89 (FIGS. 4A, 4B, 4C, 4M, 4N), is screwed onto threads 85. Into flat tool slot 84, is then inserted a large v-block 90 (FIGS. 4A, 4B, 4C, 4M, 4N, 4O, 4P), and a small v-block 87 (FIGS. 4B, 4N, 4O, 4P). Large v-block 90 is nested in a dial recessed seat 91 (FIGS. 4M, 4N) on the face of flat blade dial 89. The ends of large v-block 90, which protrude past threads 85 on flat tool guide body 82, are radiused 92 (FIG. 5O); this radius is minutely undersized relative to the radius of dial recessed seat 91, on flat blade dial 89 (FIGS. 4M, 4N), such that large v-block 90 seats within the recessed flange, is centered, yet does not bind during rotation of flat blade dial 89. On the other end of the flat tool guide body 82, inside flat tool slot 84, is seated small v-block 87 against stop screw 88. A small v-block stop screw seat 93 (FIG. 4N, 4O) on the back side of small v-block 87, provides a seat or nest for a flat blade stop screw cylindrical end 122 (FIG. 4N) of stop screw 88 when a tool is clamped into place. Small v-block 87 and large v-block 90 are sized to a minutely less height, than the height of flat tool slot 84, such they can freely move along the lengthwise axis of the clamp slot to adjust for edge-tool width, but not tilt along their respective length wise axes, once an edge-tool has been clamped. Also shown in FIG. 4B is a single bevel large block 94, and a single bevel small block 95. These blocks have the same description and installation procedure as small v-block 87 and large v-block 90, with the exception that instead of the V shaped clamping face, the clamping face has a downward slope. The utility for the two sets of blocks will be discussed in more detail in Section 5.

FIGS. 4C, 4D, 4E, 4F, 4G, 4H, 4I, 4J, 4K and 4L all pertain to a group of elongated riser support members which provide guide body base height adjustability, for purpose of honing a tool on a series of abrading surfaces of differing thicknesses. These members can be used on the current configuration, sleeved gouge guide body 20 configuration, and later configurations in this specification.

A leg collar 100 (FIGS. 4C, 4E, 4F, 4G, 4I, 4K) has a leg collar clamp bore 102 (FIG. 4K), which runs the entire width of the collar and on either side of a leg collar clamp slot 103 (FIG. 4K hidden line view). A riser collar 98 has a riser collar clamp bore 104 (FIG. 4J hidden line view) all across the body width of riser collar 98. A riser & leg collar clamp bolt 105 (FIG. 4C, 4E, 4F, 4G, 4I, 4K) is inserted through leg collar clamp bore 102 and tightened to riser collar clamp bore 104, to connect leg collar 100 and riser collar 98 together (FIG. 4E). Leg collar 100 and riser collar 98 can therefore be rotated relative to each other, along the centerline axis of riser & leg collar clamp bolt 105, and later tightened into a desired position. This allows for a riser leg 96 (FIGS. 4C, 4D, 4F, 4G, 4I) to tilt relative to the centerline axes of legs 1. Riser leg 96 is of the same previous description (and of the same diameter) of legs 1, 7 and 8, except that riser leg 96 does not have threaded end 2, and may be of a different length. However, if the user has additional threaded legs 1, 7 or 8, they could be substituted in and used as riser legs.

To assemble these base height adjust members onto the elongated support base member system, riser leg 96 is inserted into a riser collar leg bore 97 (FIG. 4E) which is in riser collar 98, and a riser leg lock bolt 99 (FIG. 4E, 4F, 4G, 4I, 4J) is fitted into riser collar 98 through an unthreaded riser clamp bore 106 (FIG. 4J hidden line view), across a riser collar clamp slot 108 (FIG. 4J hidden line view), and into a threaded riser clamp bore 107 (FIG. 4J). Leg collar 100 is then installed onto either leg 1, 7 or 8—via a leg collar leg bore 101 (FIG. 4E), and slid down onto the shaft of leg 1. Legs 1 are then installed into leg collar 3 threaded leg bores 4 and 5. Riser leg lock bolt 99 and riser & leg collar clamp bolt 105 can then be tightened to lock the riser legs into place and the collars together until height adjustment is undertaken.

FIGS. 4D, 4F, 4G and 4I show a height gauge rod 109, which is an unthreaded member of same diameter as legs 1, 7, and 8. FIGS. 4F, 4G, 4H, 4I and 4L show a height gauge—perpendicular stop 110. Height gauge rod 109 is inserted into a height gauge rod bore 111 (FIG. 4H) of height gauge-perpendicular stop 110. A perpendicular stop radius 112 (FIG. 4H), aids the user in setting riser legs 96 perpendicular to a work surface. A height gauge riser bore 113 (FIG. 4H) functions in clamping height gauge-perpendicular stop 110 to riser leg 96 (FIGS. 4G and 4I). A height gauge rod clamp slot 120 (FIG. 4H) and a height gauge riser clamp slot 121 (FIG. 4H) function in the same way as the previous clamp slots. Height gauge riser clamp slot 121 is angled to allow for placing the height gauge rod bore 111 and the height gauge riser bore 113 in close proximity.

A height gauge bolt 114 (FIG. 4F, 4L) is inserted into height gauge clamp bore 115 (FIG. 4L—unthreaded on bolt head side, threaded opposite height gauge rod clamp slot 120 as in previously clamp slots in this specification) and tightened. A height gauge rod end 116 (FIG. 4F), of height gauge rod 109, is precision machined or ground or otherwise manufactured to be perpendicular to the surface of outside diameter of height gauge rod 109, and acts as a support base for height gauge-perpendicular stop 110—to hold the surface of the perpendicular stop radius 112 to be perpendicular to a work surface. Height gauge rod 109 is then set upon a work surface that the jig base rests upon, and the perpendicular stop radius 112, which has the same radius as the outside diameter of riser leg 96, is then placed against the outside diameter of riser leg 96 (FIG. 4F).

The depth of the gap between the two v protrusions on large v-block 90 is deep enough to allow both v blocks to completely close a v-gap 124 (FIG. 4P) between two v-block valleys 123 (FIG. 4N) of small v-block 87 and large v-block 90. This inter meshing allows clamping of very narrow shanks of edge tools. Were these v blocks unable to inter mesh, the narrowest width tool that could be held by two v blocks facing each other, would be twice the v depth of either v block. Since the v blocks are able to inter mesh however, the V gap can be completely closed, and the very narrowest of shanks on edge tools can be clamped in and honed by this guide body configuration.

Figure 5A:
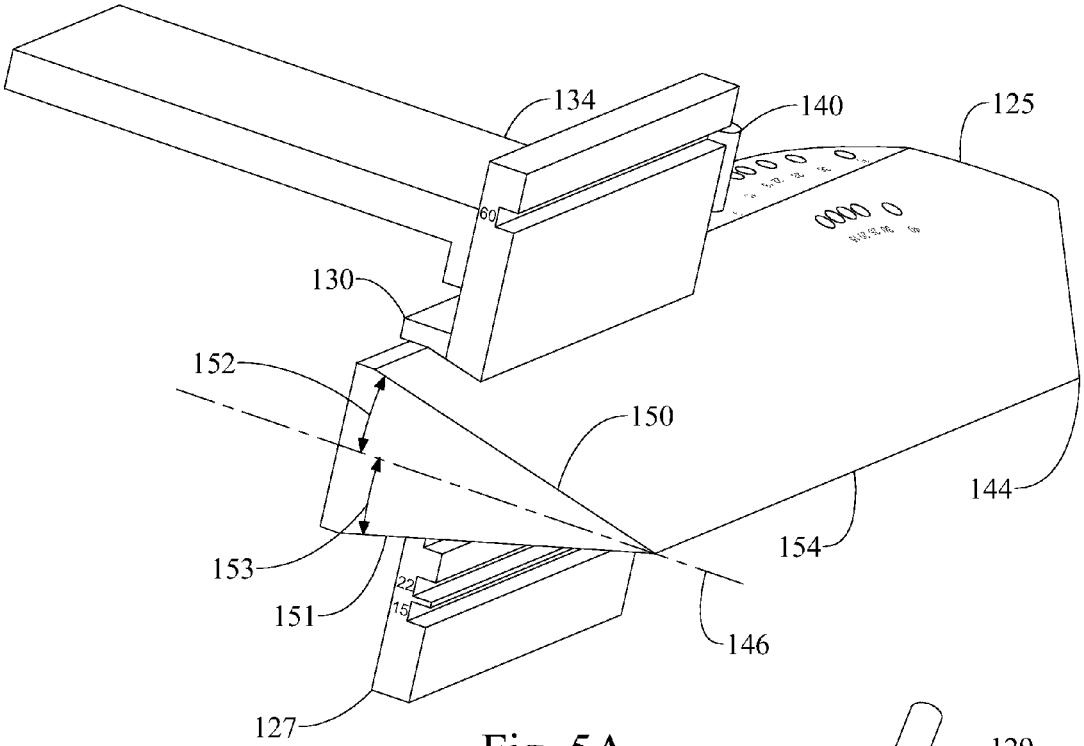
FIGS. 5A to 5V show a bevel and skew angle configuration calibration tool, called a cut edge simulator.
Figure 5B:
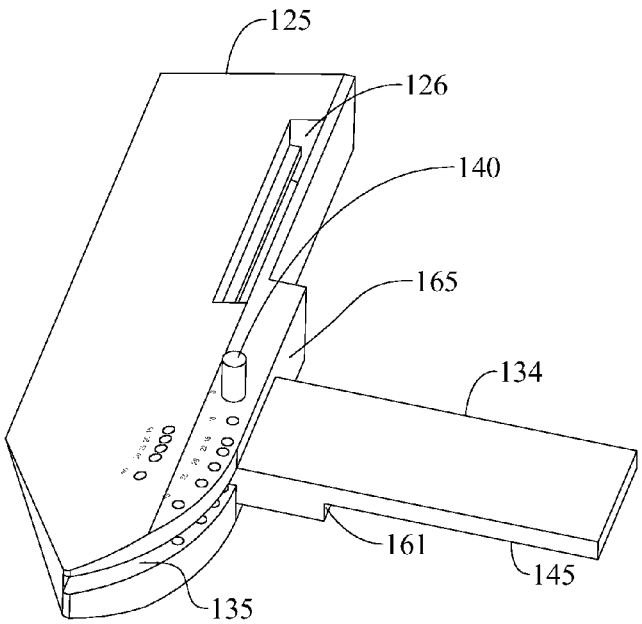
Figure 5C:
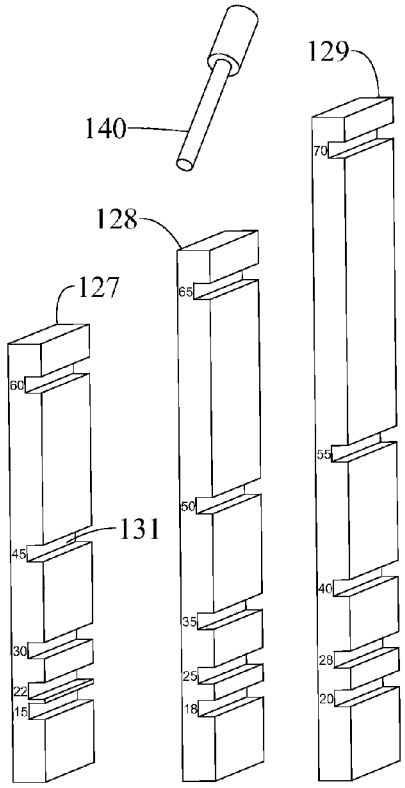
Figure 5D:
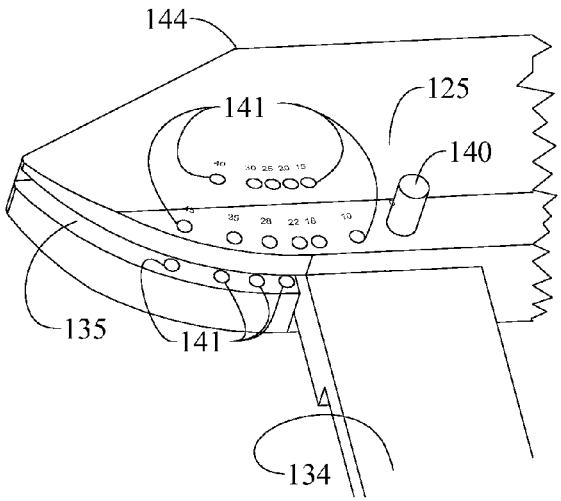
Figure 5E:
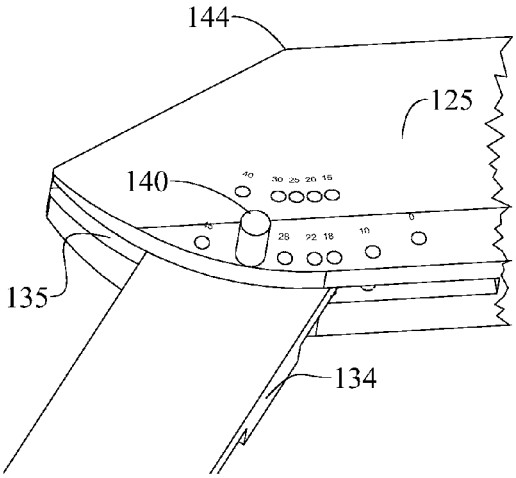
Figure 5F:
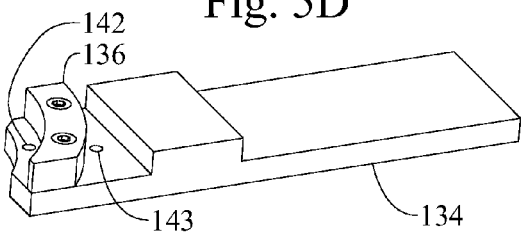
Figure 5G:
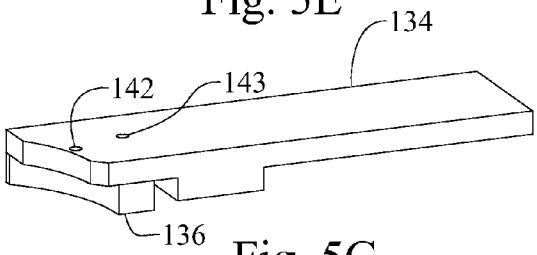
Figure 5H:
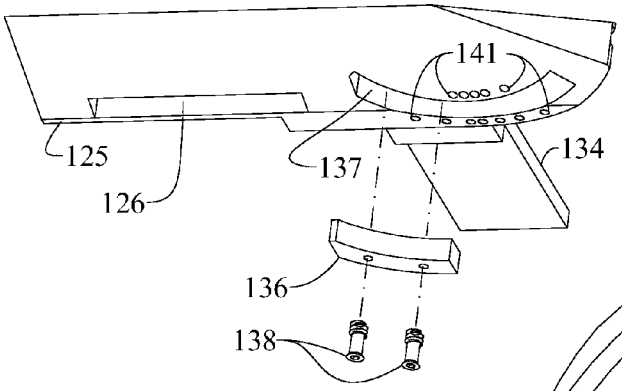
Figure 5I:
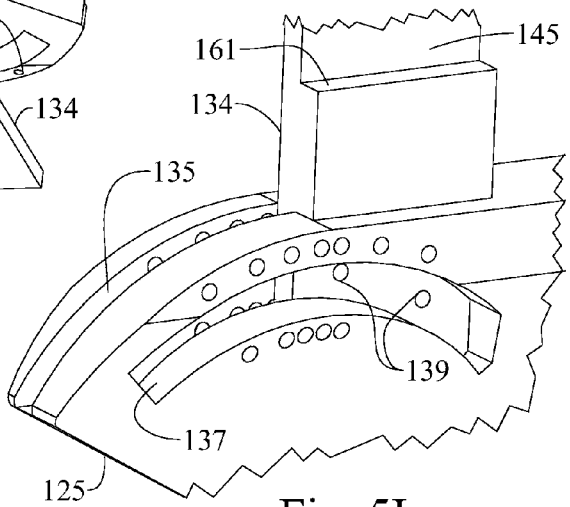
Figure 5J:
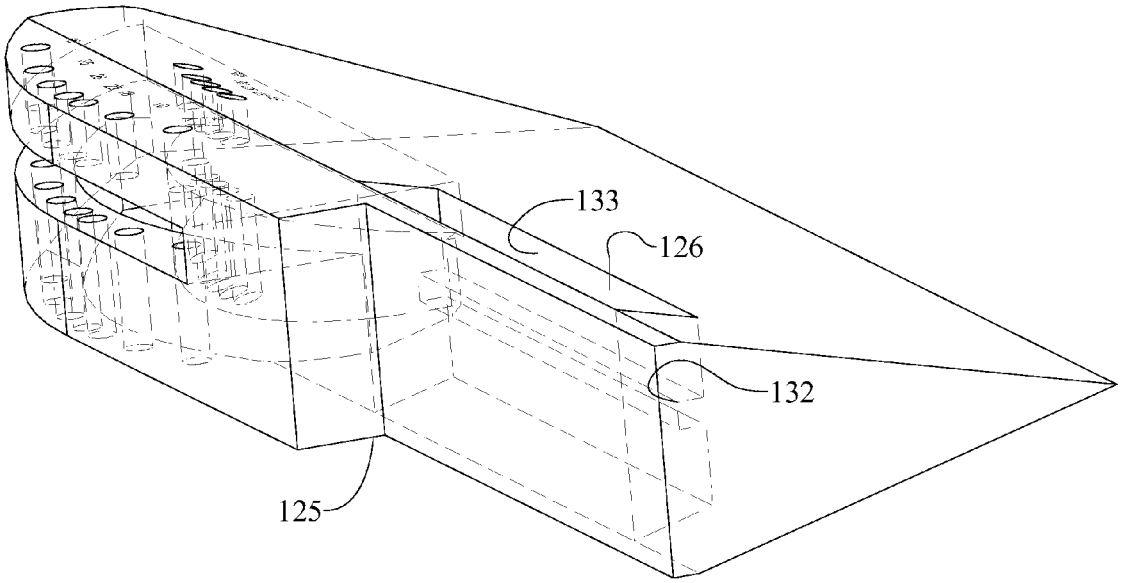
Figure 5K:
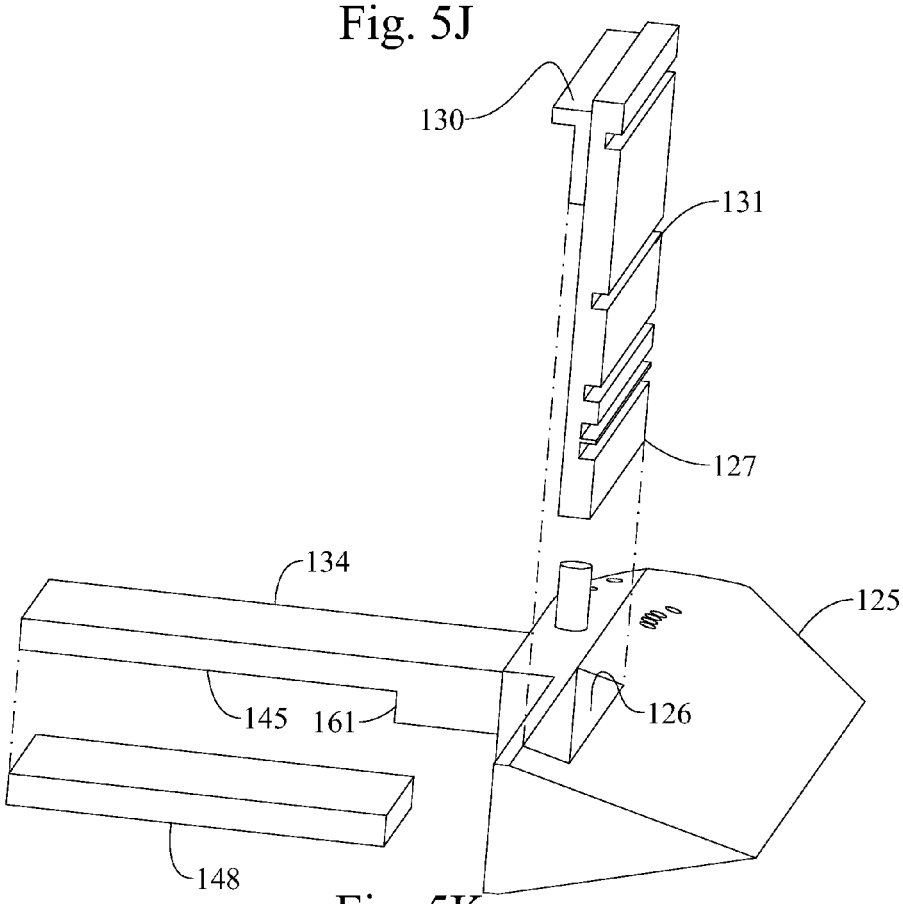
Figure 5L:
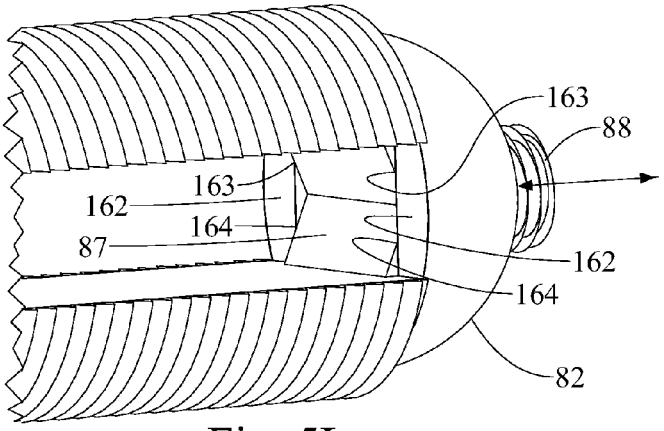
Figure 5M:
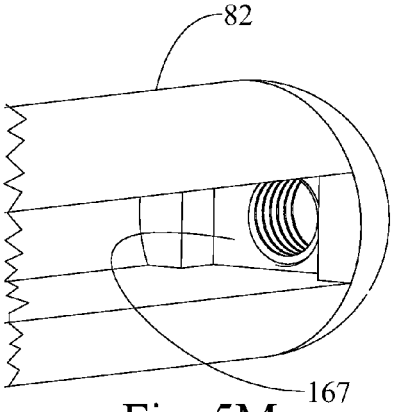
Figure 5N:
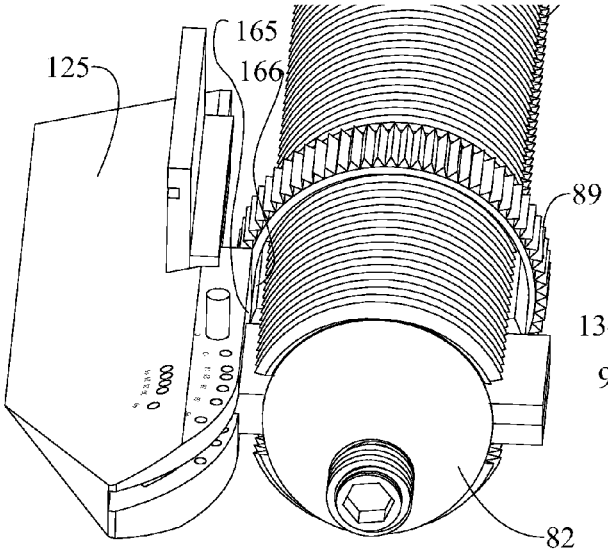
Figure 5O:
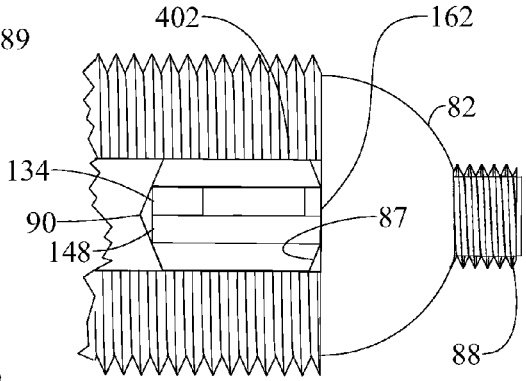
Figure 5P:
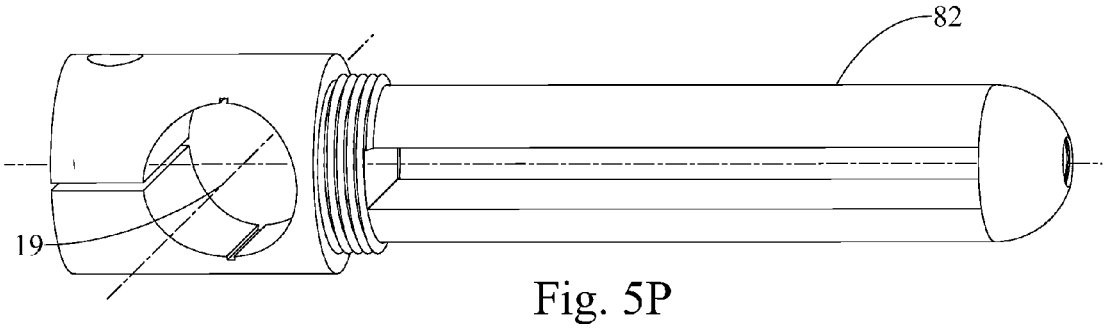

FIGS. 4A Through 4P, & 5P

Detailed Operational Description

Operation of the honing guide support base member system of legs 1, main rod 16, leg collar 3, leg collar lock bolt 15, and guide body clamp bolt 25 were described in operational section 1. Since the centerline of guide body main rod bore 19 on flat tool guide body 82 intersects and is perpendicular to the lengthwise centerline axis of flat tool guide body 82 (FIG. 5P—next section), such provides mirrored or symmetric positioning of flat tool guide body 82 relative to main rod 16, such that when flat tool guide body 82 is unclamped from main rod 16, rotated 180° about the end of main rod 16, and clamped into place on main rod 16, flat tool slot 84, and thus the tool edge, is in the same relative but opposite (or mirrored, symmetric) position relative to main rod 16.

To use this jig configuration, a flat edge-tool is inserted into flat tool slot 84, with sharp edge facing away from the configuration, and clamped by turning flat blade dial 89 such that large v-block 90 and small v-block 87 pinch the edges of the tool, and clamp the edge-tool firmly into the guide body. Since large v-block 90 is wider than threads 85 on flat tool guide body 82, and since both ends of large v-block 90 protrude past the outside diameter of the threads (FIG. 4A), dial recessed seat 91, of flat blade dial 89, catches and seats large v-block 90 within seat radius of dial recessed seat 91, and provides clamping power to the tool edges as it is dialed toward small v-block 87. Since flat tool slot 84 is centered along the center lengthwise axis of flat tool guide body 82, large v-block 90 is centered relative to the height of flat tool slot 84, in dial recessed seat 91, and thus to flat tool slot 84. Small v-block 87 and large v-block 90 inter mesh with one another. Small v-block 87 has a slightly narrower overall width, than the distance between the two outward V-protrusions on large v-block 90. This allows small v-block 87 to become nested between the two V protrusions of large v-block 90 or move into the gap between the two V protrusions of large v-block 90.

If the user is honing both sides of the cutting edge, and is honing a non skewed angle, the guide body is un clamped from main rod 16 after honing one side, flat tool guide body 82 is rotated 180° about bore axis 19, then aligns keyway 17 on main rod 16 with dual bevel keyway 83 using key 18, and re clamp flat tool guide body 82 to main rod 16. If honing a skew angle, see Sections 6 and 7. Dual bevel keyway 83, is radially positioned 180° away from guide body keyway 21.

A tool clamped into this and other configurations of this specification can be honed on abrading surfaces including abrasive papers or whetstones of differing heights (stone thickness) without readjusting the bevel and/or skew angles to the configuration. Were it not possible to adjust for these abrading height differentials, the bevel and skew angles at the tool tip would need to be re set each time a different thickness honing stone (or abrasive paper) is used. Abrading height differential methods, which allow for maintaining bevel and skew angles on a tool edge when stones are swapped in and out, have been found. The height adjust members described in the previous static description provide a way to quickly and easily adjust the jig base height for these abrading surface height differentials, by registering the perpendicular distance between an abrading surface, and a work surface. By using the height adjust members, bevel and skew angles at the tool tip can be set just once. Instead of re setting the bevel and skew angle each time a stone of differing thickness is swapped in, height gauge rod 109 and height gauge-perpendicular stop 110 allow for resetting the base height, to match these changes in elevation of an abrading surface.

FIG. 4C shows riser legs 96 elevating the base height of the configuration. To raise the tip of the tool which protrudes from this or any guide body configuration which uses leg collar 3, such that it will match the height increase (or decrease) relative to the previously used abrading surface, the procedure is as follows . . . .

After clamping an edge-tool into the jig and setting the cutting edge protrusion distance (cutting edge protrusions are discussed in the section 18), the bevel angle at the tool tip is set. This can be done with both legs and tool edge resting on a work surface prior to honing on the first abrading surface or stone. Or, the bevel angle at the tool edge could be set while the tool edge is resting on the first abrading surface that will be used. If the former method is used after the bevel angle is set, the configuration will need to be adjusted to match the first stone thickness (or height differential between work surface and first stone), before honing. The previous section 2 and section 5 discuss in more detail setting bevel angles.

Whether the tool edge is resting on a work surface or an abrading surface when the bevel angle is set, the first step in using the riser members is to set riser leg 96 perpendicular to the work and honing (or abrading) surface. Assuming the abrading surface is of uniform thickness, this is accomplished by loosening riser leg lock bolt 99 and riser & leg collar clamp bolt 105, and rotating and sliding the riser collars along the base and riser members into position such that riser leg 96 ends and leg 1 ends contact a work surface (FIG. 4F). Height gauge rod 109 is then inserted into the height gauge rod bore 111. Riser leg 96, leg collar 100 and riser collar 98, are rotated around leg 1, and rotated relative to each other via rotation at the joint between leg collar clamp bore 102 and riser collar clamp bore 104. Riser leg 96 is slid in riser collar leg bore 97, until riser leg 96 seats or nests in the perpendicular stop radius 112 (FIG. 4F), and is resting on a work surface. Once riser leg 96 seats into the perpendicular stop radius 112, and the riser end is resting on a work surface, riser & leg collar clamp bolt 105, and riser leg lock bolt 99, are tightened. Perpendicular stop radius 112 is machined to be parallel to the inside surface of radius of the height gauge rod bore 111.

If the bevel angle was set while the tool edge was resting on a work surface, a measurement is then made of the thickness of the first abrading surface that the tool is honed upon, and then transferred to riser leg 96 prior to honing. If the tool edge was resting on the first abrading surface while bevel angle was set, the user can begin to hone. Measuring thickness of an abrading surface is quickly and easily accomplished by the use of height gauge-perpendicular stop 110 which serves a dual purpose. Height gauge rod 109 is loosened such that it can move freely in the height gauge rod bore 111. The surface of height gauge-perpendicular stop 110 is placed on the surface of a honing stone or abrading surface. The top and bottom surfaces of height gauge-perpendicular stop 110 are machined parallel, and perpendicular to the surfaces of radii of the height gauge rod bore 111, perpendicular stop radius 112 and the height gauge riser bore 113. Height gauge rod 109 is then moved downward to rest on a work surface, and height gauge bolt 114 in height gauge 110 is tightened to lock height gauge rod 109 in place, to register the height differential of an abrading surface to a work surface. The protrusion distance of height gauge rod 109 from the underside of height gauge-perpendicular stop 110, matches the thickness of an abrading surface. This distance, or differential, is transferred to the riser rods using the following method . . . .

Height gauge bolt 114 is inserted into a height gauge riser bore 117 (FIG. 4L) and height gauge-perpendicular stop 110 is then clamped to riser leg 96 through the height gauge riser bore 113 as in FIG. 4G. In FIG. 4G, height gauge rod end 116 of height gauge rod 109 is seen resting on the surface of riser collar 98. The distance between the surface of the riser collar (also represented by height gauge rod end 116), and underside of height gauge-perpendicular stop 110 (represented by height gauge underside 118 in FIG. 4G), is the height differential of an abrading surface just measured. To transfer this height differential to riser leg 96, bolt riser leg lock bolt 99 is loosened, height gauge rod 109, height gauge-perpendicular stop 110 and riser leg 96 are rotated in riser collar leg bore 97 of the riser collar, are slid downward (FIG. 4I), until the underside of height gauge-perpendicular stop 110 (represented by height gauge underside 118) rests upon the surface of riser collar 98 (represented by riser collar top surface 119), and riser leg lock bolt 99 is then tightened. The same process is repeated for the other riser. The height differential between a work surface, and an abrading surface, has now been transferred to the base of the jig. Once the height differential is registered on both risers, height gauge-perpendicular stop 110 and height gauge rod 109 can then be removed from the riser and the previously process for honing can proceed on the first abrading surface.

To switch from the first stone to a relatively higher or thicker stone, the above process is repeated—but instead of resting height gauge rod end 116 on a work surface when measuring the differential, it is rested on the lower abrading surface, and the height differential between the two stones is registered by repeating the above procedure. If switching from a higher surface to a lower surface, after measuring the height differential between the two stones, the above process is repeated in reverse. In other words, instead of using the starting position of height gauge-perpendicular stop 110 shown in FIG. 4G, the position of height gauge-perpendicular stop 110 of FIG. 4I is instead used as the starting position and height gauge rod 109, height gauge-perpendicular stop 110 and riser leg 96 are slid upward, instead of downward, and locked into place.

Thus if switching from honing stones of differing height or thickness, to measure the height differential of the two stones and transfer it to the risers, place both stones on a work surface, one stone next to the other, register the height differential by the above method, i.e. the underside of height gauge-perpendicular stop 110 (118) rests on the higher stone, and the end of height gauge rod 109 (116)—rests on the lower stone, and height gauge rod 109 locked into height gauge-perpendicular stop 110. Once this differential is registered by height gauge rod 109, depending on whether one is going from higher to lower, follow the previously accordingly.

If one is honing on a set of stones or papers all of the same thickness, the risers are not needed, and instead the bevel angle can be set while the tool edge is resting on an abrading surface, and stones or surfaces of equivalent thicknesses can be swapped in and out without need of base re adjustment with the riser members. Honing can also be done on surfaces of varying heights without using riser members. However, each time a different stone is swapped in, the bevel angle would need to be re adjusted to match the new elevation of the abrading surface.

Single bevel large block 94 and single bevel small block 95 are also shown in FIG. 4B. These blocks are designed and installed in the same way as small v-block 87 and large v-block 90, with the exception that they do not have the V shape. Instead of centering a tool in clamp flat tool slot 84, these blocks slope downward to clamp a tool by forcing the tool to be pressed against the floor or seat of flat tool slot 84. They are used for edge-tools of which the cutting edge is not beveled on both sides, and therefore the tool is not centered in flat tool slot 84.

FIGS. 5A Through 5V

Detailed Static Description

A cut edge simulator 125 assembly, which simulates bevel and skew angles of a tool edge in this and other configurations in this specification, and calibrates a configuration to a specific bevel and skew angle setting, is shown in FIGS. 5A, 5B, 5D, 5E, 5H, 5I, 5J, 5K, 5N, 5O, 5S. The cut edge simulator has a bevel set slot 126 (FIGS. 5B, 5H, 5J, 5K, 5S) into which one of either a small bevel set plate 127, 128 or 129 (FIGS. 5A, 5C, 5K, 5R, 5V) elongated bevel set members are inserted, and locked into place with a bevel plate lock 130 (FIGS. 5A, 5K), which is an extruded L shaped member. Numbered notches, grooves, channels or bevel plate tang slots 131 (FIG. 5C, 5K) in each of the bevel set plates 127, 128 and 129 are bevel angle settings for the cut edge simulator 125. Numbers adjacent to each tang slot in the drawing Figs., are not to be confused with reference numbers for this specification; these slot numbers are printed, stamped or engraved on small bevel set plate 127, 128 or 129, are part of the design and represent bevel angles in degrees.

In FIG. 5J, a protrusion or bevel set tang 132 facing away from a bevel slot front face 133, of bevel set slot 126, is shown. This tang is of minutely less height and width, as the tang slots in small bevel set plate 127, 128 and 129, and can protrude into any of the tang slots on either bevel set plate 127, 128 or 129. The tang and tang slots aid the user in setting the bevel angle of cut edge simulator 125. The width of bevel set slot 126, is minutely larger than the combined thickness of either bevel set plate 127, 128 or 129, and bevel plate lock 130. Either bevel set plate 127, 128 or 129 is thus sandwiched and locked between bevel plate lock 130 and bevel slot front face 133, when any bevel plate tang slot 131 is placed over bevel set tang 132. When bevel plate lock 130 is inserted into bevel set slot 126, and presses against the backside of either bevel set plate 127, 128 or 129, it locks a bevel set member into place (FIG. 5A) at a desired bevel angle setting. The locking is possible by virtue of L shape of bevel plate lock 130 (and the tang and tang slot combination), of which the L shape catches and holds bevel plate lock 130 such that the L shape rests on the upward facing surface of cut edge simulator 125 (FIG. 5A).

Elongated bevel set plates 127, 128 and 129 could be plate shaped as shown in the drawing Figs., or could also be notched elongated members otherwise shaped, or perhaps a member set by a locking clamping collar on the underside of cut edge simulator 125, for example, collars similar to the clamping collars throughout this specification. The members aid the user in raising the rear of the cut edge simulator 125 upwards several known distances, while a cut edge simulator edge 154 (FIG. 5A, 5S) on the front end of cut edge simulator 125 (which represents a tool edge) rests on a work surface during calibration.

A calibration mount plate 134 (FIGS. 5A, 5B, 5D, 5E, 5F, 5G, 5H, 5I, 5K, 5O), is inserted into a calibration mount plate slot 135 (FIGS. 5B, 5D, 5E, 5I) in cut edge simulator 125. A radius track 136 (FIGS. 5F, 5G, 5H) is then inserted through a radius track slot 137 (FIGS. 5H, 5I), and then attached to calibration mount plate 134 with a pair of radius track bolts 138 (FIG. 5H) through radius track bolt holes 139 (FIG. 5I), on calibration mount plate 134. Radius track 136 thus pivotally mounts calibration mount plate 134 to cut edge simulator 125, and aids the user in the setting of variable skew angle settings for cut edge simulator 125. The device can now pivot into different positions, as shown for example, the two positions of calibration mount plate 134 in FIGS. 5D and 5E.

A skew calibration pin 140 (FIGS. 5A, 5B, 5C, 5D, 5E), is then inserted through any of angle numbered skew calibration holes 141 (FIG. 5D), which go entirely through cut edge simulator 125, and through either a mount plate upper skew hole 142 (FIGS. 5F, 5G) or a mount plate lower skew hole 143 (FIGS. 5F, 5G) on calibration mount plate 134. Skew registration numbers next to individual skew calibration holes 141, are not to be confused with reference numbers for this specification; the numbers are printed, stamped or engraved next to the holes, are part of the design, and are used as indicators for specific skew angle settings for the cut edge simulator 125.

A center, or pivot or skew anchor point 144 (FIG. 5A, 5D, 5E) of cut edge simulator 125, is located at the same position relative to calibration mount plate 134, throughout the entire range of motion between cut edge simulator 125 and calibration mount plate 134. Therefore, once calibration mount plate 134 is clamped into a configuration, skew anchor point 144 is also located at the same position relative to any location on any configuration, all through the range of motion of cut edge simulator 125. This is accomplished by virtue of radius track 136 and radius track slot 137, of which both lie on an arc of which radius has center point at skew anchor point 144. The protrusion distance of this point away from the front of any guide body, is a known dimension. It is also the reference point (or distance from the front of the guide body), that all tool edges are set to, when clamped into a configuration, after a bevel and skew angle combination for a configuration has been set with the cut edge simulator. A calibration plate protrusion fence 161 is shown on FIGS. 5B, 5I, 5K and a stop screw stop surface 162 is shown in FIGS. 5L and 5O. They are used as stops to correctly calibrate the configuration to a bevel and skew angle. Tool protrusions are covered in section 18.

Calibration mount plate slot 135 in cut edge simulator 125, and calibration mount plate 134, are designed such that the plane that a mount plate surface 145 (FIGS. 5B, 5I, 5K) lies upon, is the same plane that lies on a cut edge simulator body centerline 146 in FIG. 5A, and a distance 147 (FIG. 5S). This mount plate surface 145, when calibration mount plate 134 is mounted in the flat edge-tool jig configuration, is centered between small v-block 87 and large v-block 90 (FIG. 5O) when calibrating a configuration to hone double beveled skewed cutting edges, due to a mount plate spacer 148 (FIG. 5K, 5O) which is used with the previously flat edge-tool jig when calibrating for double bevel cutting edges. In other words, the plane that slices cut edge simulator 125 in half is centered to small v-block 87 and large v-block 90 and is symmetric with respect to the flat edge-tool jig, since the spacer is of the same thickness that calibration mount plate 134 is at its end that is furthest away from cut edge simulator 125. This same plane lies on the surface of calibration mount plate slot 135 and is shown by a mount plate slot surface 149, in FIG. 5S. The design makes the mounting of calibration mount plate 134 in the previously flat edge-tool jig symmetric with respect to two faces, or an upper surface 150 (FIG. 5A) and a lower surface 151 (FIG. 5A) of cut edge simulator 125, and the jig configuration it is clamped into. Once cut edge simulator 125 and mount plate spacer 148 are clamped into the flat edge-tool jig, the plane that slices the cut edge simulator 125 in half, is the same plane that is precisely centered inside the V clamp jaws in the flat edge-tool jig. This enables the combined flat edge-tool configuration and cut edge simulator 125 to be rotated to a mirrored position to check the setting on a skew bevel replicator collar (discussed in next section). In other words, once the jig configuration has been calibrated by cut edge simulator 125 to hone a double beveled skewed cutting edge, cut edge simulator 125 can be used to check the accuracy of the settings for the opposite side of the cutting edge, before clamping and honing the tool edge. Or, the opposite side of cut edge simulator 125 could be used to set a skew and bevel angle of a configuration since the design is symmetric.

In FIG. 5A, an upper facet angle 152, and a lower facet angle 153 are shown. These angles are equal. Upper facet angle 152 and lower facet angle 153 are slightly less in degrees than the lowest bevel angle that cut edge simulator 125 is designed for. Thus the cut edge simulator 125 is able to clear the low end of the bevel angle range that is designed into the distance of bevel plate tang slots 131 from the bottom ends of bevel set plates 127, 128, & 129.

A brief mathematical description of generating a multitude of bevel angles to solve for tang positions 159 (FIG. 5S, 5T, 5U) using as an example bevel set plate 128, is shown in FIGS. 5S, 5T, 5U and 5V. Distance 147 (FIG. 5S), which is a known variable dependent on cut edge simulator 125 dimensions, is parallel to cut edge simulator body centerline 146 shown in FIG. 5A, and is the perpendicular distance between cut edge simulator leading edge 154, and a tang mid point 155 (FIG. 5S) on the face of bevel set tang 132 which exists mid height of the tang. Thus distance 147 can exist anywhere along the length of the cut edge simulator leading edge 154 between either end of bevel set slot 126. Since the length of distance 147 is a known variable, the length can be used with the Law of Sines to solve for a tang to pivot edge 156 distance (FIG. 5S, 5V). Tang to pivot edge 156 is a distance from a pivot leading edge 156' (FIG. 5V) of bevel set plate 128, to a slot mid point 158 (FIG. 5V). Midpoint 158 lies on a lengthwise centerline axis (not shown) of the tang slot 158. Tang to pivot edge 156 distance is thus solved by choosing bevel angles to determine the machined locations of the tang slots.

See FIG. 5T, a right angle 160 is represented by C in the triangle. See FIGS. 5T and 5U as an additional reference for the previous paragraph.

FIGS. 5A Through 5V

Detailed Operational Description

The previous cut edge simulator 125 members can be used to set a multitude of combined bevel and skew angles for the previous flat edge-tool jig configuration, and other following configurations including fingernail and V tool configurations. The device simulates a tool edge with a specific bevel and skew angle, such that a configuration can be calibrated to match a desired bevel or bevel-skew combination to hone on a cutting edge.

To calibrate a configuration to a specific bevel and skew angle setting, the user first sets the cut edge simulator assembly to a zero skew position by inserting skew calibration pin 140 into the 0° hole position (shown in FIG. 5D). If honing a double beveled cutting edge, the user nests mount plate spacer 148 into calibration mount plate 134 against mount plate surface 145 and calibration plate protrusion fence 161. The user then inserts 134/148 sandwich into flat tool slot 84. While slowly tightening flat blade dial 89, stop screw 88 should be adjusted such that 134/148 sandwich butts up against and is flush with stop screw stop surface 162. This is accomplished by moving small v block 87 towards or away from the lengthwise edges of the sandwich via stop screw 88 (FIG. 5O), in order to match the corners of the sandwich at an upper clamped tool position 163 (FIG. 5L), and a lower clamped tool position 164 (FIG. 5L), to stop screw stop surface 162, and at the same time nesting 134/148 sandwich edge inside the single v block and against stop screw stop surface 162. This centers the sandwich in the V slot. The sandwich is being nested in small v block 87, while at the same time made flush with stop screw stop surface 162. Doing so assures that mount plate surface 145 is centered in the slot, and that the edge of calibration mount plate 134 is in contact with stop screw stop surface 162. Thus when a flat shanked cutting tool is installed into the clamp after calibration, no matter what the thicknesses of the cutting tool shank is, the cutting edge of the shank will have the same centered positioning as did cut edge simulator edge 154. This assures an extremely accurate bevel and skew angle setting.

While clamping, rear stop surface 165 (FIG. 5N) should be positioned such that it is flush against large v-block end radius 166 (FIG. 5N). Doing so sets the correct protrusion distance of the skew anchor point 144 from the front of the jig configuration. Positioning the rear stop surface 165 against the double V block, and the edge of the 134/148 sandwich against stop screw stop surface 162, assures that skew anchor point 144 of the cut edge simulator will be in the same relative position to the jig configuration, that the cutting edge to be honed or sharpened is, once the protrusion distance of the cutting edge to be honed is properly set. Since tool protrusions from the front of any guide body affect the bevel angle, and when calibrating to a specific tool protrusion, the protrusion distance that the tool edge is set to, should be matched to the protrusion distance that the cut edge simulator is set to, for an accurate bevel angle setting. This is accomplished by the protrusion stops discussed in Section 18.

In FIG. 5M, small v-block seat 167 is where small v-block block 87 almost completely nests into, at maximum tool shank thickness.

Figure 5Q:
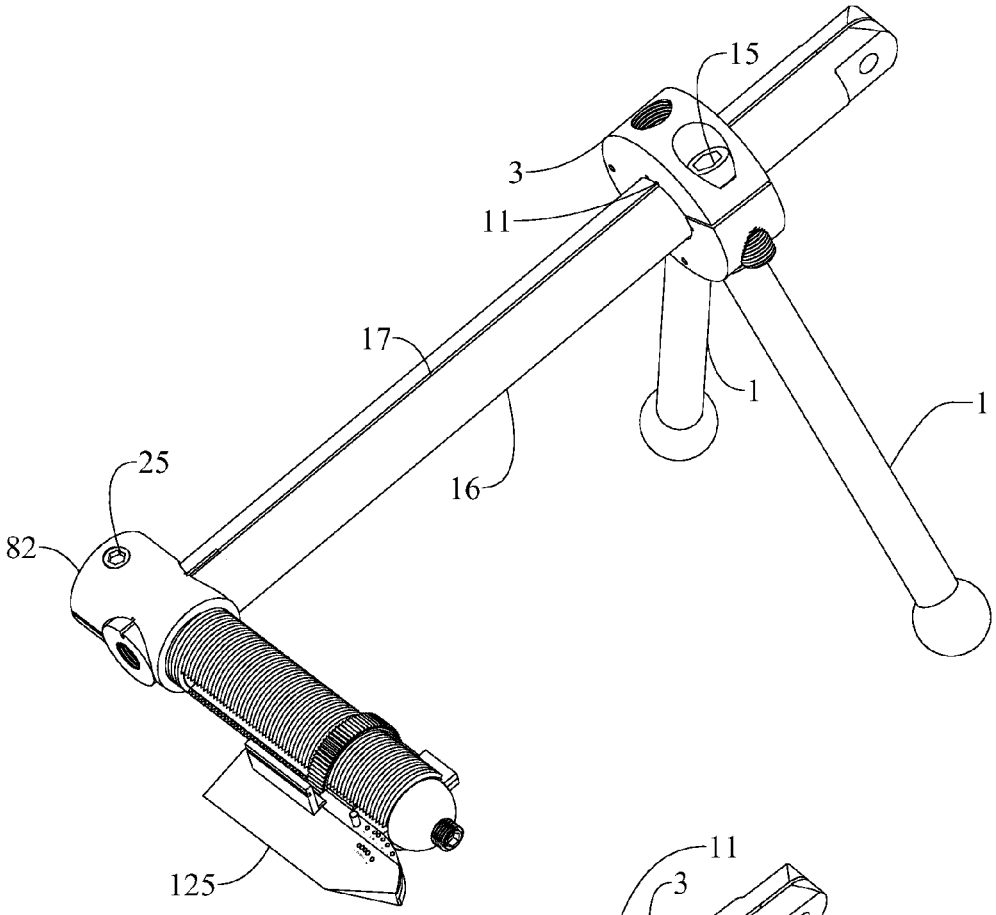
Figure 5R:
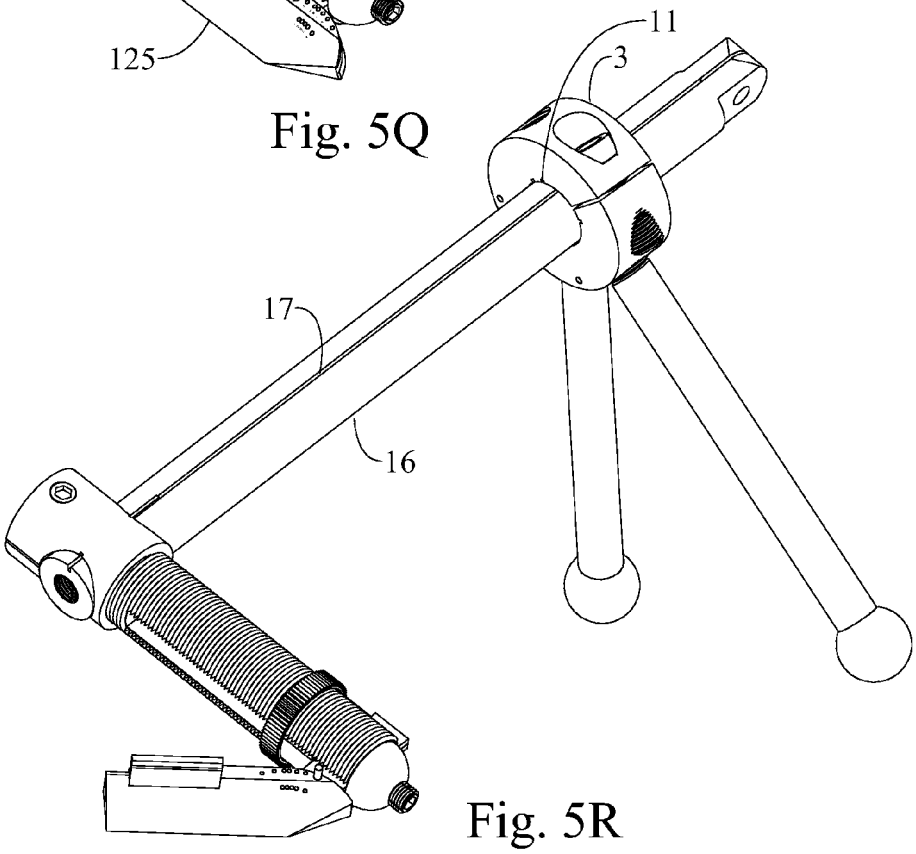

FIG. 5Q shows cut edge simulator 125 body in a zero skew position, and FIG. 5R shows cut edge simulator 125 in a 45° skewed position. In FIG. 5R, the rotation of leg collar 3 and primary keyway 11 relative to keyway 17 on main rod 16 is shown.

The skew calibration holes 141 in cut edge simulator 125 (FIG. 5D, 5H), and mount plate upper skew hole 142 and mount plate lower skew hole 143 in calibration mount plate 134 (FIGS. 5F, 5G), are positioned such that when either mount plate upper skew hole 142 or mount plate lower skew hole 143 aligns with either a top or bottom row skew calibration hole 141 respectively on cut edge simulator 125, a specific degreed skew angle is set on cut edge simulator 125, and the registration pin can be placed through skew calibration holes 141 in cut edge simulator 125, and through either mount plate upper skew hole 142 or mount plate lower skew hole 143 to set a desired skew angle.

To set a bevel angle, the user chooses an angle indicated on a bevel set member next to a tang slot, and places any bevel plate tang slot 131 (FIG. 5C), onto bevel set tang 132 in bevel set slot 126 (FIG. 5J). Then, the user inserts bevel plate lock 130 behind either bevel set plate 127, 128 or 129 to lock the bevel angle into place.

After cut edge simulator 125 assembly is installed into the previous flat edge tool jig, and the desired bevel and skew settings are made, the jig base is set on a work surface, and the elongated member base system is adjusted such that both the entire length of cut edge simulator edge 154 (FIG. 5A), and the underside leading edge on a bevel set plate 127, 128 or 129 are resting on a work or abrading surface. For the bevel set plate, the edge that is closest to cut edge simulator edge 154, is the pivot edge of the bevel plate. Sliding leg collar 3 along the length of main rod 16, and rotating main rod 16 in the inside diameter of leg collar-rod bore 9, until cut edge simulator edge 154, the previous bevel set member edge, and the base legs, are in complete contact with a work surface, will match the bevel and skew angles of the configuration, to the settings made on cut edge simulator 125. Leg collar bolt 15 is then tightened and the bevel and skew angles are locked into place. cut edge simulator 125 can then be removed, and an edge-tool to be sharpened is installed at the correct protrusion distance. Cutting edge protrusion distances are discussed in section 18.

If however the user wishes to set both bevel and skew angles visually at eye level at a cutting edge, this can also be done, and the procedure for setting such is simply by doing so at eye level while adjusting leg collar 3 to visually match existing bevel and skew angles of cutting edges to a work or abrading surface. Stop screw 88 need not be adjusted in these cases (except to make sure small v-block 87 protrudes enough such that it can clamp the edge of the tool shank). The purpose of stop screw 88 is to maintain precise tool shank thickness independent bevel and skew angle registration between the cut edge simulator and the cutting edge of a tool, while allowing any thickness flat blade to always have an edge of the blade shank in contact with surface 162, which acts as a fence and a reference surface for double beveled blades. For example, if small v block 87 were stationary, thick blades would not be able to come into contact with the surface 162, and this would throw off the calibration of the configuration slightly. Stop Screw 88 allows the v block to be horizontally moveable, so that the edge of the blade or simulator is always centered in the V groove, while also coming into contact with 162 via positioning of 88. This way, both the cut edge simulator while clamped and calibrating a configuration, and later a blade that the cut edge simulator is calibrating the jig for, are at the same relative positions within slot 84.

After setting bevel and skew angles either visually or with cut edge simulator 125, if honing on stones of differing heights is desired the same height riser procedure of Section 4 applies.

Mount plate spacer 148 is not used for single bevel edge tools in this configuration because the reference plane for cut edge simulator 125 is the same plane that lies on the surface of flat tool slot 84. This is why single bevel large block 94 and single bevel small block 95 are used for single beveled flat blades—to assure that these reference planes match up. This assures the front edge of the cut edge simulator and skew anchor point 144 on cut edge simulator 125 are co planar with the seat or floor of flat tool slot 84, and an accurate calibration of the configuration is possible.

When honing skew angles on single bevel flat blades, the point on the edge of a tool shank, that is furthest away from the base system, is the edge at the lowest skew point. In other words, (see FIG. 18B), the point 389 on the skewed edge is further away from honing guide main rod 16, than is point 376. This is because the guide body is rotated or tilted toward 389. For skewed blades, the skew angle is created by the geometry of the configuration, that is, the combined tilting forward, and the guide body tilting either to the left or to the right. So if honing single beveled skewed blades, if looking at the configuration from the rear, the blade in FIG. 18B would be mounted into flat tool guide body 82, with the guide body pointing to the left. And if honing a single beveled blade shown in FIG. 18D, the guide body should be rotated 180 degrees on main rod 16 and clamped into place, and flat tool guide body 82 would be pointing toward the right. If doing double beveled blades—the skew collar will be used, and honing double beveled skew cutting edges will be covered in detail in sections 6 and 7.

FIGS. 6A Through 6E and 7A Through 7D

Detailed Static Description

A skew-bevel replicator collar, or a skew-bevel registration collar 168 (FIGS. 6A, 6B, 6C, 6E, 7B, 7C, 7D) is a slotted clamping collar, which clamps onto main rod 16 in the same manner as leg collar 3. Clamp bolt 15, which is identical to leg collar clamp bolt or thumbscrew 15, (FIGS. 6A, 6B, 6C, 6E), provides clamping power to the inside diameter of a skew collar rod bore 169 (FIG. 6E), to clamp the outside diameter of main rod 16. A skew collar keyway 170 (FIGS. 6A, 6B), orients skew-bevel registration collar 168 into the correct radial position onto main rod 16. A skew registration pin 171 (FIGS. 6A, 6B, 6C, 6E, 7B, 7C, 7D) is passed through a skew pin slot 172 (FIGS. 6A, 6B) in skew-bevel registration collar 168, and is positioned through a skew pin plate hole-unthreaded plate 173 (FIG. 6D) in an unthreaded skew registration plate 174 (FIGS. 6A, 6B, 6C, 6D, 6E), and a skew pin plate hole-threaded plate 175 (FIG. 6D), in a threaded skew registration plate 176 (FIGS. 6A, 6B, 6C, 6D, 6E). Unthreaded skew registration plate 174 has a countersunk skew plate bore 177 (FIG. 6D) into which a skew plate lock bolt 178 (FIGS. 6C, 6E) passes through. The threaded end of the skew plate lock bolt 178 threads through a threaded skew plate bore 179 (FIG. 6D) in threaded skew registration plate 176. This bolt also passes through skew pin slot 172, as does skew registration pin 171.

Figure 6A:
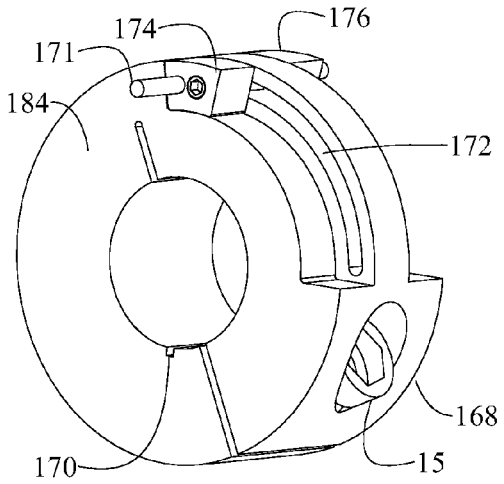
FIGS. 6A to 6E show a skew-bevel angle stop collar, used for mirroring skew and bevel angles on both sides of edge tools.
Figure 6B:
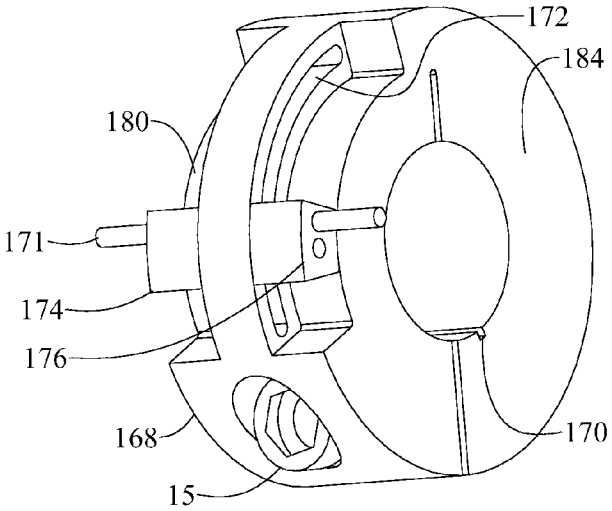
Figure 6C:
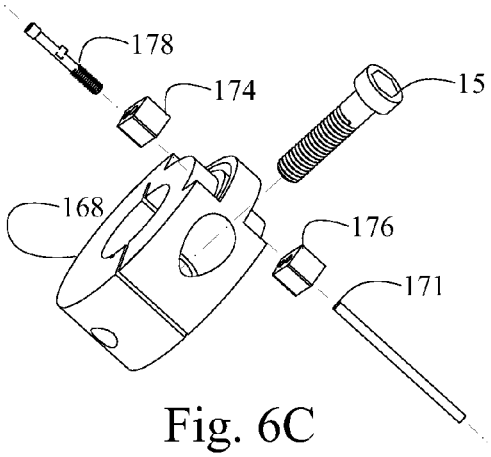
Figure 6D:
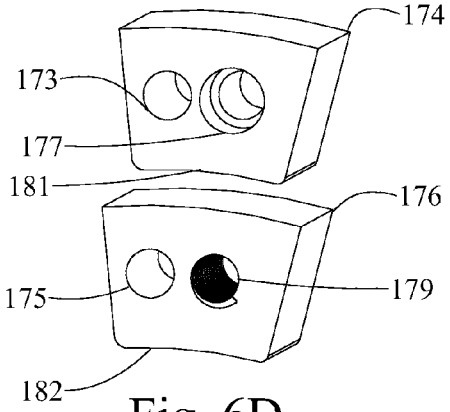
Figure 6E:
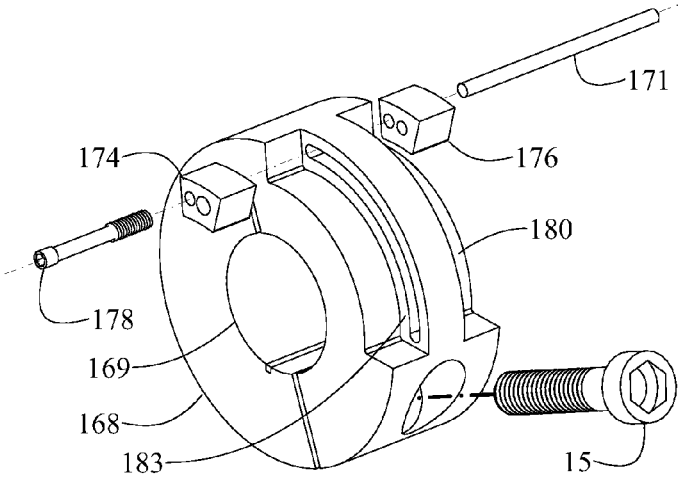

Skew pin slot 172, and a skew slot countersunk wall 180 (FIG. 6B, 6E), each have a radius that shares the same center point as does the radius of skew collar rod bore 169. Unthreaded skew registration plate 174 and threaded skew registration plate 176 are nested in this countersink area when assembled to the collar. Two undersides of unthreaded skew registration plate 174 and threaded skew registration plate 176, respectively, a skew plate radiused underside 181 (FIG. 6D) and a skew plate radiused underside 182 (FIG. 6D), have a radius that matches the radius indicated by skew slot countersunk wall 180. Once unthreaded skew registration plate 174, threaded skew registration plate 176 and skew plate lock bolt 178 are bolted on to skew-bevel registration collar 168, skew registration pin 171 can be freely inserted into, and removed from skew pin plate hole-unthreaded plate 173 and skew pin plate hole-threaded plate 175 at any time. When unthreaded skew registration plate 174 and threaded skew registration plate 176 are attached to the collar and skew plate lock bolt 178 is slightly loosened, unthreaded skew registration plate 174 and skew pin plate hole-threaded plate 175 are held close to a skew collar slot face radius 183 (FIG. 6E) on either side of the slot, and to skew slot countersunk wall 180, and both are free to move around the arc of radius of skew slot countersunk wall 180. When skew registration pin 171 is inserted into skew pin plate hole-unthreaded plate 173 and skew pin plate hole-threaded plate 175 and through skew pin slot 172, and skew plate lock bolt 178 is tightened, the pin is perpendicular at all times to two skew collar faces 184 (FIG. 6A, 6B). This pin, therefore, can travel with unthreaded skew registration plate 174 and threaded skew registration plate 176, and follows the length of arc of skew pin slot 172, it's lengthwise axis is at all times equal distant from the center point of skew collar rod bore 169. At any position around this arc, skew pin plate hole-unthreaded plate 173 and skew pin plate hole-threaded plate 175 along with skew registration pin 171 can be locked into position, and once locked into position, skew registration pin 171 can be inserted or removed at any time, while skew pin plate hole-unthreaded plate 173 and skew pin plate hole-threaded plate 175 stay in position.

After assembled, the skew collar assembly can be placed onto main rod 16 in the flat edge-tool configuration, or other configurations, by using key 18 to align skew collar keyway 170 to keyway 17 on main rod 16. Skew collar keyway 170 stays aligned to keyway 17 on main rod 16.

FIGS. 6A Through 6E and 7A Through 7D

Detailed Operational Description

Figure 7A:
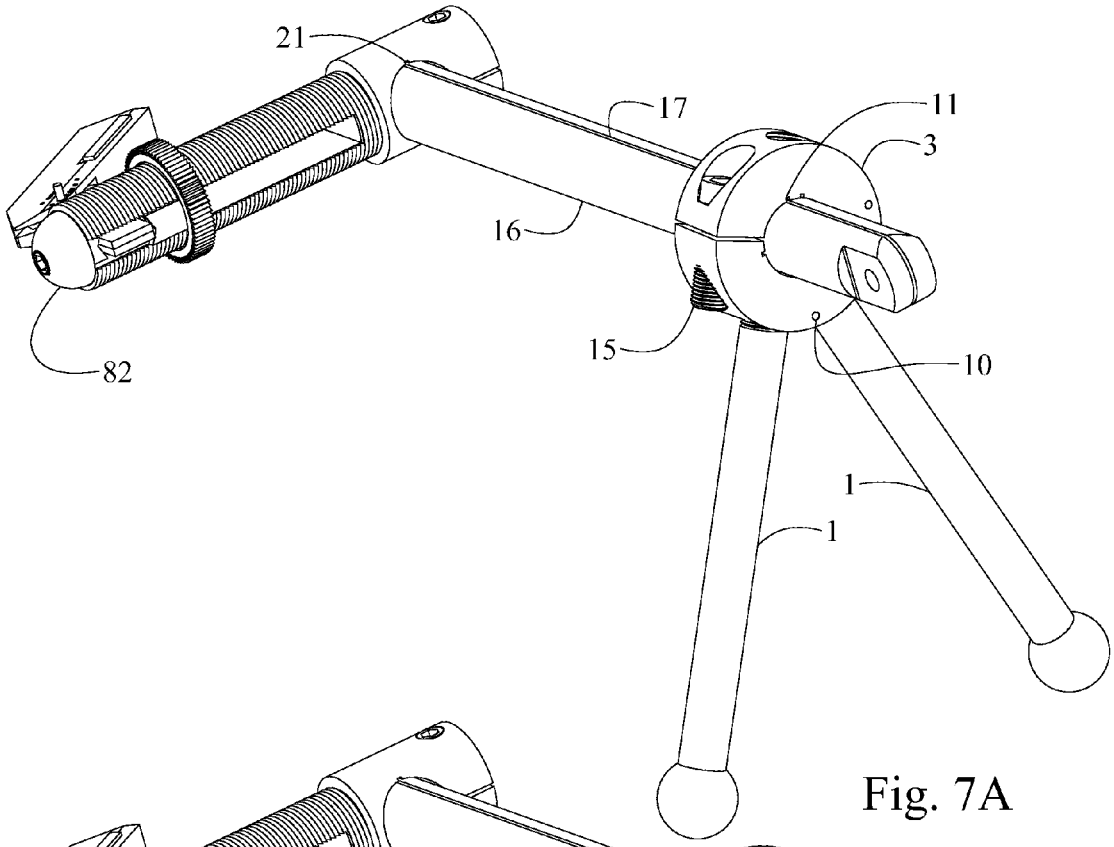
FIGS. 7A to 7D show the skew-bevel angle stop collar in use with a flat edge-tool configuration.
Figure 7B:
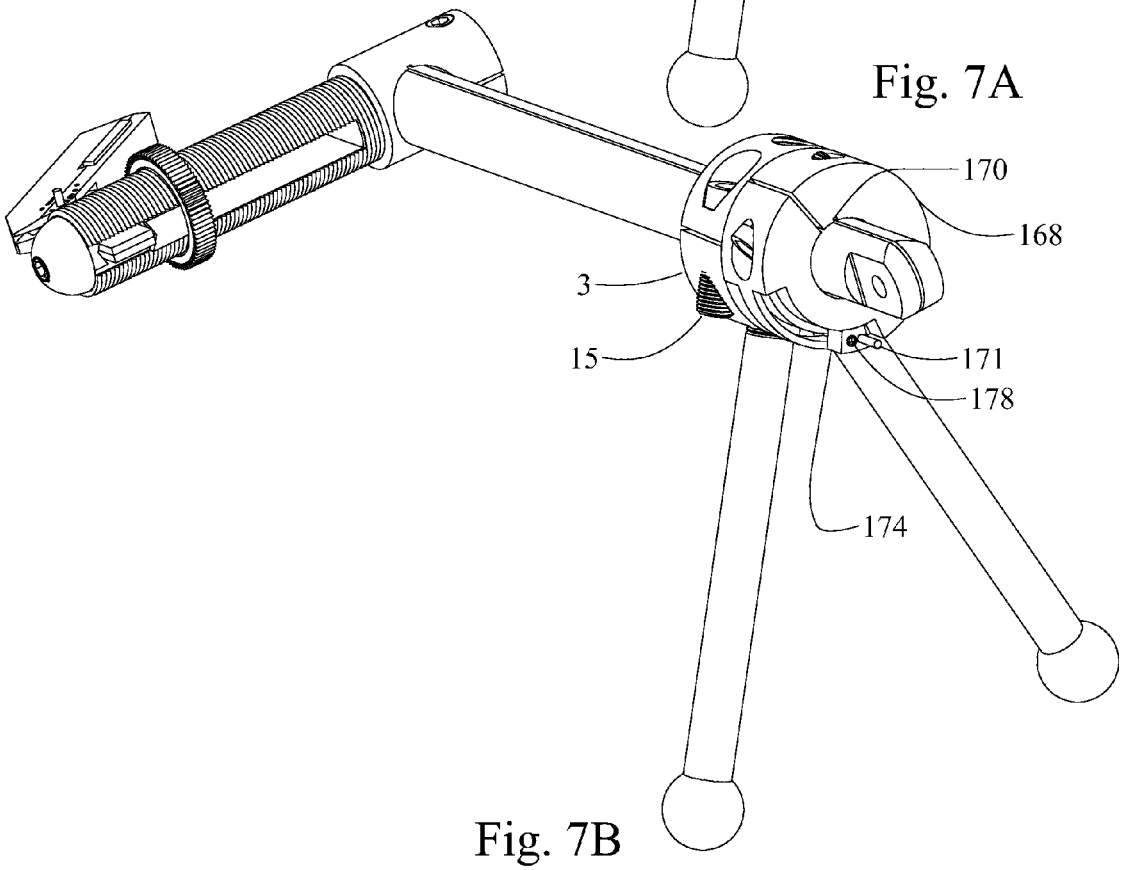
Figure 7C:
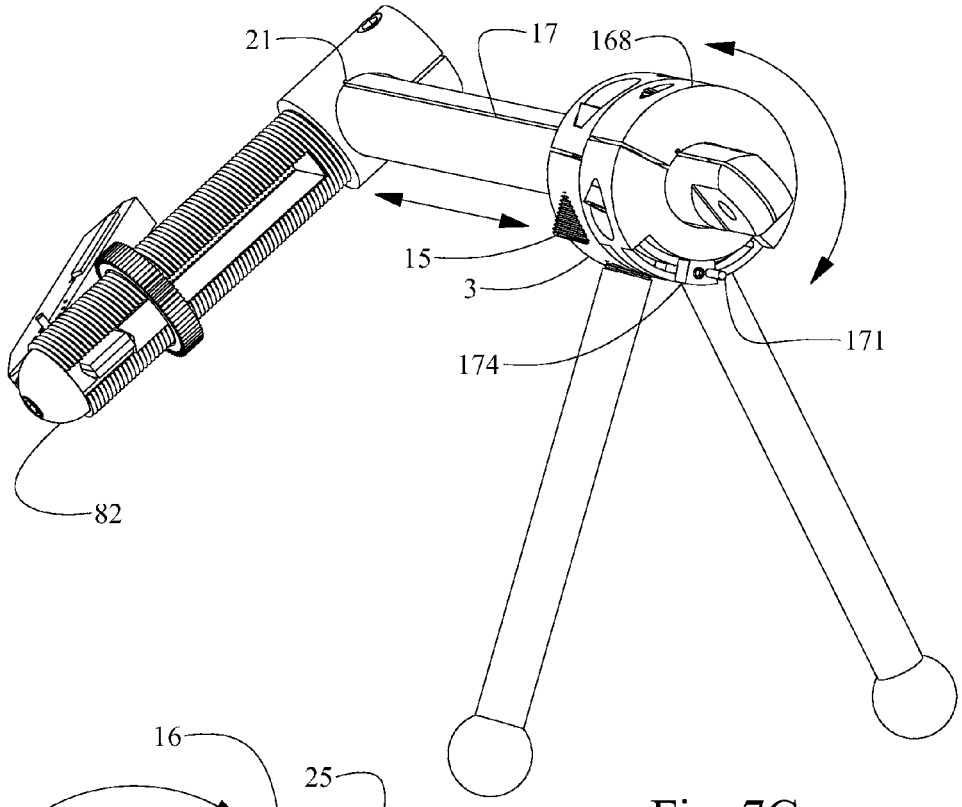
Figure 7D:
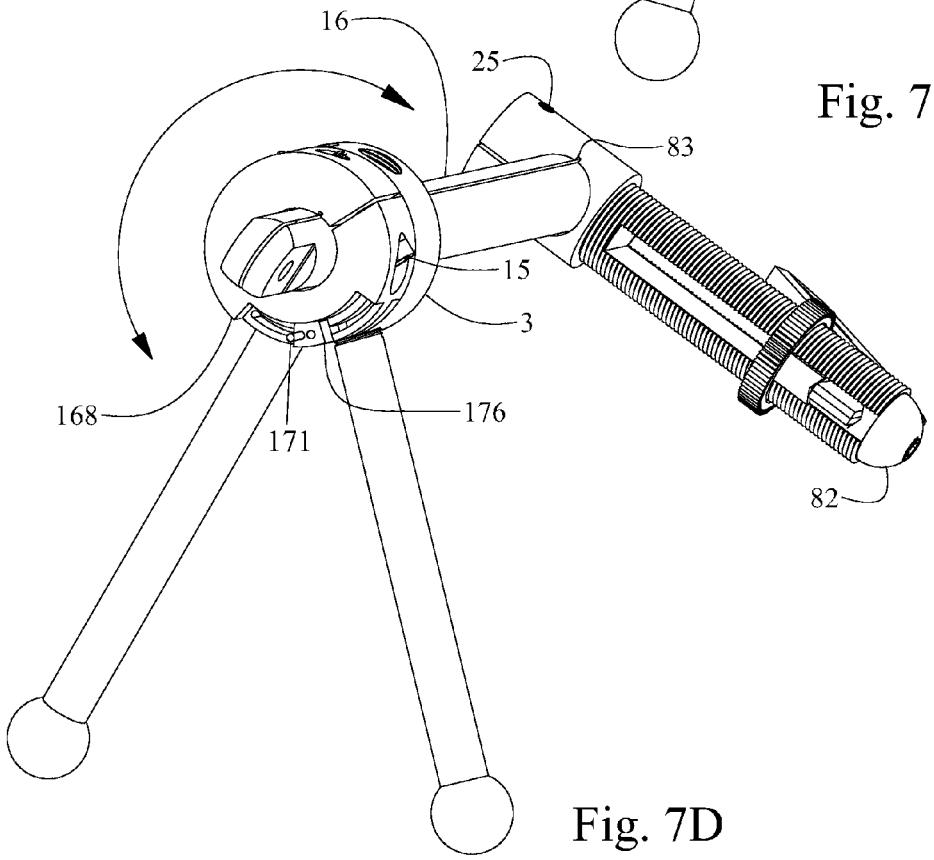

FIG. 7A shows the cut edge simulator installed in flat tool guide body 82 configuration, prior to the installation of skew-bevel registration collar 168. FIGS. 7B through 7D show the flat edge-tool configuration with skew-bevel registration collar 168 installed. In FIG. 7A, skew angle registration hole 10 is shown on leg collar 3. The purpose of skew angle registration hole 10 is to provide a reference of radial adjustment of main rod 16 and hence the guide body assembly, in relation to the base legs. FIGS. 7A and 7B show 2 configurations set to a non skewed position (for illustration and comparison to FIGS. 7C and 7D). In FIG. 7B, skew-bevel registration collar 168 has been installed onto main rod 16, the face of skew-bevel registration collar 168 is placed in contact with the face of leg collar 3, and skew-bevel registration collar 168 is aligned to keyway 17 with key 18, and locked into place with leg collar bolt 15. Keyway 17 in main rod 16 has been aligned to primary keyway 11 in leg collar 3, and keyway 17 has also been aligned to guide body keyway 21 in flat tool guide body 82. In FIG. 7B, with the installation of skew-bevel registration collar 168, skew registration pin 171 can be seen inserted into unthreaded skew registration plate 174, next to skew plate lock bolt 178, and through skew plate bore 175. Skew pin plate hole-unthreaded plate 173 and skew pin plate hole-threaded plate 175 and thus the pin, have been aligned to skew angle registration hole 10 on leg collar 3.

To register a combined skew and double bevel edge for a tool, skew registration pin 171 (FIG. 7B) is pulled out of skew angle registration hole 10, but left in unthreaded skew registration plate 174 and threaded skew registration plate 176, and the user adjusts the skew and bevel angles for the cutting edge as discussed in the in the earlier sections in this specification. Once the desired bevel and skew angles are locked into place via leg collar bolt 15 on leg collar 3, skew plate lock bolt 178 is slightly loosened, and skew registration pin 171 is used to drag unthreaded skew registration plate 174, threaded skew registration plate 176 and skew plate lock bolt 178 around skew slot countersunk wall 180, until the skew registration pin finds the new skew angle registration hole 10 position of leg collar 3 (collar 3 has been rotated on main rod 16 to set the skew angle). Once skew angle registration hole 10 is aligned to skew pin plate hole-unthreaded plate 173 and 175, the pin is again inserted through skew angle registration hole 10 on leg collar 3, and skew plate lock bolt 178 tightened. The new position of skew angle registration hole 10 in relation to keyway 17 on main rod 16 has thus been registered on the skew collar. Then the user sharpens one side of the cutting edge with the current configuration. See FIG. 7C for the new skewed position of flat tool guide body 82, and the skew registration pin 171. Notice that skew registration pin 171, and unthreaded skew registration plate 174, threaded skew registration plate 176, skew plate lock bolt 178 have now a new position which registers the new radial position of leg collar 3 on main rod 16.

When ready to sharpen the opposite side, first the user loosens leg collar bolt 15 of the skew collar and removes the skew collar from main rod 16, leaving skew plate lock bolt 178 tightened and unthreaded skew registration plate 174 and threaded skew registration plate 176 in the same positions. Leg collar bolt 15 on leg collar 3 is left tightened at this point in order to maintain a reference position for the bevel angle. The skew collar is then rotated 180° such that the opposite face of skew-bevel registration collar 168 is facing the back side face of leg collar 3. Skew-bevel registration collar 168 is then inserted back on to main rod 16 and again the face of skew-bevel registration collar 168 is placed into contact with leg collar 3. Key 18 is then used to re align skew collar keyway 170 of skew-bevel registration collar 168 to keyway 17 on main rod 16, and then the skew collar is again locked into place on main rod 16 with leg collar bolt 15. Maintaining contact between the two collars maintains a registration point on main rod 16 for the bevel angle. Leg collar bolt 15 on leg collar 3 is loosened, leg collar 3 is then rotated on main rod 16 until skew registration hole 10 on leg collar 3 aligns with skew pin plate hole-unthreaded plate 173 and 175. Skew registration pin 171 is again inserted into skew pin plate hole-unthreaded plate 173 and 175, and aligned to skew angle registration hole 10, and while holding leg collar 3 in contact with skew-bevel registration collar 168, leg collar bolt 15 on leg collar 3 is tightened. Flat tool guide body 82 is removed from the end of main rod 16, rotated 180 degrees, and dual bevel keyway 83 in flat tool guide body 82 is aligned with keyway 17 on main rod 16. While keeping the front of flat tool guide body 82 flush with the end of main rod 16 (as it was prior to removal), flat tool guide body 82 is clamped back onto main rod 16 via guide body main clamp bolt 25. The new bevel and skew angle settings of the tool edge are now a mirror image of the previous settings and the user can begin to hone or sharpen the other side of the tool.

FIGS. 8A Through 8H

Detailed Static Description

Figure 8A:
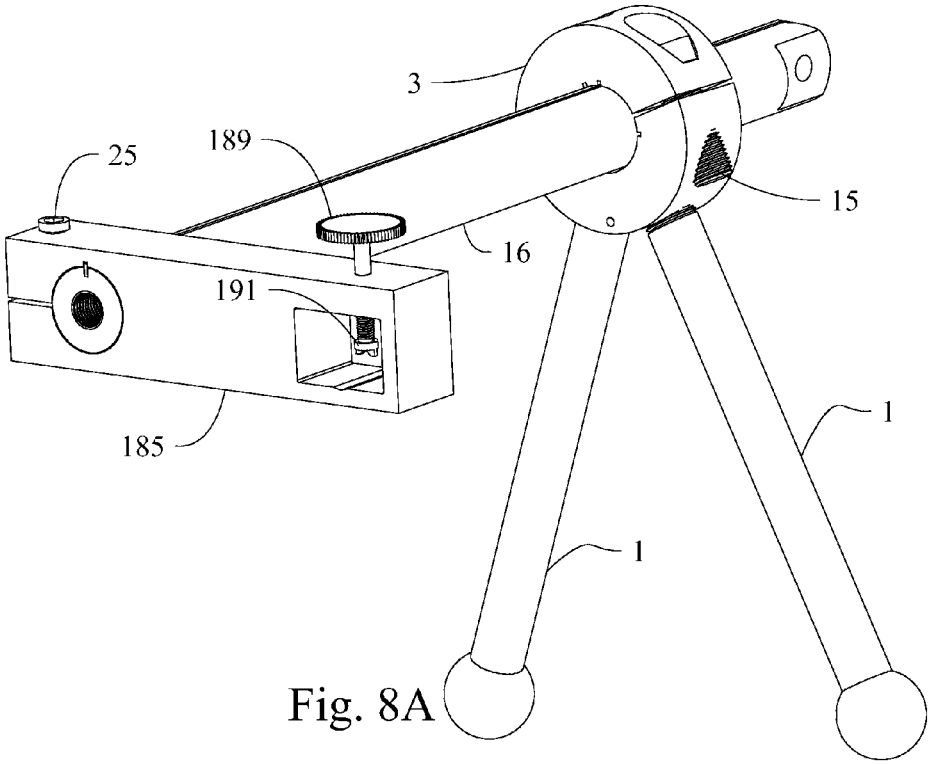
FIGS. 8A to 8H show a honing guide body assembly configuration for printmaking tools.
Figure 8B:
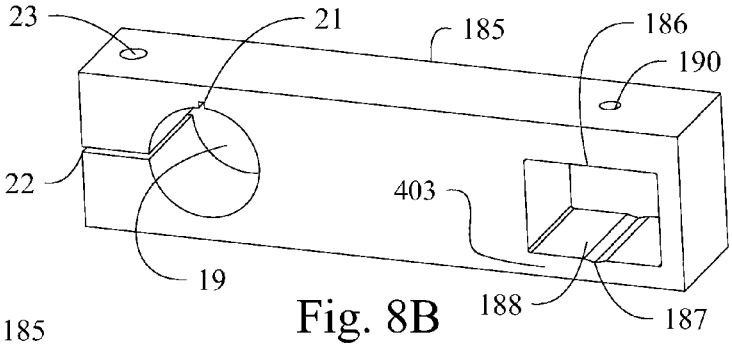
Figure 8C:
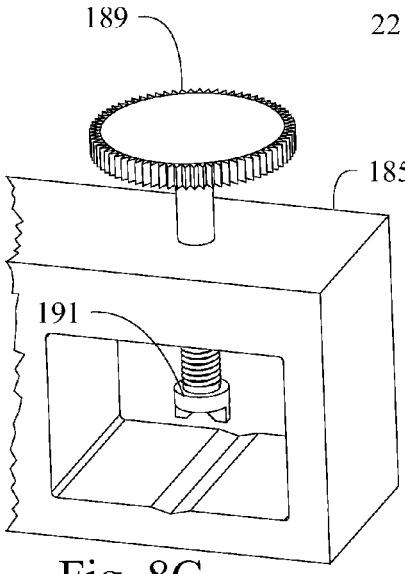
Figure 8D:
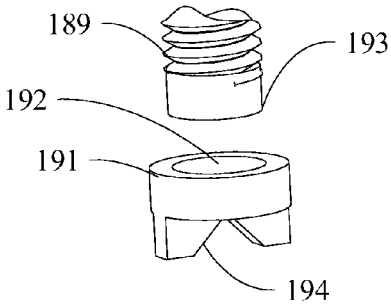
Figure 8E:
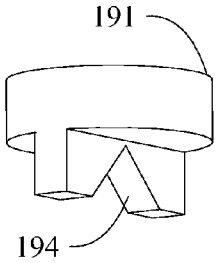
Figure 8F:
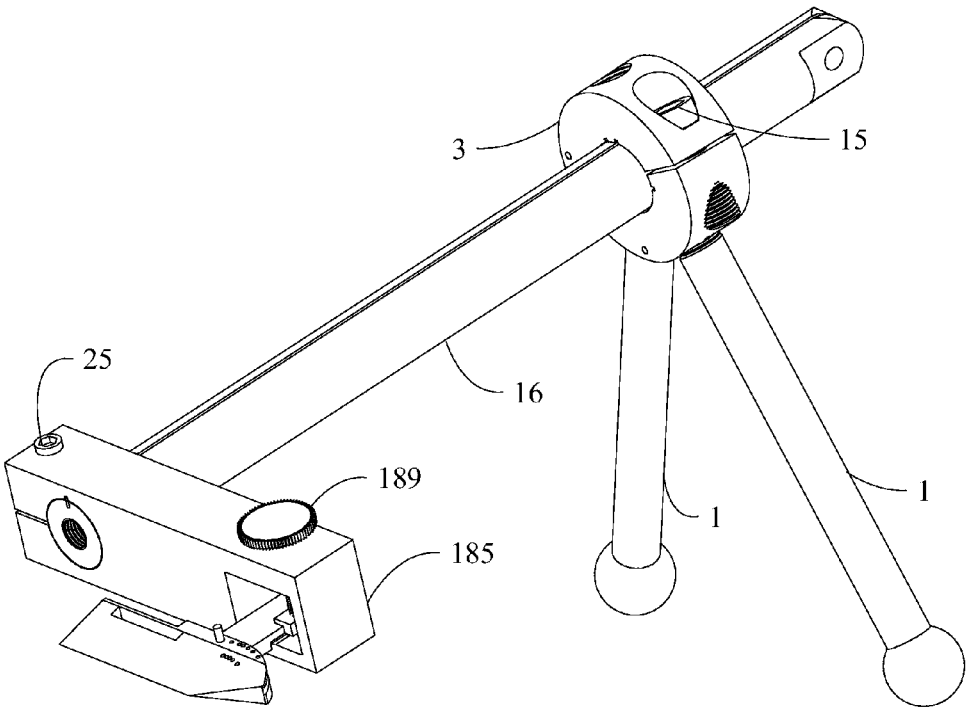

FIGS. 8A and 8F show as members of a configuration, the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous. If the user uses cut edge simulator 125 with this configuration, the assembly of the cut edge simulator was covered in detail in the static portion of Section 5. If the user is sharpening or honing on abrading surfaces of differing heights or thicknesses, the same assembly procedure for the height adjust members in the static portion of Section 4 is used.

A graver guide body 185 (FIGS. 8A, 8B, 8C, 8F, 8H), is able to clamp and hone tools such as gravers, burins, angle tint tools, elliptical tint tools and similarly related tools used for wood engraving, woodcut printmaking, metallic engraving and jewelry engraving.

Graver guide body 185 is comprised of a graver guide body opening 186 (FIG. 8B) into which a tool can be inserted. A graver body v-groove 187 (FIG. 8B) is in a graver clamp seat 188 (FIG. 8B) of graver guide body opening 186. A graver clamp thumbscrew 189 (FIGS. 8A, 8C, 8F, 8H) is installed into a graver thumbscrew clamp bore 190 (FIG. 8B). A graver v-block clamp jaw 191 (FIGS. 8A, 8C, 8D, 8E) with a graver thumbwheel clamp jaw seat 192 at the top surface (FIG. 8D), is inserted into graver guide body opening 186, and is seated under a graver cylindrical thumbscrew end 193 (FIG. 8D) of graver clamp thumbscrew 189 (FIGS. 8A, 8C). A graver deep L-clamp jaw 195 (FIG. 8G), can also be inserted into graver guide body opening 186 and clamped under graver clamp thumbscrew 189. This can be used to clamp cut edge simulator 125 to a graver guide body 185 configuration.

A graver v-block V 194 (FIG. 8D, 8E), a large L-clamp fence 196 (FIGS. 8G, 8H), a flat tool-graver body clamp plate 416 (FIG. 8G), a flat tool clamp plate fence 417 (FIG. 8G) a side-fence flat tool clamp jaw 504 (FIG. 8G), a graver inside body wall 197 (FIG. 8H) and a cylindrical thumbwheel seat 418 (FIG. 8G) are discussed in the following operational section.

FIGS. 8A Through 8H

Detailed Operational Description

Operation of the elongated support base member system was described in detail in the static section of 1A through 1P, and the same procedure for setting bevel angles applies to this configuration as in the previous. If the user wishes to use cut edge simulator 125 with this configuration, the operation of the cut edge simulator was covered in detail in the operational section for FIGS. 5A through 5V. If the user is sharpening or honing on abrading surfaces of differing heights or thicknesses, the same operation for the height adjust members in the static portion of Section 4 applies.

To use graver guide body 185 configuration, the user inserts a graver, burin, angle tint tool, elliptical tint tool or other similar or related tool, through graver guide body opening 186, positions the shank of an edge-tool vertically, and inserts graver v-block V 194 over a tool spine, and tightens graver clamp thumbscrew 189 into graver thumbwheel clamp jaw seat 192 to lock a tool into place. The lower edge of a tool is aligned square to graver guide body 185 (since graver body v-groove 187 is perpendicular to the length of graver guide body 185) and is cradled in graver body v-groove 187.

To set a bevel angle of this configuration for a tool edge, either the bevel blocks shown in 2*a* through 3*b* can be used, or the cut edge simulator can be used. Or the bevel angle can be set visually at eye level, to match an existing bevel angle at a tool edge. A tool is honed in this configuration in the same manner as described in the previous. If abrading surfaces of differing thicknesses are being used, the previous operational portion of Section 4 applies.

Figure 8G:
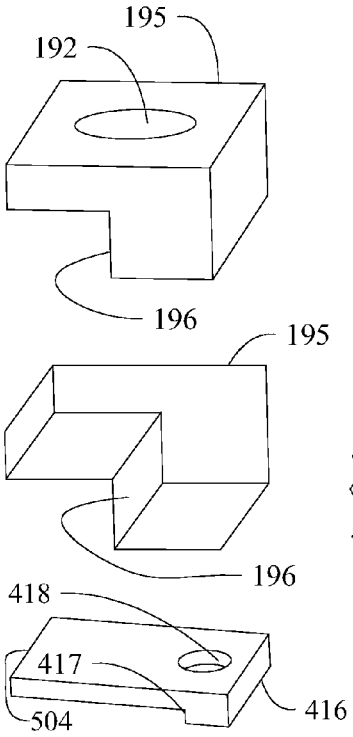
Figure 8H:
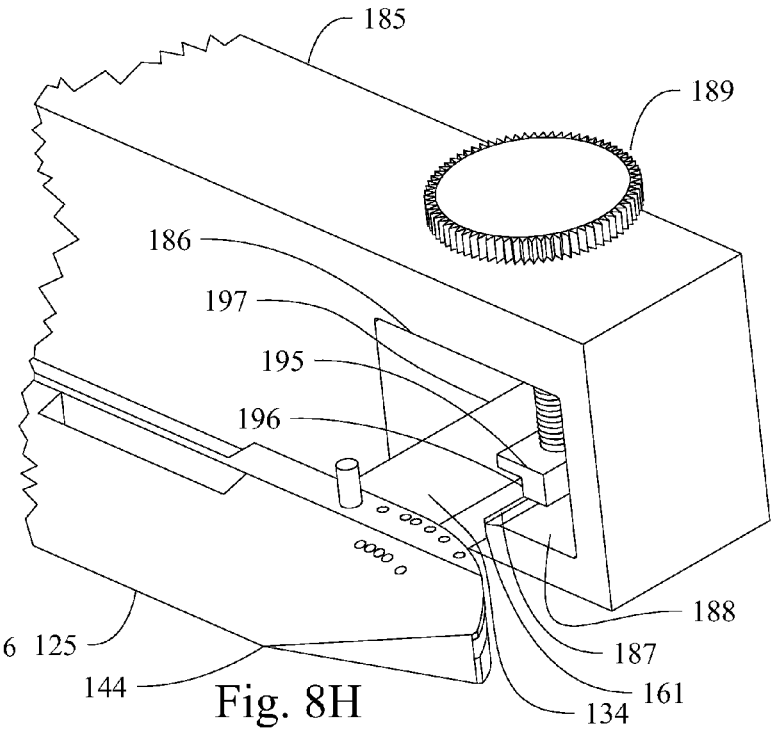

The graver deep L-clamp jaw 195 with graver thumbwheel clamp jaw seat 192 (FIGS. 8G, 8H) is shown clamping cut edge simulator into graver guide body 185 (FIGS. 8F, 8H). Notice that a large L-clamp fence 196 on graver deep L-clamp jaw 195 aligns calibration mount plate 134 to a graver inside body wall 197 of graver guide body opening 186 (FIGS. 8G, 8H). This keeps cut edge simulator 125 and calibration mount plate 134 square to the guide body for accurate bevel angle settings. Calibration mount plate 134 is designed to be exactly half the width opening of graver guide body opening 186, such that skew anchor point 144 of cut edge simulator 125 is exactly aligned to the middle of stop screw stop surface 162. This causes the bevel angle setting on cut edge simulator 125 to be referenced to the centerline of the v groove. Calibration plate protrusion fence 161 is in contact with the front of graver guide body 185. This sets the correct protrusion distance for the protrusion stops described in the Section 18. Mount plate spacer 148 is not used for single bevel edge tools, because the reference plane for cut edge simulator 125 discussed in the previous section for FIGS. 5A through 5V is the same plane that lies on graver clamp seat 188. This assures the front edge of the cut edge simulator and skew anchor point 144 on cut edge simulator 125 are co planar with graver clamp seat 188, and an accurate calibration of the configuration is possible.

Some engraving tools such as angle tint tools and the like have cutting edges with relatively steep bevel angles such as 30 to 45 degrees, and the tip of the shank is held to an abrading surface with the wider edge of the tool shank facing toward the honing stone. This is the reason why graver body v-groove 187 is wider than graver v-block V 194, to accommodate the wider shanks of these tools. This allows tools such as elliptical tint or angle tint tools to be clamped into graver guide body 185 with a wider shank edge facing downward. Thus graver clamp thumbscrew 189 will apply clamp pressure to the narrow edge of a tool shank.

FIG. 8G also shows a flat tool-graver body clamp plate 416, which can be used to clamp small carving tools such as narrow Japanese style woodcut carving gouges. This clamp is designed and used similarly to 195; a difference being that flat tool clamp plate fence 417 is shallower, allowing graver deep L-clamp jaw 195 to clamp and hold much thinner tool shanks, such as the above mentioned knives of which shanks can be as thin as 1/32". Side-fence flat tool clamp jaw 504 is used to align and center the clamp member against graver inside body wall 197, and the width of flat tool-graver body clamp plate 416 is such that an edge of a tool will be positioned along the centerline of the V groove. A cylindrical thumbwheel seat 418 serves the same purpose as graver thumbwheel clamp jaw seat 192.

FIGS. 9A Through 9E

Detailed Static Description

FIGS. 9A and 9C-9E show as members of a configuration, the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous.

The previous assembly and installation procedure for skew-bevel registration collar 168 applies to this configuration, as in the detailed static section for FIGS. 6A through 6E and 7A through 7D. If the user is sharpening or honing on abrading surfaces of differing heights or thicknesses, the same assembly procedure for the height adjust members in the detailed static portion of Section 4 applies.

Figure 9A:
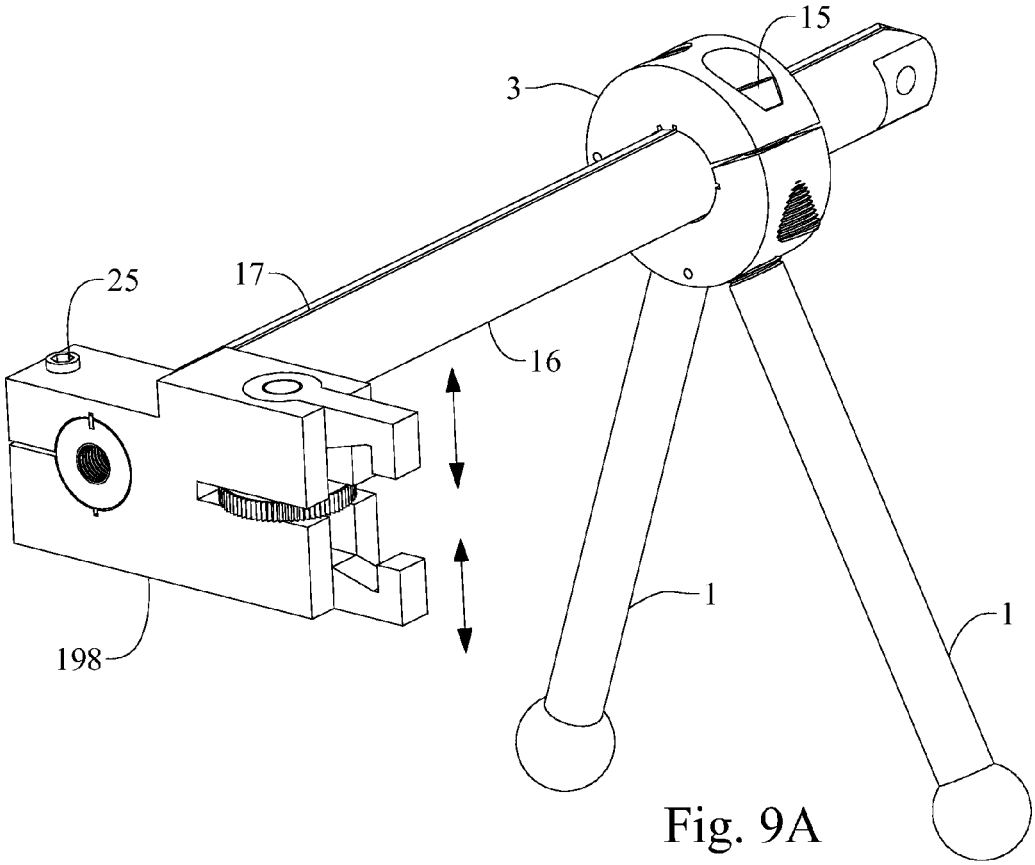
Figure 9B:
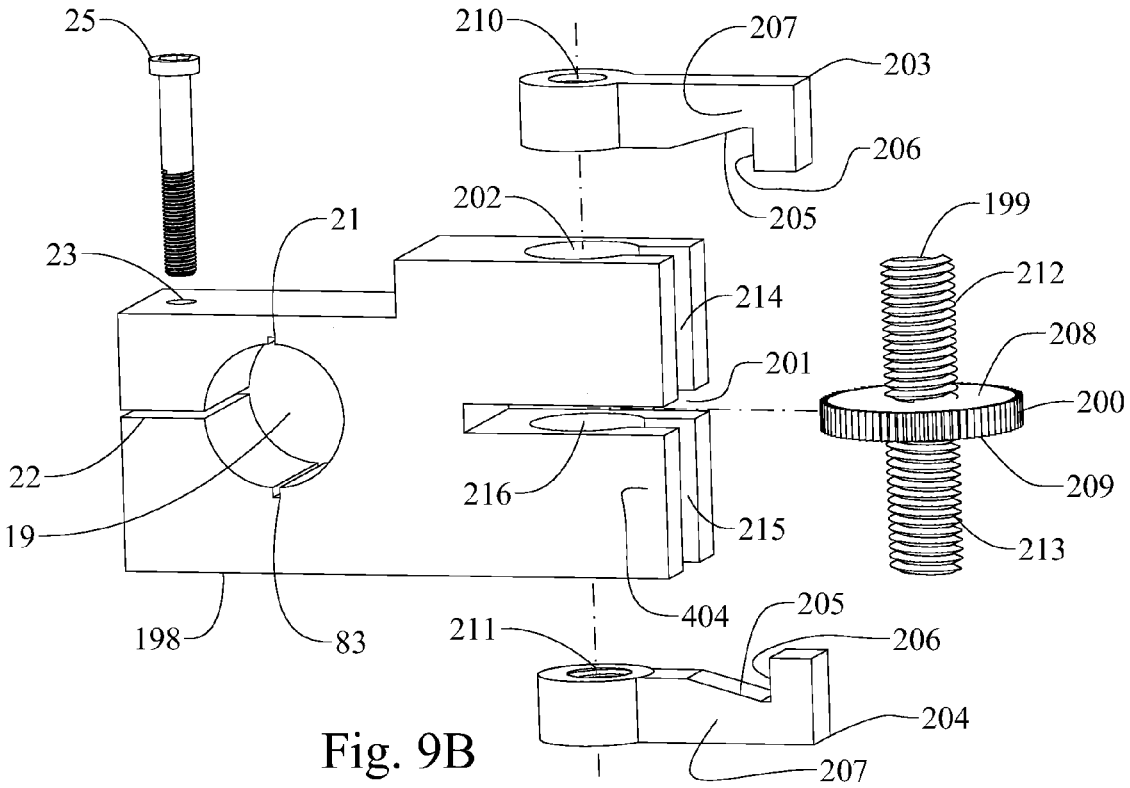
Figure 9C:
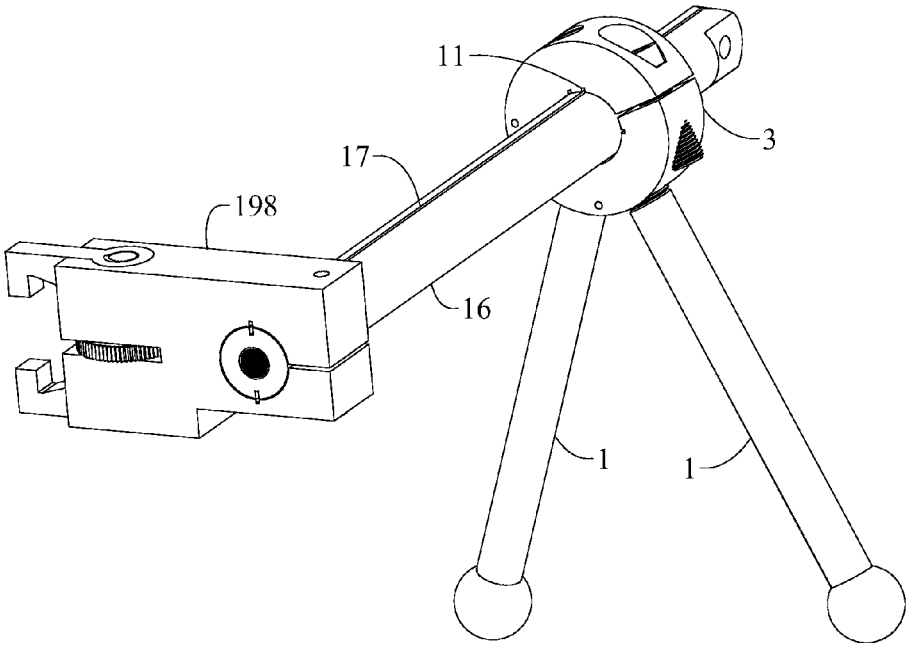
Figure 9D:
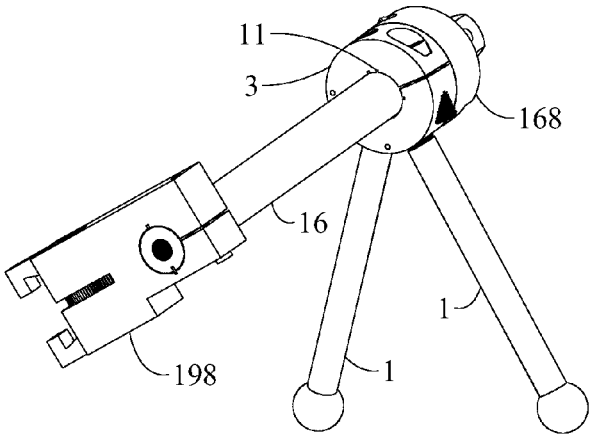
Figure 9E:
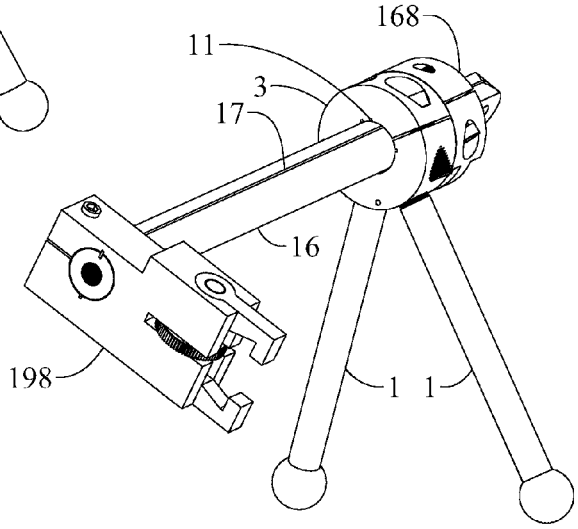

A parting tool guide body 198 (FIGS. 9A, 9B, 9C, 9D, 9E) and configurations are shown with the member base system and skew-bevel registration collar 168 (FIGS. 9D, 9E). This configuration is useful for sharpening and honing edges such as parting tools which can have diamond tipped profiles.

To assemble the guide body members, a left & right hand parting tool threaded rod 199 (FIG. 9B) with a parting tool clamp thumbwheel 200 (FIG. 9B) at center length, is inserted into a parting tool thumbwheel slot 201 (FIG. 9B), such that the member is held at center of an upper jaw bore 202 (FIG. 9B), and lower jaw bore 216 (FIG. 9B). A pair of left and right hand threaded upper parting clamp jaw 203 (FIG. 9B) and a lower parting clamp jaw 204 (FIG. 9B) are then held at top and bottom of the bore ends and in contact with a left and a right hand upper threaded parting rod 212 (FIG. 9B) and a lower threaded parting rod 213 (FIG. 9B). As the thumbwheel is turned, an upper parting jaw threaded bore 210 (FIG. 9B) and a lower parting jaw threaded bore 211 (FIG. 9B) are fed onto upper threaded parting rod 212 and lower threaded parting rod 213, into upper jaw bore 202 and lower jaw bore 216, and are drawn together as they enter an upper jaw slot 214 (FIG. 9B) and lower jaw slot 215 (FIG. 9B).

Two angled clamp jaw facets 205 (FIG. 9B), two parting jaw claws 206 (FIG. 9B), an upper dial face 208 (FIG. 9B) and a lower dial face 209 (FIG. 9B) are discussed in the following operational section.

FIGS. 9A Through 9E

Detailed Operational Description

Operation of the member base system was described in detail in the previous static section of 1A through 1P, and the same procedure for setting bevel angles applies to this configuration as in the previous. If the user is sharpening or honing on abrading surfaces of differing heights or thicknesses, the same operation for the height adjust members described in the detailed operational portion of Section 4 applies. Operation of cut edge simulator 125 assembly was covered in detail in the operational portion of Section 5; the same procedure applies here with exception. FIGS. 11H through 11M shows a v-tool cut edge simulator mount plate 268 which also functions with a parting tool. V-tool cut edge simulator mount plate 268 is installed vertically as would a parting tool be, between upper parting clamp jaw 203 and lower parting clamp jaw 204. Mount plate spacer 148 is used with v-tool cut edge simulator mount plate 268. v-tool cut edge simulator mount plate 268 is placed on a parting tool "P" mark-90 degree set 279 (FIG. 11L), which rotates cut edge simulator 125 into a horizontal position, or 90° clockwise, from a rear ward perspective of the configuration. Using cut edge simulator 125 with v-tool cut edge simulator mount plate 268 enables the user of the parting tool configuration, to set bevel and skew angles at a tool edge of parting tools. To set correct protrusion of cut edge simulator 125, cut edge simulator rear stop surface 165 of cut edge simulator 125 should be in contact with the front of parting tool guide body 198 when cut edge simulator 125 is set to a 0° skew angle.

A parting tool shank is inserted vertically between upper parting clamp jaw 203 and lower parting clamp jaw 204—or looking at the front of the jig, the width of the shank is held vertical in the jaws. As parting tool clamp thumbwheel 200 is turned, upper parting clamp jaw 203 and lower parting clamp jaw 204 are uniformly drawn together towards the center of parting tool guide body 198. Angled clamp jaw facets 205 slope towards two parting jaw claws 206. This forces the shank of the parting tool outward or away from the body and up against the claws. Angled clamp jaw facets 205 will thus force the shank up against the claws and also acts as the clamping face for one corner of one edge or one side or the edge of the shank.

If the tool edge is a simple two sided spear point with no bevels on the sides of the shank, the bevel angle at the tool tip can be set either visually to match the existing V-angle of the tip, or by the use of the gauge blocks. Or, the cut edge simulator could be used to calibrate the configuration prior to installing the tool. Once the bevel angle has been set on one side of the v shaped tool tip and leg collar bolt 15 is locked into place, the edge can be honed. To hone the opposite side, where no bevels on the shank sides are involved, parting tool guide body 198 is rotated 180° and dual bevel keyway 83 is aligned to keyway 17 of main rod 16 by key 18, and the other side of the edge can be honed. Since the bevel angle already has been set, by rotating parting tool guide body 198 180°, it hones the opposite side of the V at the same bevel angle, since leg collar bolt 15 has not been removed and the bevel angle setting has not been altered. See FIG. 9C for this position. Notice in FIG. 9C that primary keyway 11 is in the same location relative to keyway 17 on main rod 16. Notice that skew-bevel registration collar 168 is not shown, since it is not needed for non skewed angles.

Some parting tools have multi faceted tool tips. For example a diamond or v shaped tip can also have beveled edges which would mean there are at least 4 beveled facets on a tool edge. In these cases, skew-bevel registration collar 168 can be used to hone four (or more) facets on a parting tool. To hone multi facets, once the bevel and skew angles for a facet have been set by any of the previous methods, and once two facets have been honed as described in the section for FIGS. 6A through 6E and 7A through 7D, a tool is removed and the tool shank is rotated 180° and placed back into the jaws, and then re clamped in the tool at the same protrusion distance. The other two facets are then honed at the same bevel and skew angles since the configuration settings have not been changed. See FIGS. 9D and 9E showing the positions of the configuration. In FIG. 9D, keyway 17 is not showing because main rod 16 and parting tool guide body 198 have been rotated clockwise (from a rear perspective). And in 10*e*, it is showing since the configuration is set to hone a facet on the opposite side of the shank.

The parting tool guide body 198 is designed symmetrically in the same way that flat tool guide body 82 is designed, and discussed in the operational portions of Section 4 and the portion covering FIG. 5R; such provides for a mirrored image of bevel-skew angles on a tool tip. At all times, the jaws are equal distant from the centerline of parting tool guide body 198 that intersects the centerline of guide body main rod bore 19. This is accomplished by virtue of upper dial face 208 and lower dial face 209 in contact with, and centered by the faces of parting tool thumbwheel slot 201, to keep the jaws centered.

Figure 10A:
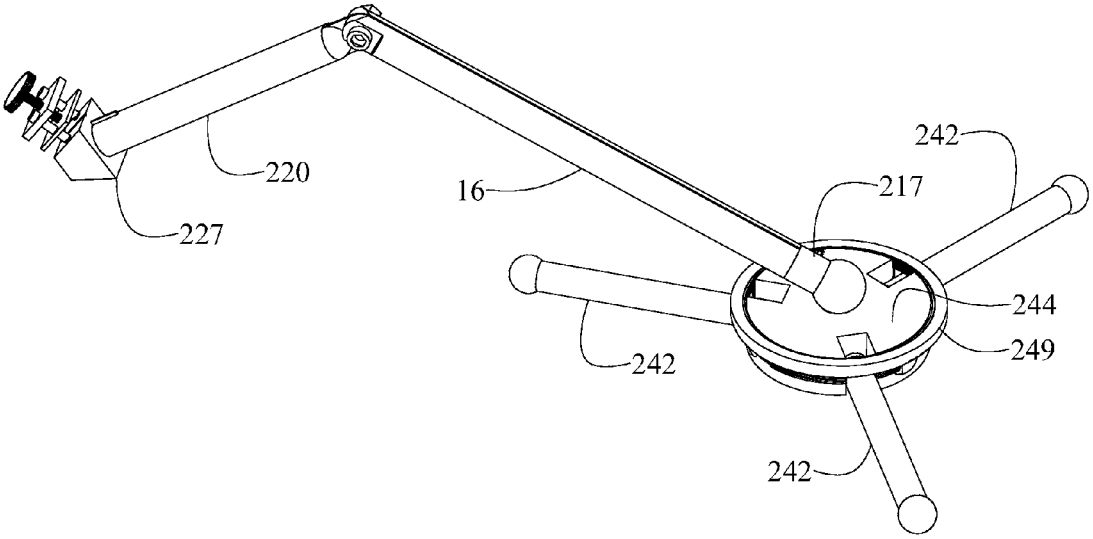
FIGS. 10A to 10R show a honing guide body assembly configuration for manually honing & sharpening fingernail profiles on gouges, using a planar abrading surface.
Figure 10B:
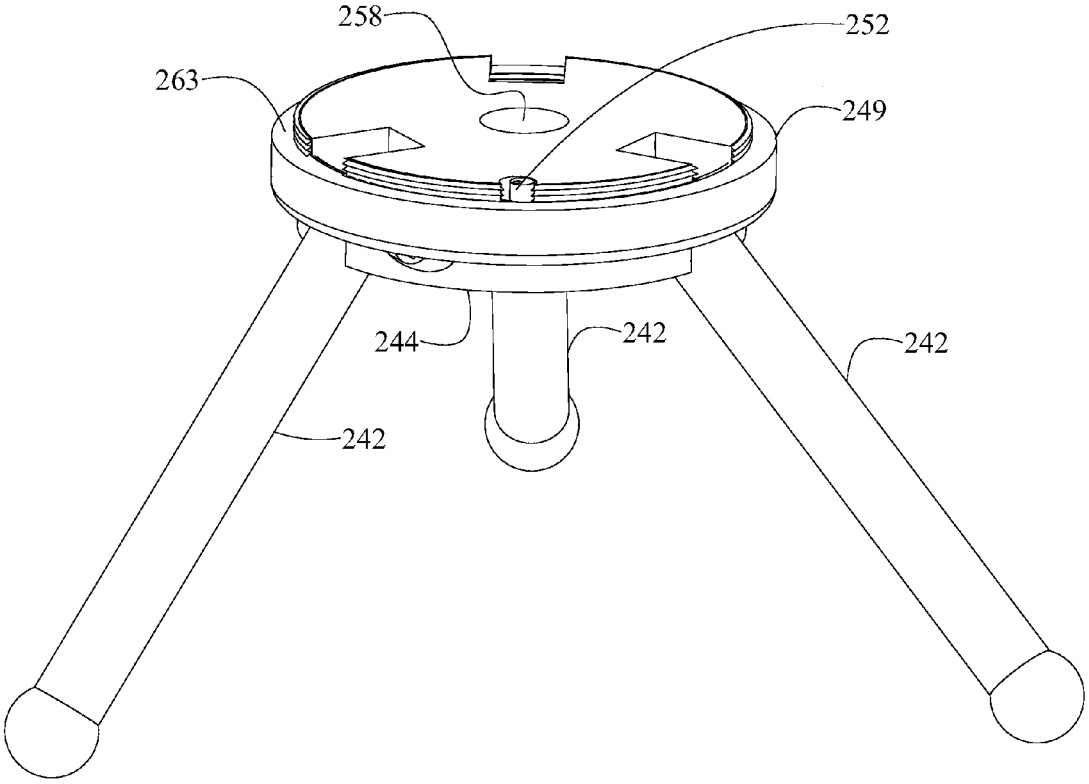
Figure 10C:
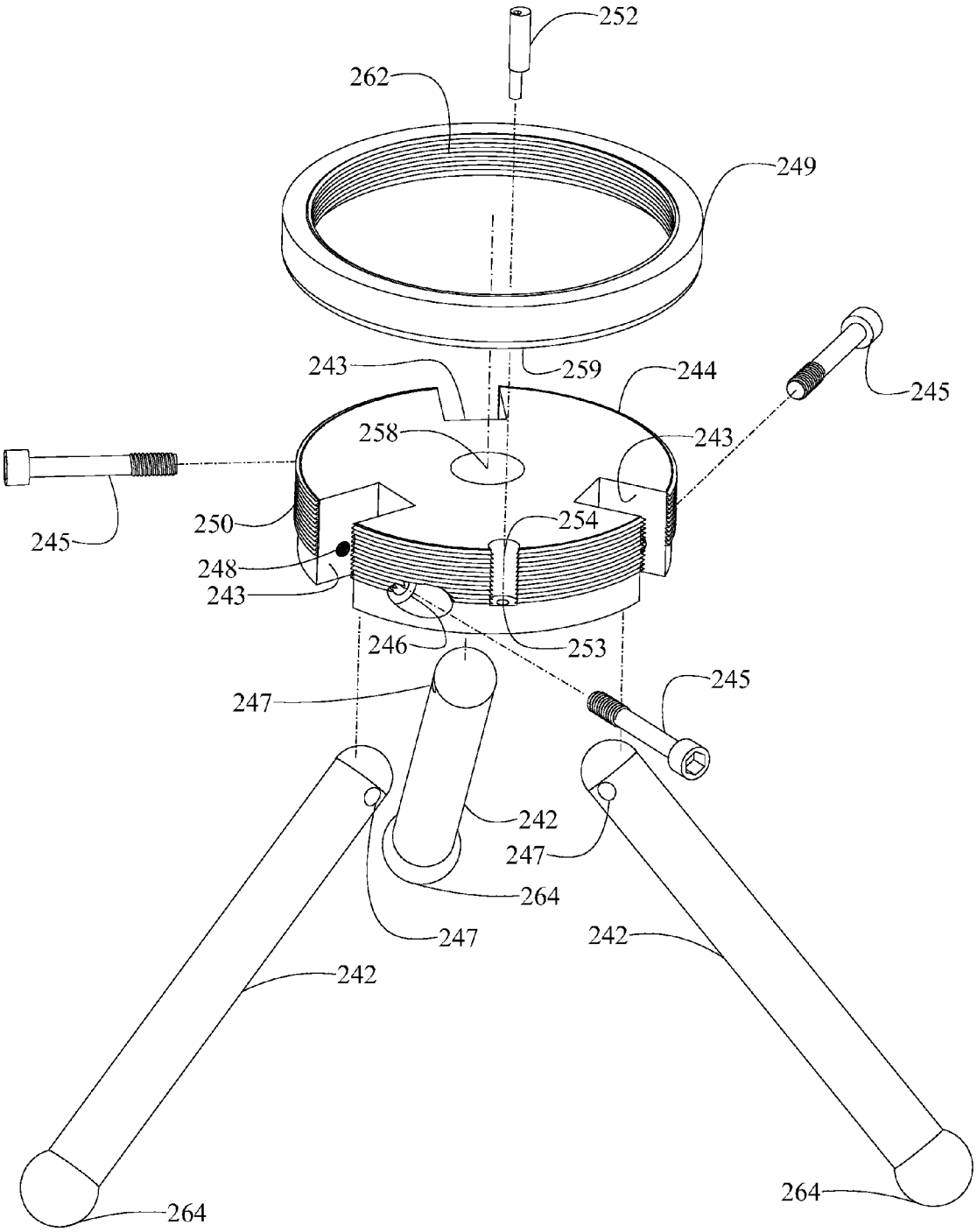
Figure 10D:
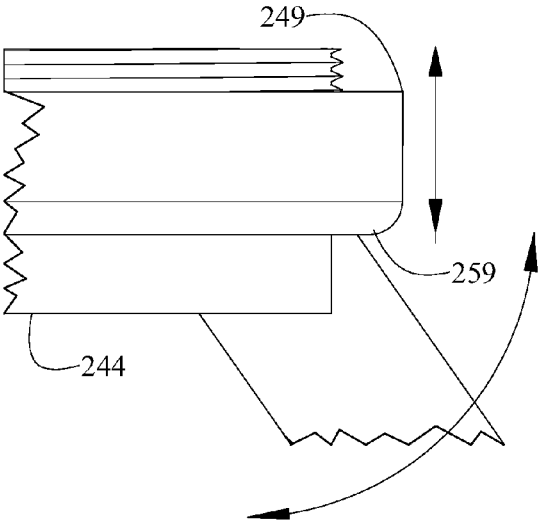
Figure 10E:
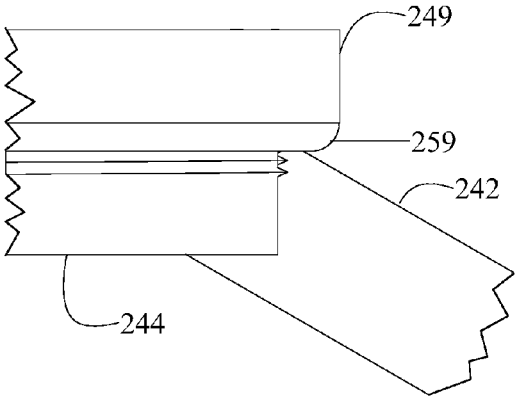
Figure 10F:
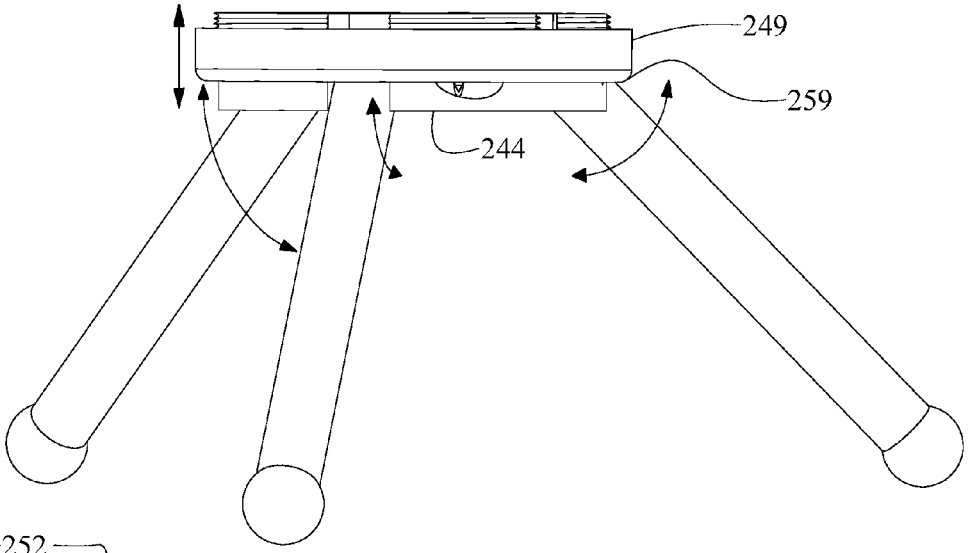
Figure 10G:
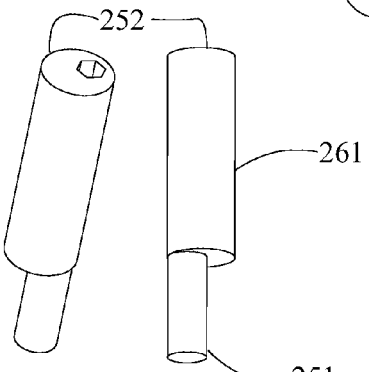
Figure 10H:
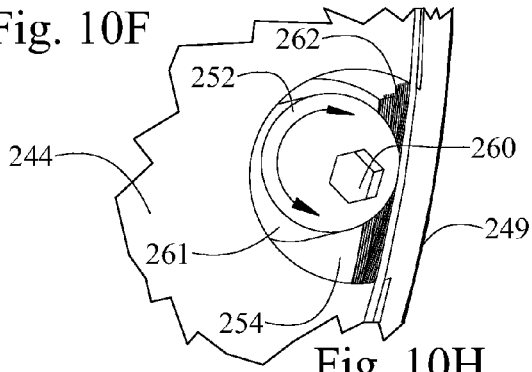
Figure 10I:
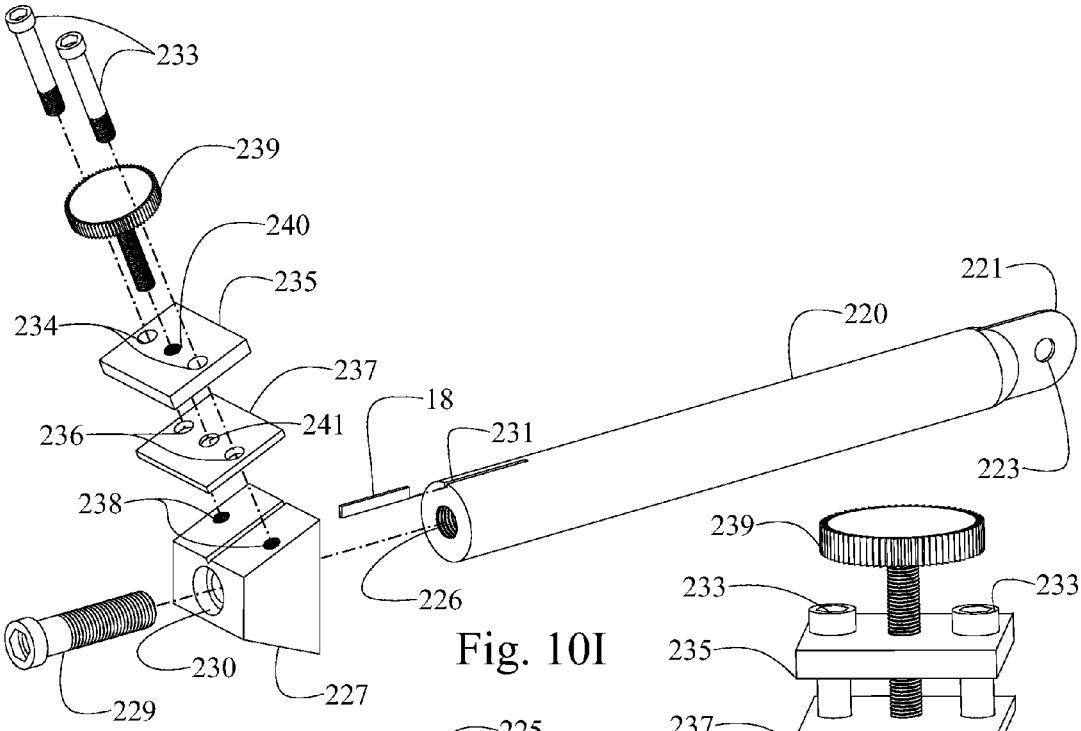
Figure 10J:
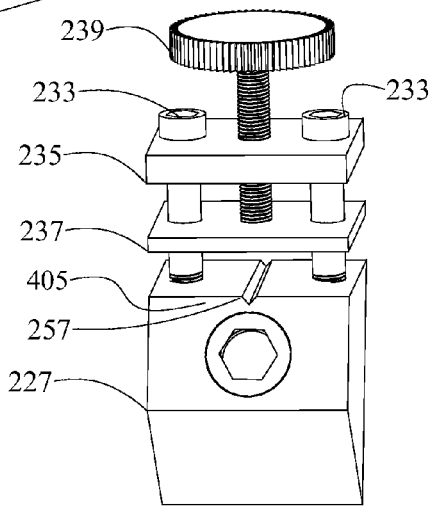
Figure 10K:
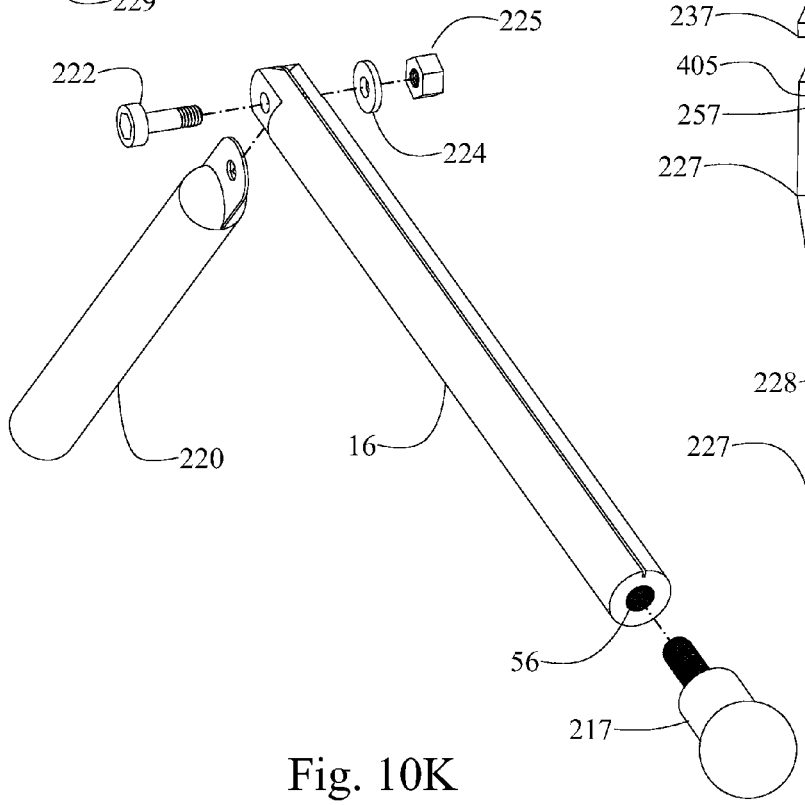
Figure 10L:
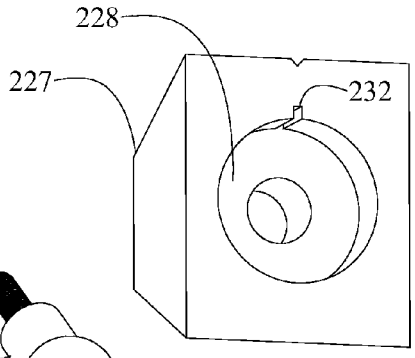
Figure 10M:
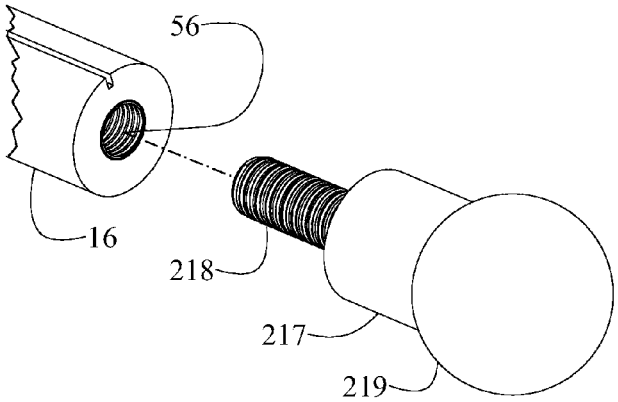
Figure 10N:
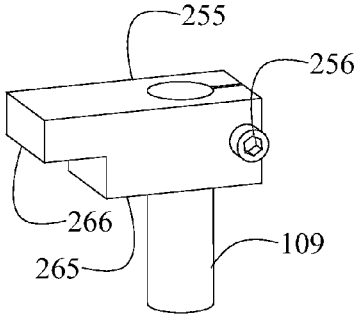
Figure 10O:
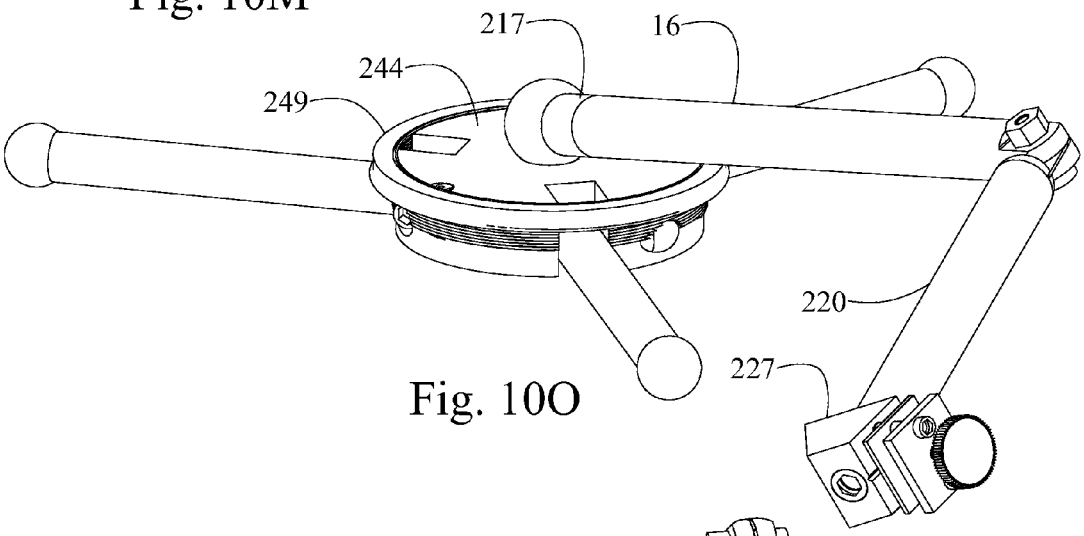
Figure 10P:
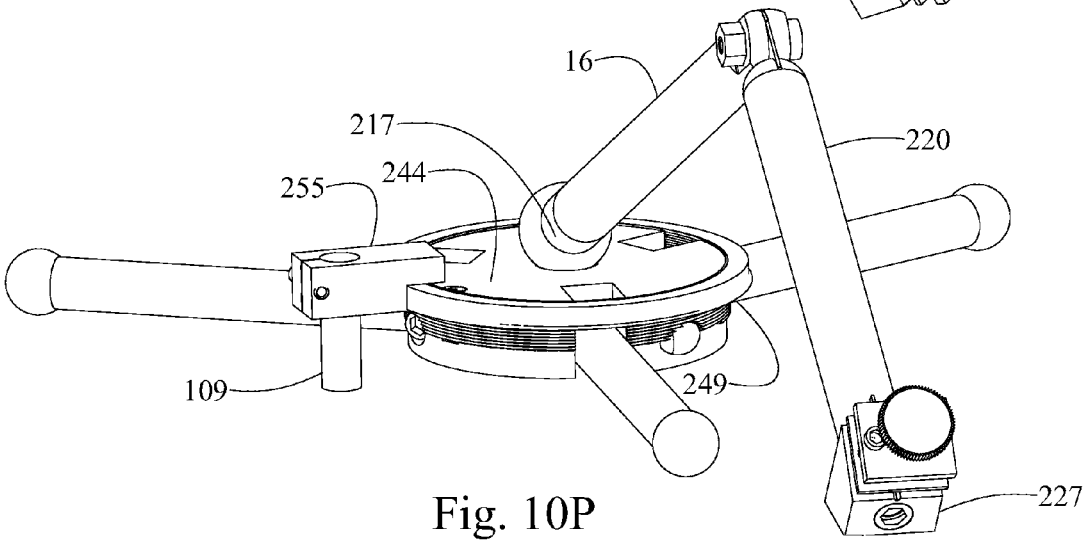
Figure 10Q:
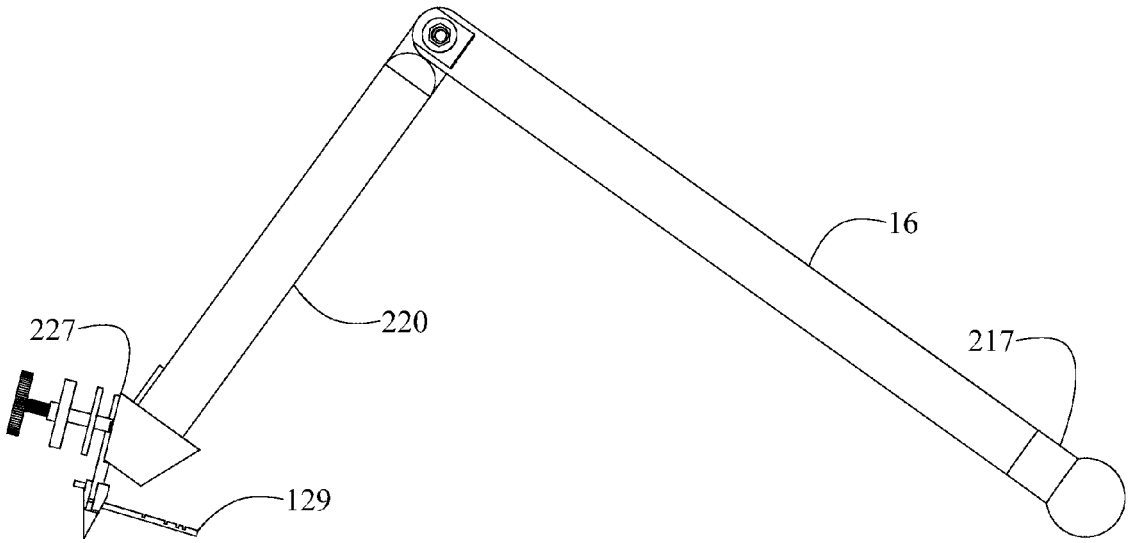
Figure 10R:
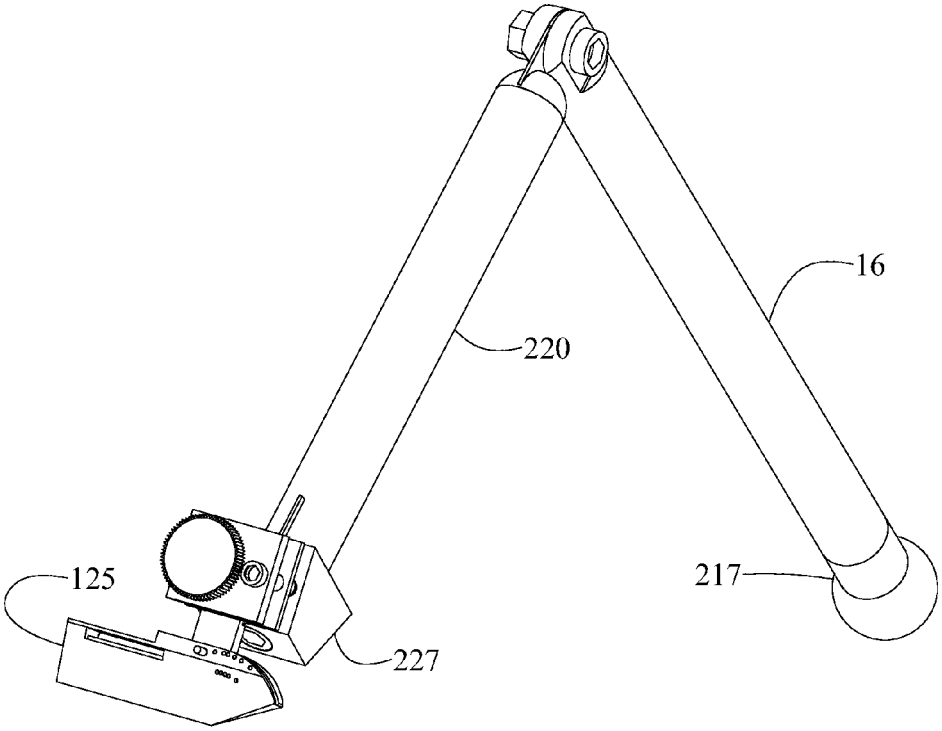

FIGS. 10A Through 10R

Detailed Static Description

FIGS. 10A through 10R show a honing guide configuration for creating a fingernail profile on gouges. FIG. 10A is a view of a fingernail arm assembly nested on a height adjustable base. To assemble the fingernail profile arm assembly, main rod 16 is screwed on to a ball end adapter assembly 217 (FIGS. 10A, 10K, 10M, 10O, 10P, 10Q, 10R). A cylindrical body (FIG. 10M) of ball end adapter assembly 217 is the same diameter as main rod 16. The ball end adapter assembly 217 has a ball-end threaded stud 218 (FIG. 10M) affixed to one end, and a ball 219 (FIG. 10M) affixed to the other end. The ball is either magnetic, such as a spherical neodymium magnet or other type of magnet, or made of other material such as magnetic or non magnetic metal or composite or plastic. If neodymium, ball 219 is affixed to ball end adapter assembly 217 by industrial adhesive, by virtue of a spherical bore on the end of ball end adapter assembly 217 of the same radius as ball 219. If ball 219 is non magnetic, the ball is affixed by welding, brazing, or other industrial adhesive process. To install into main rod 16, the stud is screwed into a main rod end bore 56 (FIGS. 1I, 10K, 10M) in main rod 16.

A fingernail rod 220 (FIGS. 10A, 10I, 10K, 10O, 10P, 10Q, 10R) is then attached to main rod 16 by inserting a tab or fingernail rod tang 221 (FIG. 10I) into a fingernail arm tang slot 57 (FIG. 1J), on the end of main rod 16. A fingernail rod bolt 222 (FIG. 10K), is then inserted through a fingernail arm tang slot bore 58 (FIG. 1K) on the end of main rod 16, and through a fingernail rod tang bore 223 (FIG. 10I). A fingernail rod washer 224 (FIG. 10K), and a fingernail rod nut 225 (FIG. 10K) are then inserted onto fingernail rod bolt 222 and tightened.

On the end of fingernail rod 220 is a fingernail rod threaded bore 226 (FIG. 10I). A fingernail-v tool guide body 227 (FIGS. 10A, 10I, 10J, 10L, 10O, 10P, 10Q, 10R) is placed onto the end of fingernail rod 220, and attached by fitting a fingernail body countersunk bore 228 (FIG. 10L) over the end of fingernail rod 220, and screwing a fingernail body bolt 229 (FIG. 10I) through a fingernail body countersunk mount bore 230 (FIG. 10I), and into fingernail rod threaded bore 226. Key 18 is then used to align fingernail-v tool guide body 227 to a fingernail rod keyway 231 (FIG. 10I) in fingernail rod 220, and a fingernail body keyway 232 (FIG. 10L) in fingernail-v tool guide body 227. Fingernail rod tang 221 is aligned vertically on fingernail rod 220 relative to the radial position of fingernail rod keyway 231.

Fingernail-v tool guide body 227 can also be called a rod end guide body; any guide body that attaches to the end of an elongated member by bolting through a guide body and elongated member in the above manner, can be called a rod end guide body.

A pair of fingernail clamp bolts 233 (FIG. 10I, 10J) are then inserted through a pair of unthreaded clamp plate bores 234 (FIG. 10I) on a thumbscrew mount plate 235 (FIG. 10I, 10J), and through a pair of unthreaded pressure plate bores 236 (FIG. 10I) on a clamp pressure plate 237 (FIGS. 10I, 10J) and then screwed in to a pair of threaded clamp bolt bores 238 (FIG. 10I) in fingernail-v tool guide body 227. A fingernail thumb screw 239 (FIGS. 10I, 10J) is then threaded into a fingernail thumbscrew threaded bore 240 (FIG. 10I) on thumbscrew mount plate 235, into a pressure plate seat 241 (FIG. 10I) in clamp pressure plate 237.

A fully assembled height adjustable base for the fingernail profile arm is shown in FIG. 10B, and an exploded view in FIG. 10C. To assemble the base, three base disk legs 242 (FIG. 10C) are inserted into three base leg notches 243 (FIG. 10C) in a base disc 244 (FIGS. 10A, 10B, 10C, 10D, 10E, 10F, 10H, 10O, 10P). Three base disk leg bolts 245 (FIG. 10C) are then inserted through three unthreaded disk leg bores 246 (FIG. 10C) in base disk 244, through three disk leg unthreaded bores 247 (FIG. 10C) in the ends of base disk legs 242, and tightened into three threaded disk leg bores 248 (FIG. 10C), in base disk 244. Three base disk legs 242 are of similar construction to legs 1, 7 and 8 in that they also have balls affixed to the ends, or machined-in spherical ends. A threaded base disk ring 249 (FIGS. 10A, 10B, 10C, 10D, 10E, 10F, 10H, 10O, 10P) is then screwed onto a threaded outside diameter 250 (FIG. 10C), of base disk 244 (FIG. 10C). A threaded or unthreaded cam lock pin 251 (FIG. 10G) affixed or machined-in on the underside of an eccentric cam lock 252 (FIGS. 10B, 10C, 10G, 10H) is then inserted into a threaded or unthreaded cam lock pin bore 253 (FIG. 10C) at the bottom of a countersunk and partially exposed cam lock bore 254 (FIG. 10C).

A height gauge for the fingernail profile height adjustable base is shown in FIG. 10N. To assemble the unit, height gauge rod 109 is inserted into the slotted clamp bore in a fingernail height gauge 255. The member can then be locked into place with fingernail height gauge bolt 256. Height gauge rod 109 is clamped in fingernail height gauge 255 in the same way that all the other slotted clamps function.

A fingernail body v-groove 257 (FIG. 10J), a spherical cup 258 (FIG. 10B, 10C), a radiused underside-base disk ring 259

(FIGS. 10C, 10D, 10E, 10F) a top surface of base disk ring 263 (FIG. 10B), a cam lock hex socket 260 (FIG. 10H), a cam lock outside diameter 261 (FIG. 10G, 10H), an underside of fingernail gauge 265 (FIG. 10N), and an underside step 266 (FIG. 10N) are discussed in the following operational section.

FIGS. 10A Through 10R

Detailed Operational Description

To operate the fingernail profile configuration, the user first clamps a gouge onto the surface of fingernail-v tool guide body 227 by inserting the underside of a gouge over a fingernail body v-groove 257. Fingernail thumb screw 239 is then tightened. The end of the rod on the thumbwheel presses pressure plate seat 241 and applies pressure to clamp pressure plate 237. Thus pressure is applied to the top of a gouge such that the gouge aligns to fingernail rod 220 by virtue of fingernail body v-groove 257.

The bevel angle of the fingernail profile arm assembly is then set for the tool. This angle can be set in at least three ways, all of which are accomplished by resting both the ball end of ball end adapter assembly 217 and the tool edge on a work surface, with fingernail rod bolt 222 slightly loosened. Fingernail arm tang slot 57, fingernail rod tang 221, fingernail rod tang bore 223, fingernail rod nut 225 and fingernail rod bolt 222 create a lockable hinge or joint, which allows the user to align or position the rod configuration to match, maintain or change a bevel angle at a tool-edge, and lock the bevel angle into place. The user can use one of the multi-faceted angle gauge blocks described in the detailed static and operational Sections 2 and 3. This is done by placing a gauge block (shown in FIG. 3A or 3B), for a desired angle against both front edges, or top of the U shape on the gouge, while high angle block base 81 is resting on a work surface. When both upper edges of the gouge are touching a face of an angle gauge block, the arm assembly is then perpendicular to a work surface, and fingernail rod bolt 222 is tightened, and a bevel angle is locked into place. A second method is by clamping cut edge simulator 125 assembly to the surface of fingernail-v tool guide body 227. The width of calibration mount plate 134 for the cut edge simulator is exactly half the width of the distance between the outside diameters of two fingernail clamp bolts 233. Facing the front of the arm assembly, the left edge of calibration mount plate 134 is butted up against fingernail clamp bolts 233 on the left side of the arm assembly (in other words, fingernail clamp bolt 233 is used as a fence). Calibration plate protrusion fence 161, on calibration mount plate 134 is then butted up against the front of fingernail-v tool guide body 227. This allows the edge of calibration mount plate 134 to align over fingernail body v-groove 257, such that cut edge simulator 125 is square to the arm assembly. Thus skew anchor point 144 of the cut edge simulator assembly is aligned with the center line of the v groove, and rests on the same plane that the surface of fingernail-v tool guide body 227 lies on. The bevel angle of the cut edge simulator is then set as described in Section 5; pivot edge on 129, and cut edge simulator edge 154, when both are resting on a work surface, and when the ball end 219 is resting on a work surface, will set the arm assembly perpendicular to work surface. Fingernail rod 220 is clamped, and the bevel angle for the arm assembly is set. FIGS. 10Q and 10R show the fingernail profile arm assembly with the previous cut edge simulator installed, and with 129 setting the bevel angle, and cut edge simulator 125 set for a 0° skew. A third way to set the bevel angle is to hold the assembly perpendicular to a work surface and align visually the existing bevel angle of a clamped in tool edge with a work surface, and tighten fingernail rod 220.

Once the bevel angle of the fingernail arm assembly is set, the height adjustable base is set to match the height of an abrading surface. The purpose of the height adjustable base is three fold. First, it matches the relative height of the point of contact that ball 219 makes with the bottom of a spherical cup 258 to the height or thickness of an abrading surface. Thus, allowing the ability of the user to move from abrading surfaces of differing heights or thicknesses, without affecting the previously set bevel angle. Secondly, the height adjustable base provides a cradle for ball 219. The arm assembly is thus able to swing such that uniform and smooth motion and operation are the result. The third function of the base is to act as a swing stop. Once the outside diameter of main rod 16 comes into contact with the surface of base disk 244 at the bottom of the swing, a full swing has been attained, and the user then rocks the arm back in the other direction. The depth of spherical cup 258 is sized such that at the bottom of the swing of the arm assembly, main rod 16 can rest on the surface of base disk 244 while the ball is still fully seated in spherical cup 258.

If the height or thickness of an abrading surface is less than the distance from a work surface to the bottom of a spherical cup 258, then an abrading surface will need to be placed on an elevated surface to bring it up to the level of the base. For abrading surfaces equal to or higher than the minimum height capability of the base, no elevation is needed for an abrading surface. Elevating the height provides clearance for the front of fingernail-v tool guide body 227, if a full swing of 180° is desired.

To raise or lower the height of the fingernail profile height adjustable base, the user simply turns threaded base disk ring 249 to raise or lower base disk legs 242. As the ring is screwed downward, a radiused underside-base disk ring 259 of threaded base disk ring 249 presses against the outside diameters of three base disk legs 242, and thus forces the legs downward, thus raising the height of base disc 244 and thus spherical cup 258. Screwing threaded base disk ring 249 upward lowers the height of the base disc. When a top surface of base disk ring 263 is flush with the top surface of base disk 244, the legs are parallel to base disk 244 and the base is at its lowest height capacity. Once a desired height is set, the ring can be locked into place by cam lock 252. The user inserts an Allen wrench into a cam lock hex socket 260 of cam lock 252 and rotates cam lock 252 within cam lock bore 254. A cam lock outside diameter 261 on cam lock 252 is off center or eccentric from the axis of rotation of cam lock pin 251, and thus as cam lock 252 is rotated, cam lock outside diameter 261 comes into contact with base disk ring inside diameter threads 262 (FIGS. 10C, 10H) of threaded base disk ring 249, thus locking both threaded base disk ring 249, and thus the height of the base, into place.

The diameters of base disk legs 242, the thickness of the ring wall and thus radiused underside-base disk ring 259, the thickness of base disk 244, placement of unthreaded disk leg bores 246 and threaded disk leg bores 248 are sized and located such that when top surface-base disk ring 263 of threaded base disk ring 249 is flush with the top surface of base disk 244, base disk legs 242 are parallel to base disk 244 top surface. When the legs are thus parallel, the ball (or machined in) spherical leg ends 264 (FIG. 10C) slightly elevate the base from a work surface, equal to the dimensional differential between the radius of the legs, and the radius of the balls. Base disk legs 242 could be swapped in as substitutes for the height adjust members that were discussed in the previous Sections 4 and 5, if made the same diameter.

To match the height of the lowest point of spherical cup 258, to the height or thickness of the first abrading surface used, an underside of fingernail gauge 265 of fingernail height gauge 255, is placed on an abrading surface, and the end of height gauge rod 109 slid down to contact a work surface. The member is then locked into place by fingernail height gauge bolt 256 and the height differential is locked in. Then the gauge is brought adjacent to base disc 244, and threaded base disk ring 249 is turned until an underside step on fingernail gauge 266 comes into contact with base disk 244. The step distance from underside of fingernail gauge 265 to underside step on fingernail gauge 266 represents the differential distance between the surface of base disk 244, and the depth of spherical cup 258. Thus the bottom of the adjustable spherical cup 258 (and not the surface of base disk 244) is aligned to an abrading surface, since the ball was used to calibrate the arm configuration on the work surface.

To switch from abrading surfaces of different heights or thicknesses while honing, underside of fingernail gauge 265 is placed on the higher abrading surface, and the end of height gauge rod 109 on the lower surface, the height differential is registered on fingernail height gauge 255, and thus the base adjusted as described in the previous.

Once the base height has been set and gouge installed into the arm assembly, the user can then hone a gouge. This is accomplished by nesting ball 219 into spherical cup 258, and rocking the arm back and forth on the base, while moving the base on a work surface in a random manner, and moving the tool tip across an abrading surface in a random manner. The balls provide low friction allowing the base to glide easily on most work surfaces. FIGS. 10O and 10P show two positions of the arm assembly as it is being rocked back and forth while resting on the base. When an abrading surface is swapped out for a new surface with a differing thickness or height, the process of adjusting the base height is repeated, to match that base height to an abrading surface height such that the bevel angle of the tool tip is maintained. If honing on surfaces of equal thickness, the height need not be changed after the first adjustment.

If ball 219 as provided is magnetic, such as neodymium or other spherical magnetic material, base disk 244 is metallic such that the ball can magnetically attach to base disk 244. The purpose of ball 219 being magnetic would be purely as a convenience to the user, since lifting the arm off of a work surface would also take the base with it. The magnetic ball is not for purpose of positioning in any way. If the ball is non magnetic, base disk 244 can be of a non magnetic material. If base disk 244 is non magnetic, such would not affect the operation of the arm assembly, since the slight downward force applied to the arm as it is going through the swing motions would provide sufficient pressure to maintain ball 219 cradled in spherical cup 258 at all times during use.

Figure 11E:
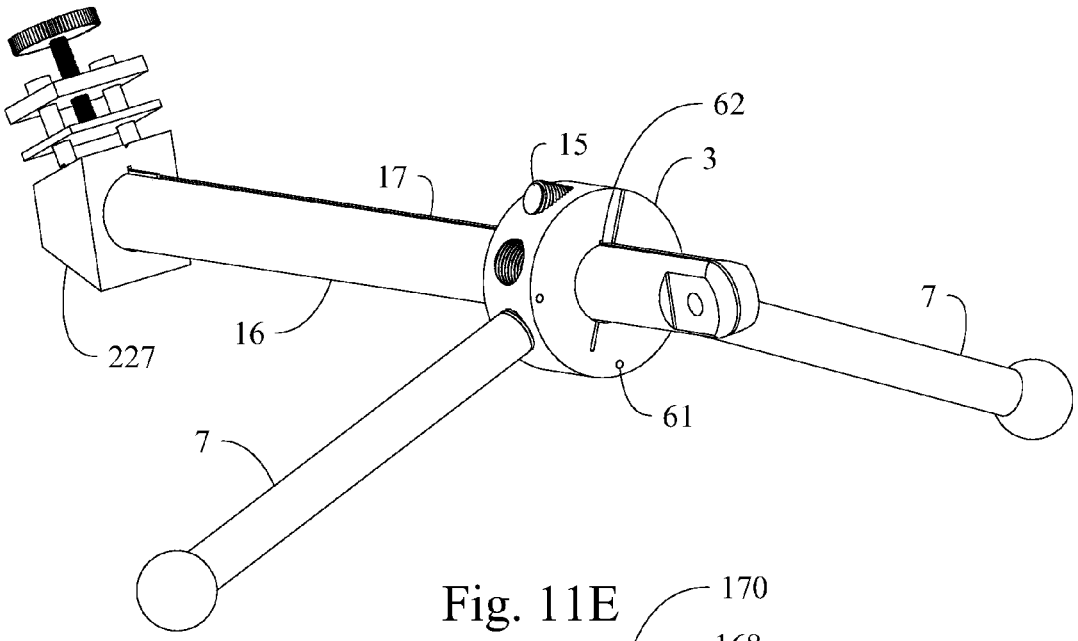
FIGS. 11A to 11P show a honing guide body assembly configuration for V tools, and a v-tool mount plate used with the cut edge simulator and the v tool configuration.
Figure 11F:
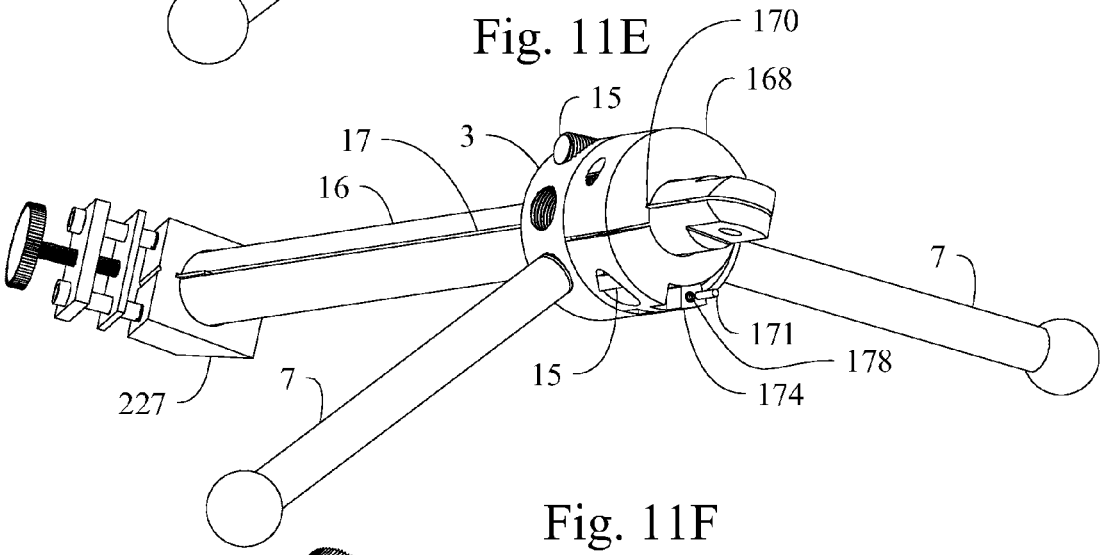
Figure 11G:
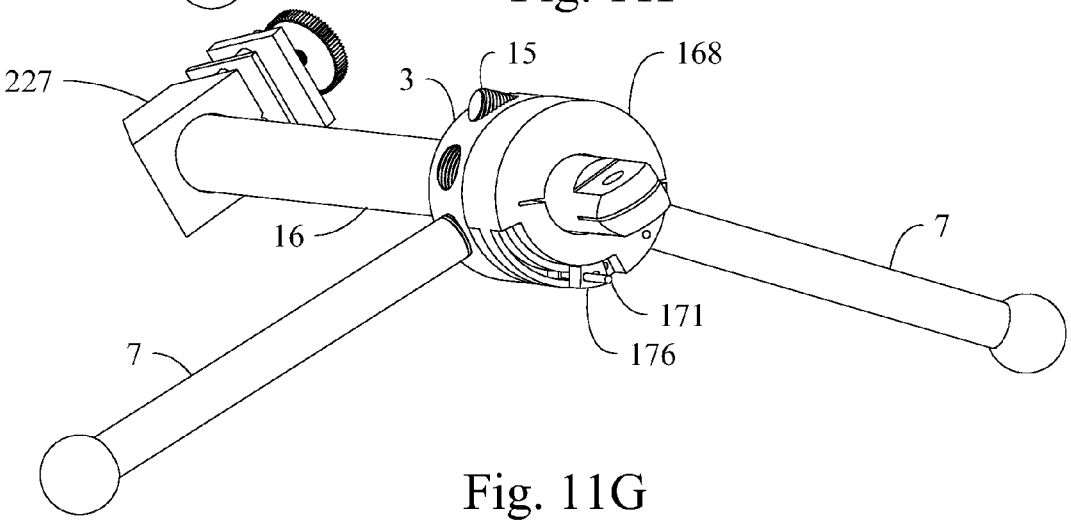
Figure 11H:
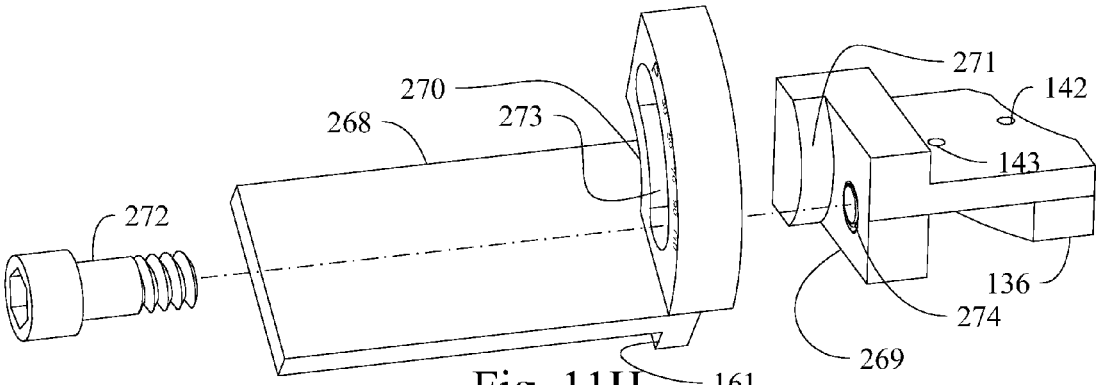
Figure 11I:
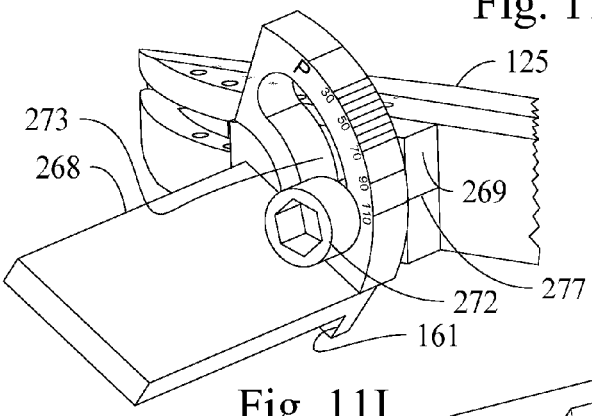
Figure 11J:
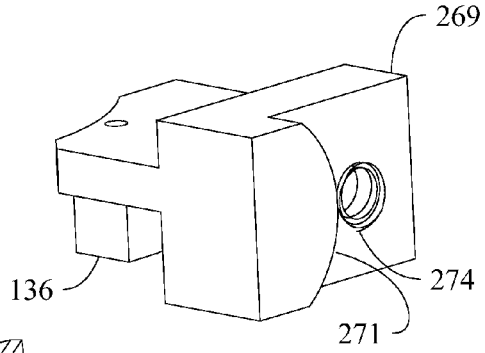
Figure 11K:
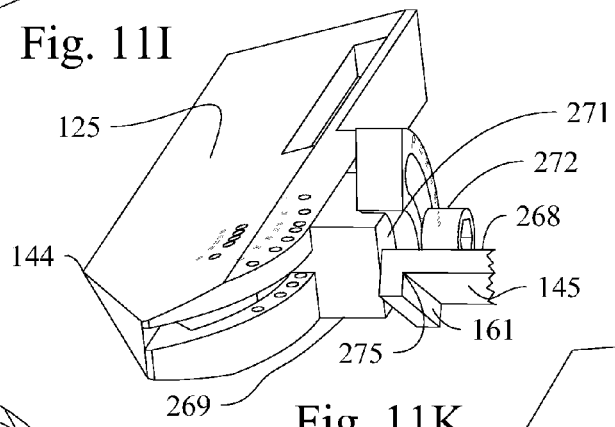
Figure 11L:
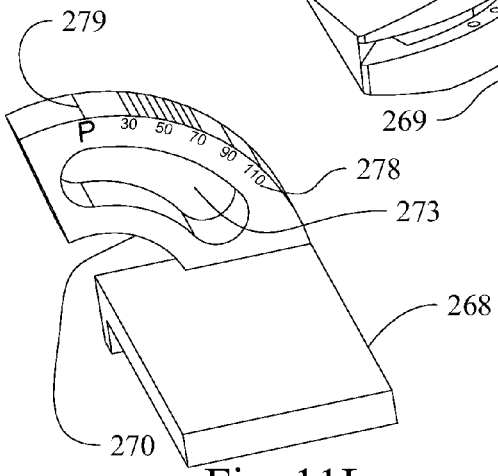
Figure 11M:
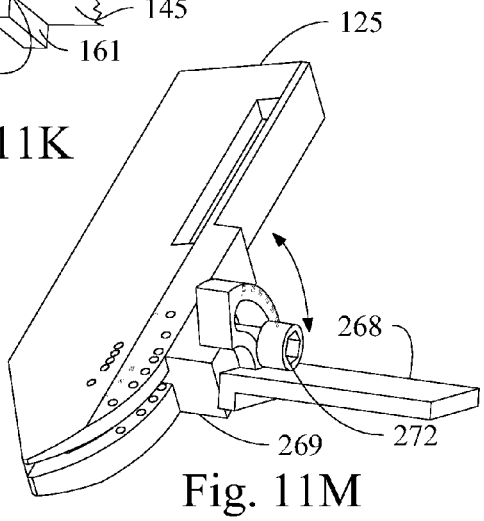
Figure 11N:
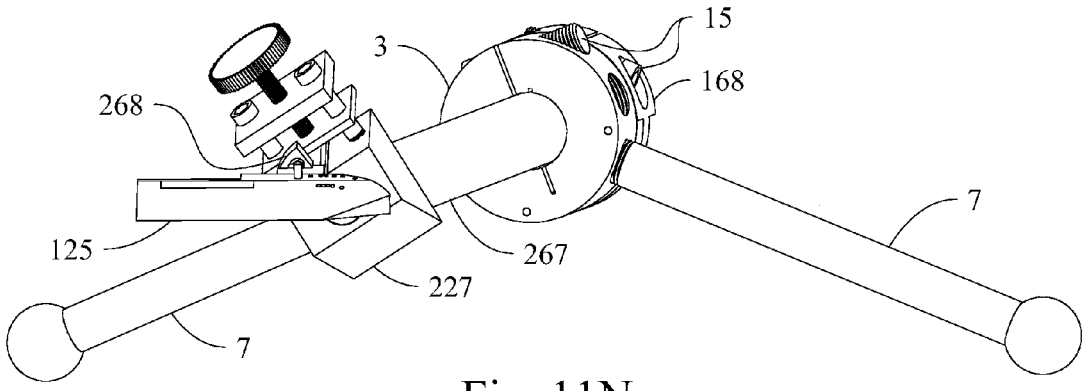
Figure 11O:
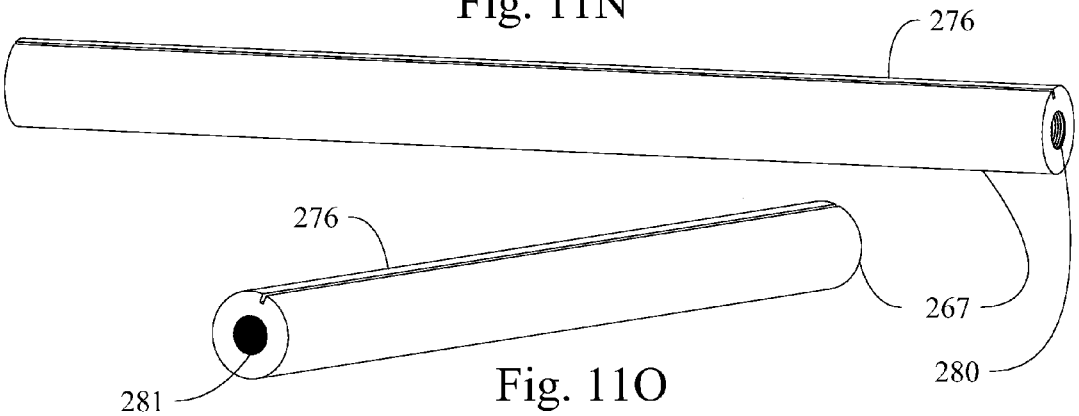
Figure 11P:
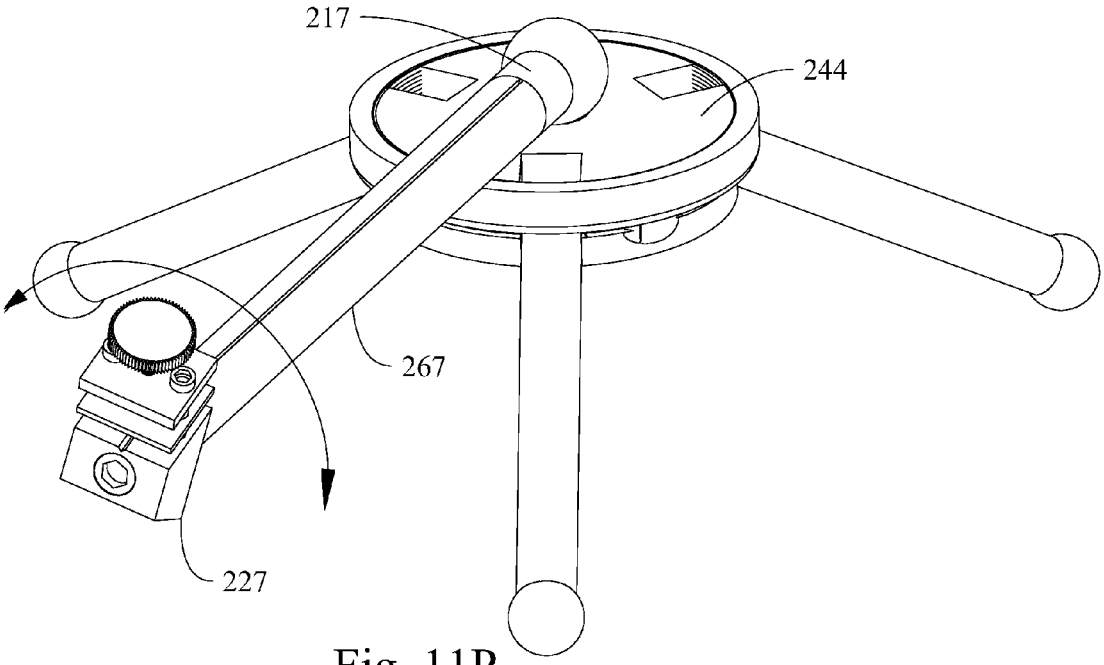

FIGS. 11A Through 11P

Detailed Static Description

FIG. 11A shows as members of a configuration, the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous.

FIG. 11D shows as members of a configuration, the same members as in the previous paragraph, with the exception of long legs 7 in lieu of legs 1, and a v-tool rod 267 (FIGS. 11C, 11D, 11N, 11O, 11P) which is an elongated member such as a rod or bar in place of main rod 16. V-tool rod 267 can be used in any of the previous configurations, except the configuration shown in FIGS. 10A through 10R In this configuration, instead of using keyway 17, a v-tool leg collar keyway 62 (FIG. 11D, 11E) is used.

Assembly of the honing guide elongated support base member system was described in detail in the previous static section of 1A through 1P, and the same procedure applies for these two configurations as in the previous, with the following exceptions. Fingernail-v tool guide body 227 is installed to either main rod 16 (FIG. 11B) or to v-tool rod 267 (FIG. 11C), with fingernail body bolt 229. In the configuration of FIG. 11D, the long legs 7 are screwed into threaded leg bores 5 and v-tool threaded leg collar bore 59, instead of threaded leg bores 4 and 5.

If skew-bevel registration collar 168 assembly is used with this configuration, the same assembly procedure applies to this configuration as in the static portion of Sections 6 and 7. Assembly for fingernail-v tool guide body 227 and the related components was also described in detail in the static portion of Section 10 and the same procedure applies for this configuration as described in the previous. If the user is sharpening or honing on abrading surfaces of differing heights or thicknesses, the same assembly procedure for the height adjust members in the detailed static portion of 5 applies.

A v-tool cut edge simulator mount plate 268 (FIGS. 11H, 11I, 11K, 11L, 11M) and a v-tool cut edge simulator body mount 269 (FIGS. 11H, 11I, 11J, 11K, 11M) are assembled by fitting a v-tool cut edge simulator inner radius 270 (FIGS. 11H, 11L), onto a v-tool cut edge simulator radial stop 271 (FIGS. 11H, 11J, 11K), and threading a v-tool cut edge simulator lock bolt 272 (FIGS. 11H, 11I, 11K, 11M) through a v-tool cut edge simulator radius slot 273 (FIGS. 11H, 11I, 11L) and into a v-tool cut edge simulator threaded bore 274 (FIGS. 11H, 11J) on v-tool cut edge simulator body mount 269. On the end of v-tool cut edge simulator body mount 269, on which mount plate upper skew hole 142, mount plate lower skew hole 143 and radius track 136 are located, such are numbered the same as in FIG. 5G, since they serve the same function. V-tool cut edge simulator body mount 269 is mounted into cut edge simulator 125 using the same procedure as previously discussed in the static portion of Section 5. V-tool cut edge simulator mount plate 268 provides an additional axis of rotation (compared to calibration mount plate 134), along a line which runs through skew anchor point 144 (FIG. 5A), and a reference point for rotation axis 275 (FIG. 11K), which is a corner between calibration plate protrusion fence 161 (FIG. 11K), and mount plate surface 145, on the left edge (looking towards the rear of cut edge simulator 125) of v-tool cut edge simulator mount plate 268.

A v-tool rod keyway 276 (FIG. 11D, 11O), v-angle indicator markings 278 (FIG. 11L), a v-tool rod threaded bore 280 (FIG. 11O) and a v-tool rod threaded bore 281 (FIG. 11O) are discussed in the following operational section.

FIGS. 11A Through 11P

Detailed Operational Description

If the user is sharpening or honing on abrading surfaces of differing heights or thicknesses, the same operational procedure for the height adjust members in the detailed operational portion of Section 5 applies.

To sharpen or hone a V-tool, the tool is first installed onto the surface of fingernail-v tool guide body 227. The V point, or underside of the tool edge where the two chisels meet, are aligned to fingernail body v-groove 257 on the body surface. The tool is then clamped onto fingernail-v tool guide body 227 by turning fingernail thumb screw 239 such that clamp pressure plate 237 clamps down onto the top two edges of the chisels of the V tool, and secures the tool to the body.

FIGS. 11A and 11D show two of a multitude of configurations that are possible for honing or sharpening V tools. Leg collar 3 can be slid along the length of main rod 16 or v-tool rod 267, while rotating either member in the leg collar bore, (and thus fingernail-v tool guide body 227) to increase or decrease the bevel angle, and to match the v angle on one side of the tool. For V tools, if the user is not using the skew collar or the cut edge simulator or the angle blocks, in order to meet the angle on both sides of the V shape of the tool edge, leg collar 3 is slid and rotated along either rod, while checking at eye level a work or abrading surface where the tool edge is resting. Once the beveled edge of the tool is flush with either a work surface or abrading surface, and the bevel angle is met, leg collar bolt 15 can be tightened to lock the setting for the tool edge into place. Once this angle is met the user can then hone the tool edge. This process is repeated for the other side of the V tool edge.

If using skew-bevel registration collar 168 assembly, see FIGS. 11E, 11F, 11G. Once the bevel and v angles for the tool tip have been met on one side of the V profile, and the configuration locked into place with leg collar bolt 15 and one side of the V honed, the user aligns skew collar keyway 170 on skew-bevel registration collar 168 to keyway 17 on main rod 16 using key 18, or v-tool rod keyway 276 (if v-tool rod 267 is used instead of main rod 16), and locks skew-bevel registration collar 168 into place on either main rod 16 or member 267 with leg collar bolt 15. Since threaded leg bores 5 and v-tool threaded leg collar bore 59 on leg collar 3 are being used in this configuration, v-tool skew registration hole 61 (FIG. 11E) on leg collar 3 is used as a reference point to register the radial position of leg collar 3 relative to keyway 17. This is because v-tool skew registration hole 61 is an equal radial distance away from both threaded leg bores 5 and v-tool threaded leg collar bore 59—with respect to the center point of leg collar-rod bore 9, and is positioned 180° away from v-tool leg collar keyway 62.

Skew plate lock bolt 178 is then loosened, skew pin plate hole-unthreaded plate 173 and skew pin plate hole-threaded plate 175 are rotated by skew registration pin 171 to meet v-tool skew registration hole 61, the pin is inserted into skew pin plate hole-unthreaded plate 173, skew pin plate hole-threaded plate 175 and v-tool skew registration hole 61 and skew plate lock bolt 178 is tightened to lock the pin holes in place to register the location of v-tool skew registration hole 61. Skew-bevel registration collar 168 is then removed from main rod 16 (or v-tool rod 267), and rotated 180° and re installed back onto the member such that the opposite face of skew-bevel registration collar 168 contacts the face of leg collar 3. Skew collar keyway 170 is then re aligned with keyway 17 or v-tool rod keyway 276, and leg collar bolt 15 on skew-bevel registration collar 168 is tightened while both leg collar 3 and skew-bevel registration collar 168 are flush or butted up against each other—FIG. 11G.

Leg collar bolt (or thumbscrew) 15 in leg collar 3 is then loosened and either main rod 16 or v-tool rod 267 are rotated such that v-tool skew registration hole 61 meets skew pin plate hole-unthreaded plate 173 and 175. Skew registration pin 171 is then inserted into all three holes to align, and leg collar bolt 15 is tightened on leg collar 3 while holding leg collar 3 flush to skew-bevel registration collar 168. The user can now hone the opposite side of the V tool, and both the bevel and V angles of the v tool on the second side are a mirror image of the previously sharpened side.

FIGS. 11H through 11M show the v-tool cut edge simulator mount plate 268, v-tool cut edge simulator body mount 269, and v-tool cut edge simulator lock bolt 272. The purpose of these three members is to provide the user repeatable calibration of a v tool configuration for bevel, skew and V-angles for the cutting edge of V-tools, prior to clamping v-tools to fingernail-v tool guide body 227. These members are also useful for parting tool applications. For curved shafted v-tools, either visually setting the tool edge using the previously described can be used, or the static and operational portions of Section 2 for the multi faceted angle gauge block can be applied to curved (or straight) shafted v tools. Section 2 could also be used for straight shafted V tool configurations if the user desires. A facet on a multi faceted angle block can be positioned next to the cutting edge of a curve shafted gouge, and the top edges of the shank close to the cutting edge on the gouge could be sighted down or "eyeballed" to align as closely as possible with the plane of the facet while setting the bevel angle of the jig.

To calibrate a v tool configuration to match a bevel angle and a V angle for a V tool, v-tool cut edge simulator mount plate 268 is clamped to fingernail-v tool guide body 227 in exactly the same way as described in the operational portion of Section 10: A difference in the use of v-tool cut edge simulator mount plate 268 compared to the previous, is to set the V angle of the configuration. V-tool cut edge simulator lock bolt 272 is loosened, and cut edge simulator body 125 and v-tool cut edge simulator body mount 269 are rotated such that a cut edge simulator body mount v-angle reference mark 277 (FIG. 11I) is aligned to v-angle indicator markings 278. Tool protrusion settings are covered in detail in section 18.

The actual angle that v-tool cut edge simulator mount plate 268 is rotated is 180° minus the V angle of the V tool, divided by two. This is because the v tools are clamped in their upright positions onto fingernail-v tool guide body 227. For example, a 90° v tool, when clamped upright, the actual angle that makes the V is 90°. But a vertical centerline drawn between the two chisels of the V edge makes a 45° angle towards either side of the V. So to calibrate a configuration for one side or one chisel of a 90° V, cut edge simulator 125 is rotated 45°. Or, for a V tool with a 45° V, a rotation of 67.5° is done to meet one side of the V—since the narrower V is closer to the vertical centerline and thus further away from a perpendicular to that centerline. It is the perpendicular to the centerline of the V that c-clamp trunnion nut slot 285 is being rotated towards to meet. Therefore v-angle indicator marks 278 do not correspond directly to the actual degree of rotation, but rather the previous angular relationship described. When using this v tool configuration with cut edge simulator 125, it calibrates a configuration to one side of the V. Meeting the other side of the V is accomplished with skew-bevel registration collar 168 as previously described, after the v tool has been sharpened on one side of the V and the user is ready to hone the other side. FIG. 11N shows a parting tool configuration with the cut edge simulator 125, in use with the v-tool cut edge simulator mount plate 268 and v-tool cut edge simulator body mount 269 assembly clamped in.

Parting tool "P" mark-90 degree set 279 (FIG. 11L) adjacent to v-angle indicator marks 278 is the setting for use with the parting tool configuration. This sets cut edge simulator 125 in a 90° vertical position relative to v-tool cut edge simulator mount plate 268, which is useful for setting bevel and skew angles for parting tools, since v-tool cut edge simulator mount plate 268, and parting tool shanks are clamped vertically in the parting tool guide body.

The V-tool rod 267 is multi purpose. It can be used in the previous configurations and can also be used as shown in FIG. 11P with the height adjustable base. V-tool rod threaded bore 280 and v-tool rod threaded bore 281 allow installation of fingernail-v tool guide body 227 on one end, and ball end adapter assembly 217 on the other end. This configuration could be useful in some applications for honing the "keel" of v-tools, which is the v point, or the point on the underside of the tool where the two v chisels meet. This point can be rounded off and formed as a tiny chisel by rotating v-tool rod 267 while moving the tool across an abrading surface.

FIGS. 12A Through 12I

Detailed Static Description

Figure 12A:
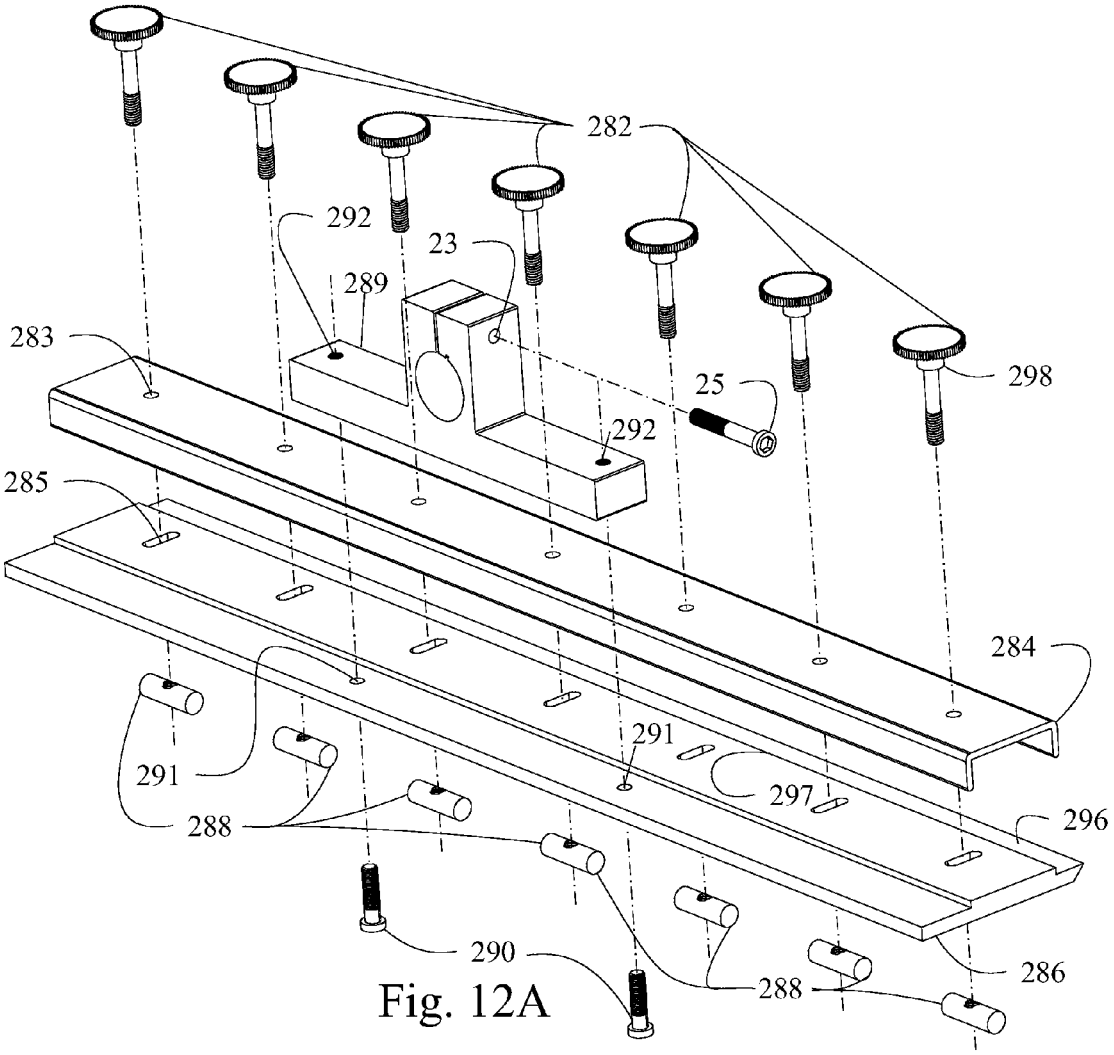
FIGS. 12A to 12I show a honing guide body assembly configuration which can be used for the sharpening or honing of long narrow power planer blades.

FIG. 12A shows a power plane blade clamp assembly. To assemble the clamp, a plurality of planer blade clamp thumbscrews 282 (FIGS. 12A, 12B, 12E) are inserted into a plurality of planer clamp unthreaded bores 283 (FIG. 12A) in a planer blade c-clamp 284 (FIGS. 12A, 12B, 12H, 12I), through a c-clamp trunnion nut slot 285 (FIGS. 12A, 12C, 12D) in a planer blade clamp base 286 (FIGS. 12A, 12B, 12C, 12D, 12E, 12H, 12I), and screwed into a plurality of planer trunnion nut bores 287 (FIG. 12F) in a plurality of planer trunnion nuts 288 (FIGS. 12A, 12B, 12E, 12F). A planer blade guide body 289 (FIGS. 12A, 12G, 12H, 12I) is then bolted to planer blade clamp base 286 by inserting a pair of planer body base plate bolts 290 (FIG. 12A) through a pair of unthreaded planer body-base bores 291 (FIG. 12A) in planer blade clamp base 286, and into a pair of threaded planer body mount bores 292 (FIGS. 12A, 12G) in planer blade guide body 289.

The clamp assembly in FIG. 12A is then installed onto main rod 16 (or v-tool rod 267). See FIGS. 12H and 12I. Since a guide body rod clamp slot 293 (FIG. 12G) on planer blade guide body 289 is vertical, keyway 17 can not be placed in the usual vertical position, if using a two leg base configuration. Therefore a secondary guide body keyway 294 (FIG. 12G) has been located off vertical in planer blade guide body 289 to make way for the clamp slot. A secondary leg collar keyway 60 (FIG. 1N) on leg collar 3, is used with secondary guide body keyway 294. The alignment of these two keyways is such that both base leg ends are able to contact a work surface, when any blade is clamped in a zero skew position in this configuration.

Guide body main clamp bolt 25, is then inserted into unthreaded guide body clamp bore 23 (FIG. 12A), and tightened to threaded guide body clamp bore 24 (FIG. 12G) as described in the previous configurations.

Note that since power plane blades are so long and provide additional stability, that the one leg configuration of 12I can also be used, since for power plane blades, no skew angle is involved, and the function for the base in this configuration is to set bevel angles. In this case, leg collar 3 and secondary leg collar keyway 60 can be used with threaded leg bore 4, since in this position, secondary leg collar keyway 60 is radially separated from 4 by 180 degrees, and provides a zero skew position.

If the user is sharpening or honing on abrading surfaces of differing heights or thicknesses, the same assembly procedure for the height adjust members in the static portion of Section 4 also applies to this configuration. If using the one leg configuration of FIG. 12I, the difference would be that the height adjust members would be installed onto one leg, and adjusted accordingly as described in the previous.

A planer blade clamp seat 296 (FIGS. 12A, 12B), a planer blade fence 297 (FIGS. 12A, 12B), a planer thumbwheel flange 298 (FIGS. 12A, 12B), a c-clamp top surface 299 (FIG. 12B), a c-clamp radiused clamp edge 300 (FIG. 12B), trunnion nut rotation 301 (FIG. 12B) and a radiused edge hinge action 302 (FIG. 12B) are discussed in the following operational section.

FIGS. 12A through 12I

Detailed Operational Description

To use this configuration to sharpen power planer blades, planer blade clamp thumbscrews 282 are loosened and a power plane blade is inserted onto a planer blade clamp seat 296, and is butted up against a planer blade fence 297. The thumbwheels are then tightened such that a wider portion of the outside diameter, or a planer thumbwheel flange 298 on planer blade clamp thumbscrews 282, press down onto a c-clamp top surface 299 of planer blade c-clamp 284, of which a c-clamp radiused clamp edge 300 on planer blade c-clamp 284 presses against the top surface of the blade being clamped into place against planer blade clamp seat 296.

Figure 12B:
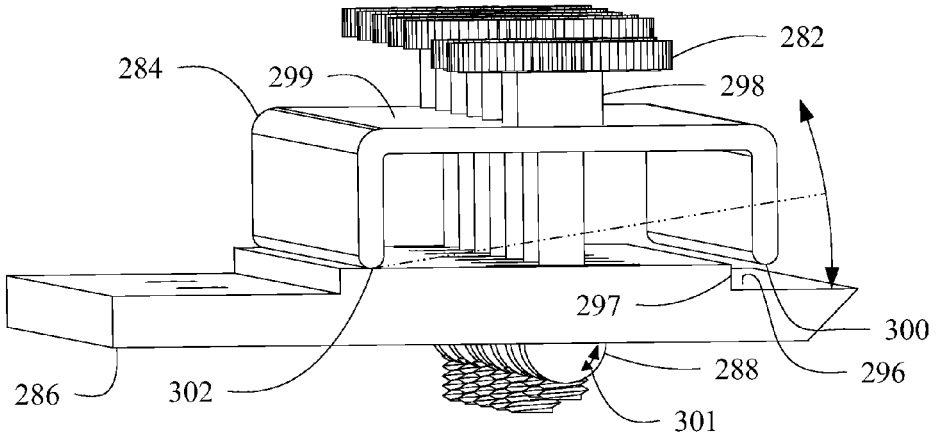
Figure 12C:
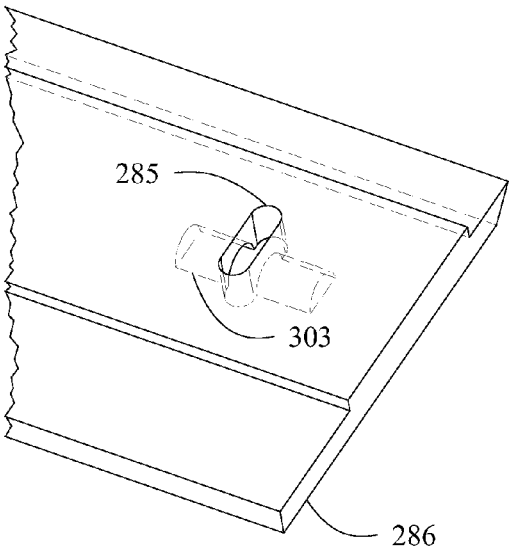
Figure 12D:
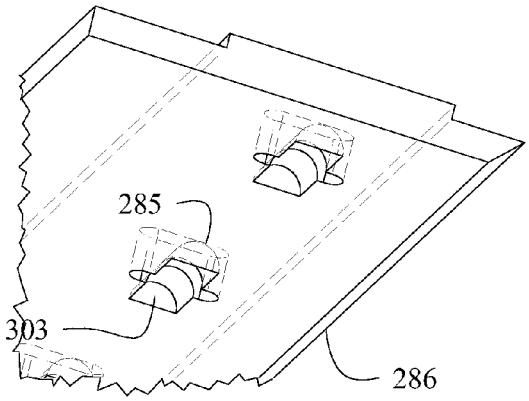
Figure 12F:
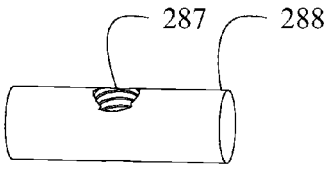
Figure 12E:
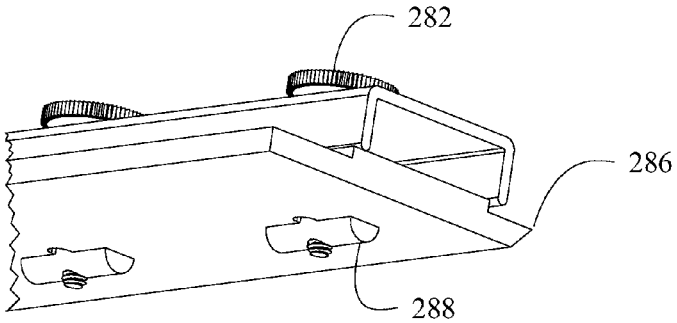
Figure 12G:
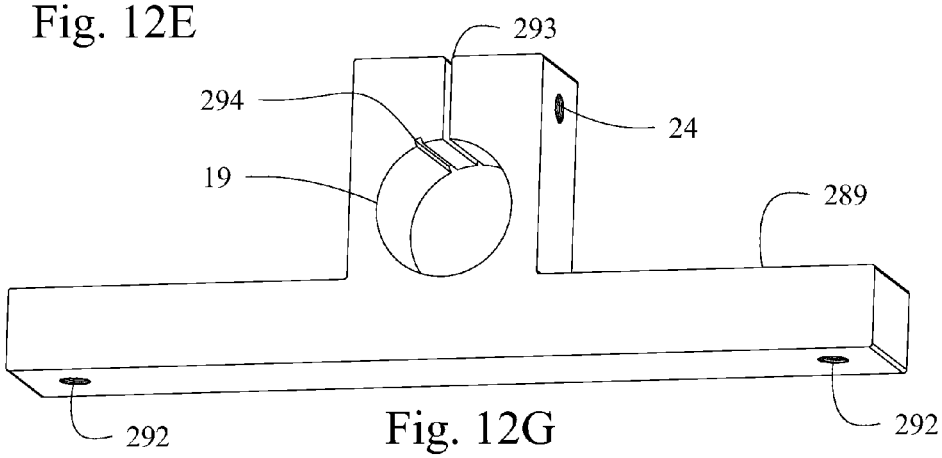
Figure 12H:
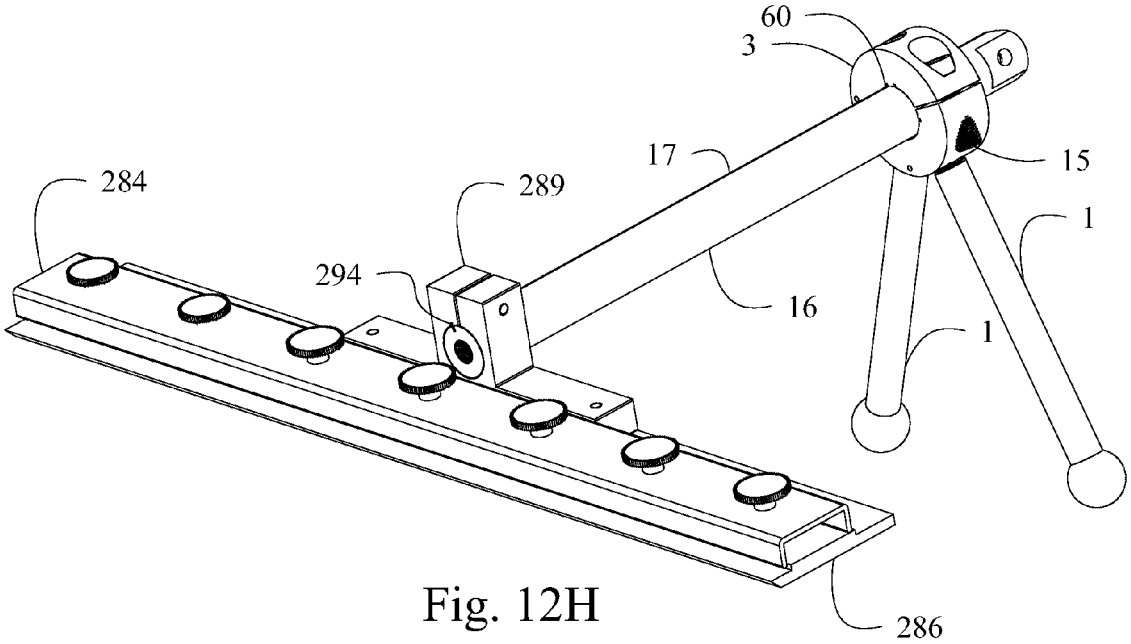
Figure 12I:
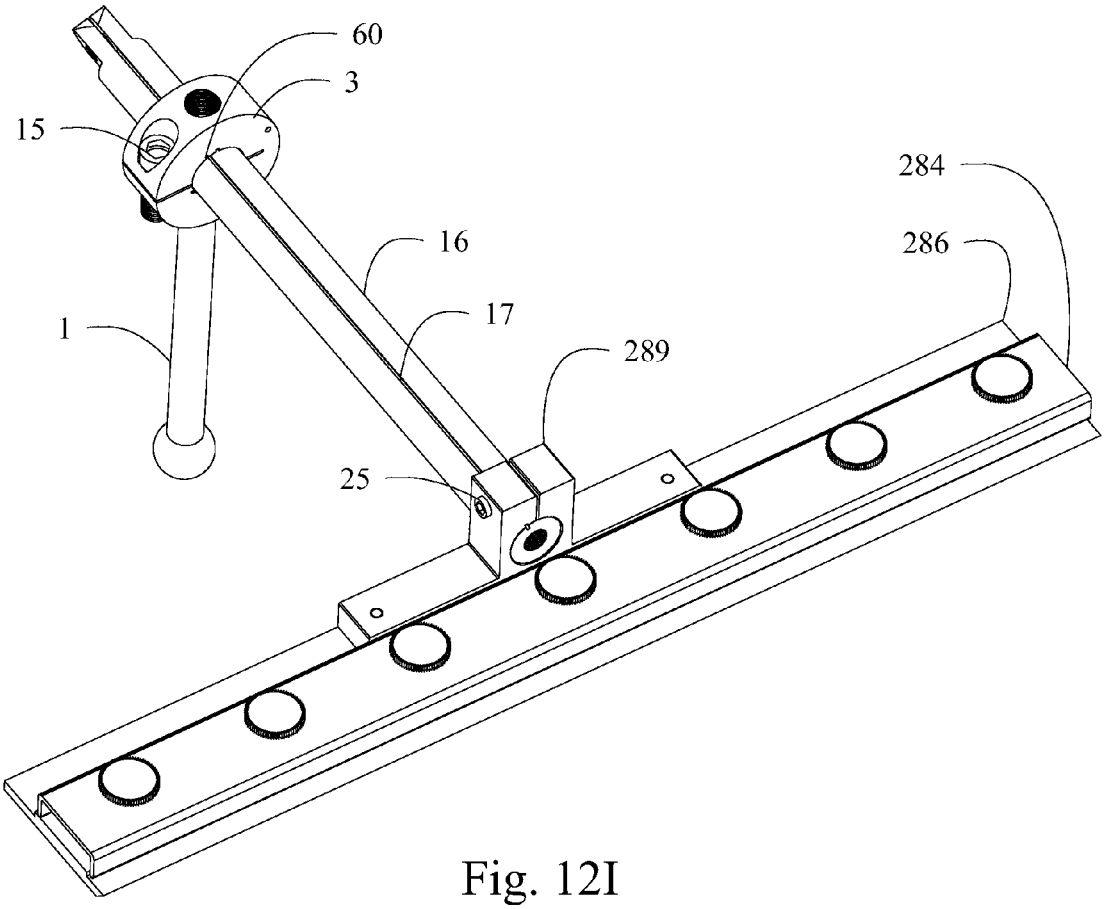

Planer blade c-clamp 284 is able to slightly rock forward or tilt towards the top blade surface—or tilt downward toward planer blade clamp seat 296, and acts in a hinge like fashion to adjust to the blade thickness—see FIG. 12B and the angle of rotation indicated by trunnion nut rotation 301 indicating rotation of the trunnion nuts. This is accomplished by virtue of a radiused edge hinge action 302, and trunnion nuts 288. Trunnion nuts 288 are housed on the underside of planer blade clamp base 286 in ½ cylinder trunnion sockets 303. They are held and clamped upward against the cylindrical surface of planer blade clamp base 286 by planer thumbwheel flanges 298. C-clamp trunnion nut slot 285 allow the thumbwheel shafts to slightly rock or tilt forward toward the blade, and backwards, as the thumbwheels are tightened or loosened respectively. Since the thumbwheels are able to rock by virtue of the trunnion nuts and radiused edge hinge action 302, planer thumbwheel flange 298 is able to maintain full contact with c-clamp top surface 299 and provide even clamping pressure onto planer blade clamp seat 296, and also able to allow planer blade c-clamp 284 to rock freely to easily adjust for variable blade thicknesses.

To set the bevel angle for power planer blades, at least two methods can be used. Either visually at eye level between a work surface and a cutting edge, leg collar 3 can be adjusted to meet the existing bevel angle of a cutting edge in a similar manner as described previously. Or a multi faceted angle gauge block in Sections 2 and 3 can be held against a blade while leg collar 3 is moved along member 2 to adjust the bevel angle of the cutting edge. If the user is sharpening or honing on abrading surfaces of differing heights or thicknesses, the same operational procedure for the height adjust members in the detailed operational portion of Section 4 also applies to this configuration.

Figure 13A:
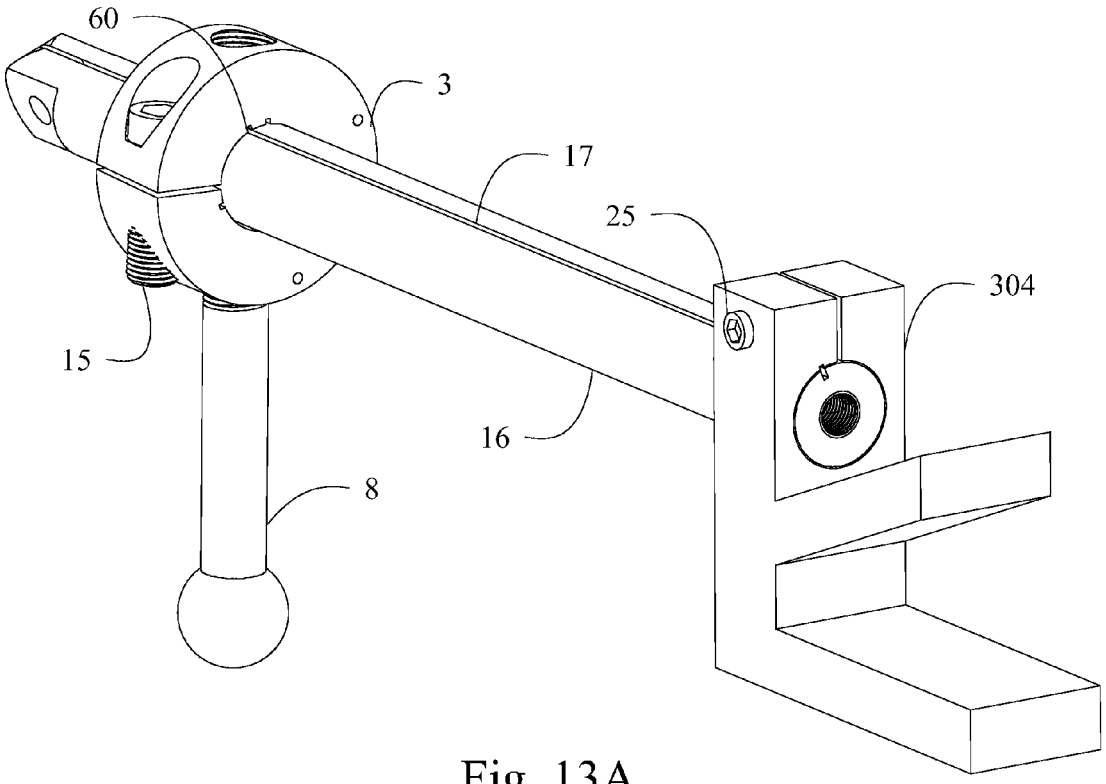
FIGS. 13A and 13B show a honing guide body assembly configuration which can be used for the sharpening or honing of hatchets or axe heads.
Figure 13B:
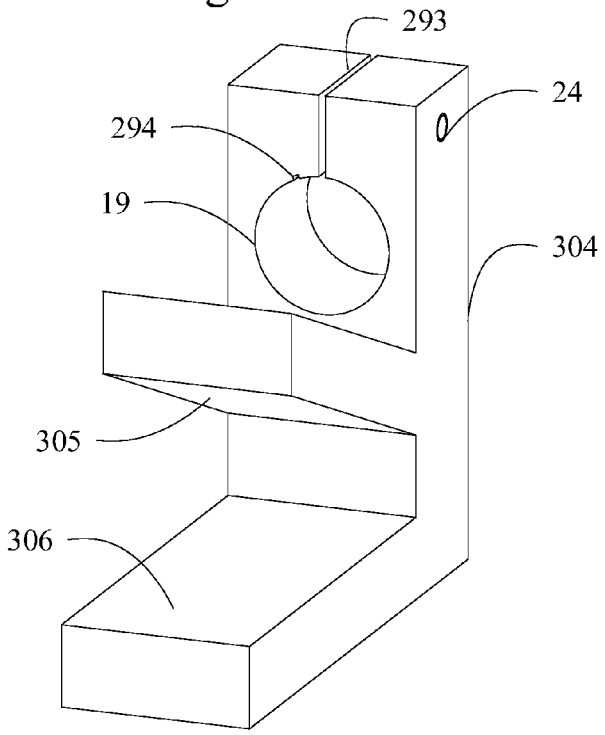

FIGS. 13A and 13B

Detailed Static Description

A hatchet guide body 304 (FIGS. 13A, 13B) is inserted onto the end of main rod 16, through guide body main rod bore 19, and secondary guide body keyway 294 (FIG. 13B) is aligned with main rod 16 keyway 17 using key 18. Guide body clamp bolt 25 is then tightened through vertical guide body rod clamp slot 293 to threaded guide body clamp bore 24, to clamp hatchet guide body 304 onto main rod 16.

Keyway 17 on main rod 16 is then aligned to secondary leg collar keyway 60 on leg collar 3 using key 18. Short leg 8 is now perpendicular to hatchet guide body 304 and the configuration is ready to sharpen a hatchet. In this configuration, shorter leg 8 is used. Any of three legs 1, 7 or 8 can be used in this and many of the other configurations.

If the user is sharpening or honing on abrading surfaces of differing heights or thicknesses, the same assembly procedure for the height adjust members in the static portion of Section 4 also applies to this configuration. A difference in this configuration would be that the height adjust members would be installed onto one leg, and adjusted accordingly as described in the previous.

A lower hatchet jaw 306 (FIG. 13B) and an upper hatchet jaw 305 (FIG. 13B) are discussed in the following operational section.

FIGS. 13A and 13B

Detailed Operational Description

A hatchet blade is inserted onto a lower hatchet jaw 306, and held in place by hand while nested between lower hatchet jaw 306 and an upper hatchet jaw 305. Leg collar 3 can then be adjusted along main rod 16 as described previously to set a desired bevel angle for a hatchet cutting edge, and then locked into place with leg collar bolt 15. Then with a steady rocking motion, a hatchet and the configuration are rocked while a cutting edge of a hatchet is passed over an abrading surface. Upper hatchet jaw 305 is an aid to keep the spine of a hatchet nested into the guide body, while the operators hand holds a lower hatchet jaw 306 while passing the hatchet cutting edge over an abrading surface, or honing stone or whetstone and following the curvature of the cutting edge on an abrading surface.

FIGS. 14A Through 14H

Detailed Static Description

Figure 14A:
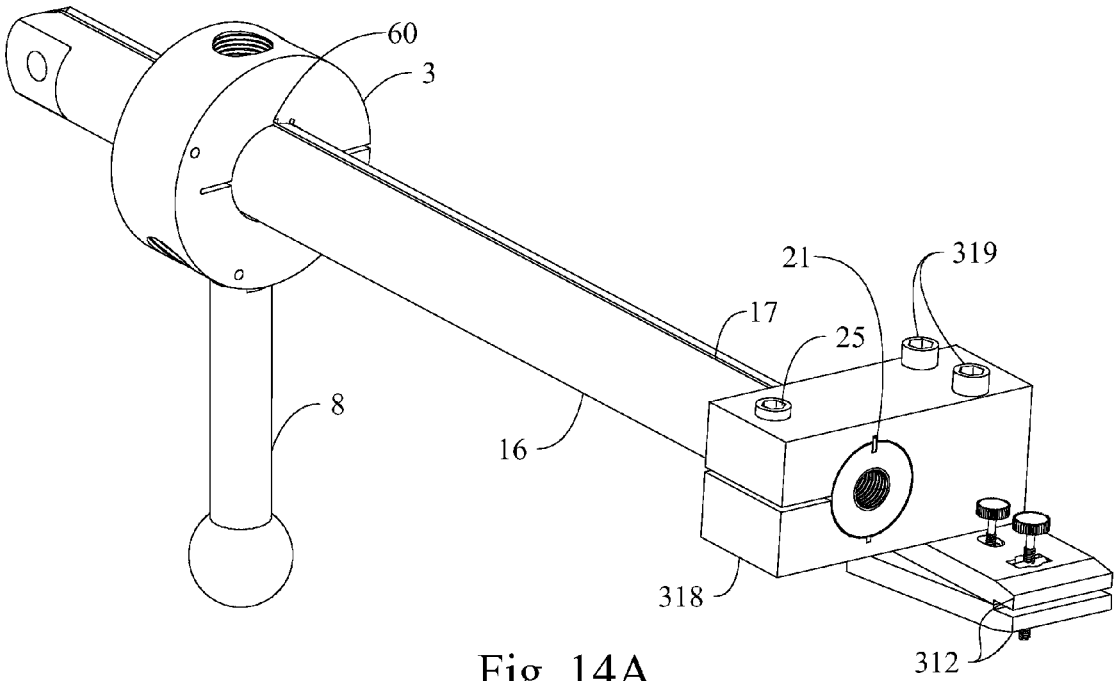
Figure 14B:
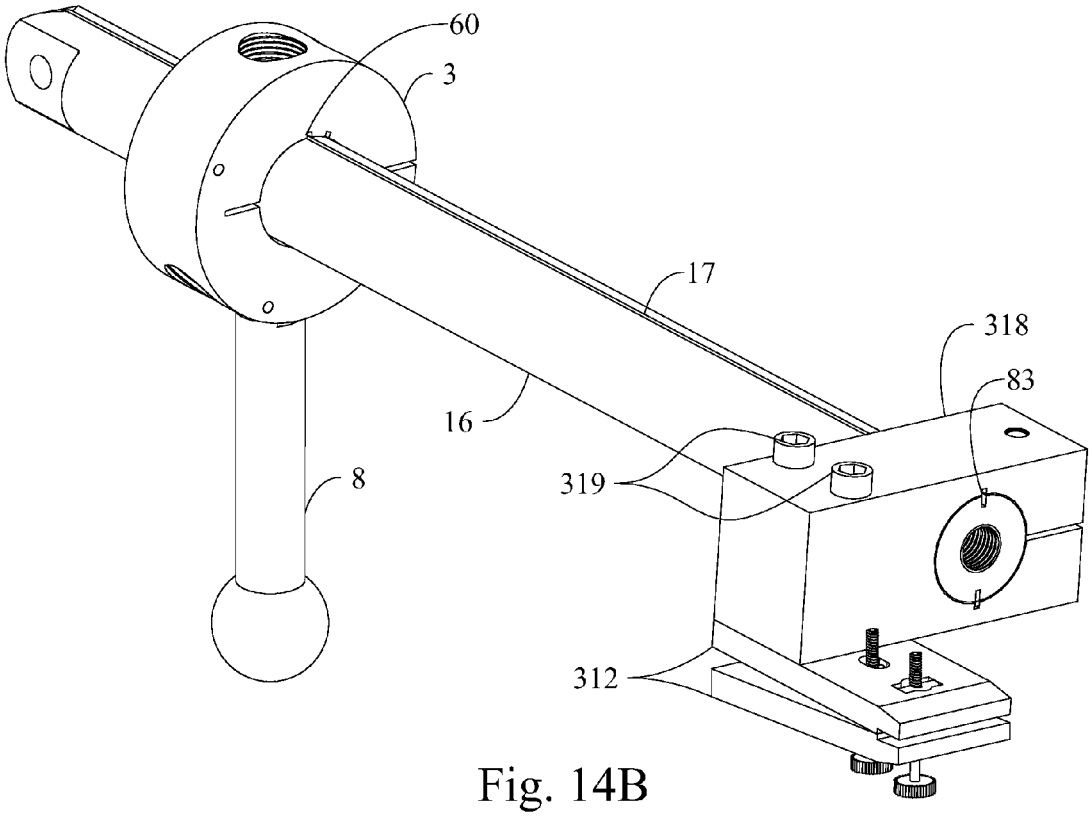
Figure 14D:
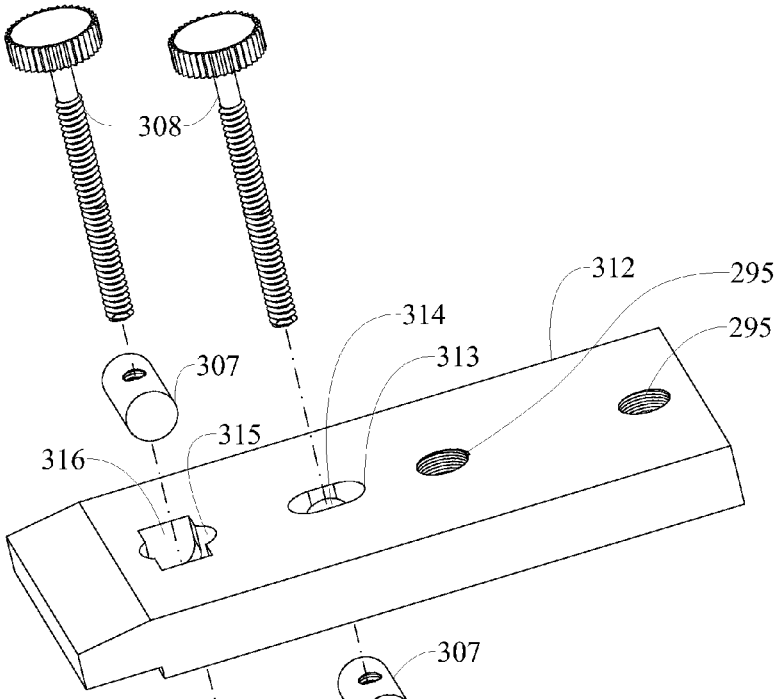
Figure 14D:
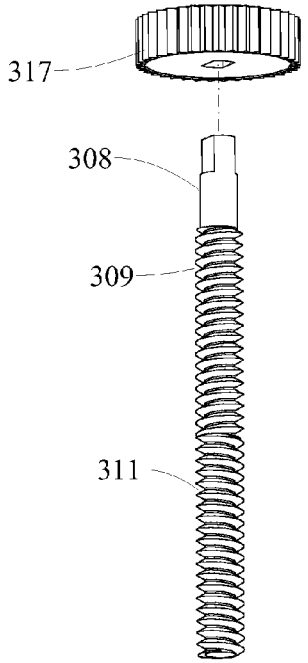
Figure 14C:
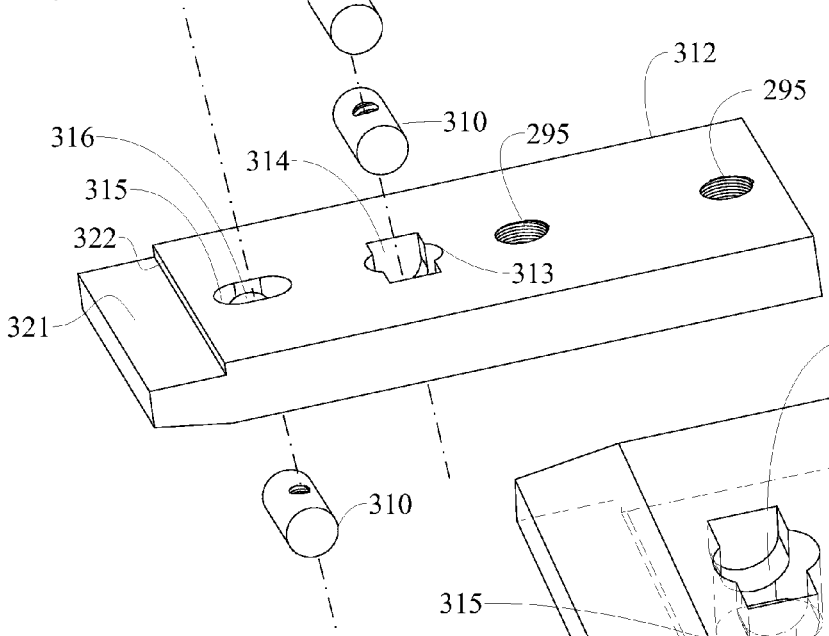
Figure 14E:
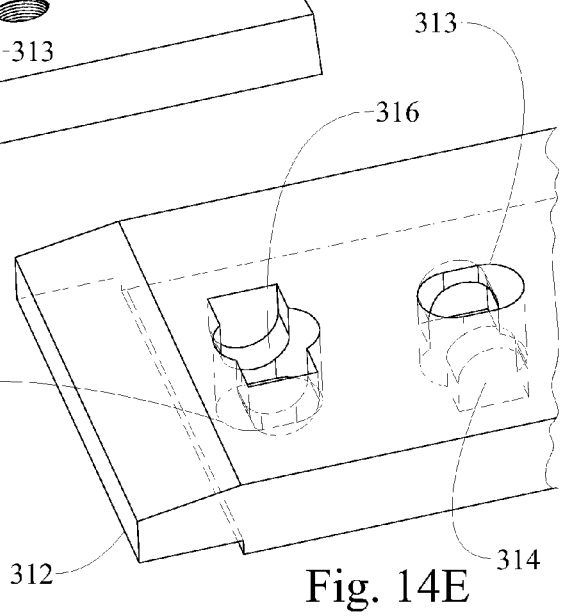
Figure 14F:
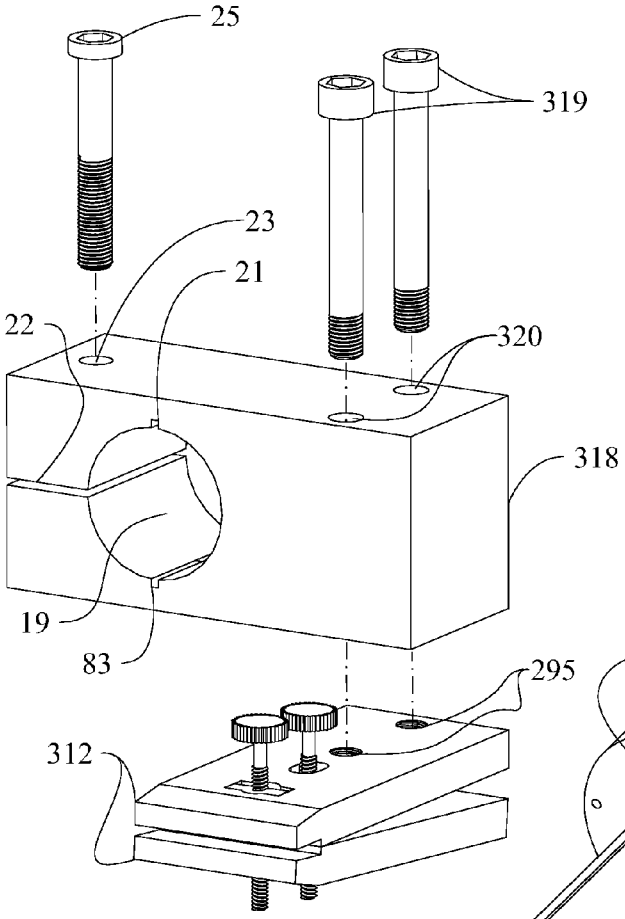
Figure 14H:
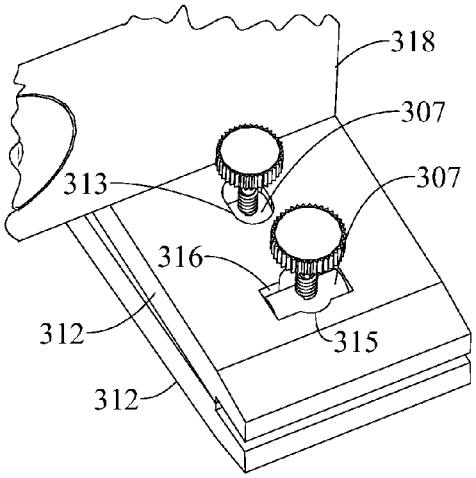
Figure 14G:
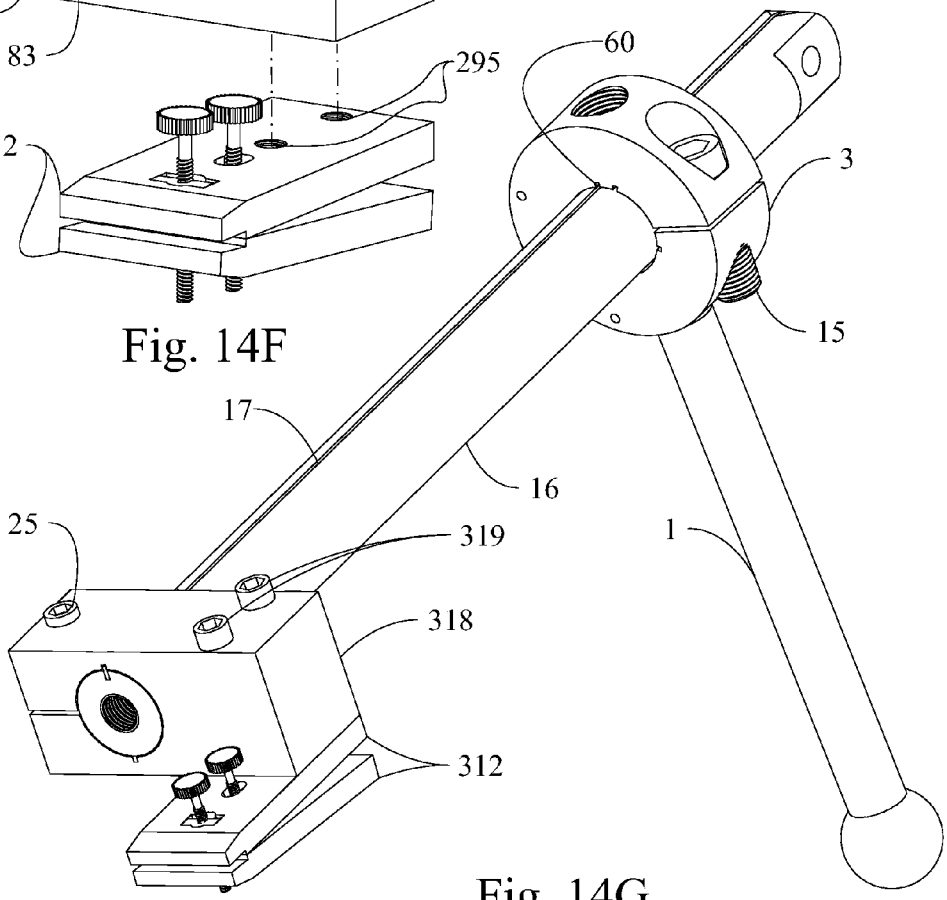

FIG. 14C shows an exploded view of a knife blade clamp assembly. An upper trunnion nut 307 (FIGS. 14C, 14H) is threaded onto an upper end of a left and right hand threaded rod 308 (FIG. 14C, 14D), onto upper threads 309 (FIG. 14D). 307 is threaded all the way to the end of upper threads 309 towards the center of the rod. A lower trunnion nut 310 (FIG. 14C), which has threads in the opposite direction of threads in 307, is then threaded onto the opposite end of left and right hand threaded rod 308, onto lower threads 311 (FIG. 14D), towards the center of the rod, until it meets trunnion nut 307. A knife clamp jaw 312 (FIGS. 14A, 14B, 14C, 14E, 14F, 14G, 14H), is then inserted onto the end of left and right hand threaded rod 308, through a rear trunnion rod slot 313 (FIGS. 14C, 14E, 14H). A second and identical knife clamp jaw 312, is then inserted into the other end of left and right hand threaded rod 308, through rear trunnion rod slot 313. If the jaws are brought together to meet, both 307 and lower trunnion nut 310 would be cradled in a pair of ½ cylinder trunnion socket-rear 314 (FIGS. 14C, 14E).

Another trunnion nut 307 is threaded onto the upper end of left and right hand threaded rod 308, onto upper threads 309. The nut is placed at upper most position on left and right hand threaded rod 308 such that the threaded bore in 307 reaches the end of upper threads 309.

The left and right hand threaded rod 308 and nut 307 are then inserted into a front trunnion rod slot 315 (FIG. 14C, 14E, 14H) in knife clamp jaw 312 such that 307 rests in and is cradled in a ½ cylinder trunnion socket-front 316 (FIGS. 14C, 14E, 14H). Lower trunnion nut 310 is then threaded onto the other end of the left and right hand threaded rod 308, onto lower threads 311 (FIG. 14D), while maintaining the previous position of 307 on left and right hand threaded rod 308. 308 is placed at the lower most position of left and right hand threaded rod 308 such that threaded bore in lower trunnion nut 310 reaches the ends of lower threads 311. Lower trunnion nut 310 is then cradled in ½ cylinder trunnion socket-front 316 on knife clamp jaw 312. Once both 307 and lower trunnion nut 310 are at the same relative outermost positions on left and right hand threaded rod 308, the jaws are brought together with thumbwheel 317 (FIGS. 14A, 14B, 14D) such that both 307 and lower trunnion nut 310 are cradled in ½ cylinder trunnion socket-front 316 and the front of the clamp jaws come together.

The jaw assembly is then mounted onto the underside of a knife guide body 318 (FIGS. 14A, 14B, 14F, 14G), by inserting two knife jaw mount bolts 319 (FIG. 14F, 14G) through a pair of unthreaded knife jaw mount bores 320 (FIG. 14F) and into a pair of knife jaw mount threaded bores 295 (FIG. 14C, 14F) on one knife clamp jaw 312. Thus, one of the two jaws is clamped flush to the underside of knife guide body 318 (FIGS. 14A, 14B).

For the base, main rod 16 (or v-tool rod 267) is inserted into guide body main rod bore 19 and clamped to the guide body as described previously. In this initial configuration, guide body keyway 21 is aligned to keyways 17 and secondary leg collar keyway 60 (FIG. 14A), and thus short leg 8 is perpendicular relative to knife guide body 318 as described previously.

If the user is sharpening or honing on abrading surfaces of differing heights or thicknesses, the same assembly procedure for the height adjust members in the static portion of Section 4 also applies to this configuration. A difference in this configuration would be that the height adjust members would be installed onto one leg, and adjusted accordingly as described in the previous.

A clamp face 321 (FIG. 14C) and a clamp jaw fence 322 (FIG. 14C) are discussed in the following operational section.

FIGS. 14A Through 14H

Detailed Operational Description

The configuration shown in FIGS. 14A and 14B are useful for sharpening tools such as pocket knives, cutlery, or carving knives and the like, for blades in which the cutting edge runs along the length of the shank of the tool.

To use this configuration to hone knives, the user inserts the blade shank between a pair of clamp faces 321, and butts the spine, or back edge of the knife, against one of two clamp jaw fences 322. Removable thumbwheel 317 is then inserted onto the end of left and right hand threaded rod 308. The threaded rod 308 that is closest to clamp jaw fence 322 is adjusted first, such that the spacing between the jaws matches the shank thickness at the knife spine or back edge—the thickest part of the tool. The clamping mechanism of the two jaws is designed such that near the fence, the left and right hand threaded member and the trunnion nuts pull the jaws together, since the trunnion nuts, while resting in the sockets on the outside surface of the jaws, pulls the jaws together as the nuts are drawn closer together. The sockets in the jaws allow the jaws to tilt, or pivot, as they are clamped. Thus a pinching action onto the knife spine (FIG. 14A, 14B, 14D) is possible. Removable thumbwheel 317 is removed from left and right hand threaded rod 308 and insert it onto the end of left and right hand threaded rod 308. By turning the thumbwheel in the opposite direction that left and right hand threaded rod 308 was turned, the clamp jaw ends are spread apart, since in this case, the trunnion nuts are resting in sockets which are on the inside surfaces of the jaws. The jaws can be spread apart, and provide the pinching action between the two clamp faces 321. This allows the jaw assembly to clamp a knife shank and closely match the taper of the shank, or the varying thickness of the knife blade, where the shank of the knife is thickest—at the spine, and follow the thinner portion of the blade towards the cutting edge. Thus, very secure clamping of even the smallest of knife blades is possible. By repeatedly adjusting both front and rear left and right hand threaded rod 308 in this manner, a close or exact match of the blade taper can be made with the jaws, and the knife is clamped securely into place.

The clamping of the knife into the jaws can be done either when the jaw assembly is mounted on knife guide body 318 or prior to. Once the tool is clamped into place, the cutting edge and configuration are held in an upright position on a work surface, and the leg collar 3 is slidably moved along main rod 16 (while keeping the keyways aligned as in the previous) to either visually match at work or abrading surface, the existing bevel angle of the cutting edge, or one of the multi faceted angle gauge blocks can be placed against the blade shank to match and set a desired bevel angle as described in Sections for FIGS. 2A through 3B. Leg collar bolt 15 is then tightened into place to set the bevel angle. The user then runs the knife edge over an abrading surface while gently rocking the configuration back and forth to follow the contour of the cutting edge.

When one side of the cutting edge is honed, the user then removes knife clamp jaw 312 from knife guide body 318, leaving the blade clamped in the jaws. Guide body clamp bolt 25 is loosened, and knife guide body 318 is then rotated 180°. Dual bevel keyway 83 is aligned to keyway 17 and secondary leg collar keyway 60 with key 18 (FIG. 14B). Leg collar 3 remains clamped in place. The jaws are then rotated 180° such that the other clamp jaw is bolted to the underside of knife guide body 318, such that the other side of the cutting edge is facing an abrading surface. See FIGS. 14A and 14B for the two positions. This maintains the same bevel angle for the opposite side of the cutting edge, and will create a mirror image of the profile honed on the previous side. The other side of the cutting edge is then honed as described in the previous. The process is repeated until the knife has been honed to the satisfaction of the user.

FIGS. 15A Through 15E

Detailed Static Description

Figure 15A:
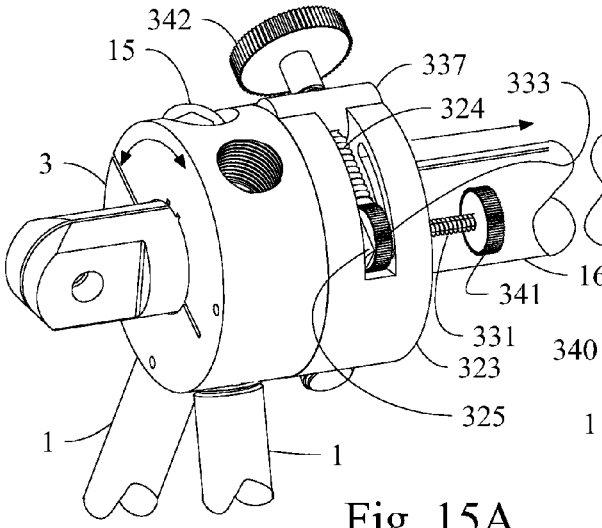
FIGS. 15A to 15E show a simple micro adjust collar assembly, useful for precisely adjusting the elongated support member system to a desired bevel and skew angle combination.
Figure 15B:
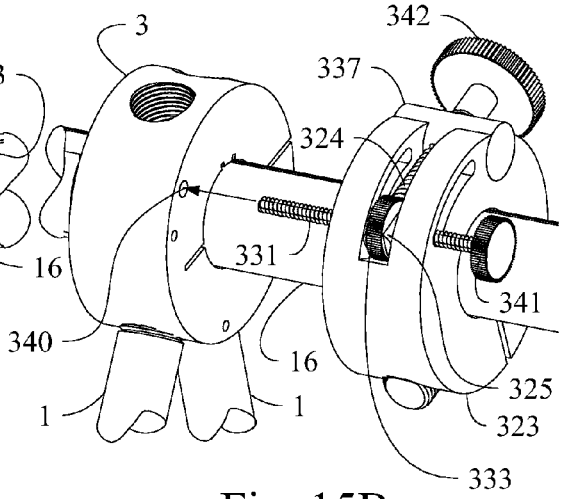
Figure 15C:
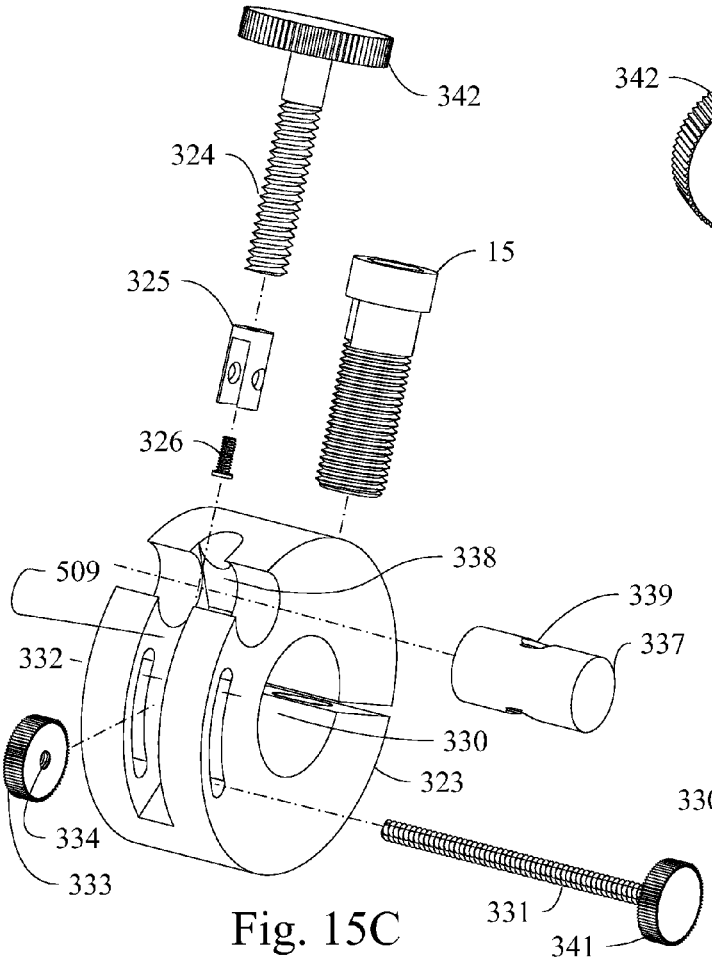
Figure 15D:
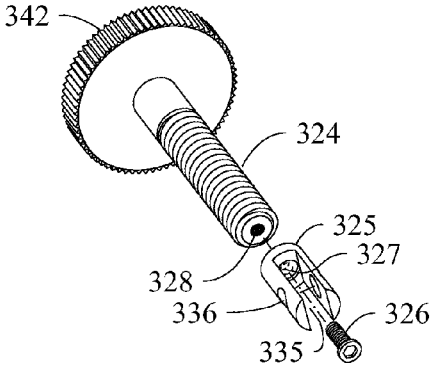

FIGS. 15A, 15B, 15C, 15E show a micro adjust collar 323 and related members, which is a simple mechanism that can be useful to aid the user in adjusting bevel and skew angles with greater ease or with more precision. To assemble micro adjust collar 323, a micro skew adjust rod 324 (FIGS. 15A, 15B, 15C, 15D) is attached to the end of a bevel adjust attachment pin 325 (FIGS. 15A, 15B, 15C, 15D) via a small screw, rivet or bevel attachment pin bolt 326 (FIGS. 15C, 15D). Screw bevel attachment pin bolt 326 could be permanently attached to micro skew adjust rod 324 with a thread locking industrial adhesive, or welded or brazed or permanently attached in some other way, such that micro skew adjust rod 324, bevel adjust attachment pin 325 and bevel attachment pin bolt 326 are a permanent assembly. Or, no adhesive may be used and bevel adjust attachment pin 325 could be removed from the assembly at any time. Bevel adjust attachment pin 325 is able to revolve along the lengthwise axis of micro skew adjust rod 324. If screwed on, bevel adjust attachment pin 325 is attached to micro skew adjust rod 324 by an unthreaded countersunk bore 327 (FIG. 15D) in the mount end of bevel adjust attachment pin 325, and a threaded attachment pin mount bore 328 (FIG. 15D) in the end of micro skew adjust rod 324, by screw 326.

Figure 15E:
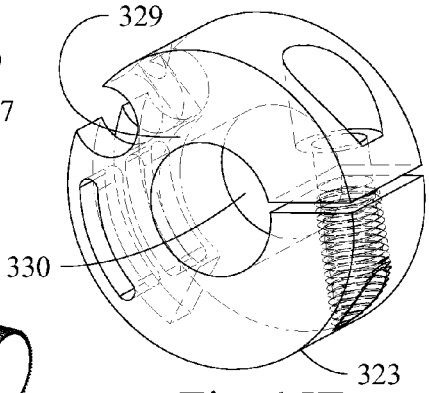

A micro adjust trunnion nut 337 (FIG. 15A, 15B, 15C) is then inserted into a trunnion nut collar bore 338 (FIG. 15C). The trunnion nut collar bore 338 centerline is parallel to the centerline axis of micro collar main rod bore 330. Micro skew adjust rod 324 with the bevel adjust attachment pin 325 and bevel attachment pin bolt 326 are then screwed into a trunnion nut bore 339 (FIG. 15C). Micro skew adjust rod 324 is then screwed down into a micro collar radiused skew slot 509 (FIG. 15C), of which a floor of radiused slot 329 (FIG. 15E hidden line view) is radiused, such that the inner base radius of the slot follows an arc that shares the same center point as does a micro collar main rod bore 330 (FIGS. 15C, 15E). A bevel adjust thumbwheel 333 (FIG. 15A, 15B, 15C) with a thumbwheel threaded bore 334 (FIG. 15C) is then inserted into micro collar radiused skew slot 509 (FIG. 15C) and then placed and held in an attachment pin c-slot 335 (FIG. 15D) of bevel adjust attachment pin 325, while a micro collar bevel adjust screw 331 (FIGS. 15A, 15B, 15C) is then inserted through radiused adjust slot 332, through 2 attachment pin unthreaded bevel bores 336 (FIG. 15D) of attachment pin c-slot 335, while threaded in to thumbwheel threaded bore 334.

Micro adjust collar 323 is then inserted onto main rod 16 or v-tool rod 267, with a bevel adjust rod thumbwheel 341 (FIGS. 15A, 15B, 15C) of micro collar bevel adjust screw 331 facing a guide body, and micro adjust collar 323 left unclamped (FIG. 15B) on a rod. The leg collar is then installed onto main rod 16 and moved into the approximate position for a desired skew and or bevel angle of any tool edge, and is clamped onto the member in that location. The micro collar is then brought into close proximity with leg collar 3, and micro collar bevel adjust screw 331 is screwed in to a micro bevel adjust mount bore 340 (FIG. 15B), which is threaded (non through) bore in leg collar 3. Bevel adjust mount bore 340 has not been shown in previous Figs. of leg collar 3, but will be mentioned in the alternative embodiment section at the end of this specification. Micro collar bevel adjust screw 331 is then tightened into bevel adjust mount bore 340 by a bevel adjust rod thumbwheel 341 (FIGS. 15A, 15B, 15C) on the end of micro collar bevel adjust screw 331, such that micro collar bevel adjust screw 331 can not rotate. The micro collar assembly is then moved along main rod 16 or v-tool rod 267 towards or away from leg collar 3 by turning bevel adjust thumb wheel 333, to adjust the location of micro adjust collar 323 until there is an approximate equal length of micro collar bevel adjust screw 331 between the two collars, and protruding away from both collars—or toward a guide body. Micro adjust collar 323 is left un clamped to either main rod 16 or v-tool rod 267 and is now ready to use. The slotted clamp on micro adjust collar 323 is identical to the type that has been discussed in the previous for the leg and skew collars, and thus uses the same leg collar bolt 15.

A skew adjust thumbwheel 342 (FIGS. 15A, 15B, 15C, 15D) is discussed in the following operational section.

FIGS. 15A Through 15E

Detailed Operational Description

The micro adjust collar is a simple mechanism which slowly and minutely moves leg collar 3 along a short linear distance of main rod 16 or v-tool rod 267, and allows rotation of leg collar 3 around the outside diameter of either rod. Once the leg collar has been locked into a position on main rod 16 or v-tool rod 267 which is relatively close to a desired skew and or bevel angle setting for a tool edge, the micro collar, once connected to the leg collar as in the previous, is also locked into place with leg collar bolt 15 to set a current reference point of the leg collar 3 setting. Then leg collar bolt 15 on leg collar 3 is slightly loosened, just enough such that the leg collar is free to overcome friction at the collar clamp joint.

A micro skew adjust thumbwheel 342 is then turned to adjust the skew angle of the configuration. When turned, micro adjust trunnion nut 337 allows micro skew adjust rod 324 to pivot at trunnion nut collar bore 338, as skew adjust attachment pin 325 either pulls or pushes micro collar bevel adjust screw 331 towards or away from micro adjust trunnion nut 337, thus rotating the leg collar around the main rod. As micro collar bevel adjust screw 331 travels radiused slot 332, it follows an arc that shares the same center point as micro collar main rod bore 330. Thus micro collar bevel adjust screw 331, (of which 331 is used to both adjust the bevel angle and also used as a rod to rotate the leg collar) and the leg collar 3, are minutely rotated around the centerline axis of, the main rod, thus minutely changing the skew angle of the configuration. To adjust the bevel angle of a configuration, bevel adjust thumbwheel 333 as it is turned, slidably moves leg collar 3 minutely towards or away from the micro adjust collar—since it is using screw 331 to push or pull the leg collar along the rod, and in doing so slightly decreases or increases respectively the bevel angle at the tool edge. Therefore, as long as the user positions the leg collar to a relatively close but not exact match to a desired bevel and skew angle, the micro collar is an aid or convenience to dial in a precise final bevel and skew angle, while checking visually the tool edge.

FIGS. 16A Through 16E

Detailed Static Description

FIG. 16A shows gouge guide body 20 in a configuration for honing etching or dry point scribers used in the printmaking arts. Members of this configuration are the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous.

Included in this configuration is an etching or dry point-etching scriber 343 (FIGS. 16A, 16B, 16D, 16E), which could be supplied with this configuration, or manufactured by a third party to these specifications, such that it will properly fit into the configuration. To assemble the configuration, the member base system and sleeved gouge guide body 20 are assembled as described in the previous section 1. Assembly of the height adjust members as described in section 4 can also be used in this configuration.

A scriber sleeve housing 344 (FIGS. 16A, 16B, 16D) is installed into gouge guide body 20 and locked in as described in section 1, using the same method for the gouge housings. The outside diameter of the housing is the same as sleeved guide body housing bore 33. Into a housing sleeve bore 354 (FIG. 16B) is inserted a scriber sleeve 345 (FIGS. 16A, 16B, 16D). Scriber sleeve 345 has an outside diameter minutely less than housing sleeve bore 354 inside diameter. Scriber sleeve 345 has a scriber sleeve flange 346 (FIGS. 16B, 16D) which rests on the surface of scriber sleeve housing 344, such that when a scriber sleeve collar 347 (FIGS. 16B, 16C) is locked onto the rear end of scriber sleeve 345, both scriber sleeve 345 and scriber sleeve collar 347 are free to rotate 360° in housing sleeve bore 354, and the collar and flange are held flush against the front and rear faces of the housing, such that scriber sleeve 345 has no travel along it's lengthwise axis. Dry point-etching scriber 343 is then inserted into a through scriber sleeve through bore 353 (FIG. 16B) in scriber sleeve 345, and through a collar inside diameter 355 (FIG. 16B) of scriber sleeve collar 347 and a scriber set screw clamp 348 (FIGS. 16B, 16C, 16D, 16E), which has a set screw hemisphere (or cylindrical) end 349 (FIG. 16C), the setscrew is screwed into a scriber sleeve collar threaded bore 350 (FIG. 16B) in scriber sleeve collar 347, and partway through a threaded (or unthreaded) bore in scriber sleeve 351 (FIG. 16B) in scriber sleeve 345. The sleeve is then held to prevent rotation in the housing, and dry point-etching scriber 343 is then rotated in the sleeve and collar assembly such that a spherical or cylindrical seat 352 (FIGS. 16B, 16E) on the shaft of the tool aligns with set screw hemisphere end 349. Scriber set screw clamp 348 is then tightened with an Allen wrench such that set screw hemisphere end 349 finds spherical or cylindrical seat 352, and thus the scriber is clamped into the configuration. Dry point-etching scriber 343, scriber sleeve collar and scriber sleeve 345 all freely rotate within scriber sleeve housing 344 as one unit.

FIGS. 16A Through 16E

Detailed Operational Description

Operation of the scriber—dry point configuration is simple. The user sets a bevel angle for the tool tip as described in the previous sections 1 and or 2. For variable heights or thicknesses of abrading surfaces, the same operational procedure for the height adjust members in section 4 applies to this configuration as in the previous, To hone, the user simply moves the configuration across an abrading surface and work surface while uniformly rotating dry point-etching scriber 343 from the rear of the configuration, to hone a point on the tip of the scriber. Since the configuration holds the tip of the scriber at a constant bevel angle to an abrading surface, if the scriber is rotated at a uniform and steady rate of rotation, a near perfect scriber point will be the result.

Note that since the outside diameter of dry point-etching scriber 343 is minutely less than the inside diameter of scriber sleeve through bore 353, that a near perfect axis of rotation along the lengthwise axis of dry point-etching scriber 343 is the result. Such provides results of a uniformly honed scriber tip.

FIGS. 17A Through 17F

Detailed Static Description

Figure 17A:
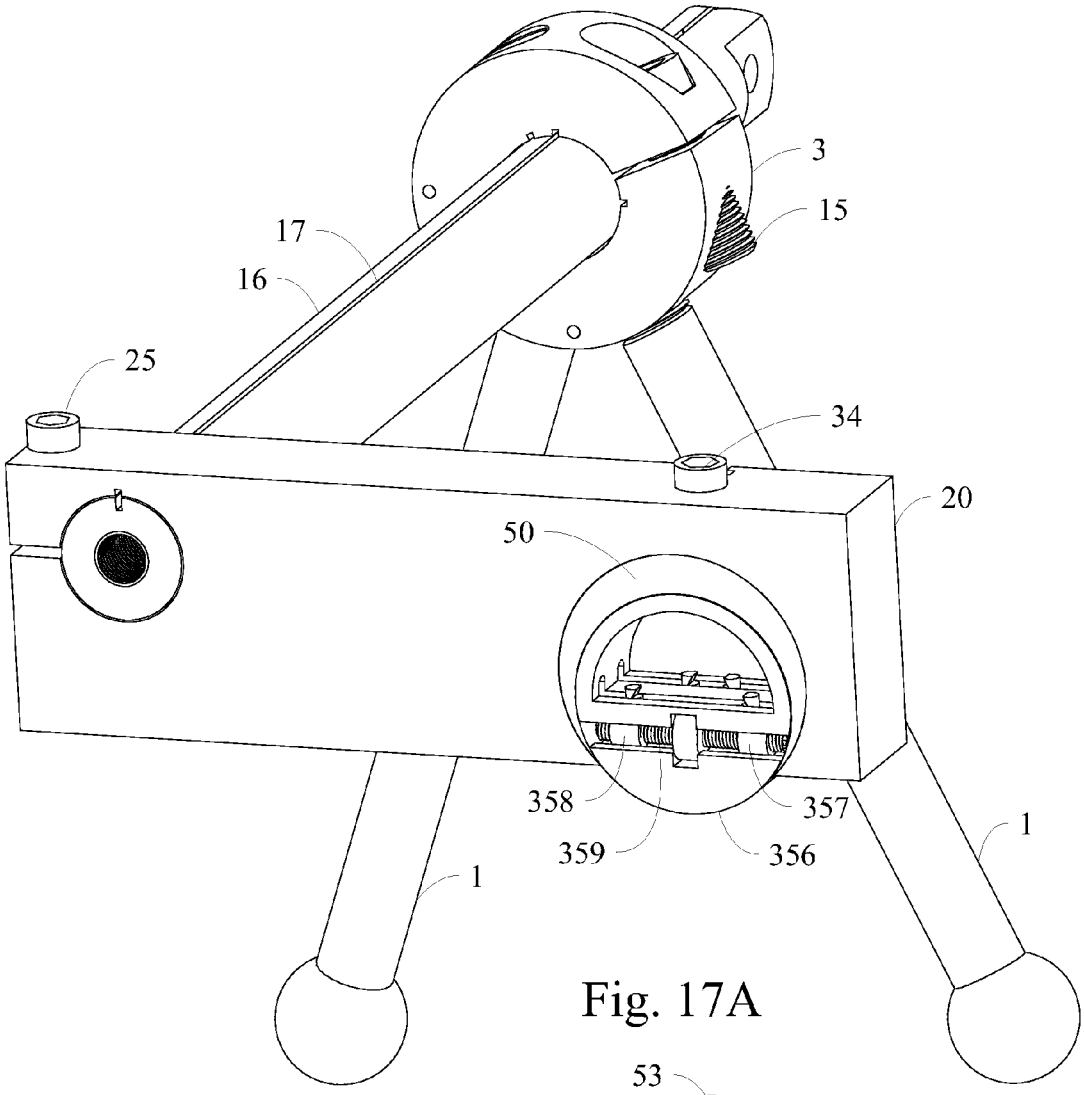
FIGS. 17A to 17F show a simple clamping sleeve mechanism used in the sleeved gouge guide body and useful for clamping and sharpening—honing of gouges having flat tool shanks.

FIG. 17A shows a honing guide configuration using gouge guide body 20 and related members for the honing of flat shanked carving gouges or shallow gouges called sweeps and the like. Members of this configuration, the honing guide elongated support base member system comprised of legs 1, main rod 16, keyway 17, leg collar 3, leg collar bolt 15, guide body main clamp bolt 25, guide body main rod bore 19, key 18, guide body keyway 21, guide body clamp slot 22, guide body threaded clamp bore 24 and unthreaded guide body clamp bore 23. These members were described in detail in Section 1, and the same assembly procedure applies for this configuration as in the previous.

The shank of these types of gouges or carving tools is generally relatively thinner and wider than the more traditional carving tools, and many of these tool shanks are tapered such that they are narrow at the tool edge, and the shank width widens as the shank approaches the handle. Others of this type start out wide at the tool edge, then narrow and then widen towards the handle. Since this type of tool shank is more difficult to clamp and center to a configuration, or align the tool shank axis of rotation square to the configuration, a clamp has been designed to both clamp and align the tool shank axis of rotation to the configuration, such that the tool edge can be held square to the configuration and a uniform edge profile can be honed at the tool tip.

The assembly of this guide body configuration, use of height adjust members, setting bevel angles is as in the previous sections. Therefore, differences between this configuration and the configuration in the previous sections will be discussed.

FIG. 17A shows large sleeve housing 50 of the previous section 1, FIG. 1E. This same housing can also be used with this configuration, since the inside diameter of large sleeve bore 51 of large sleeve housing 50 (FIG. 1E), is sized matched to a flat shank sleeve outside diameter 362 (FIG. 17C) of a flat shank gouge sleeve 356 (FIGS. 17A, 17C, 17D, 17E, 17F). Or, a smaller version of this clamp could be made to fit medium sleeve housing 45 (FIG. 17D). To assemble flat shank gouge sleeve 356, a left & right hand threaded clamp jaw rod 359 (FIGS. 17A, 17D, 17F) is inserted and held into a rod clamp slot 360 (FIGS. 17C, 17D) in flat shank gouge sleeve 356. A flat shank clamp jaw 357 (FIGS. 17A, 17D, 17F) and a flat shank clamp jaw opposite threaded 358 (FIGS. 17A, 17D, 17F) are then held onto the ends of left & right hand threaded clamp jaw rod 359. An Allen wrench is then placed through the inside diameter of flat shank clamp jaw 357 to find a clamp hex socket 361 (FIGS. 17D, 17F) and rotate left & right hand threaded clamp jaw rod 359 to draw flat shank clamp jaw 357 and flat shank clamp jaw opposite threaded 358 into rod clamp slot 360, and towards each other and to the center of the sleeve body. A clamp jaw post opening 364 (FIG. 17C), allows a clamp post 366 (FIG. 17B) to pass through the sleeve side wall. The process is then repeated for the second set of clamp jaws. The sleeve is ready to clamp a flat shanked tool. After the tool is clamped into sleeve 356, it is then installed into large sleeve housing 50 as described in prefixed section 1.

A flat shank clamp surface 363 (FIG. 17D), an angled clamp jaw face 365 (FIG. 17B), a left or right hand threaded bore 372 (FIG. 17B), a clamp post clamp surface 371 (FIG. 17B), a slot inner radius 369 & slot outer radius 369' (FIG. 17E), a rod centering disk 367 (FIG. 17D), a centering disk slot 368 (FIG. 17D) and a clamp opening 373 (FIG. 17D) are discussed in the following operational section.

FIGS. 17A Through 17F

Detailed Operational Description

To clamp a flat shanked gouge in this configuration, the tool is placed on a flat shank clamp surface 363, and an Allen wrench is inserted into the hex sockets of the threaded rods, to draw the two sets of clamp jaws toward the edges of a flat gouge shank. While clamping a flat shanked gouge, an angled clamp jaw face 365, on clamp post 366, comes into contact with the top edge of the tool shank, and the inside slope of angled clamp jaw face 365. Thus, the tool shank is forced downward firmly against flat shank clamp surface 363, and is pinched at the top edges of the tool shank, such that the tool shank is clamped firmly against flat shank clamp surface 363, and between angled clamp jaw face 365. Once the tool shank is snugly clamped into the sleeve, the sleeve can then be installed into large sleeve housing 50, which can then be installed into sleeved gouge guide body 20, as described in the previous prefixed section 1.

Figure 17B:
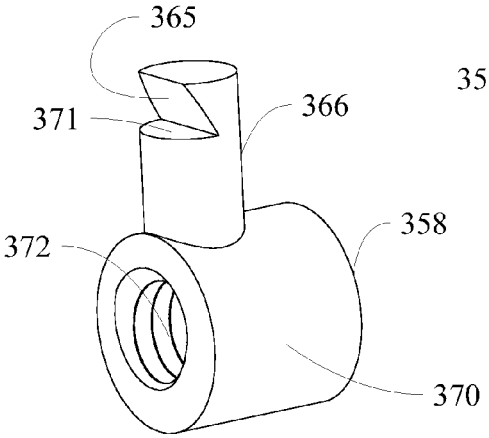
Figure 17C:
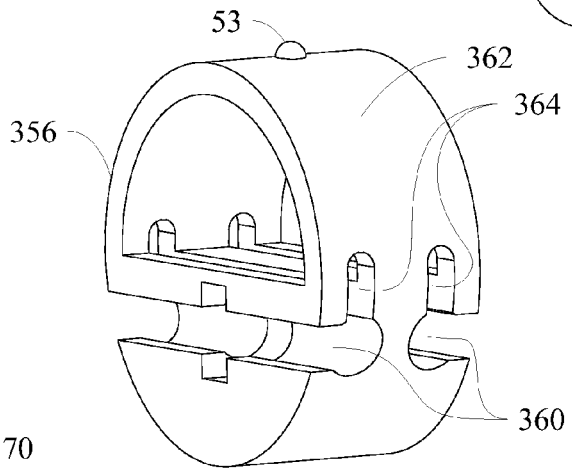
Figure 17D:
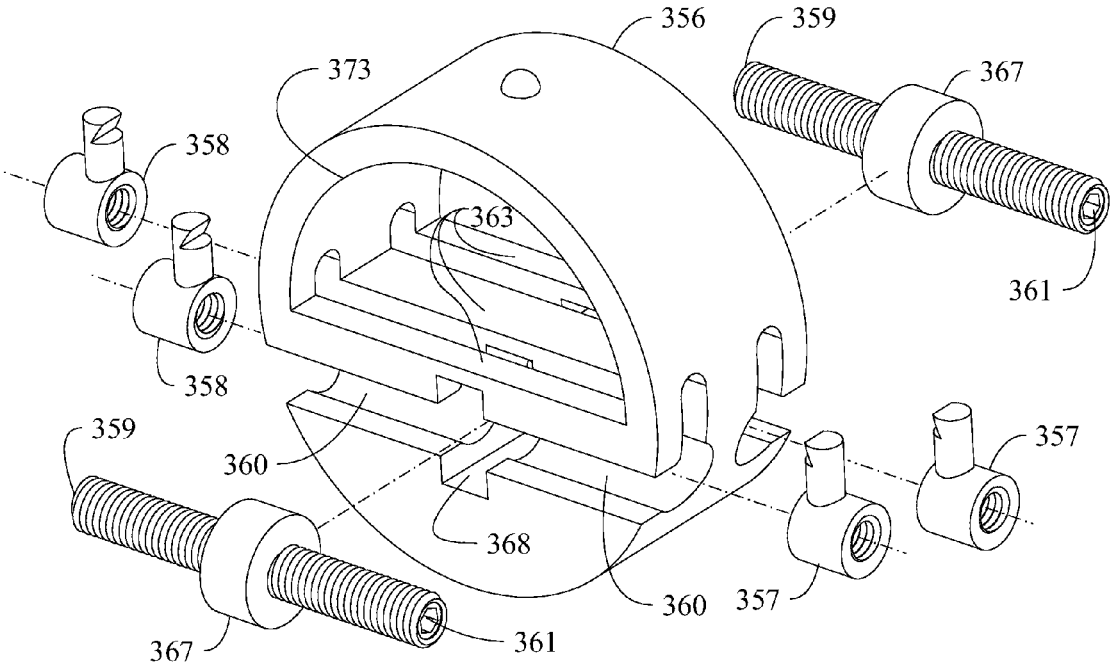
Figure 17E:
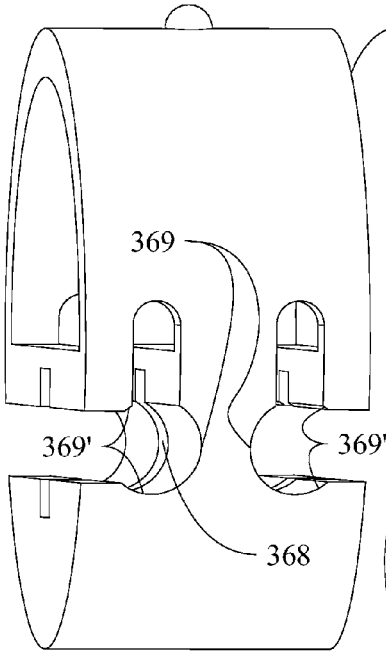
Figure 17F:
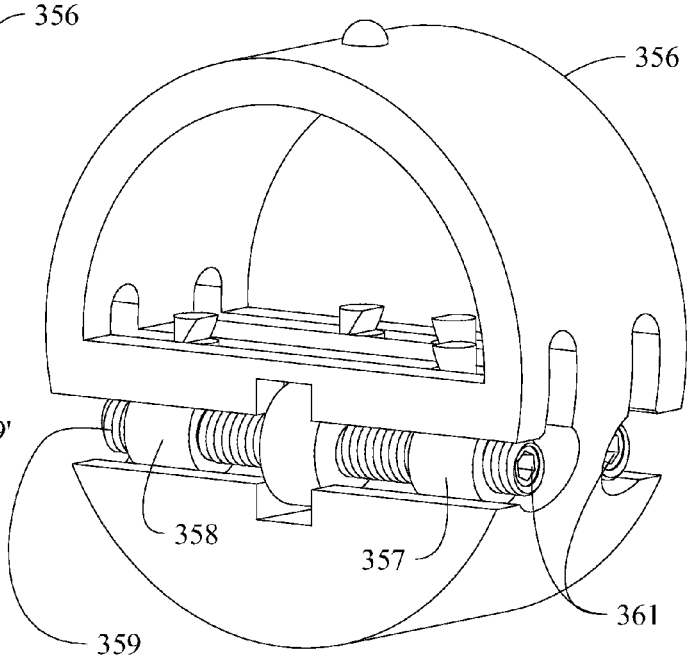

FIG. 17B shows a clamp jaw; the difference between flat shank clamp jaw 357 and flat shank clamp jaw 358 are the left or right hand threaded bore 372. Clamp post surface 371 is flush with flat shank clamp surface 363. The tool shank is thus clamped flush to both clamp post clamp surface 371 and flat shank clamp surface 363. The equivalent radii of a slot inner radius 369 and slot outer radius 369' hold left & right hand threaded clamp jaw rod 359 into the sleeve such that it will not fall out of the slots when installed. Slot inner radius 369 seats flat shank clamp jaw 357 and flat shank clamp jaw 358. Slot outer radius 369' prevents the member and jaws from falling out of the sleeve, once flat shank clamp jaw 357 and flat shank clamp jaw 358 are installed. Clamp sleeve outside diameter radius 370 is minutely less than slot inner radius 369 and slot outer radius 369'.

At the middle of left & right hand threaded clamp jaw rod 359, a rod centering disk 367 which has a larger outside diameter than the threaded portion, seats into a centering disk slot 368. Rod centering disc 367 and centering disk slot 368 centers the threaded member in the rod clamp slot 360, and prevents the member and jaws from falling out of the ends of the rod clamp slot, once the jaws are inside the sleeves. The centering allows flat shank clamp jaw 357 and flat shank clamp jaw 358 to at all times to be equal distant from the centerline of a clamp opening 373 (FIG. 17D). Thus, flat shank clamp jaw 357 and flat shank clamp jaw 358 can center a tool shank inside clamp opening 373, even if the shank is tapered, such that the centerline of the tool shank will be in alignment with the centerline of clamp opening 373, and in alignment to the axis of rotation of the sleeve in the housing, and square to the configuration. Such provides a uniform and non skewed gouge edge for the flat tapered shanks of this type of gouge. The clamp jaw sets independently self-center tapered flat gouge shanks, since they can center a tool and pinch the edges of the shank at varying widths at two locations along the tool shank. Thus, flat shanked tools are centered inside the gouge sleeve 356.

The plane that flat shank clamp surface 363 lies upon, is designed to be slightly lower than the centerline of clamp opening 373. This is to attempt to account for the thickness of the tool shank and allow it to be as close as is possible to the axis of rotation of the sleeve.

FIGS. 18A Through 18M

Detailed Static Description

Figure 18A:
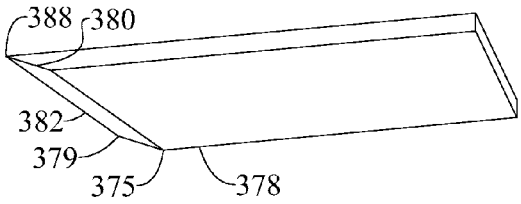
FIGS. 18A to 18M show related members including protrusion stops, a guide body elbow mount.
Figure 18B:
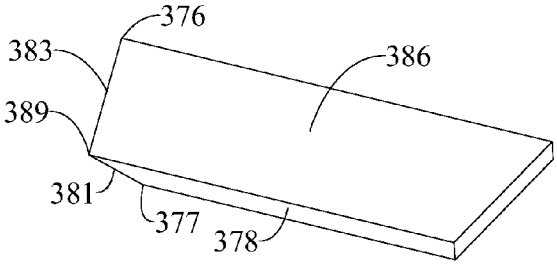
Figure 18C:
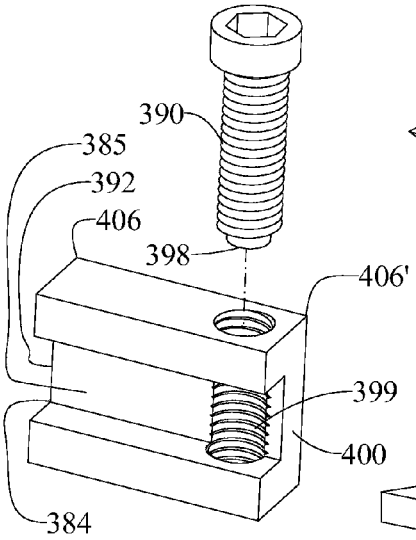
Figure 18D:
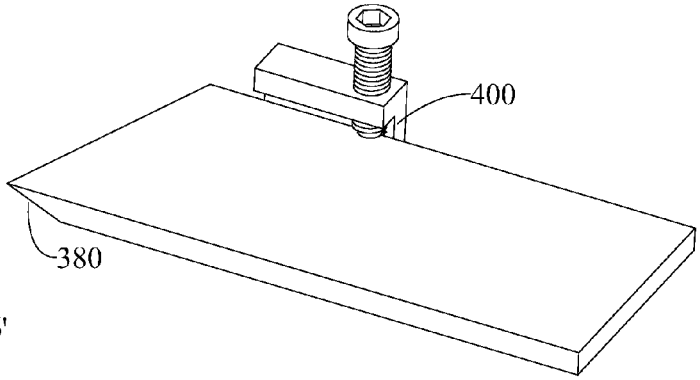
Figure 18E:
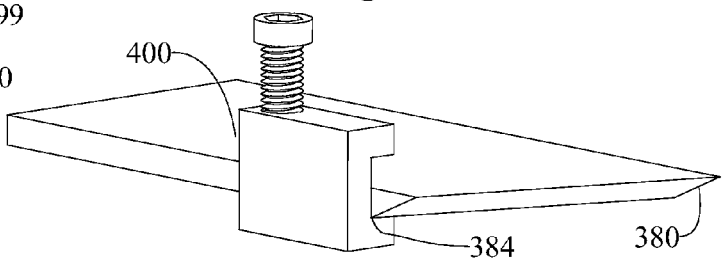
Figure 18F:
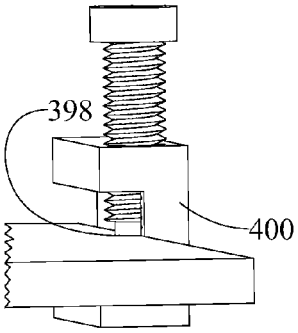
Figure 18G:
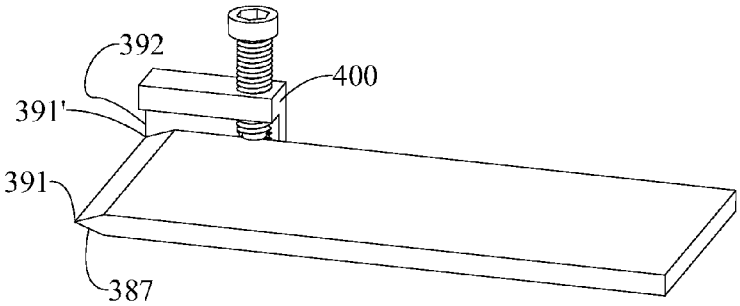

A left right skewed bevel edge 380 is shown in FIGS. 18A, 18D, 18E. A left skewed bevel edge 381 is shown in FIG. 18B. And a double bevel non skewed edge 387 is shown in FIG. 18G. We define the edge-tool in FIGS. 18A, 18D and 18E as being skewed right, because this is the skew resulting from tilting guide body 82 to the right, if viewing the blade and guide body from the leg side or rear of the configuration. We define the edge tool in FIG. 18B as left skewed, for the opposite reason.

For the right skewed single bevel edge-tool in FIG. 18A, the protrusion distance from right skewed cutting edge 382, to the front of the guide body, is measured from reference point 375. Reference point 375 can be called the "heel" of the bevel angle, or in other words, where the bevel starts, and not where the cutting edge starts. To clamp a protrusion stop (FIG. 18C) to the right skewed edge-tool in FIG. 18A and match up reference point 375 to a protrusion stop anchor point 384 (FIG. 18C, 18E), it is clamped at a protrusion gauge mount location 378 (FIG. 18A), by placing a protrusion stop clamp surface 385 (FIG. 18C) against protrusion gauge mount location 378, making sure that reference point 375 is aligned and located at 384 (FIG. 18C, 18E), on the protrusion stop. FIG. 18D is a top view of the clamped protrusion stop on the right skewed edge tool, and FIG. 18E is a view from the other side of the same left right skewed edge tool. For clamping to left skewed single beveled edge tools, the process is the same other than a reference point 377 (FIG. 18B) is used. In this case, a protrusion stop bolt 390 (FIG. 18C) would be facing upside down, with respect to a top surface 386 (FIG. 18B). For both left and right skewed single beveled edge tools, the protrusion stop is installed at the side of the tool where the cutting edge is furthest from the main rod. For single beveled non skewed edge tools, it does not matter which side of the edge-tool the stop is installed, as long as the point of the heel is used as a reference point—for example as shown in reference point 375—furthest point from guide body 376.

For double beveled non skewed edge tools, instead of the heel of the tool used as a reference point for the protrusion stop, a double bevel edge-reference point 391 (FIG. 18G) or second double bevel edge-reference point 391' (FIG. 18G) can be used—which is either end point of the cutting edge, not the heel of the bevel such as in the previous. Instead of aligning double bevel edge-reference point 391 or second double bevel edge-reference point 391' to protrusion stop anchor point 384 on the protrusion stop, double bevel edge-reference point 391 or second double bevel edge-reference point 391' is aligned to be flush with a protrusion stop edge 392 (FIGS. 18C, 18G) of the protrusion stop. For double beveled left and right hand skewed edge tools, again it is not the heel, but the tip of the cutting edge that is used as a reference point to align flush with protrusion stop edge 392. The difference between skewed and non skewed double beveled edge tools is, when skewed, the protrusion stop is clamped to the side of the edge-tool where the cutting edge is furthest from the main rod, whereas in non skewed cases, it does not matter which side edge the stop is clamped to.

The protrusion stop can also be clamped to parting tools. In the case of parting tools, if the tool edge is an arrow shaped point, as most parting tools are, the point of the tip is aligned to protrusion stop edge 392.

Figure 18J:
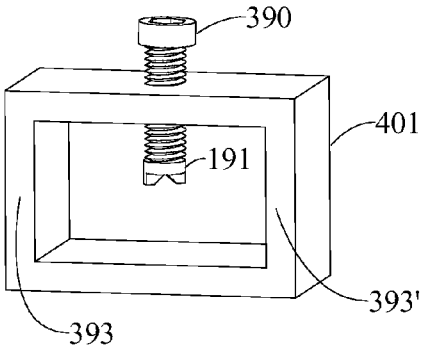
Figure 18J:
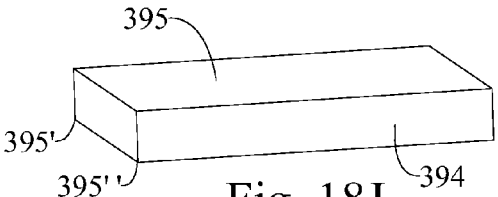
Figure 18I:
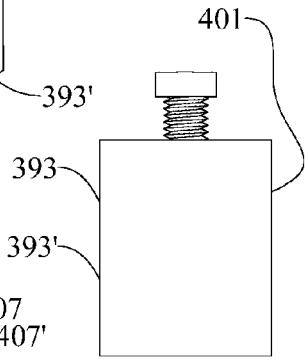
Figure 18H:
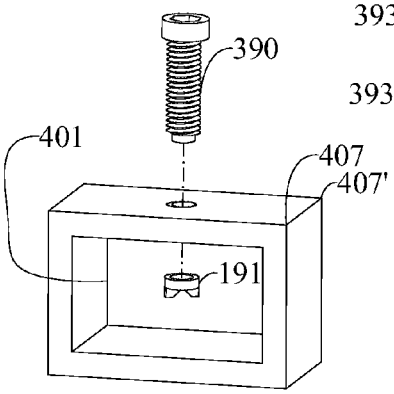

FIGS. 18H and 18I show a protrusion stop for V tools and gouges. V tools and gouges can be clamped into this protrusion stop with the tool or cutting edge facing upward, toward graver v-block clamp jaw 191. This is the same graver v-block clamp jaw 191 that is used in the graver configuration in section 8, and can be used interchangeably with this stop. Protrusion stop bolt 390 is the same that is used in the protrusion stop for flat edge tools.

As in the case with the previous flat edge tools, it is the heel of the bevel on gouges and V tools that is used as the reference point for tool protrusion with this stop. So to set the correct reference point for protrusion, once the gouge or V tool is loosely clamped in, the stop with the gouge are viewed from the side and a front face-gouge protrusion stop 393 (FIGS. 18H, 18I) & a front face-gouge protrusion stop 393' (FIGS. 18H, 18I) are visually aligned and the gouge or v tool edge is moved outward and away from front face-gouge protrusion stop 393 and front face-gouge protrusion stop 393', until the heel of the V tool or gouge bevel is aligned to both front faces, while viewed from the side perspective shown in FIG. 18I.

FIG. 18J shows a protrusion extending spacer that can be used with calibration mount plate 134, the cut edge simulator Mount Plate. It is installed by placing a cut edge simulator mount plate spacer edge-face 394 (FIG. 18J) against calibration plate protrusion fence 161 (FIG. 5K), and a mount spacer 395 (FIG. 18J) against mount plate surface 145 (FIG. 5K), and then clamping the sandwich into a guide body.

Figure 18L:
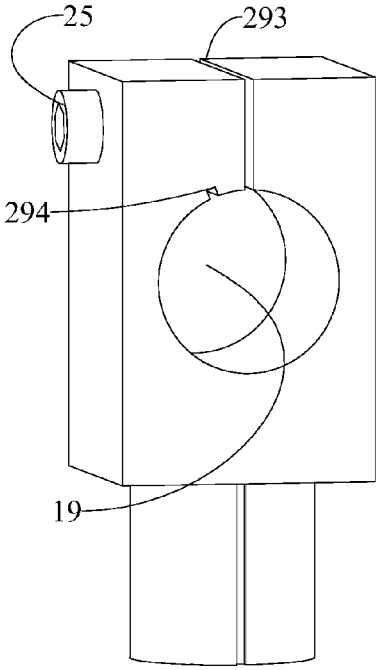
Figure 18K:
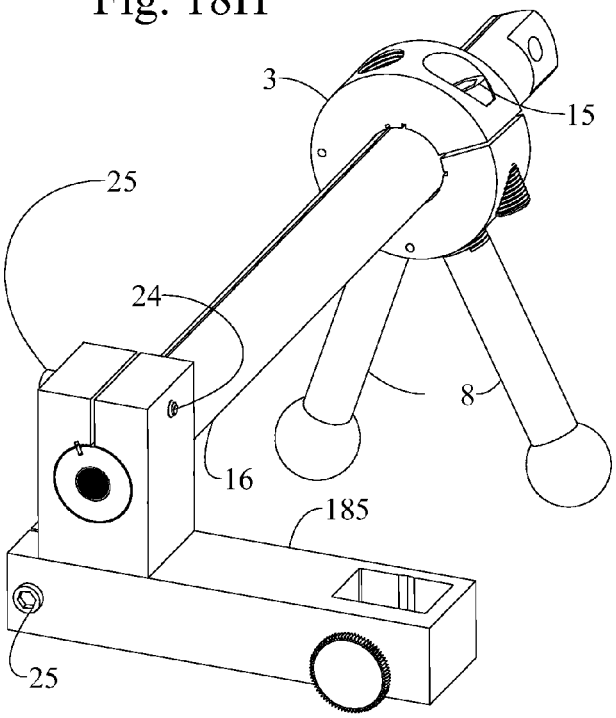
Figure 18M:
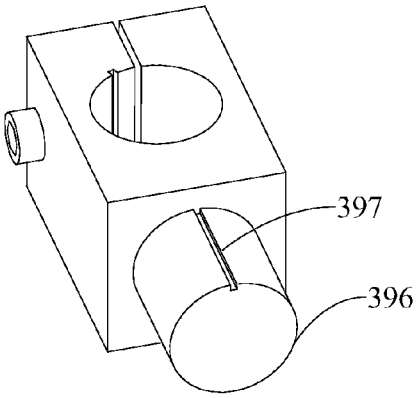

FIGS. 18K, 18L, 18M show a 90° guide body mount elbow. It is installed into a guide body by inserting guide body mount post-90° elbow 396 (FIG. 18M) into a guide body main rod bore 19, and aligning secondary guide body keyway 294 (FIG. 18L) to a guide body keyway slot, and then tightening guide body main clamp bolt 25. A 90° elbow keyway 397 (FIG. 18M) aligns with guide body keyway 21.

A point on protrusion distance line 406 & a point on protrusion distance line 406' (FIG. 18C), a point on spacer 395' and point on spacer 395" (FIG. 18J), a point on protrusion distance line 407 and a point on protrusion distance line 407' (FIG. 18H) an inset half threaded bore 399 (FIG. 18C) and a flat cylindrical protruding end 398 (FIG. 18C) are discussed in the following operational section.

FIGS. 18A Through 18M

Detailed Operational Description

The protrusion stop shown in FIGS. 18C, 18D, 18E, 18F, 18G can be used with flat tool guide body 82, graver guide body 185 and parting tool guide body 198. The protrusion stop shown in FIGS. 18H and 18I can be used with fingernail-v tool guide body 227 for V tools and gouges. The protrusion stops are used when cut edge simulator 125 is used to set bevel and skew angles in one of the above five configurations. For the rest of the configurations in this specification, the bevel angle can be set either visually when the tool is clamped into the guide body, or one of the multi faceted angle blocks of sections 2 and 3 can be used. In some situations the user could also find the angle blocks useful for flat tool guide body 82, graver guide body 185, parting tool guide body 198 and fingernail-v tool guide body 227.

If the cut edge simulator is used in flat tool guide body 82 configurations, once the protrusion stop is installed onto a flat edge tool, a guide body end of protrusion stop 400 is butted up against a front face of flat tool guide body 82 against the surface of the outside diameter threads. The cutting tool is then clamped into the guide body. If the cut edge simulator was used in graver guide body 185 configuration, 400 is butted up against a front face of graver guide body 403. And if the cut edge simulator was used in parting tool guide body 198 configurations, 400 is butted up against a parting jaw face 207 or if the parting tool shank is wide and comes into close proximity of the guide body, a front face of parting tool guide body 404.

If the cut edge simulator was used in a fingernail profile or V tool configuration with fingernail-v tool guide body 227, a guide body end of gouge protrusion stop 401 is butted up against a front face of fingernail-v tool guide body 405.

The distance between a point on protrusion distance line 406 and point on protrusion distance line 406' on the flat edge-tool protrusion stop, is the protrusion distance we are setting from the tool edge, to the front of the guide body. The distance between a point on protrusion distance line 407 and a point on protrusion distance line 407', is the protrusion distance we are setting from either the V tool or gouge edge, to the front of the guide body. For the convenience of the user, there may be a plurality of protrusion stops with slightly greater 406 and 407 distances. In these cases, the longer stops would be matched with a cut edge simulator protrusion spacer shown in FIG. 18J, which would have the additional added protrusion distance between point 395' and point 395", to extend the distance between calibration plate protrusion fence 161, and the front face (or jaw) of a guide body.

Note that the stop shown in FIG. 18C, has an inset half threaded bore 399, of which half of the bore cuts through protrusion stop clamp surface 385, such that a flat cylindrical protruding end 398 (FIG. 18C) of protrusion stop bolt 390 is bisected and intersects protrusion stop clamp surface 385. The purpose of 398 being offset and into the face is so that very narrow edge tools can be clamped into the stop. Some flat edge tools, especially the Japanese style wood cut print-making knives, can be 1/32" wide. This stop can clamp these tiny tools, and will also work with much wider flat edge tools. FIG. 18F shows an example of the clamping of this stop.

FIGS. 18K, 18L, 18M show the handy 90° elbow mount for guide bodies. A configuration is shown in FIG. 18K. This elbow is useful if the user damages a tool and needs to re profile a tool edge. With this configuration, a tool can be held perpendicular to an abrading surface, and a broken or damaged tool edge can be quickly ground down as one would use a grinding wheel to re face a broken tool prior to finish honing.

FIGS. 19A Through 19O & 20A Through 20V

Alternative Embodiments of Previous Members

Figure 19A:
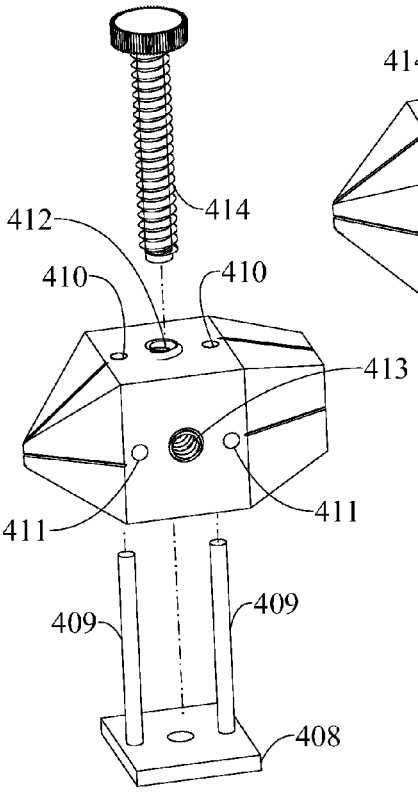
FIGS. 19A to 19O show alternative embodiments of members described in the previous drawing Figs.
Figure 19B:
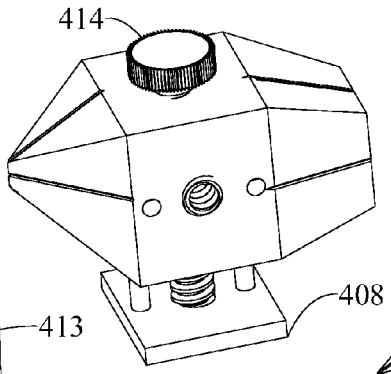
Figure 19C:
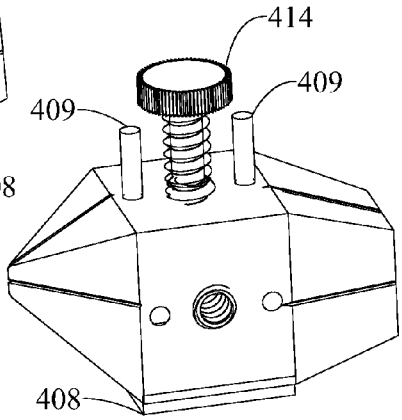

FIGS. 19A through 19C show an additional embodiment of the member shown in FIGS. 2A, 2B and 2C—the height adjustable bevel angle block. To assemble the height adjustable bevel angle block, two facet block riser posts 409 (FIG. 19A) affixed to a multi facet block riser stand 408 (FIGS. 19A, 19B, 19C) are inserted into either a pair of unthreaded riser post bores 410, or unthreaded riser post bores 411 (FIG. 19A). A facet block riser thumbscrew 414 (FIG. 19A) is then threaded into either of two threaded riser block thumbscrew bore 412 or riser block thumbscrew bore 413 (FIG. 19A). This embodiment can be used with large shanked gouges and V tools, in situations where the facets on the block are unable to reach the top edges of the gouge. The block can be raised or lowered by turning the thumbscrew, to enable the facets to meet the top edges of the tool. FIGS. 19B and 19C show the adjustability of the block.

Figure 19E:
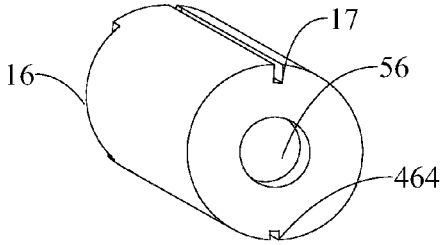
Figure 19D:
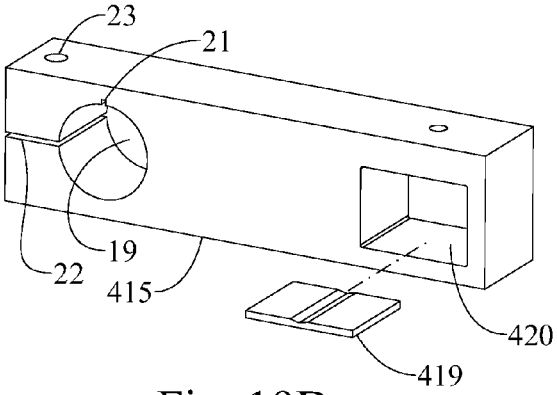

FIG. 19D shows a graver body alternate embodiment 415 of graver guide body 185 of section 8. Graver body alternate embodiment 415, unlike graver guide body 185, does not have a machined in v groove on graver clamp seat 188 (FIG. 8B). Instead, a removable base plate with a v-insert 419 (FIG. 19D) is shown, and graver body alternate embodiment 415 has a clamp seat 420 (FIG. 19D) that does not have the machined in v groove. This embodiment may be useful for clamping very narrow carving knives with a flat tool-graver body clamp plate 416, since some of these knives can be 1/32" wide.

Figure 19G:
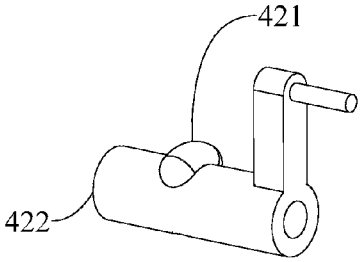
Figure 19F:
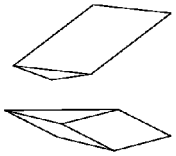

FIG. 19F shows a v-shaped insert that can be inserted into the V-groove of 419 or 187, if narrow flat bladed tools instead of V shaped tools are used in the graver guide body shown in FIG. 19D or 8B. This aids in preventing narrow flat bladed tools from being pressed into the V-groove slot upon clamping.

FIG. 19G shows an alternate embodiment of gouge small gouge sleeve 422. An alternate tang on gouge sleeve 421 is shown, which is a torus shaped tang that extends over a longer radial distance (and thus area) of the outside diameter of the sleeve, than the spherical tangs shown in section 1. This longer tang could be provided on all sizes of sleeves. An additional embodiment of a tang for these sleeves (not shown) would be a plurality of tangs on all sleeves.

Figure 19H:
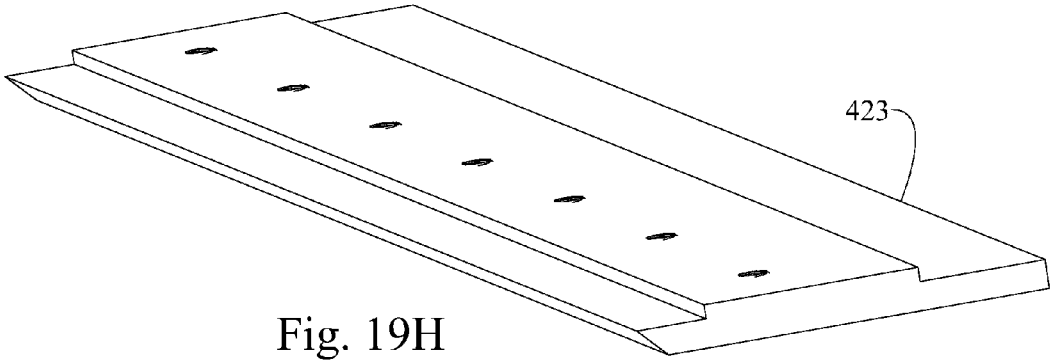
Figure 19I:
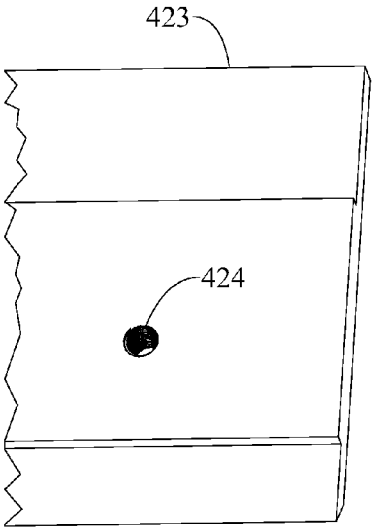

FIGS. 19H and 19I show an alternate embodiment 423, for the planer blade clamp base of Section 12. 423, instead of c-clamp trunnion nut slot 285 and planer blade clamp base 286, has a threaded bore 424 (FIG. 19I) for planer thumbwheel flange 298.

Figure 19J:
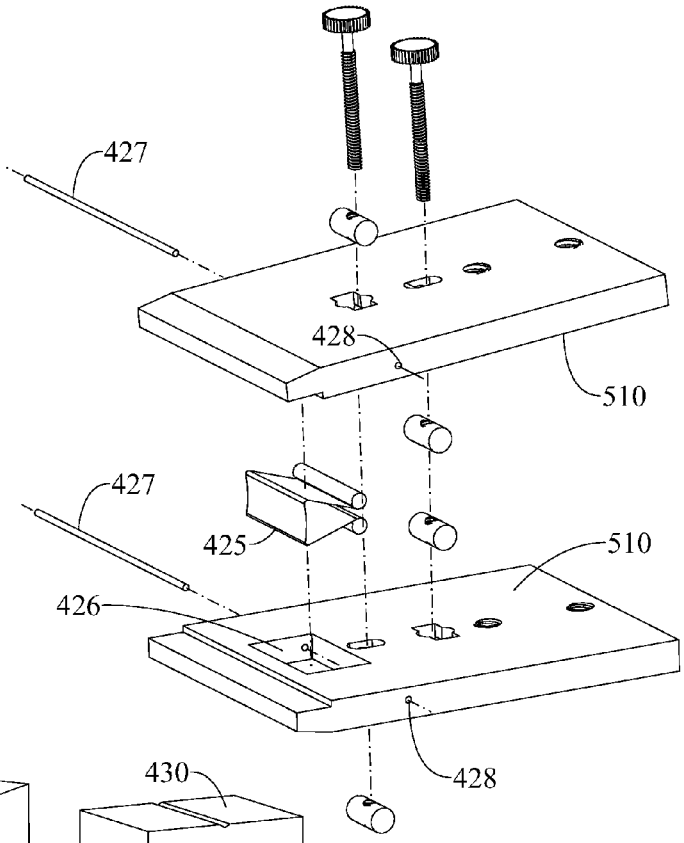

FIG. 19J shows an alternative embodiment of the knife clamp assembly shown in FIG. 14C. A knife clamp spring clip 425 (FIG. 19J), which fits into two spring clip sockets 426 (FIG. 19J) on inside surface alternate knife jaws 510 (FIG. 19J), held in by two spring clip pins 427 (FIG. 19J) that are inserted into two spring clip pin holes 428, (FIG. 19J) is shown. Thus the clamp jaws are spring loaded and may provide additional convenience to the user.

Figure 19K:
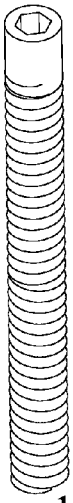

FIG. 19K shows an alternative embodiment for left and right hand threaded rod 308 of the clamp jaw assembly shown in FIG. 14C. Instead of removable thumbwheel 317, a threaded member with a hex socket is shown. Such would allow the clamping be accomplished by Allen wrench, instead of by turning a thumb wheel.

Figure 19L:
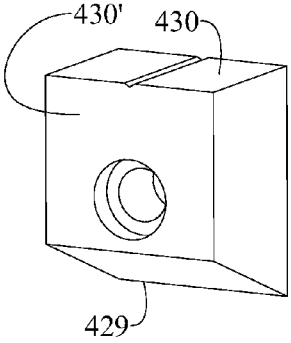
Figure 19L:
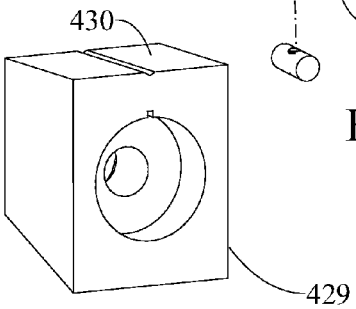

FIG. 19L shows an alternative embodiment of fingernail-v tool guide body 227 shown in sections 10 and 11. Instead of a clamping (V-groove) surface that meets the countersunk front end of the guide body at an (un specified—any) angle, alternate fingernail-v-tool guide body 429 (FIG. 19L) has a clamp surface 430 (FIG. 19L) that meets the front face of guide body 430' (FIG. 19L) at a 90° angle. Although the threaded bores for the clamp member bolts are not showing, alternate fingernail-v-tool guide body 429 is equipped with them.

Figure 19M:
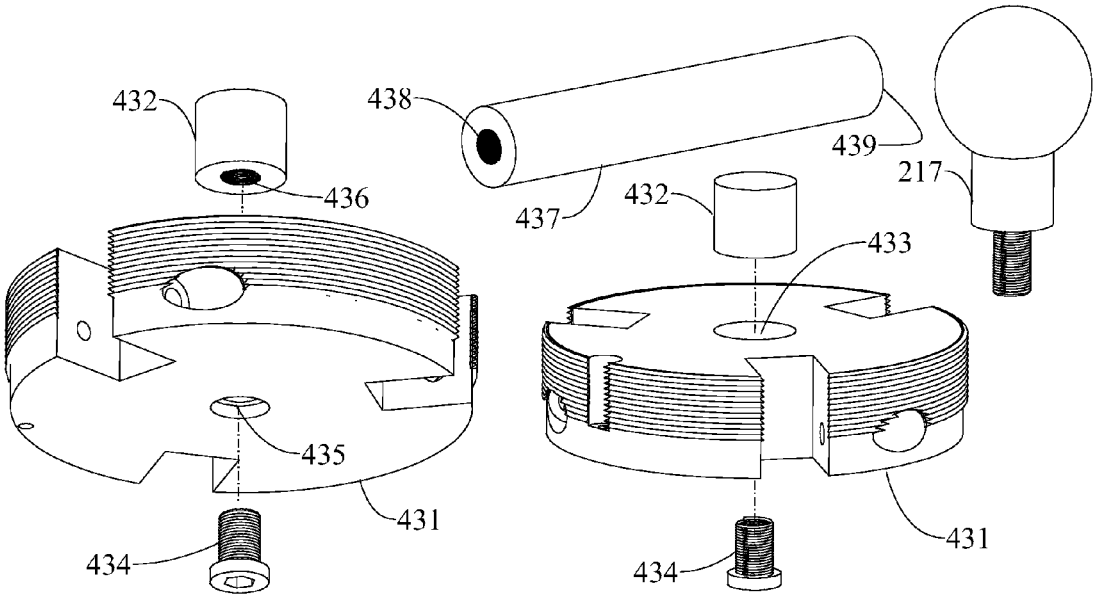

FIG. 19M shows an alternate base disk 431 and related alternate members, of height adjustable base disk 244 of sections 10 and 11. Instead of machined or molded in spherical cup 258, alternate base disk 431 has a spherical socket plug 432, which can be removed from a spherical socket plug bore 433, in alternate base disk 431, and replaced by a base disk alternate rod 437. Spherical socket plug 432 is attached to alternate base disk 431 by spherical socket plug bolt 434 through a countersunk unthreaded plug bore 435 on the underside of alternate base disk 431, which threads to a spherical plug threaded bore 436 on the underside of the removable spherical socket-plug. Included in this embodiment is base disk alternate rod 437 with a threaded end 438, that can be inserted into spherical socket plug bore 433 and bolted to the alternate base disk 431. A spherical cup or threaded end 439 can be used with future applications such as elevating an arm assembly higher off of a work surface. The end can be a threaded bore for attachment to future embodiments for other honing applications.

Figure 19N:
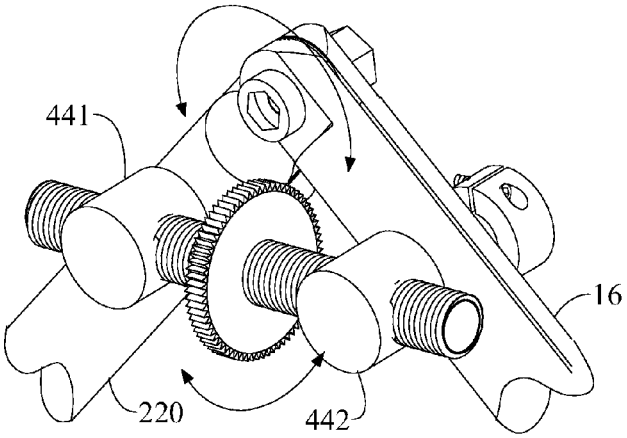
Figure 19O:
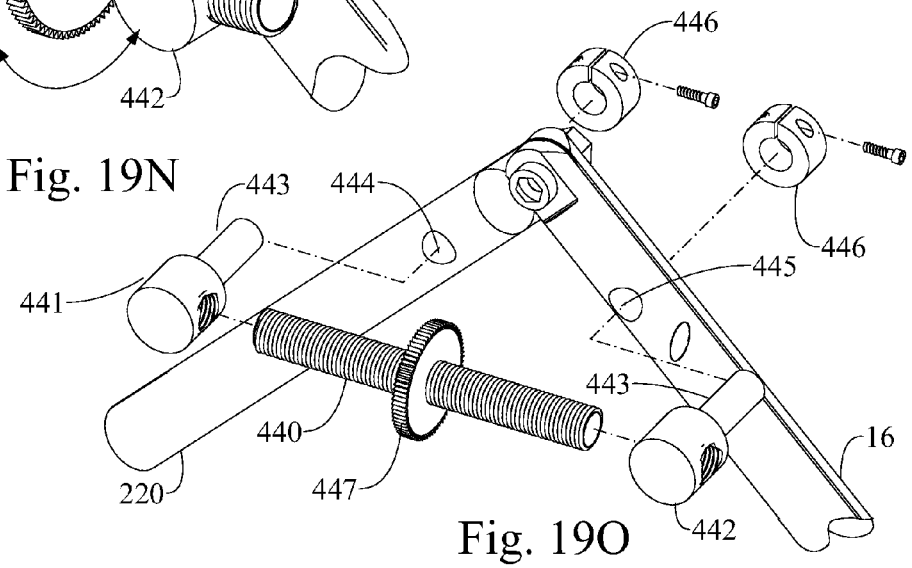

FIGS. 19N and 19O show a micro adjust assembly that can be used with the fingernail profile member assembly shown in FIGS. 10I, 10K and throughout section 10, and two slightly modified embodiments of main rod 16 and fingernail rod 220. It could also be used with the alternative embodiment of the honing guide base assembly shown in FIGS. 20A through 20O.

Two left and right hand threaded trunnion nuts 441 and 442 are installed onto the ends of a left and right hand threaded rod 440. Trunnion posts 443, are inserted into micro mount holes 444 and 445. The mount holes are modifications made to main rod 16 and fingernail rod 220. Two clamp collar-set screw sets 446 are then clamped onto the ends of trunnion posts 443, and hold the micro adjust assembly into place on the fingernail member assembly. When a micro adjust thumbwheel 447 (FIG. 19O) is turned, the trunnion nuts pull together or spread apart main rod 16 and fingernail rod 220, thus increasing or decreasing respectively, the bevel angle of the configuration. This embodiment could be convenient for the user to precisely adjust the bevel angle at the tool edge if the bevel angle blocks are used, or to calibrate the configuration to a specific bevel angle if the cut edge simulator unit is used.

FIG. 19E shows an alternative embodiment of main rod 16. This has the addition of a second multi bore rod keyway 464, which is 180° radially separated from keyway 17. The second keyway could be useful for some of the previous configurations. Although main rod end bore 56 in FIG. 19E is not shown as threaded, but is in fact threaded in the alternative embodiment, as in main rod 16.

Figures 20A, 20B, 20C, 20D:
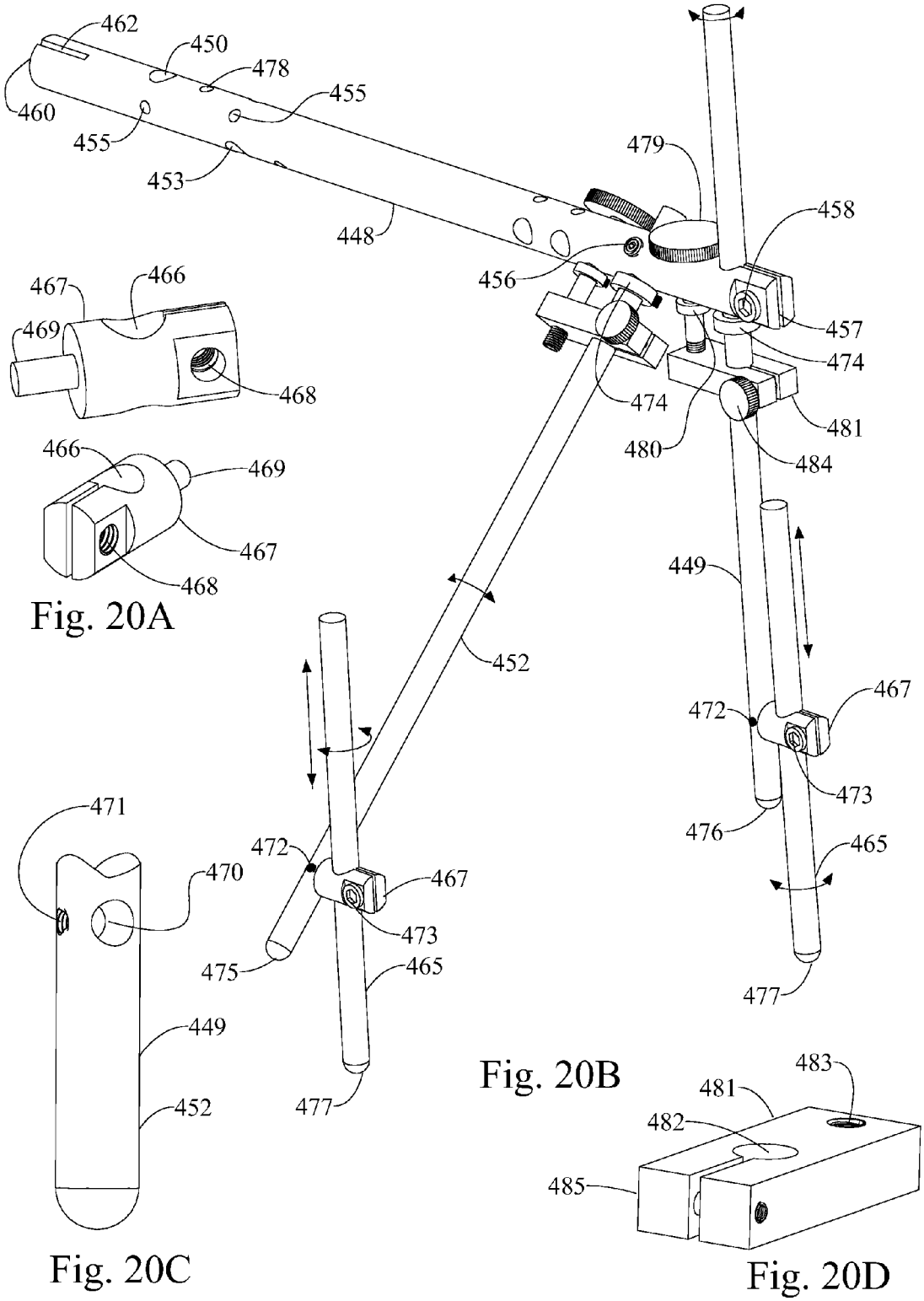
FIGS. 20A to 20V show alternative embodiments of elongated support member systems, including an alternative micro adjust system.
Figure 20E:
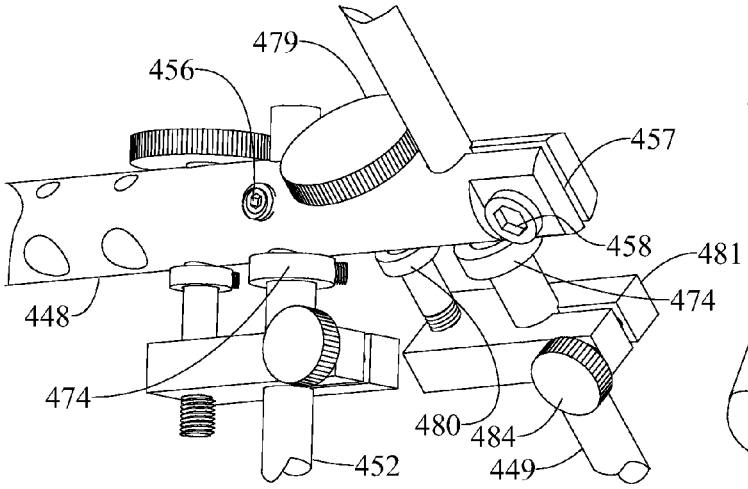
Figure 20F:
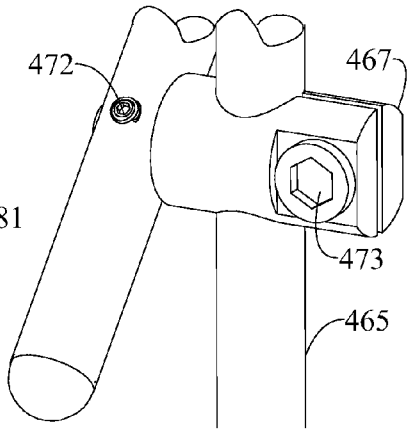
Figure 20G:
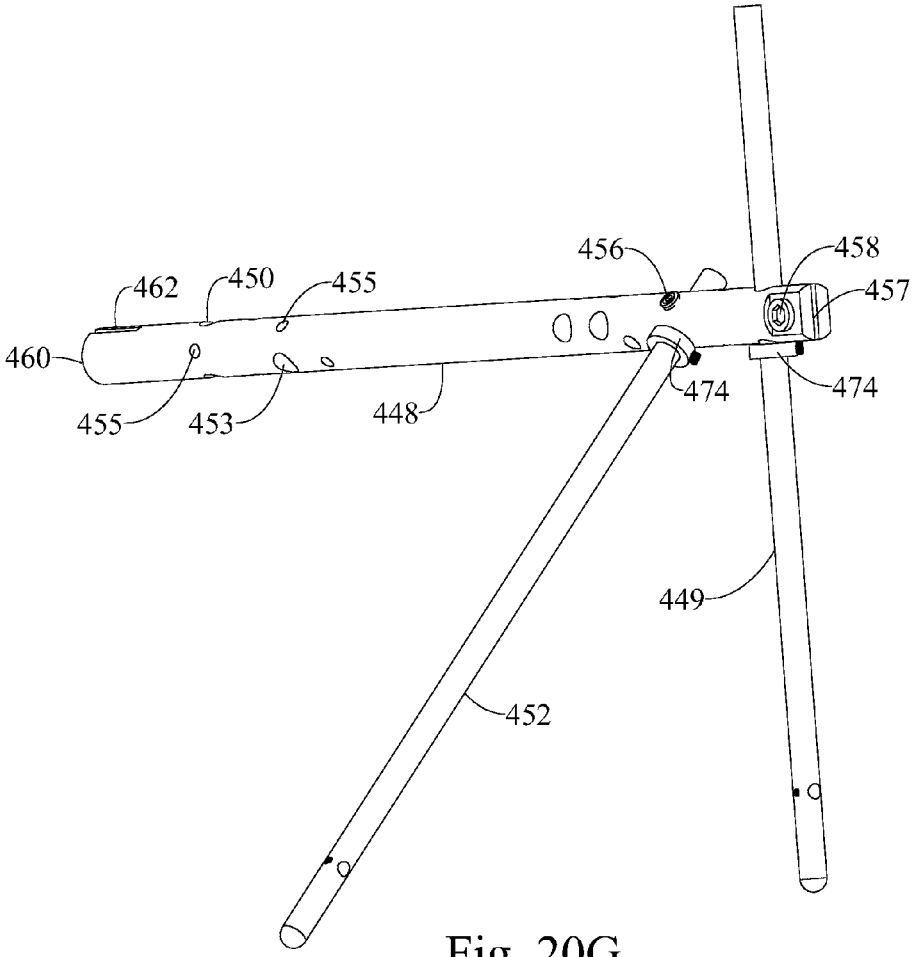
Figure 20P:
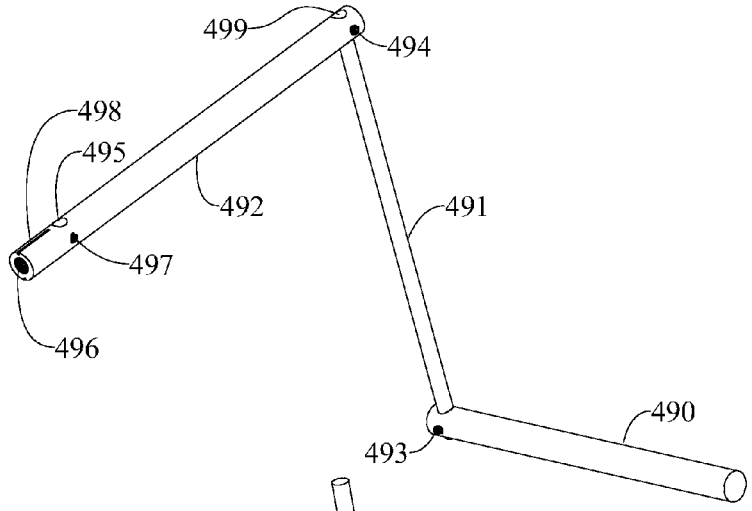
Figure 20Q:
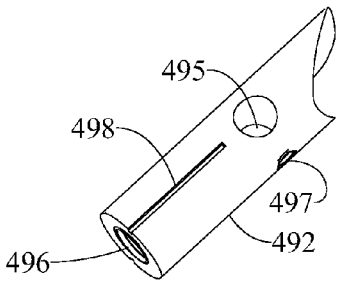
Figure 20R:
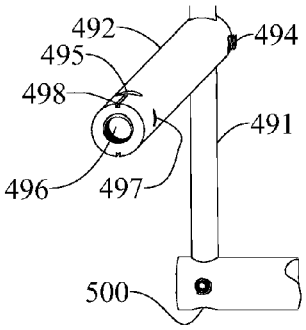
Figure 20S:
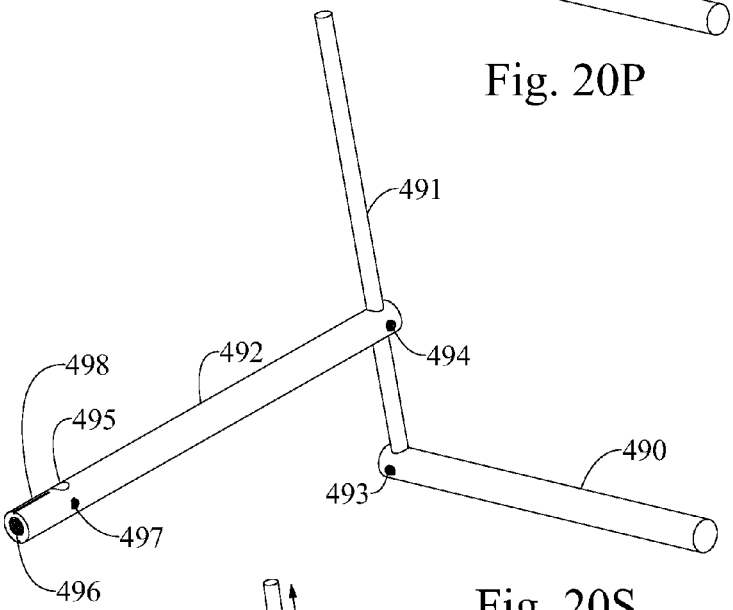
Figure 20T:
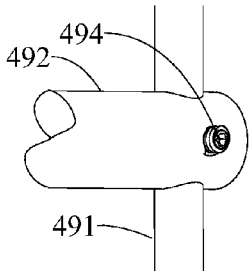
Figure 20U:
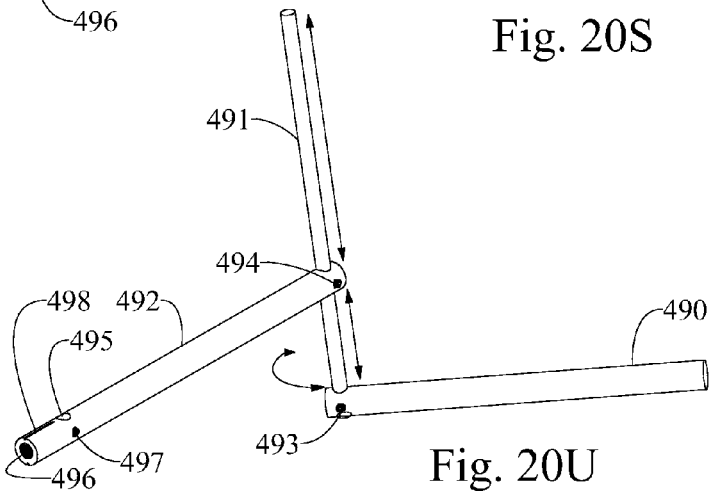
Figure 20V:
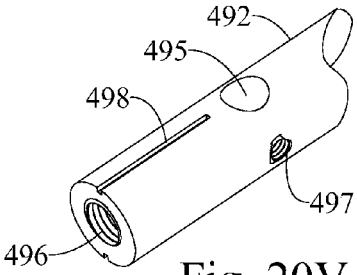

FIG. 20B shows an alternative embodiment of the honing guide base assembly shown in the previous sections. Instead of the sliding—rotating leg collar 3 used to adjust the bevel and skew angles of a configuration, a multi bore main rod 448 (FIGS. 20B, 20E, 20G, 20H, 20J, 20K, 20L, 20M, 20O) is connected to any of the guide bodies shown in this specification. The multi bore main rod is a cross bored rod (bores are perpendicular to the lengthwise axis of the rod). In this configuration, a bevel angle rod 449 to adjust the bevel angle (FIGS. 20B, 20E, 20G) is inserted into either a front bevel angle rod bore 450 (FIG. 20B, 20G, 20J, 20K, 20L), or a rear bevel angle rod bore 451 (FIG. 20H, 20J, 20K, 20L, 20M, 20O). The configurations shown in FIGS. 20B, 20E and 20G show bevel angle rod 449 installed into rear bevel angle rod bore 451. A skew angle rod 452 (FIGS. 20B, 20E, 20G) of a configuration is installed into either a front skew bore 453 (FIGS. 20B, 20G, 20J, 20K, 20L, 20M), or a rear skew bore 454 (FIGS. 20J, 20K, 20L, 20M). The rods can be locked into place in a desired setting by set screw bore lock 455 (FIGS. 20B, 20G, 20J, 20K, 20L, 20M) and a set screw 456 (FIG. 20B, 20E, 20G). However, if rear bevel angle rod bore 451 is used for the bevel rod, instead of a set screw lock, a fingernail rod tang clamp slot 457 (FIGS. 20B, 20E, 20G, 20J), a fingernail bolt 458 (FIG. 20B, 20E, 20G) through a fingernail bolt hole 459 (FIGS. 20J, 20K) with a nut and fingernail rod washer 224 and fingernail rod nut 225 (as in FIG. 10K) is used to clamp the bevel rod into position. This same fingernail rod tang clamp slot 457 is used in the fingernail profile assembly as shown in FIG. 10K.

Multi bore rod front end 460 (FIGS. 20B, 20G, 20J, 20K, 20L, 20M) can then be clamped into any guide body configuration as described in the previous. Or, if in the case of the fingernail or V tool configurations of sections 10 or 11, the guide body is bolted to threaded bore end multi bore rod 461 (FIG. 20O), as described in the previous. Multi bore rod keyway 462 (FIGS. 20B, 20G, 20J, 20O), and multi bore rod keyway 463 (FIG. 20O) serve the same function as keyways 17 and keyway 464 as in main rod 16 (shown in FIG. 19E).

To set the bevel and skew angles with this alternative base member configuration, both set screws 456 are loosened, the guide body and cutting edge are adjusted to a desired bevel and skew angle setting as described using the various previous methods, and skew angle rod 452 and bevel angle rod 449 are locked into place with set screw 456 and fingernail bolt 458 (if rear bevel angle rod bore 451 is used). Or, both set screws in set screw bore lock 455 are used (at guide body end of multi bore main rod 448). These set screws could be replaced with thumb screws if desired.

This alternative base member configuration also has an alternative embodiment to the height adjust members of section 4. A pair of alternate height adjust risers 465 (FIGS. 20B, 20C, 20F are inserted into trunnion riser bores 466 (FIG. 20A) in riser trunnions 467 (FIGS. 20A, 20B, 20F). Riser trunnions 467 have a trunnion riser clamp 468 as in previous described slotted clamps. A trunnion post 469 (FIG. 20A) is then inserted into a trunnion post mount bore 470 (FIG. 20C) on bevel angle rod 449 and skew angle rod 452. A trunnion lock bore 471 (FIG. 20C) in bevel angle rod 449 and skew angle rod 452 is then used to install a trunnion lock bore set screw 472 (FIGS. 20B, 20F) to lock the trunnion posts and thus the trunnions into position. A riser lock bolt 473 (FIGS. 20B, 20F) is then inserted into trunnion riser clamp 468, to lock alternate height adjust risers 465 into position. Next a skew & bevel rod collar 474 (FIGS. 20B, 20E, 20G) is installed onto skew angle rod 452 and bevel angle rod 449. Skew angle rod 452 and bevel angle rod 449 are then installed into either front skew bore 453 and front bevel angle rod bore 450, or rear skew bore 454 and rear bevel angle rod bore 451 respectively, and locked into place with set screw bore lock 455 and fingernail bolt 458 if using the rear slotted clamp. When the set screws in threaded skew and bevel lock bores are loosened (front end), or when set screw and fingernail bolt 458 is loosened if rear bevel angle rod bore 451 is used, rods skew angle rod 452 and bevel angle rod 449 are free to rotate in the bores.

The procedure for using alternate height adjust risers 465 is the same as discussed in section 4 with a few exceptions. When the alternative risers are used in this alternative configuration, instead of using set screw bore lock 455 to lock the risers into place, skew & bevel rod collar 474 are used to lock into place a desired skew and bevel angle setting of a configuration. Doing so allows skew angle rod 452 and bevel angle rod 449 to freely rotate even after a bevel and skew angle for the configuration has been set. In place of leg collar 100 in section 4, which is used to rotate the riser leg into position, the skew and bevel rods are rotated, and riser trunnions 467 is rotated in trunnion post mount bore 470. The perpendicular stop radius 112 of section 4 is then used to set the riser rods perpendicular to a work surface while all four ends of the riser legs, and the bevel and skew legs, are contacting the work surface. Once perpendicular, and a skew rod end 475 (FIG. 20B), a bevel rod end 476 (FIG. 20B) and riser rod end 477 are all contacting a work surface, trunnion lock bore set screw 472, riser lock bolt 473, set screw 456 and fingernail bolt 458 lock the configuration into place. When an abrading surface of a differing thickness or height is used, raising or lowering alternate height adjust risers 465 as described in section 4 will set the configuration to match the new height of an abrading surface.

A group of (optional accessory, not required for unit to function) micro adjust members can also be used with this configuration. A micro adjust screw with micro adjust thumbwheel 479 (FIGS. 20B, 20E) is inserted into either of two bevel rod micro adjust bore 478 (FIGS. 20B, 20J, 20L, 20M). Two skew rod micro adjust bores 486 (FIGS. 20J, 20K, 20L, 20M) are used for skew angle rod 452. A micro adjust collar & setscrew 480 (FIGS. 20B, 20E) is then inserted onto the micro adjust screw shaft. The thumbscrew is thus locked into place on member surface 448 and the thumbwheel is flush to the outside surface of multi bore main rod 448 such that it can freely rotate, but not move lineally in bevel rod micro adjust bore 478. A micro adjuster collar 481 (FIGS. 20B, 20D, 20E) is then inserted onto skew angle rod 452 through a micro adjust rod bore 482 (FIG. 20D). The threaded end of the micro adjust screw is then threaded into a micro adjust threaded bore 483 (FIG. 20D) in micro adjuster collar 481. A micro adjust thumbscrew lock 484 (FIGS. 20B, 20E) is then threaded into micro adjust clamp bore 485 (FIG. 20D) of micro adjusting collar 481. The assembly process is repeated for bevel angle rod 449. To use the micro adjust members, micro adjust thumbscrew locks 484 are loosened and an approximate skew and bevel angle setting is locked in with skew & bevel rod collar 474. Once locked in, micro adjust thumbscrew lock 484 is tightened just enough such that it can move freely but with some friction along bevel angle rod 449 and skew angle rod 452. Micro adjust thumbwheel 479 is adjusted such that micro adjuster collar 481 is approximately mid way along the threaded portion of the thumb screw. Micro adjust thumbscrew lock 484 is then tightened to grab the skew and bevel rod, and the micro adjust thumb wheels can then be used to dial in a desired bevel and skew angle for the configuration by moving a short distance the rods through the main member bores. Therefore, 479, 480, 481, 482, 483, 484, 485, 486 are to be considered an accessory package to this alternate embodiment, and a rod 448 which includes added bores 486 and 478 would be an alternate embodiment, of 448.

A member for this alternative embodiment is a mirror image adapter 487 (FIG. 20H, 20I, 20N). Mirror image adapter 487 can be installed onto the slotted clamp end as shown in FIGS. 20H and 20I. When installed onto multi bore main rod 448, mirror image adapter 487 can be mounted to a guide body. This is useful for orienting multi bore main rod 448 in a mirror image of itself, such that skew angle rod 452, as shown in FIGS. 20B and 20G can be useful for V-tool honing applications.

Two final bores in multi bore main rod 448 are 2 fingernail stop bores 488 (FIG. 20K) and fingernail stop bore locks 489. These bores can be used to insert stop rods into multi bore main rod 448 for purpose of having a secondary stop for a full swing of the fingernail member configuration.

Front bevel angle rod bore 450 and front skew bore 453. These are used if a relatively high bevel angle is wanted, generally approaching or above 45 degrees. For most honing situations however, rear bevel angle rod bore 451 and rear skew bore 454 should suffice.

Skew rod end 475, bevel rod end 476 and riser rod end 477 as in the previous, are spherical machined in, or hardened steel balls attached by welding, brazing, industrial adhesive or by some other technique.

See Drawing FIGS. 20P through 20V for the rest of this specification. FIGS. 20P through 20V show an additional alternative embodiment of a honing guide base assembly. The members are comprised of an alternate base rod 490, an elevator rod 491, and a main rod 492. Any of the guide bodies can be clamped to main rod 492 as in the previous. There is a threaded guide body bore 496 which allows for fingernail-v tool guide body 227 to be bolted on to the end of the main member. A keyway 498 which serves the same function as in the keyway for main rod 16.

Once a guide body is clamped on to main rod 492, elevator rod 491 is inserted into a base rod elevator bore 500 and locked into place with a base rod setscrew clamp 493. An elevator rod bore 499 can then be inserted onto elevator rod 491. It is this joint, elevator rod bore 499, which sets both bevel and skew angles for a configuration. As main rod 492 is raised along elevator rod 491, the bevel angle is increased. As it is lowered, the bevel angle is decreased. As main rod 492 is rotated in elevator rod bore 499, the skew angle for a cutting edge can be adjusted. Once a bevel and a skew angle for the configuration have been set, a main rod setscrew clamp 494 is tightened, and the configuration is ready to hone. Alternate base rod 490 acts as a base for the configuration as the tool edge and alternate base rod 490 are run across an abrading surface and work surface respectively.

Elevator rod 491 can be inserted into a front elevator bore 495 and tightened with a threaded bore lock 497 if a steeper bevel angle range is desired.

Additional Members not Shown in the Drawing Figures

V block inserts for large gouges can be used with the fingernail or V tool configurations. Although these v-blocks are not shown in the drawing figures for this specification, they are shown in the referenced provisional filing drawings. The v-blocks have through bores perpendicular to the upper and lower (mount) surfaces, into which fingernail clamp bolts 233 can be inserted, and are bolted onto the clamping surface of fingernail-v tool guide body 227 or on the clamp surface 430, of alternate fingernail-v-tool guide body 429. They align to the edges of the smaller V groove on the clamping surface of either body, and can aid in the centering and clamping of very wide shanked gouges and v tools.

An additional member that is useful for the honing guide base assembly shown throughout this specification is a secondary camber base member into which the legs 1, 7 or 8 seat in to. This is a slightly arched elongated member such as a slightly bent or radiused rod, which contacts a work surface, having sockets into which leg 1, 7, 8 ends seat in to. The secondary camber base member allows for a slight rocking motion of the base legs during honing, and provides a slight curvature on the edges of chisels and the like. A camber edge on a chisel or a plane blade is desirable to many wood workers; placing a slight arc or taper on the cutting edge can prevent tool marks in wood.

A honing guide body not shown, utilizes the same clamping method as shown in the drawing figures for section 17 for tools having flat shanks. The difference being, instead of the flat shank clamp jaws 357 and 358 mounted into the sleeve as shown in section 17, they are mounted into a guide body similar to 227 or 429 with the same type of rod and clamp slot 360 and the same type of centering disk slot 368 as shown in section 17. This guide body has the same type of attachment to a rod such as the v-tool rod 267 or main rod 16. This would be for purpose of honing flat shanked tools having cutting edges such as skewed or non skewed chisels and the like, in a v-tool type configuration as shown in section 11.

Alternate Embodiments of Members not Shown in the Drawing Figures

An alternate embodiment that should be mentioned in this section is the slightly modified leg collar 3 that is shown in drawing FIGS. 15A and 15B. This collar has the addition of one bevel adjust mount bore 340, which is shown in these two drawing Figs. Bevel adjust mount bore 340 is for the accommodation of the micro adjust feature discussed in Section 15.

An alternate embodiment of the sleeve housings for sleeved gouge guide body 20, is a version of medium sleeve housing 45 and large sleeve housing 50 with larger outside diameters. A relatively larger sleeved gouge guide body 20 with relatively larger sleeve housings (holding sleeve housing bores and thus sleeves to the same diameters), and larger diameter bore 33, has no guide body tang slot 52, since the housing walls are thicker. There are advantages for both versions. The smaller version takes up less space and is easy to handle for small tools, and the larger version works well with larger gouge sizes but can still hold the smaller gouges. A third embodiment is a small version of sleeved gouge guide body 20 designed only for the smallest of gouges, and having no guide body tang slot 52.

An alternate embodiment for sleeved gouge guide body 20 is sleeved gouge guide body 20 with out t-slot 38 and without t-nut 37. Instead, mounting crankshaft dial 39 to a fixed position on sleeved gouge guide body 20, to a threaded bore near the location of the T slot, is the alternative. A plurality of different length crank shafts 43, each sized matched to each differently sized sleeve and housing set, would be the alternative to moving the dial vertically and clamping for adjustment to the sleeve size.

An additional alternate embodiment of sleeved gouge guide body 20 is a modified body with a simple arm mounted on the back of the guide body, with a catch on the end, to catch the sleeve crank pin, such that the sleeve can be locked into position for other applications that do not require rotation, such as for honing v-tools or other flat blades.

A slightly simpler version of the honing guide base configurations of the prefixed 20 drawing figures, is a modified multi bore main rod 448. In this simpler version, the outside diameters of bevel angle rod 449 and skew angle rod 452 are threaded. The bevel and skew angles would then be adjusted by rotating skew angle rod 452 and bevel angle rod 449 in threaded bores 450, 453, 454, 451, to adjust for skew and bevel angles. The rods are then are locked into place with set screw bore lock 455—and fingernail bolt 458—if rear bevel angle rod bore 451 is used.

An alternate embodiment of the alternative honing guide base assembly shown in FIGS. 20P through 20V, is hardened steel (or other hardened material) balls or hemispherical or rounded shaped ends, on both ends of alternate base rod 490. Such would aid in lowering friction of alternate base rod 490 as it moves across a work surface.

An alternate embodiment of the honing guide base assembly of section 20, would be base rod elevator bore 500 located in the middle of an alternate base rod 490, instead of on the end of alternate base rod 490. In other words, alternate base rod 490 and elevator rod 491 would show as a T-shaped base, instead of an L shaped base. Alternate base rod 490 would still rotate and be clamp able, relative to elevator rod 491 in this configuration, in order to set skew angles.

An alternate embodiment for main rod 16 is a relatively oversized outside diameter of the rod, holding the end of the rod which mounts into main rod bore 19, to the same outside diameter shown in the drawings. This would allow for a larger rod bore 9 on the leg collars and a greater surface area to clamp to, with out requiring an increase in the diameter of the guide body main rod bore 19 and in the sizes of the guide bodies.

An alternate embodiment for planer blade c-clamp 284 and planer blade clamp base 286 would be fewer planer trunnion nuts 288, and fewer planer blade clamp thumbscrews 282 with fewer associated trunnion slots in the clamp assembly.

An alternate embodiment of the honing guide base assembly which uses legs 1, 7 and 8 and leg collar 3, is a triangular shaped plate member, with rounded ends at 2 vertices of the triangle plate which act as points of contact between a work surface, and the configuration. Leg collar 3 is thus modified, such that instead of the threaded bores 4 and 5, has a slot which arcs in radial fashion over the outside diameter of the leg collar, into which the triangular shaped plate is inserted in to, and attached with a threaded fastener through the rear face of the leg collar and the triangle plate.

An alternate embodiment of the honing guide base assembly of legs 1, 7 and 8 and leg collar 3, is an embodiment of unthreaded ends of the three legs which fit into altered and unthreaded bores 4, 5 and 59. In this alternate embodiment, the legs are allowed to rotate in the bore holes. The legs can be rotated along their lengthwise axes, and locked into position by a setscrew or bolt via a threaded bore through the face of leg collar 3 and into the alternate unthreaded leg bore. The purpose of this is to provide the same functionality that is shown in the drawing FIG. 20B, in which the support legs are able to rotate. In this embodiment however, legs 1, 7 and 8 are able to rotate in the bores by virtue of the leg ends in contact with and resting on the end surfaces of the alternate unthreaded bores, instead of requiring the collars 474 as a means of support. The legs are provided with bores similar to bores 470 and 471 near the rounded ends, so that riser trunnions 467 shown in FIG. 20A can be inserted and locked as described in section 20. The riser trunnions are used with the leg risers to provide the same functionality as the risers of section 4. These risers in this alternate configuration can be used with the height gauge perpendicular stop 110 and the height gauge rod 109, and the perpendicular abrading height differential method of the earlier section provides base height adjustability for abrading surfaces of differing thicknesses in this alternate configuration. The mirco adjusters shown in FIG. 20B would not be used in this alternate embodiment however; instead the micro collar of section 15 is used.

An alternate embodiment of a honing guide base assembly is two base legs attached to the leg collar 3, in a fashion similar to what is shown FIGS. 19N and 19O for the fingernail profile configuration. In this embodiment, the legs are mounted and bolted to leg collar 3 slots such that they are spread—able by trunnion nuts attached to the legs in a similar fashion as 20*l* and 20*m* such that they can be spread apart, thus increasing or decreasing elevation of a configuration. The trunnion nuts can also be configured in a way similar to the way trunnion nuts are inserted into drafting compasses.

CONCLUSION, RAMIFICATIONS AND SCOPE

From the description above, a number of advantages of some embodiments of a modular honing guide system become evident The benefits of a unified parts interchangeable system for the sharpening and honing of a wide variety of tools on a non motorized planar surface include but are not limited to:

(a) A system that is capable of honing a wide variety of tools used in woodworking, wood carving, finish carpentry, printmaking, jewelry making, metal smith or silver smith work and related arts and crafts, which provides a simple and uniform method of adjusting bevel and skew angles for a wide variety of tool types. Thus, the user can learn the same method or system for a wider variety of tools, rather than learning how to use several disparate tools and or methods for individual tool groups.

(b) In some embodiments in the description, honing guide configurations allows full access to an abrading surface, with no need to run the honing guide on an abrading surface.

(c) All embodiments have a system to provide for base height adjustability of the honing guide configuration, such that when abrading surfaces of differing heights are used to hone a tool during the same honing session, bevel and skew angles can remain constant while the configuration is adjusted for abrading surface height differentials.

(d) In the embodiments, the tool edge can be run across an abrading surface in a completely random pattern of movement. This provides for a sharper and more uniformly honed tool edge, as well as for more even wear of an abrading surface. Thus, extending both tool life and abrading surface life.

(e) There are no limitations as to the size of the honing stone or abrading surface that can be used. Even the smallest of abrading surfaces can be used even for large tool edges, while keeping bevel and skew angles constant, since the honing guide base operates on a work surface, and not an abrading surface.

(f) The embodiments shown are part of a unified modular parts interchangeable system, such that at least a plurality of members in any one honing guide configuration can be used in other configurations.

(g) Tiny short shafted gouges used in wood cut printmaking can be uniformly honed to an inch or less shank length allowing the gouge tool holding apparatus full passage over an abrading surface.

(h) Honing of fingernail profiles on gouges, of which traditionally have required motorized equipment to accomplish, can now be maintained at a consistent bevel angle by non motorized honing on a planar abrasive surface.

(i) Due to the geometry of the design, honing in many cases is near effortless, since the honing guide base can be held at or near the rear of many configurations. This allows the weight of the front end of the configuration to do most of the work, since the base is moved across a work surface while the tool edge moves across an abrading surface.

(j) Honing and sharpening a wide range of widths of cutting edges on flat edge-tool shanks is possible. Cutting edges down to fractions of an inch width and thickness, such as tiny, short length Japanese style carving knives commonly used in the art of woodcut printmaking, as well as wide, thicker hand plane blades, chisels and other various flat blades and skew knives, can be honed.

(k) A new way to hone etching and dry point needles for printmakers is provided.

(l) A quick and simple way to hone both sides of a doubled beveled edge tool is provided.

Although the description above contains many specificities, these should not be construed as limiting the scope of the embodiments but as merely providing illustrations of some of several embodiments. For example, many of the bolts shown in the drawing figures, for example clamp guide bodies to the main rod or to clamp collars etc, can be replaced by knurled thumbscrews or other types of threaded fasteners to perform the same function. Gouge sleeves can have other shaped tangs. More than one tang slot or differently shaped tang slots in the sleeve housings can be employed. Guide bodies such as those for the fingernail and v-tool embodiments can be differently shaped. The skew and bevel adjustment by the leg collar and legs on the main rod would not need to be accomplished by other forms or types of clamping. The ball ends of the legs can be differently shaped, or a ball and cup can be used on the leg ends to provide for a rotatable ball in a cup. A flange could be added to guide body main rod bore such that it would act as a stop for the main rod or other rods shown in the specification.

Thus the scope of the embodiments should be determined by the appended claims and their legal equivalents, rather than by the examples given.

I claim:

1. A modular, member interchangeable honing guide system for holding and sharpening or honing a plurality of differently shaped edge-tools, of which a plurality of honing guide configurations are moved with random or unidirectional manual motion across a work surface, and a cutting edge of the edge-tools are moved across an abrading medium, the modular honing guide system configurations capable of interchangeably mounting and positioning a plurality of interchangeable edge-tool clamps or guide bodies comprising:

a honing guide base configuration and a honing guide body configuration, the honing guide base configuration comprising an elongated main rod, at least one elongated base leg, an annular leg collar, and a key the main rod configured with at least one indexing keyway groove arranged on an outer surface to indexably clamp an end to the honing guide body configuration, the annular leg collar configured with a plurality of leg collar keyway grooves angularly spaced on an inside diameter to indexably align one of the plurality of leg collar keyway grooves with the at least one indexing keyway groove on the main rod wherein a key is selectively inserted into both the indexing keyway groove and the leg collar keyway groove to fix an angular position between the annular leg collar and the main rod, the leg collar, with the fixed angular position, configured to slide and rotate along the outer surface of the main rod and adjustably mount to the main rod to lock a desired sharpened bevel angle and skew angle, the at least one elongated base leg removably secured, or permanently affixed, to the leg collar to radially extend from the leg collar wherein the sharpened bevel angle and skew angle of a tool with a cutting edge is set and maintained during random or uniform motion of the honing guide against the abrading medium, the honing guide body configuration comprising a tool holding portion and a base member attachment interface longitudinally spaced from the tool holding portion wherein the base member attachment interface to provide an indexable attachment interface to secure the end of the main rod at a selected angle relative to the honing guide body configuration;

wherein the tool with a cutting edge to be sharpened is secured into the honing guide body configuration, the honing guide body configuration is attached to the end of main rod at an indexable angle, the at least one elongated base leg is secured to the annular leg collar, the annular leg collar is indexed on the main rod to a desired skew angle relative to the honing guide body and slidably positioned along the outer surface of the main rod and locked at a desired bevel angle and skew angle, wherein the honing guide system configuration is placed with the at least one elongated base leg resting on a work surface with the cutting edge to be sharpened placed on an abrading medium held at a desired bevel and skew angle while random or uniform motion is applied to the assembled honing guide system to currently slide the base leg along the work surface and slide the cutting edge of the tool along the abrading medium to perform a desired sharpening operation.

2. The modular honing guide system of claim 1, wherein the leg collar locks into position on the elongated main rod to set both the skew and bevel angle with a single thumbscrew, a single bolt or a single fastening point.

3. The modular honing guide system of claim 1, further including a skew-bevel registration collar indexed on the main rod to a desired skew angle relative to the honing guide body and slidably positioned and locked along the outer surface of the main rod adjacent the surface of the leg collar, for the contactual registering of a radial and a lineal position of the leg collar along the main rod, and the duplication or mirroring and or maintaining of a double bevel and a skew angle of a plurality of cutting edges on edge-tools.

4. The modular honing guide system of claim 1, wherein the at least one elongated base leg further includes one or a plurality of a riser leg, one or a plurality of a riser collar, a height gauge rod, and a height gauge-perpendicular stop, for abrading surface height differential positioning for a tool edge to be sharpened on an abrading surface.

5. The modular honing guide system of claim 1, further including a cut edge simulator assembly fixable to the tool holding portion of the honing guide body configuration, for simulation of a bevel, skew and v-angle of a tool edge, for purpose of calibrating the modular honing guide system to a bevel, skew and v-angle for a tool edge to be sharpened.

6. The modular honing guide system of claim 1, wherein the honing guide body configuration comprises a plurality of different diameter gouge clamping sleeves and matching sleeve housings sized for a plurality of gouges with various shaft diameters, wherein axis of rotation of the plurality of clamping sleeve diameters is proximately collinear to a lengthwise centerline axes of the gouges with various shaft diameters, the plurality of gouges fixable inside the clamping sleeves, the matching sleeve housings individually mounted to a gouge guide body, the clamping sleeve freely rotatable inside an offset bore near outside diameter of the matching sleeve housing, a sleeve crank pin located on a crank or rim of the clamping sleeve, a crankshaft dial is vertically positionable and lockable on the gouge guide body, a dial crank pin attached to a crankshaft dial, a crank shaft attached between the sleeve crank pin and the dial crank pin, the gouge guide body attached to the main rod, the crankshaft dial providing de-amplified motion of a user's hand while rotating the gouge for uniform precise motion, wherein the gouge clamped into the clamping sleeve selected from a group of sleeves to match the gouge shaft diameter, whereby the honing guide base configuration attached to the gouge guide body is moved with random or uniform motion across the work surface, a cutting edge of the gouge moved over the abrading medium resting on the work surface, the crankshaft dial rocked back and forth to uniformly rotate the gouge, thus providing a uniformly sharpened or honed bevel angle at a cutting edge of the gouge.

7. The modular honing guide system of claim 1, wherein the honing guide body configuration comprises a flat tool guide body configuration, the flat tool guide body being a threaded rod with a rectangular tool slot cutting entirely through the threaded rod, the flat tool guide body including a set of large and small v-blocks and large and small single bevel blocks, the set of either large and small v-blocks or large and small single bevel blocks arranged inside the rectangular tool slot, a flat blade dial having a recessed bore seat, the flat blade dial being threaded onto the flat tool guide body, ends of the large v-block or large single bevel block nesting in the recessed bore seat of the flat blade dial, rotation of the flat blade dial applies clamping pressure to the large v-block or the large single bevel block, thus to lengthwise edges of single and double bevel flat tools, whereby a flat tool is clamped, the flat tool guide body attached to the main rod, whereby the honing guide base configuration attached to the flat tool guide body is moved with random or uniform motion across the work surface, a cutting edge of the flat tool moved over an abrading surface resting on the work surface, thus providing a uniformly sharpened or honed bevel angle at the cutting edge.

8. The modular honing guide system of claim 1, wherein the honing guide body configuration is configured to sharpen tools consisting of wood carving tools, wood working tools, metal work tools, carpentry tools, metal smith tools, silver smith tools, jewelry making tools, parting tools, chisels, gouges, fingernail gouges, v-tool, hand plane blades, power planar blades, axes, hatchet blades, knives, and printmaking tools, such as gravers and scribers, elliptic tint tools, and buins.

9. A honing guide for gouges for honing a cutting edge of a gouge against a top surface of an abrading medium, comprising;

a plurality of differently sized gouge clamping sleeves and matching sleeve housings, sized for honing a plurality of gouge shaft diameters against a top surface of an abrading medium, wherein a honing guide configuration for a specific sized gouge comprises;

a clamping sleeve including an outer cylindrical surface and an inner diameter hole for fixing a shaft of the specific sized gouge for a honing operation on a cutting edge of the specific sized gouge, wherein the outer cylindrical surface and the inner diameter hole are concentrically located about a clamping sleeve centerline, the clamping sleeve having a crank lever projecting radially from the outer cylindrical surface of one end of the clamping sleeve, the crank lever including a sleeve crank pin interface located on its distal end projecting parallel to the clamping sleeve centerline, or the sleeve crank pin interface located on a face of the sleeve projecting parallel to the clamping sleeve centerline;

a matching sleeve housing shaped to include a bottommost surface, a cylindrical groove formed cutting through the bottommost surface, the cylindrical groove having a groove centerline located above the bottommost surface, the cylindrical groove sized to rotationally receive the outer cylindrical surface of the clamping sleeve;

a gouge guide body containing a mating surface to secure the matching sleeve housing with the bottommost surface projecting downward toward the top surface of the abrading medium, the gouge guide body additionally containing a support base member attachment interface longitudinally spaced from the mating surface, a crankshaft dial rotationally attached to the gouge guide body proximate the mating surface, the crankshaft dial containing a dial crank pin interface radially offset from the pivotal attachment location and projecting parallel to the clamping sleeve centerline, an elongated crankshaft containing a longitudinally spaced first and second end, the first end pivotably connected to the sleeve crank pin interface and the second end pivotably connected to the dial crank pin interface, an elongated support base member system attached to the support base member attachment interface of the gouge guide body for providing an adjustable and lockable sharpened bevel angle and skew angle position at the cutting edge of the specific sized gouge;

wherein the specific sized gouge is fixed inside the clamping sleeve, the clamping sleeve is rotationally mounted about the clamping sleeve centerline within the cylindrical groove of the matching sleeve housing, the matching sleeve housing is mounted to the mating surface on the gouge guide body, the crankshaft dial is rotationally mounted to the gouge guide body, the elongated support base member system is clamped to the gouge guide body to set the sharpened bevel angle and skew angle of the cutting edge of the specific sized gouge and the first and second ends of the elongated crankshaft linking a rotation movement of the crankshaft dial to a uniform precise rotational movement of the clamping sleeve and the cutting edge of the specific sized gouge against the top surface of the abrading medium.

10. The honing guide for gouges of claim 9, wherein the crankshaft dial is vertically positionable and lockable on the gouge guide body.

11. The honing guide for gouges of claim 9, wherein a lengthwise axes of the shaft of the specific sized gouge is fixed inside the clamping sleeve such that the lengthwise axes of the shaft is proximately collinear with the clamping sleeve centerline.

12. The honing guide for gouges of claim 9, further comprising an annular scriber sleeve collar sized to slidably lock onto the shaft of a scriber providing an adjustment to an overall extended length the cutting edge of the specific sized gouge extends from the clamping sleeve.

13. The honing guide for gouges of claim 9, wherein the elongated support base member system comprises an elongated main rod, at least one elongated base leg, and an annular leg collar, an end of the main rod configured to indexably clamp to the support base member clamping interface of the gouge guide body, the annular leg collar adjustably mounted to slide and rotate along the main rod and lock into position to set the sharpened bevel angle, the at least one elongated base leg removably secured, or permanently affixed, to the leg collar to radially extend from the leg collar wherein the sharpened bevel angle of the tip of the specific sized gouge is set and maintained during random or uniform motion of the honing guide against the abrading surface.

14. The honing guide for gouges of claim 13, wherein the leg collar locks into position on the elongated main rod to set both the skew and bevel angle with a single thumbscrew, a single bolt or a single fastening point.

15. A honing guide for flat tools for honing a cutting edge of a flat tool against a top surface of an abrading medium, comprising;

a flat tool guide body containing a flat tool holder portion and a support base member attachment interface portion longitudinally spaced from the flat tool holder portion, wherein the flat tool holder portion comprises an elongated externally threaded body with an outside diameter and a threaded body centerline, a substantially rectangular flat tool slot cut entirely through the outside diameter of the elongated externally threaded body, the substantially rectangular flat tool slot forming two short slot sides having a slot height with a shortest dimension extending perpendicular to the threaded body centerline and two long slot sides having a slot length having a longest dimension extending parallel to the threaded body centerline;

a small holder block with a first tool supporting surface and a first opposing mounting surface and a first height selected to substantially match the slot height and a first length shorter than the outside diameter of the elongated externally threaded body, a large holder block with a second tool supporting surface and a second opposing mounting surface and a second height selected to substantially match the slot height and a second length longer than the outside diameter of the elongated externally threaded body, a flat blade dial comprising an internal threaded hole sized to thread onto the externally threaded body of the flat tool guide body, an elongated support base member system attached to the support base member attachment interface of the flat tool guide body for providing an adjustable and lockable sharpened bevel angle and skew angle position at a cutting edge of the specific sized flat tool wherein the mounting surface of the small holder block is adjustably fixed to one of the two short slot sides inside the substantially rectangular flat tool slot of the flat tool guide body with the first tool supporting surface facing the second of the two short slot sides;

wherein the large holder block is slidably mounted inside the substantially rectangular flat tool slot of the flat tool guide body with the second tool supporting surface facing the first tool supporting surface of the small holder block with distal ends of the large holder block projecting radially outward from the externally threaded body of the flat tool guide body;

wherein the flat blade dial is arranged to thread onto the externally threaded body and directly contact the projecting distal ends of the second opposing mounting surface providing a controlled adjustable position of the large holder block relative to the small holder block as the flat blade dial is rotated toward or away from the small holder block;

wherein a flat tool is placed inside the substantially rectangular flat tool slot of the flat tool guide body with a first tool edge of the flat tool against the first tool supporting surface of the small holder block and a cutting edge of the flat tool projecting a desired distance from the outside diameter of the external threaded body, the large holder block is arranged to slide toward the small holder block by the rotation of the flat blade dial while in contact with the distal ends of the large holder block projecting radially outward from the externally threaded body of the flat tool guide body to a point where the second tool supporting surface of large holder block contacts a second tool edge of the flat tool to create a clamping pressure to secure the flat tool to the flat tool guide body, the elongated support base member system is clamped to the flat tool guide body to set the sharpened bevel angle and skew angle of the cutting edge of the flat tool relative to an abrading medium.

16. The honing guide for flat tools of claim 15, wherein the small holder block is adjustably fixed with a threaded stop screw to maintain precise tool shank thickness independent double bevel and skew angle registration when honing both sides of the cutting edge.

17. The honing guide for flat tools of claim 15, wherein the first tool supporting surface and second tool supporting surface are a flat surface at an angle to press the flat tool against one of the long slot sides of the substantially rectangular flat tool slot or the first tool supporting surface and second tool supporting surface are v-shaped.

18. The honing guide for flat tools of claim 15, wherein the flat blade dial includes a recessed seat that is sized to contain the distal ends of the large holder block projecting radially outward from the externally threaded body of the flat tool guide body.

19. The honing guide for flat tools of claim 15, wherein the elongated support base member system further includes an elongated main rod, at least one elongated base leg, and annular leg collar, an end of the main rod configured to indexably clamp to the support base member clamping interface of the flat tool guide body, the annular leg collar adjustably mounted to slide and rotate along the main rod and lock into position to set the sharpened bevel angle, the at least one elongated base leg removably secured, or permanently affixed, to the leg collar to radially extend from the leg collar wherein the sharpened bevel angle and skew angle of the tip of the flat tool is set and maintained during random or uniform motion of the honing guide against the an abrading surface.

20. The honing guide for flat tools of claim 19, wherein the leg collar locks into position on the elongated main rod to set both the skew and bevel angle with a single thumbscrew, a single bolt or a single fastening point.

* * * * *